US006973931B1

(12) United States Patent
King

(10) Patent No.: US 6,973,931 B1
(45) Date of Patent: Dec. 13, 2005

(54) AUTOMATED HAIR ISOLATION AND PROCESSING SYSTEM

(76) Inventor: Christopher R. King, 7508 Wood Ct., Fishers, IN (US) 46038

( * ) Notice: Subject to any disclaimer, the term of this patent is extended or adjusted under 35 U.S.C. 154(b) by 0 days.

(21) Appl. No.: 09/530,303

(22) PCT Filed: Oct. 30, 1998

(86) PCT No.: PCT/US98/23055

§ 371 (c)(1),
(2), (4) Date: Apr. 27, 2000

(87) PCT Pub. No.: WO99/22694

PCT Pub. Date: May 14, 1999

Related U.S. Application Data

(60) Provisional application No. 60/063,574, filed on Oct. 30, 1997.

(51) Int. Cl.[7] ..... A45C 3/00
(52) U.S. Cl. ..... 132/212; 132/201
(58) Field of Search ..... 132/53, 56, 119.1, 132/124, 136, 143, 144, 201, 219, 212, 270, 901

(56) References Cited

U.S. PATENT DOCUMENTS

| | | | | | |
|---|---|---|---|---|---|
| 1,678,891 | A | * | 7/1928 | Walsh | 132/144 |
| 2,091,738 | A | * | 8/1937 | Moulin | 132/139 |
| 3,295,534 | A | * | 1/1967 | Dorkin | 132/139 |
| 3,521,645 | A | * | 7/1970 | Frishman et al. | 132/201 |
| 3,903,903 | A | * | 9/1975 | Matsumra | 132/56 |
| 3,926,200 | A | * | 12/1975 | Losenno | 132/212 |
| 4,108,186 | A | * | 8/1978 | Esposto | 132/124 |
| 4,385,638 | A | * | 5/1983 | Masegawa | 132/270 |
| 5,018,542 | A | * | 5/1991 | Lee | 132/139 |
| 5,107,867 | A | * | 4/1992 | Barrington | 132/201 |

FOREIGN PATENT DOCUMENTS

| | | | | |
|---|---|---|---|---|
| JP | 48-10817 | * | 4/1973 | 132/201 |

* cited by examiner

*Primary Examiner*—Todd E. Manahan

(57) ABSTRACT

A device comprised of hair-flow-channel guides continuously moved over the surface of the scalp. A track cap of parallel tracks is placed on the head to guide device's movement over the scalp along non-overlapping rows. At the front of the device is a hair-tensioning straightener that pulls hairs perpendicular to the scalp before and during processing. A bend-under assembly, formed by two pinching conveyer belts, facilitates hair exit from the channels by bending scalp-attached hairs beneath the walls of each hair channel. Intermittent intersection of each channel by an obstructing member isolates one or a few leading hairs for processing and forces trailing hairs to wait their turn for cosmetic processing behind it. Isolated scalp hairs may be cosmetically processed in ways including coloration; cross-section reshaping, hair-extension attachment and removal, and cutting to length according to position along track. Hair extensions removed at one position along a track cap are conveyed to corresponding holding clips and loaded in an order so as to permit their reattachment to the same scalp area. Hair extensions so held can be channeled and isolated for attachment, as are scalp hairs. A bend-under assembly can be used to draw one or a group of isolated hairs longitudinally through the chamber in which they are isolated facilitating cross-sectional reshaping of hairs or cutting to a preprogrammed length. Intersecting member and cosmetic processing actuation synchronized by computer.

49 Claims, 90 Drawing Sheets

FIG. 1
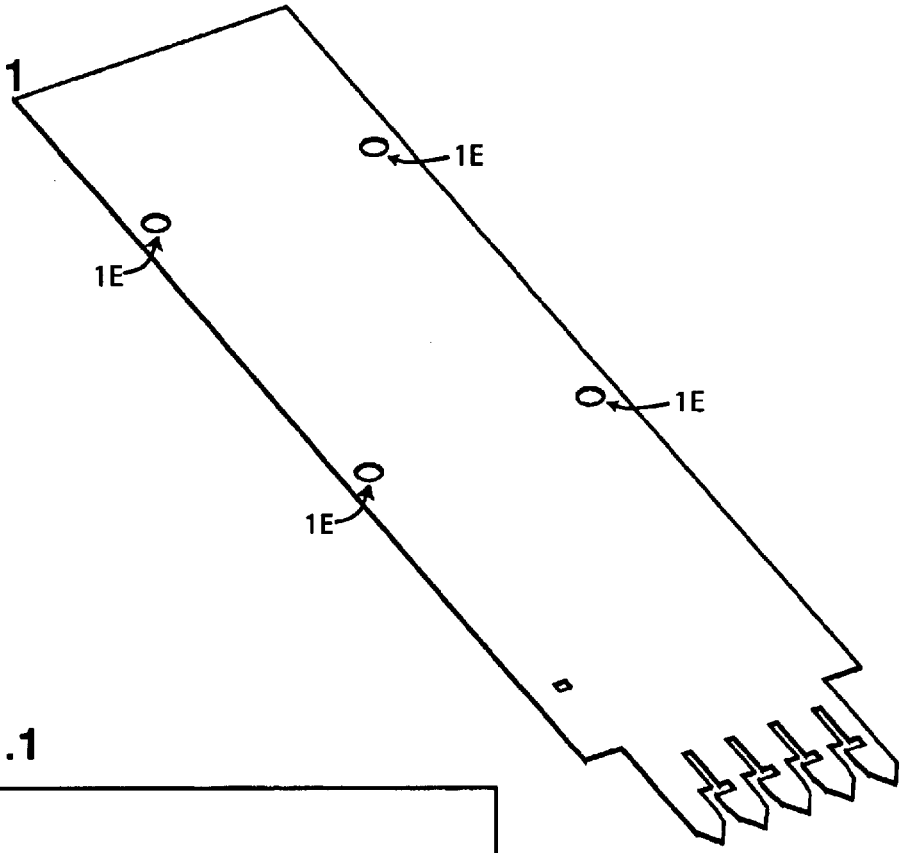
FIG. 1.1
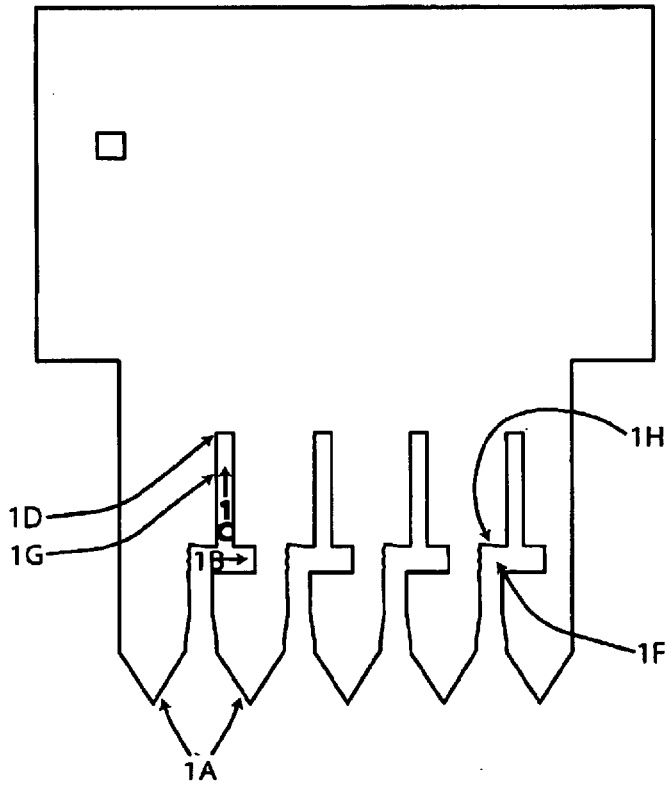

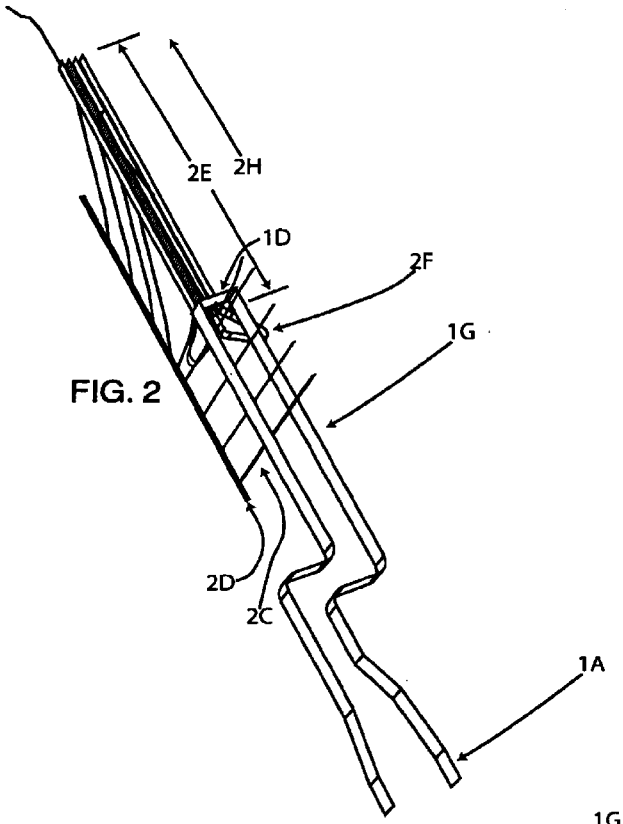
FIG. 2
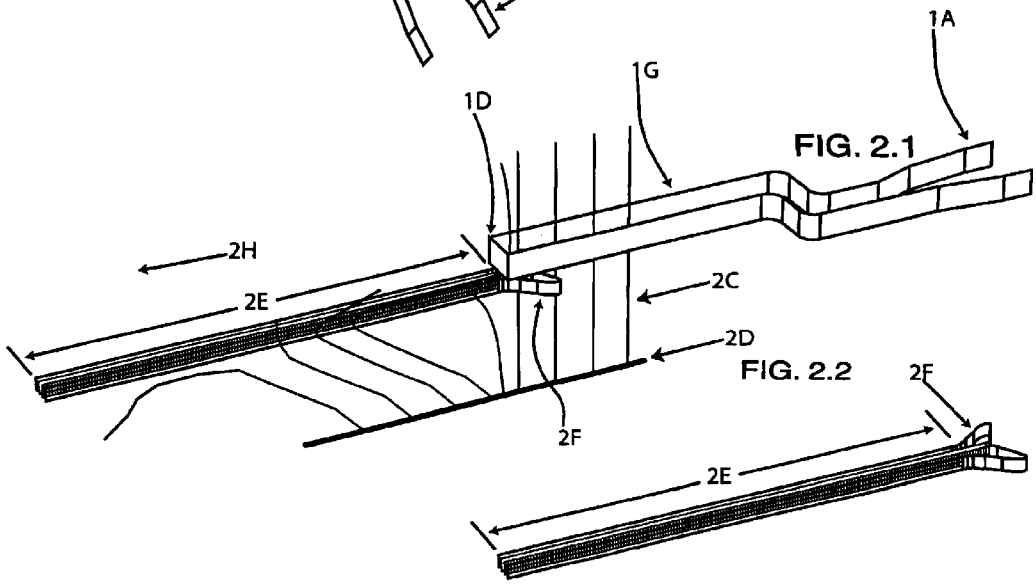
FIG. 2.1
FIG. 2.2

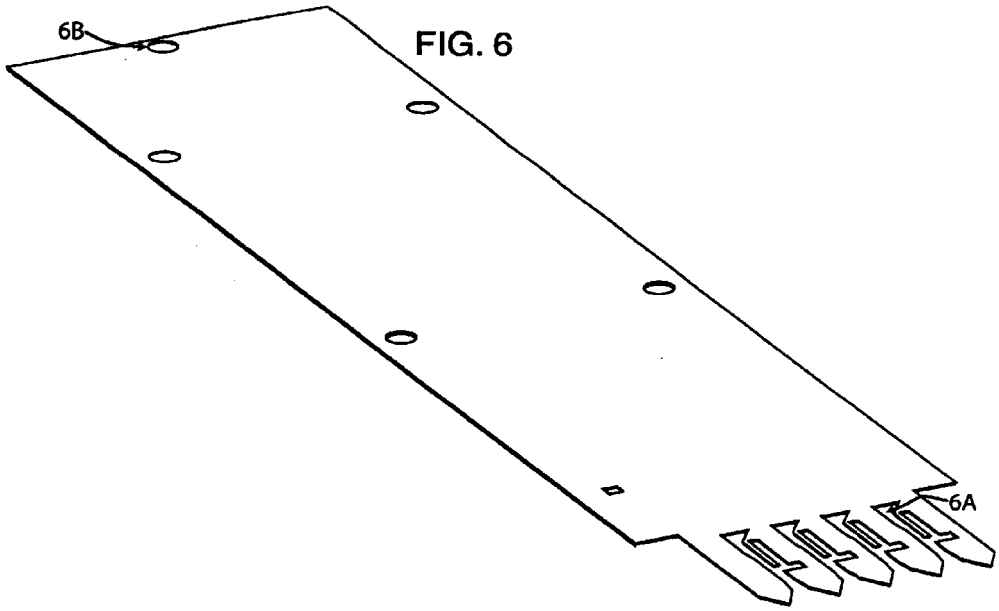
FIG. 6
FIG. 7
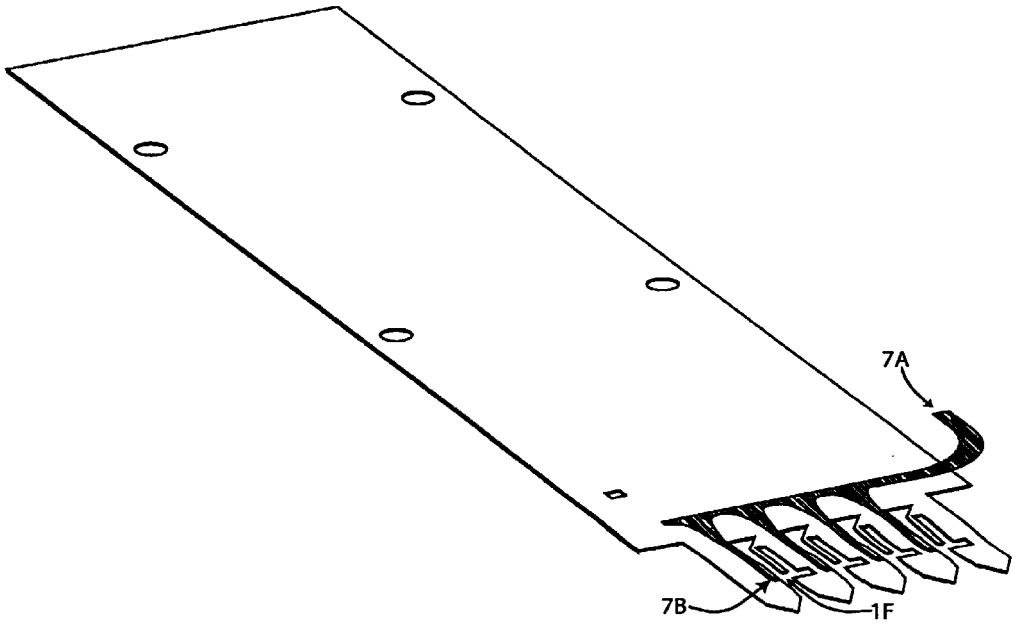

FIG. 12
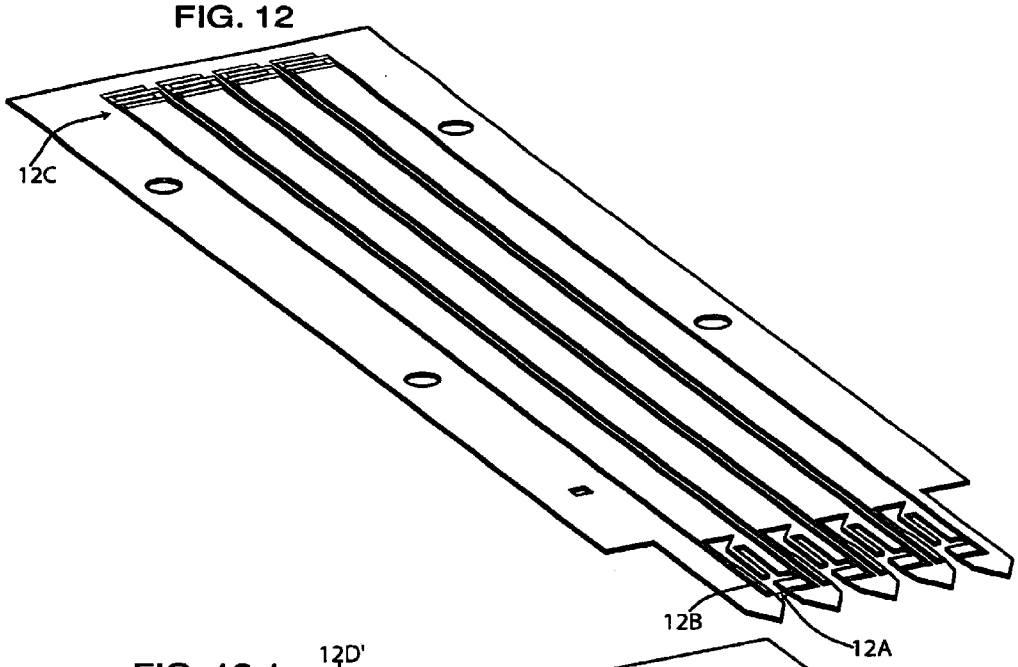
FIG. 12.1
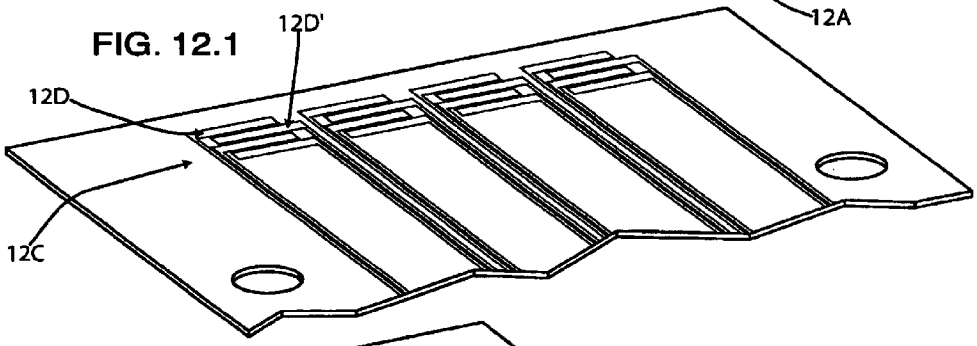
FIG. 13
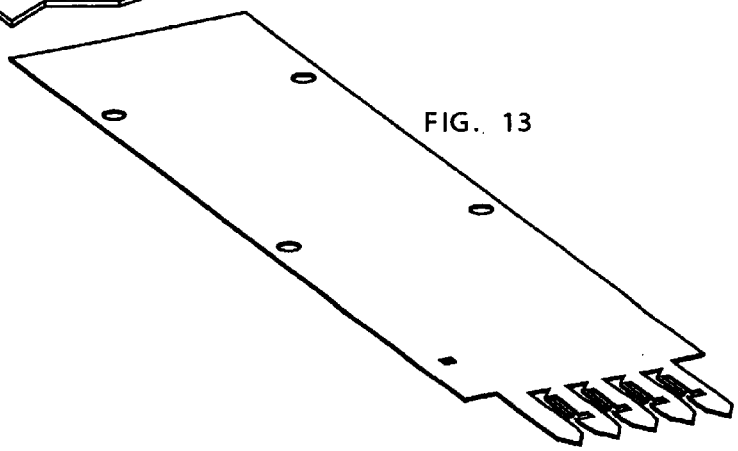

FIG. 14
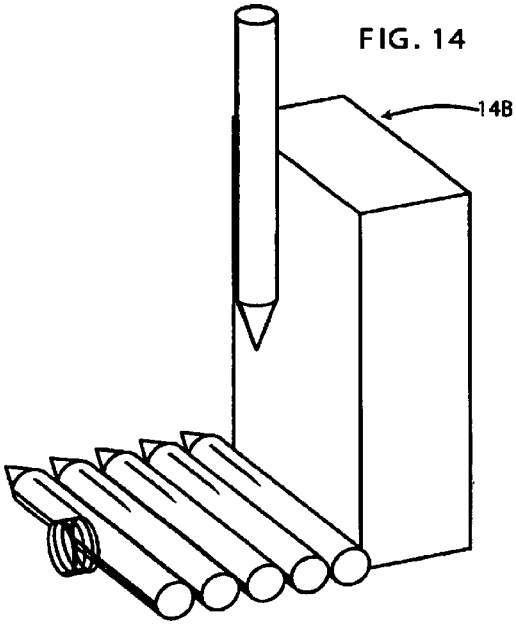
FIG. 14.1
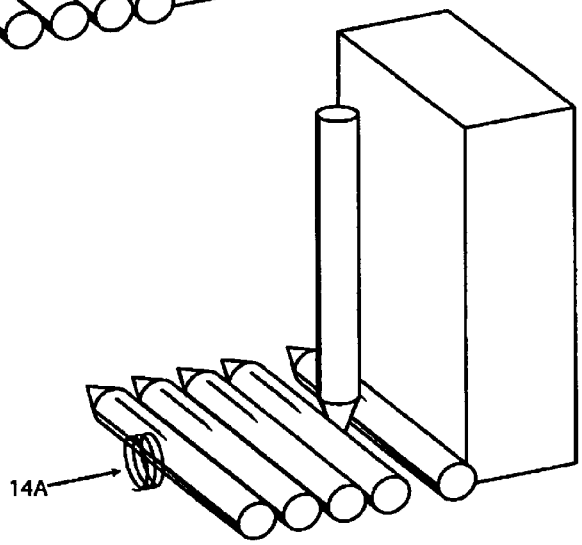
FIG. 14.2
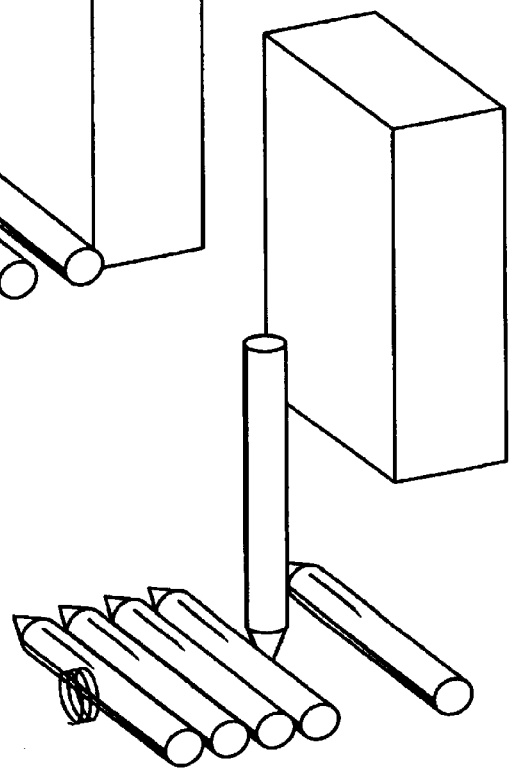

FIG. 15
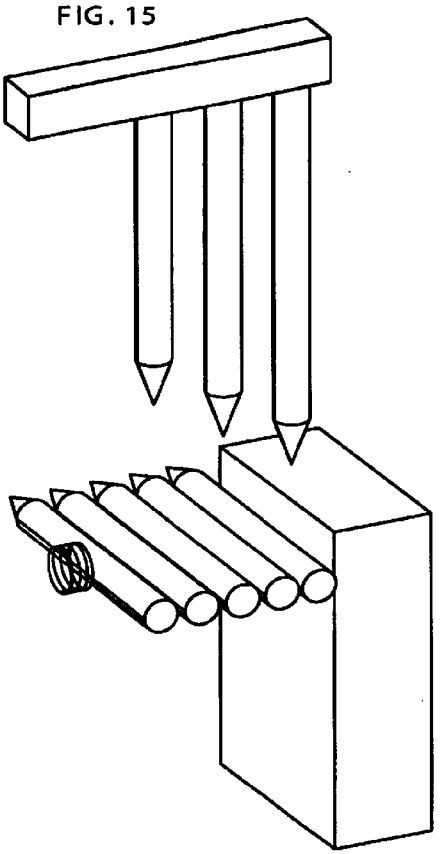
FIG. 15.1
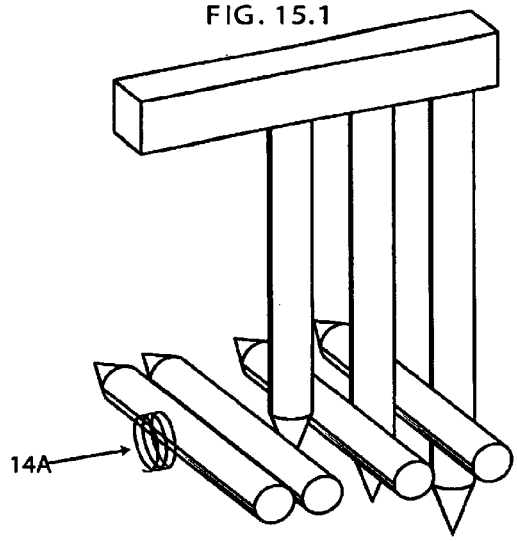
FIG. 15.2
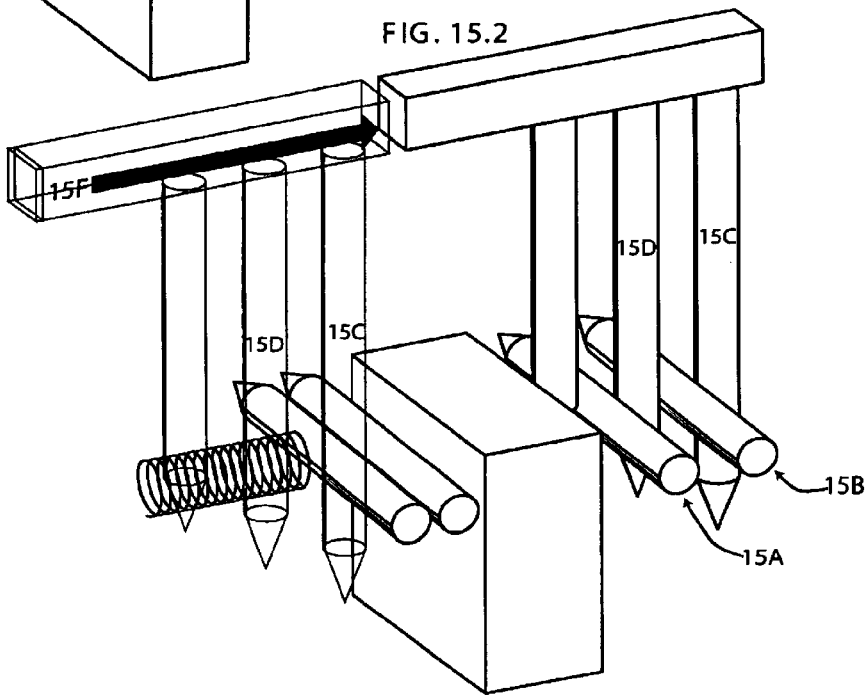

FIG. 16
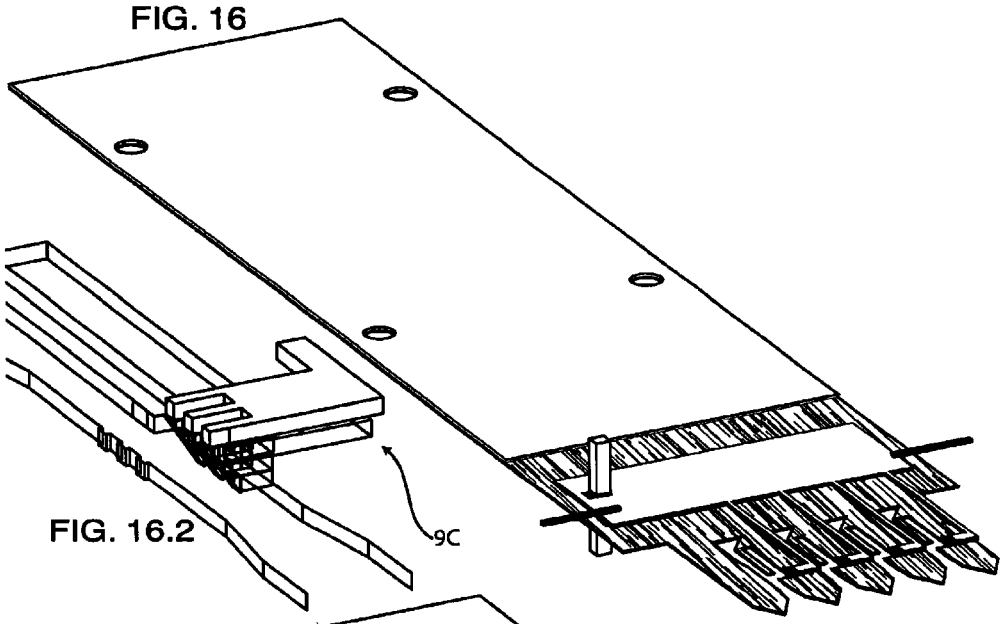
FIG. 16.2
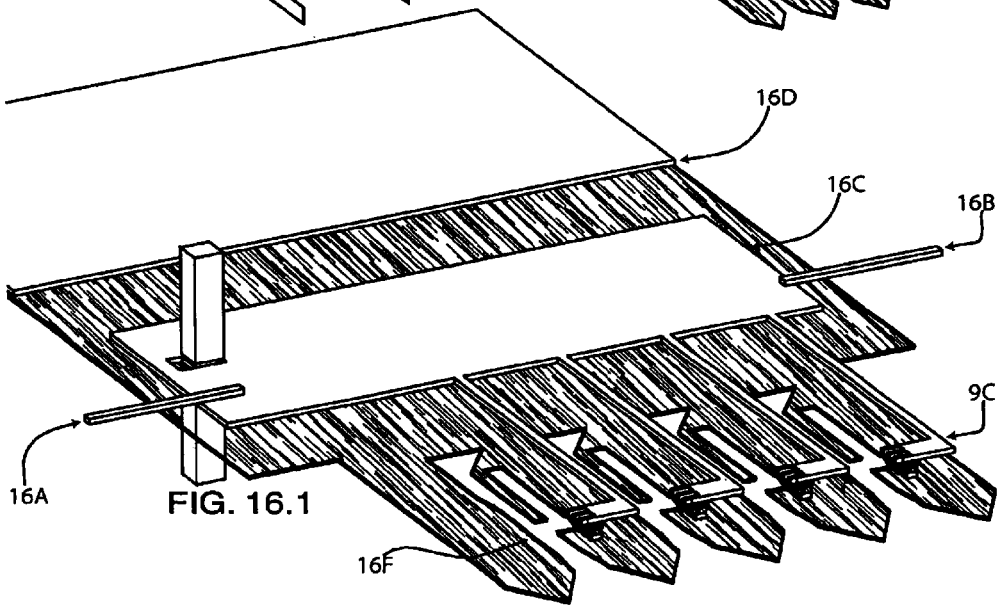
FIG. 16.1

FIG. 17
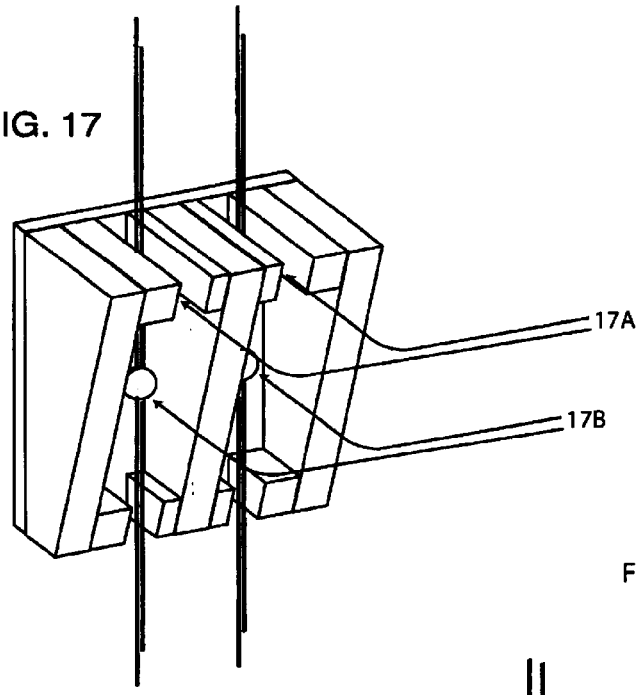
FIG. 18.2
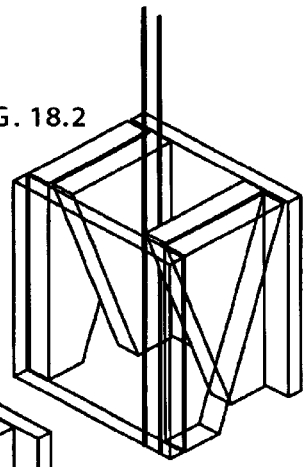
FIG. 18.1
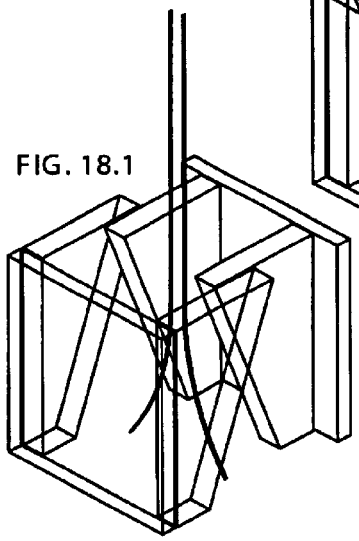
FIG. 18
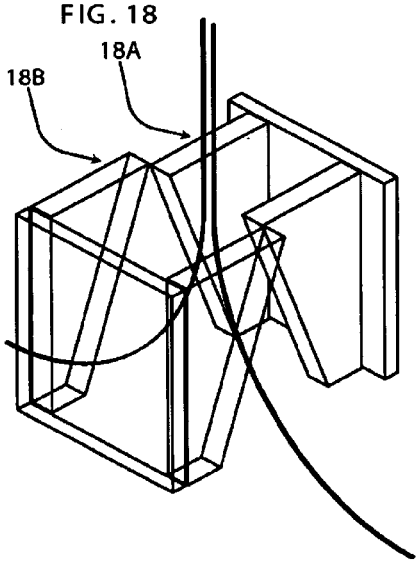

FIG. 19
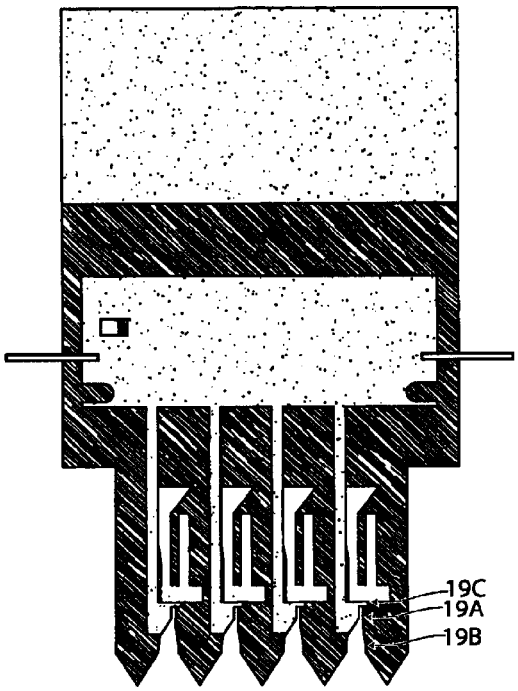
FIG. 20
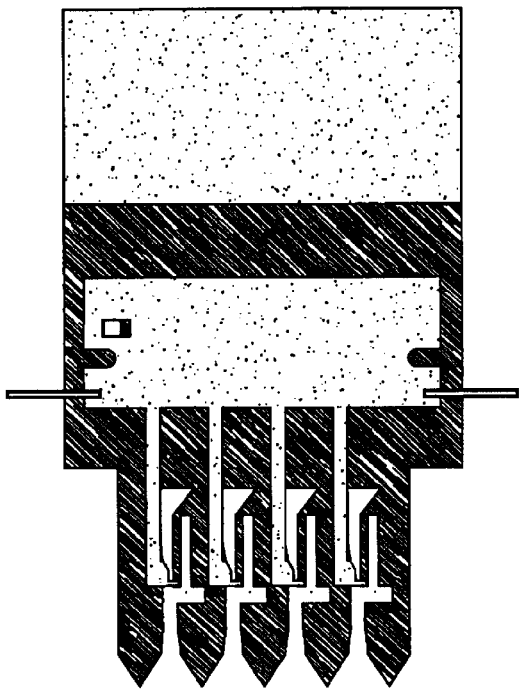
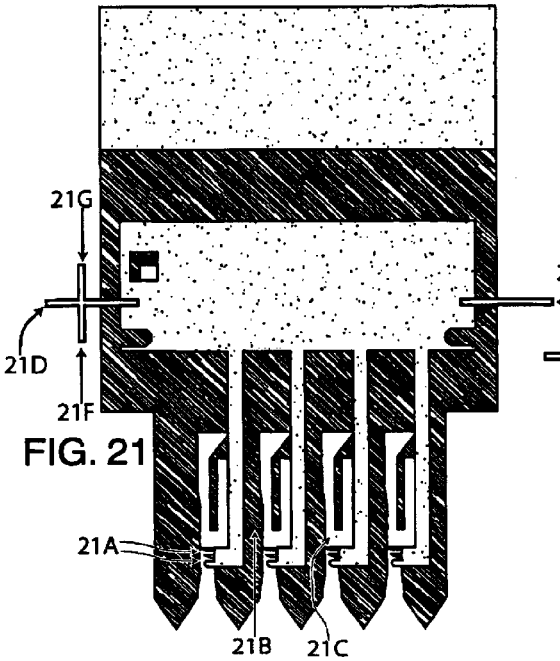
FIG. 21
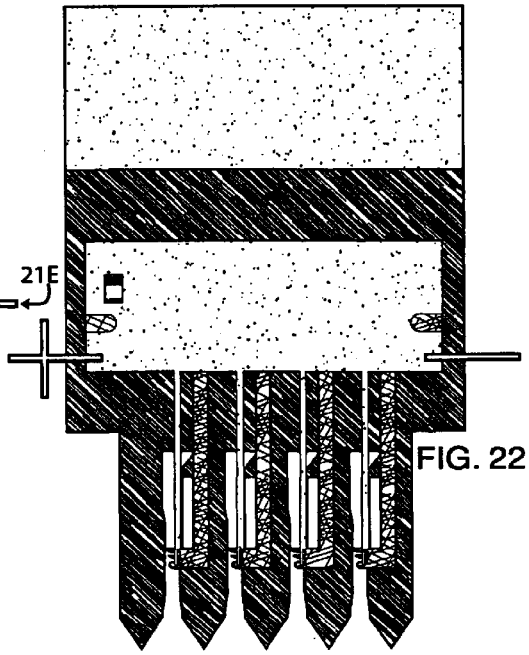
FIG. 22

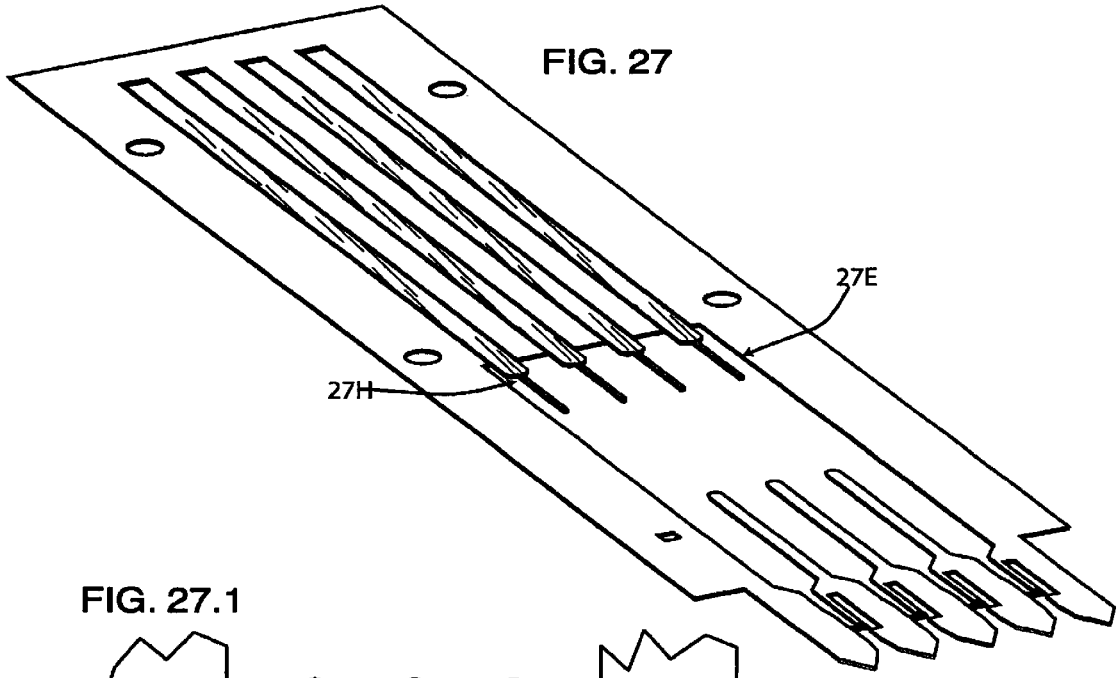
FIG. 27
FIG. 27.1
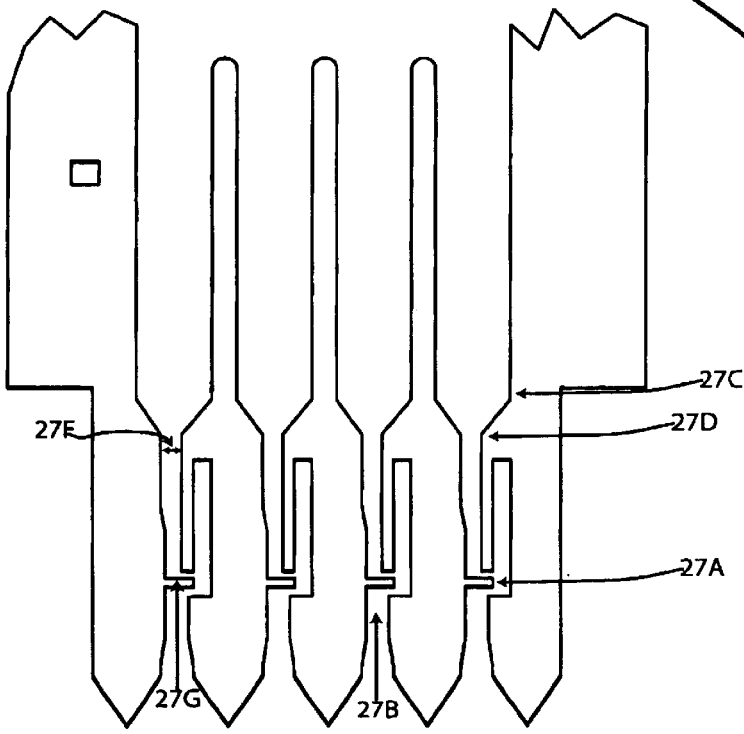

FIG. 32
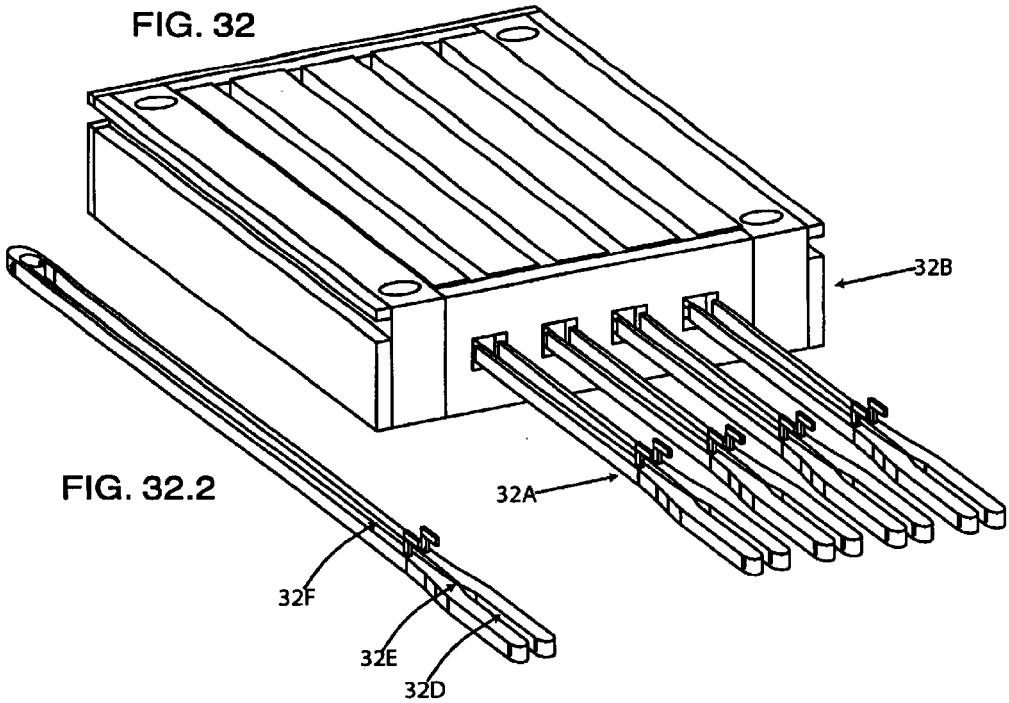
FIG. 32.2
FIG. 32.1
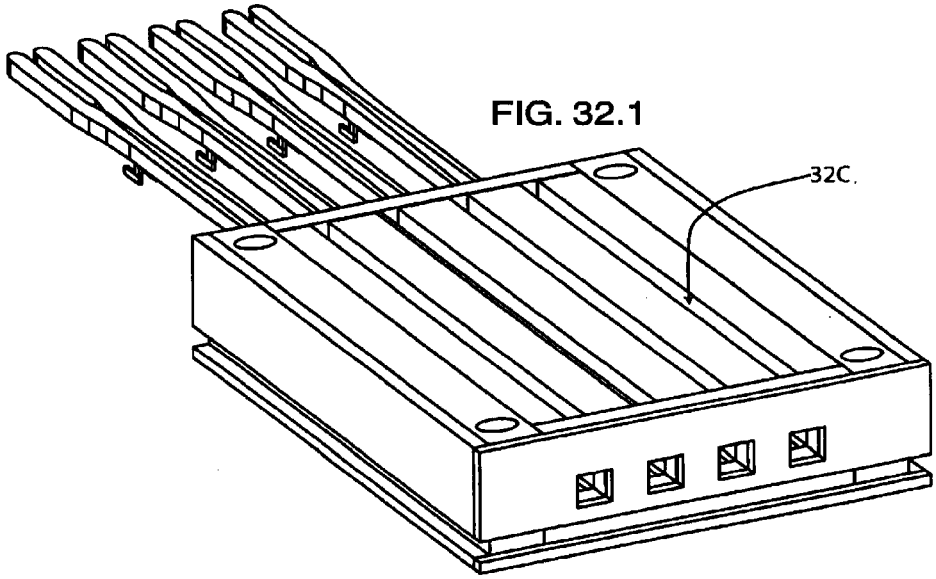

FIG. 33
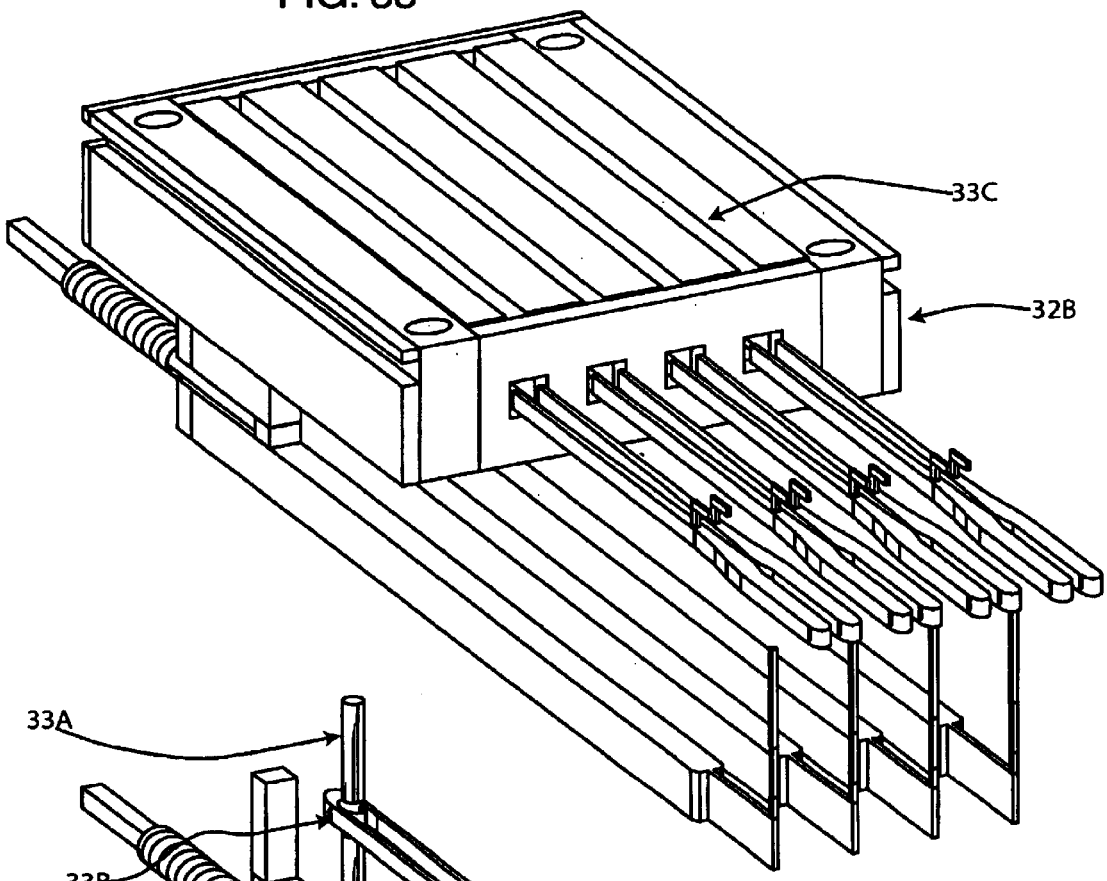
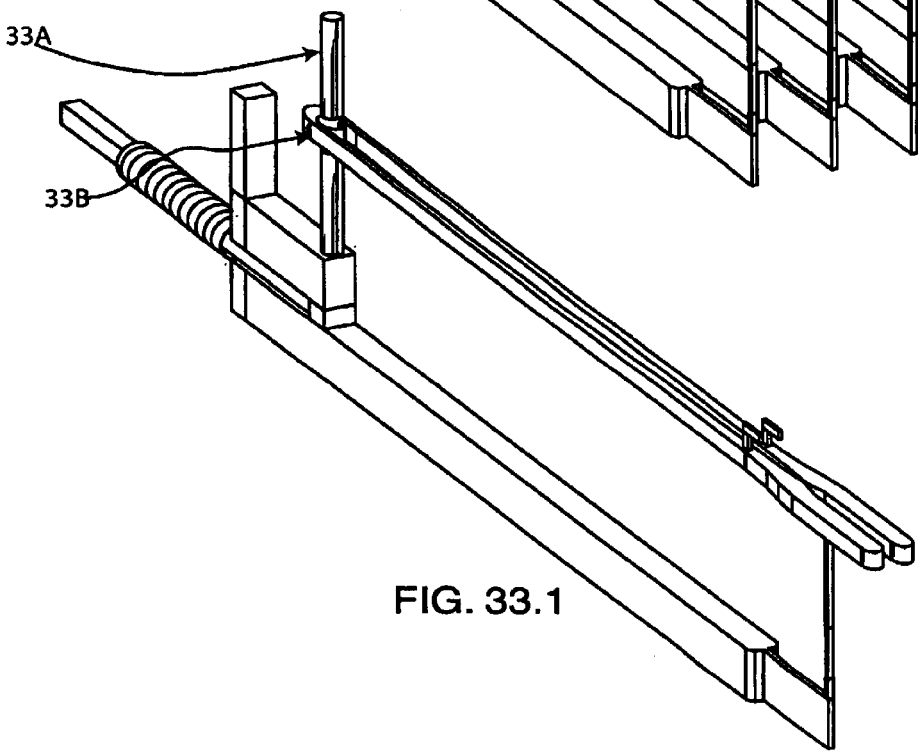
FIG. 33.1

FIG. 36.1

FIG. 37
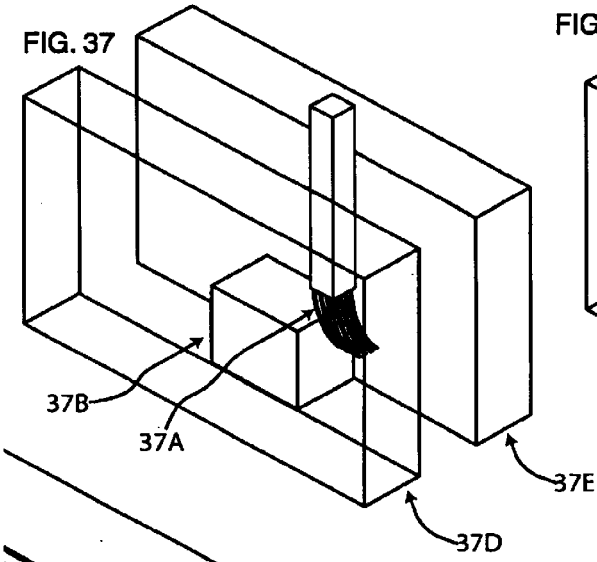
FIG. 37.1
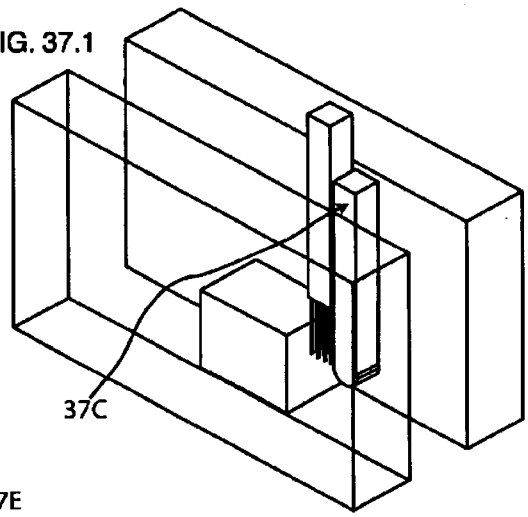
FIG. 38
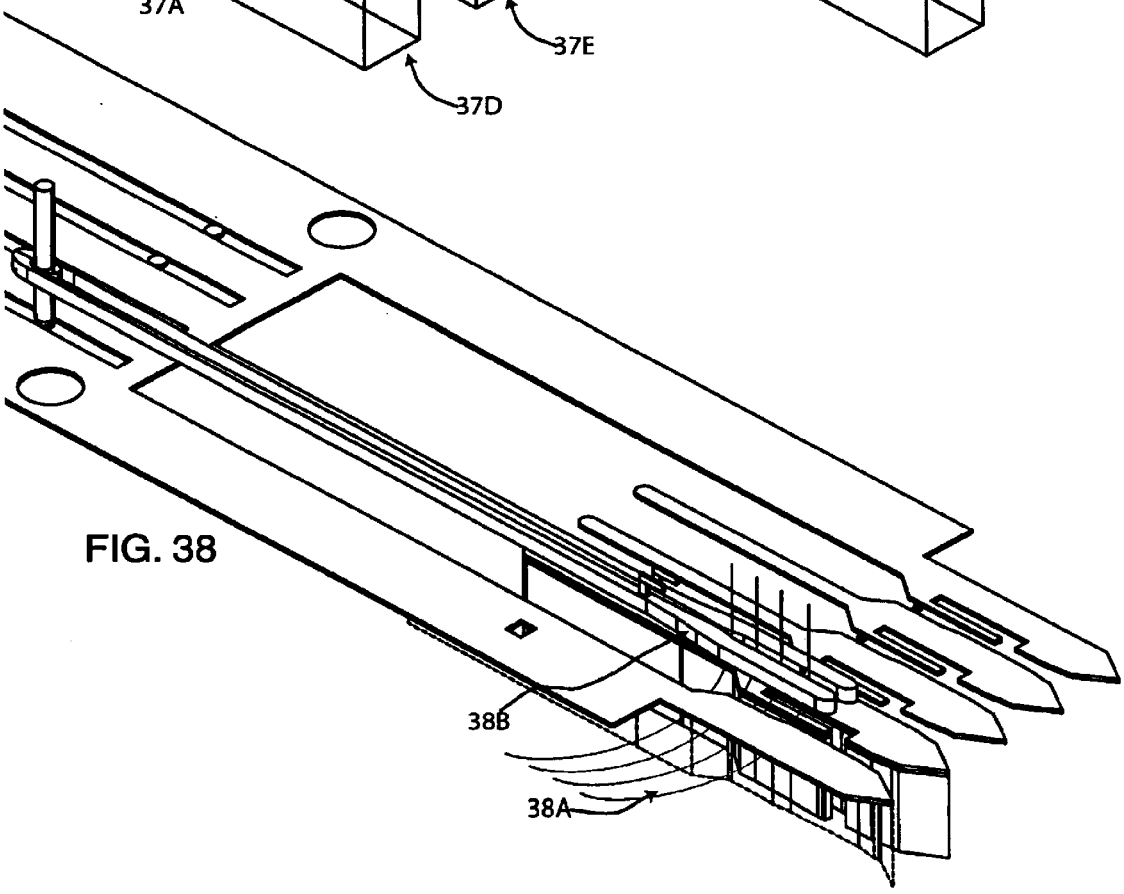

FIG. 39.1

FIG. 40
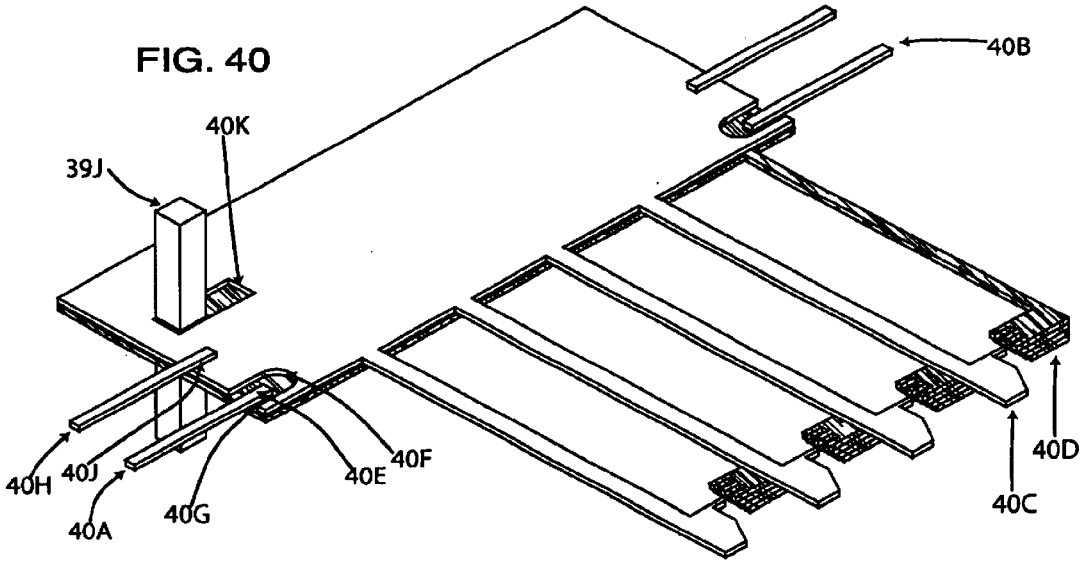
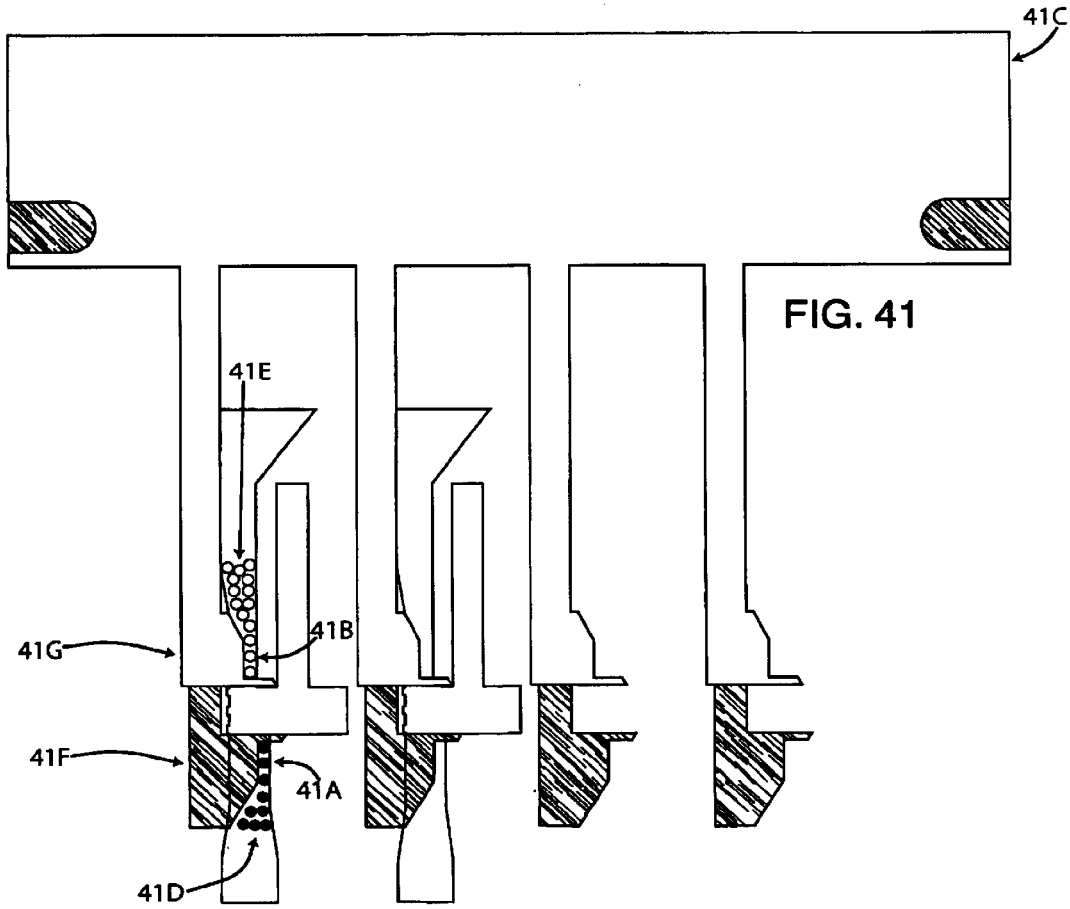
FIG. 41

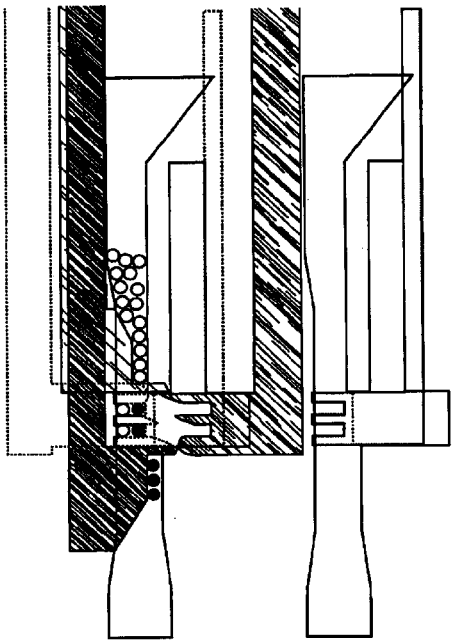
FIG. 54
FIG. 55
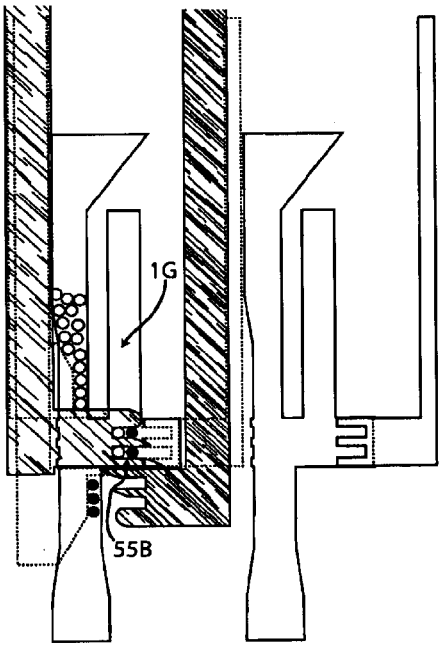
FIG. 55.1
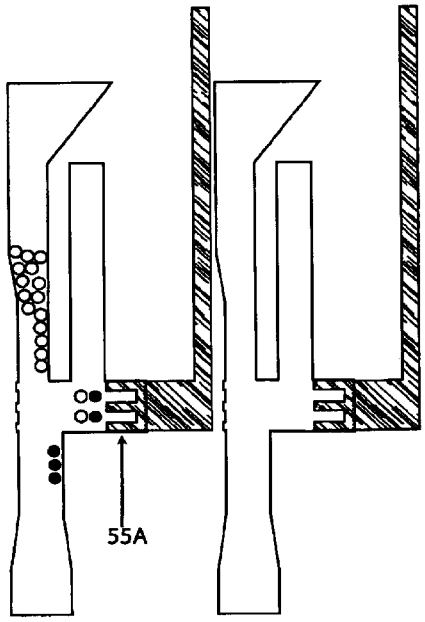

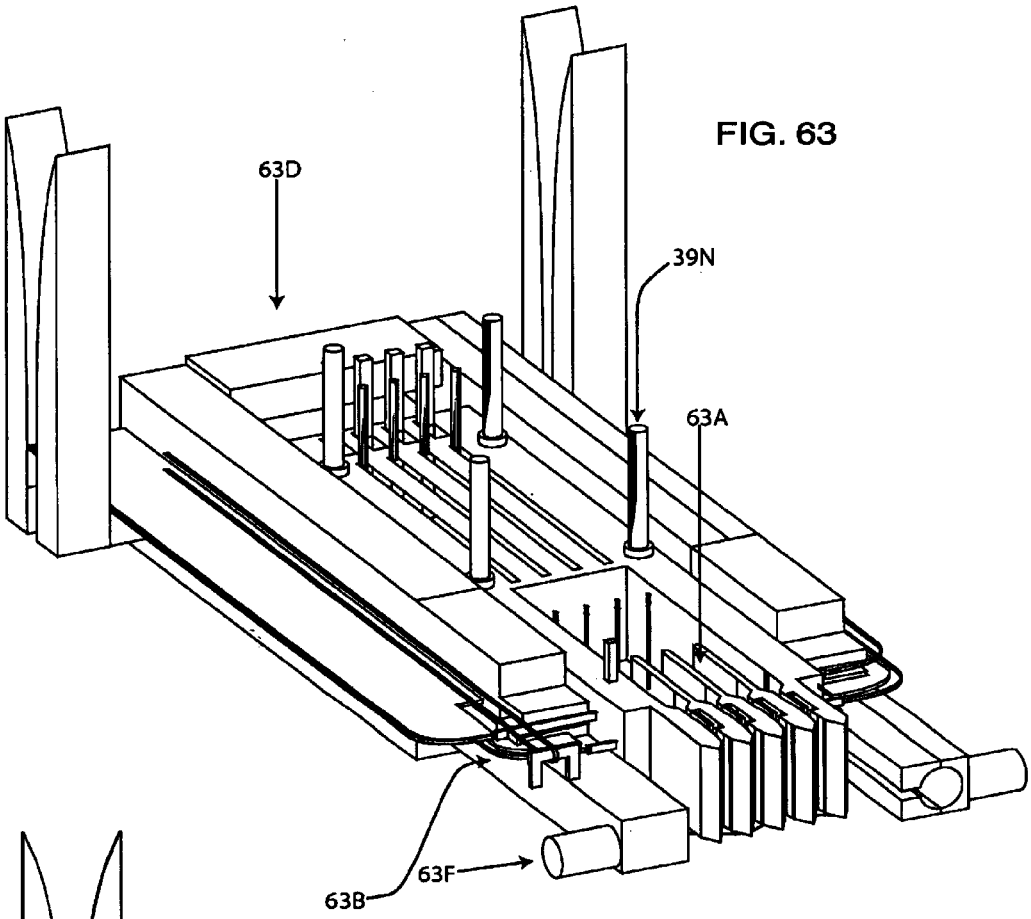
FIG. 63
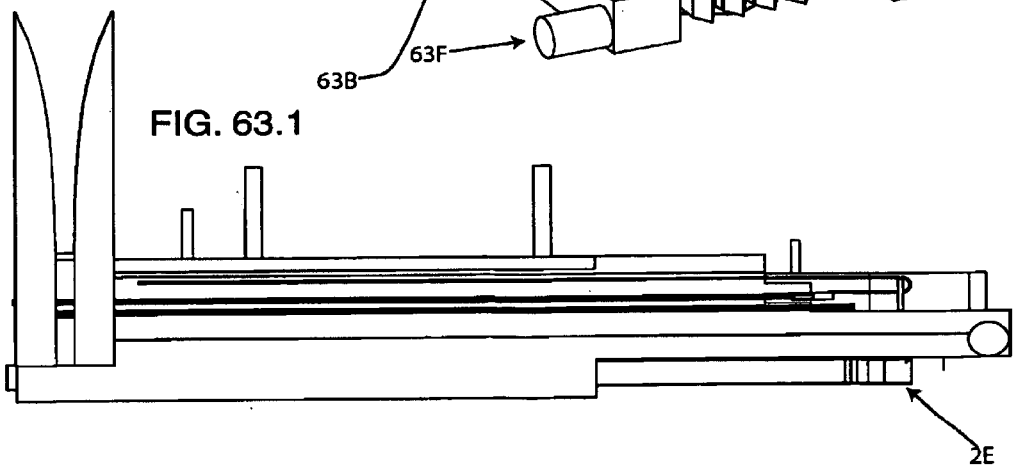
FIG. 63.1

FIG. 64
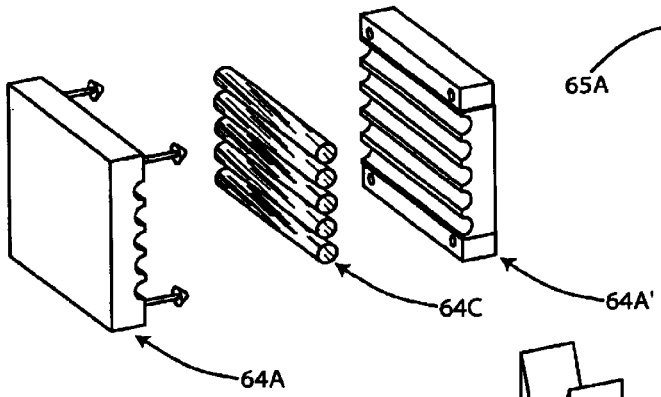
FIG. 64.1
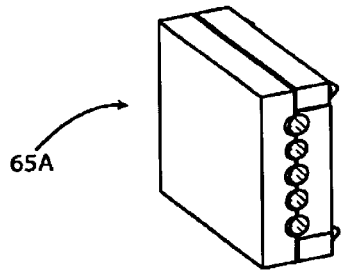
FIG. 65
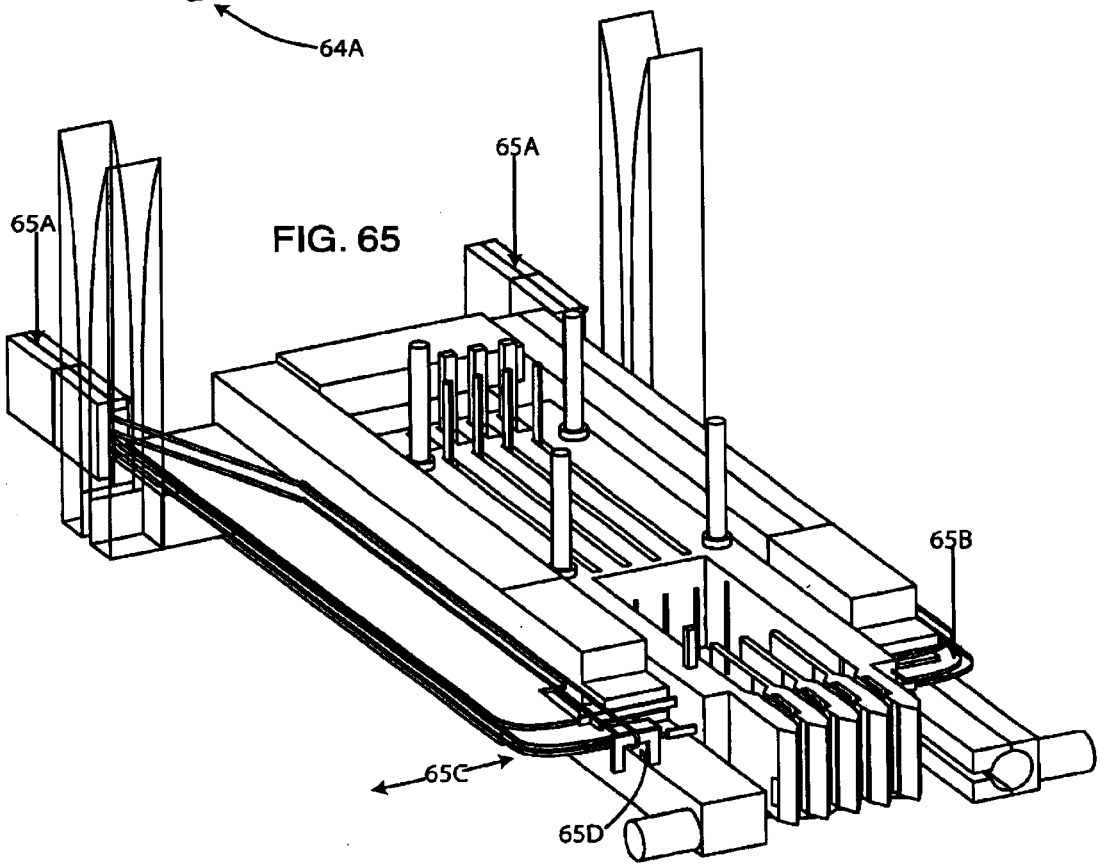

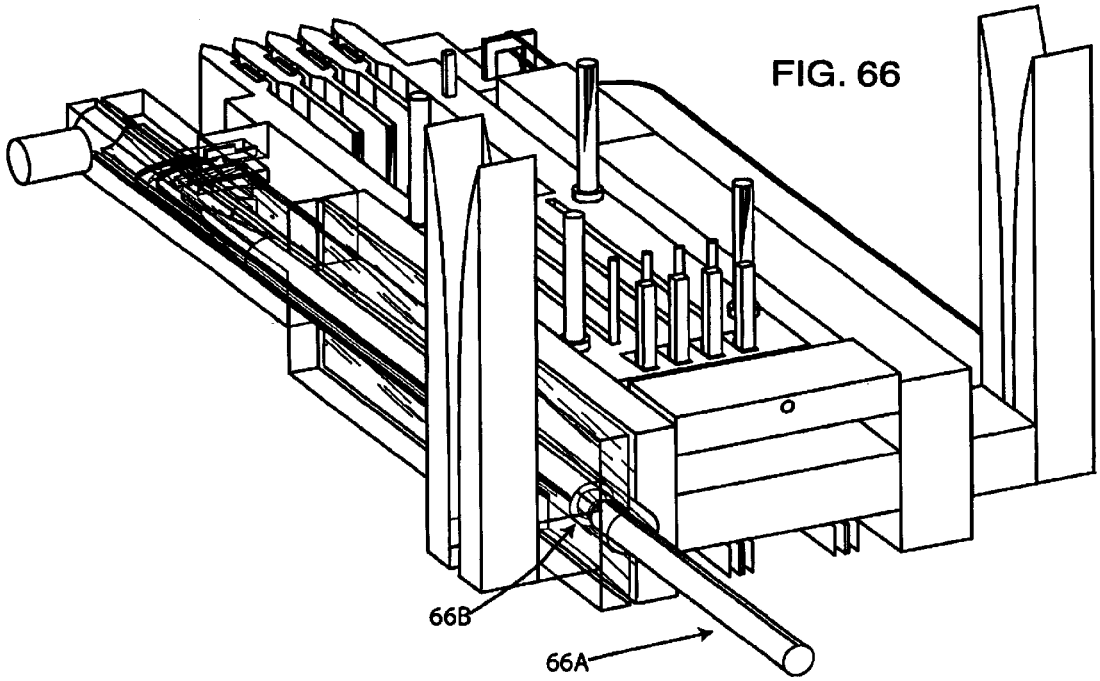
FIG. 66
FIG. 67
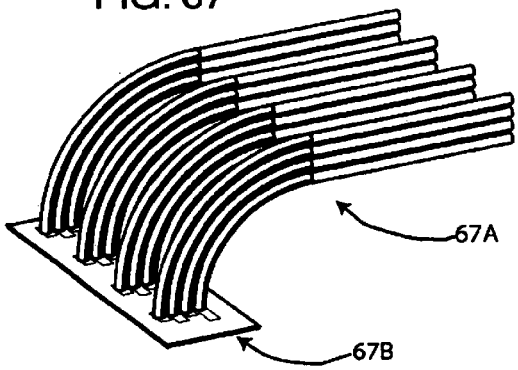

FIG 78
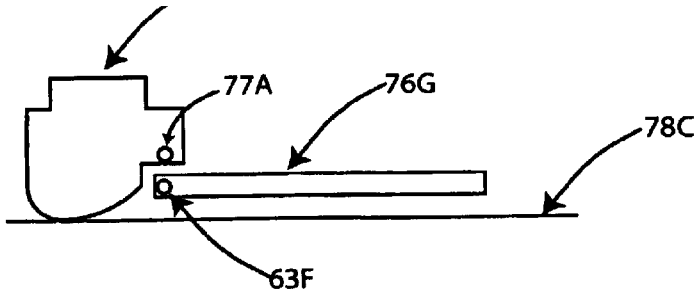
FIG 78.1
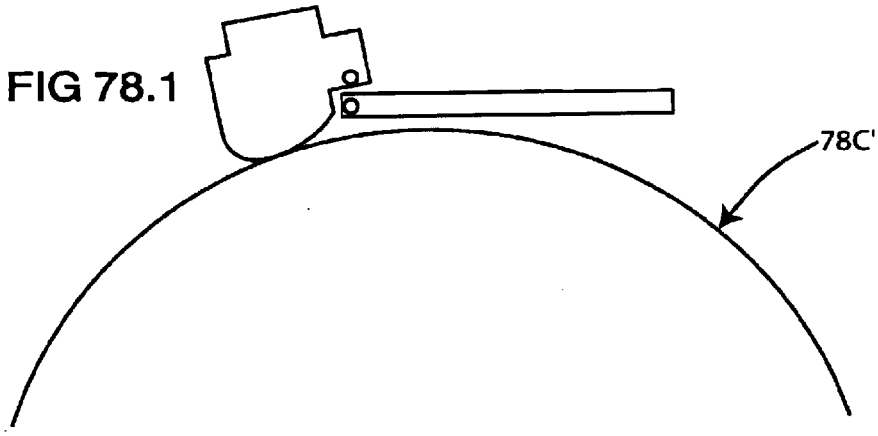
FIG 78.2
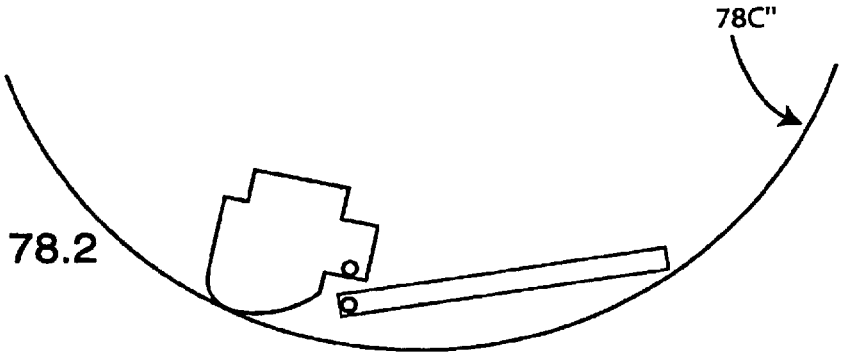

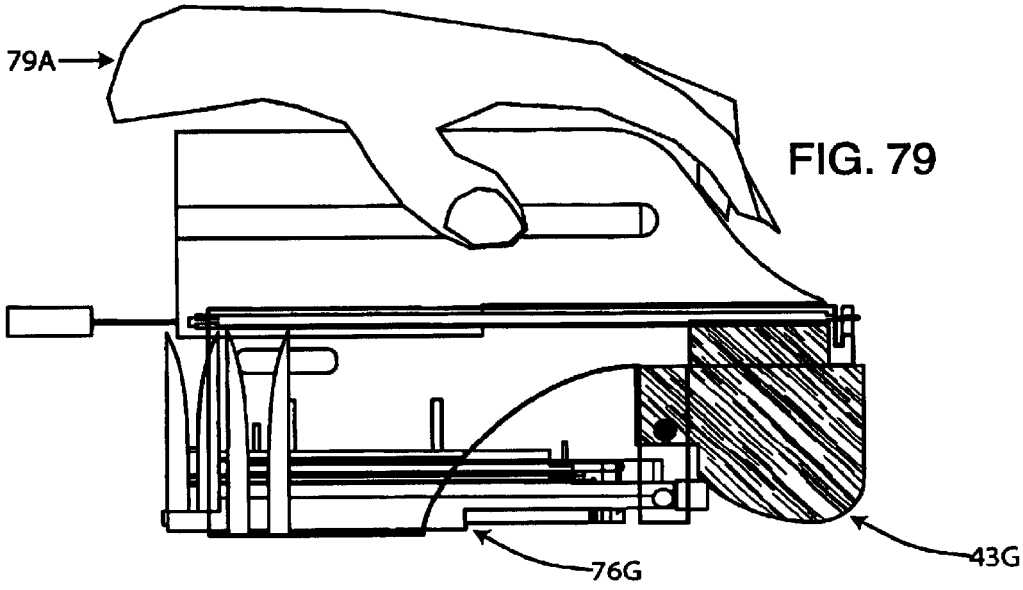
FIG. 79
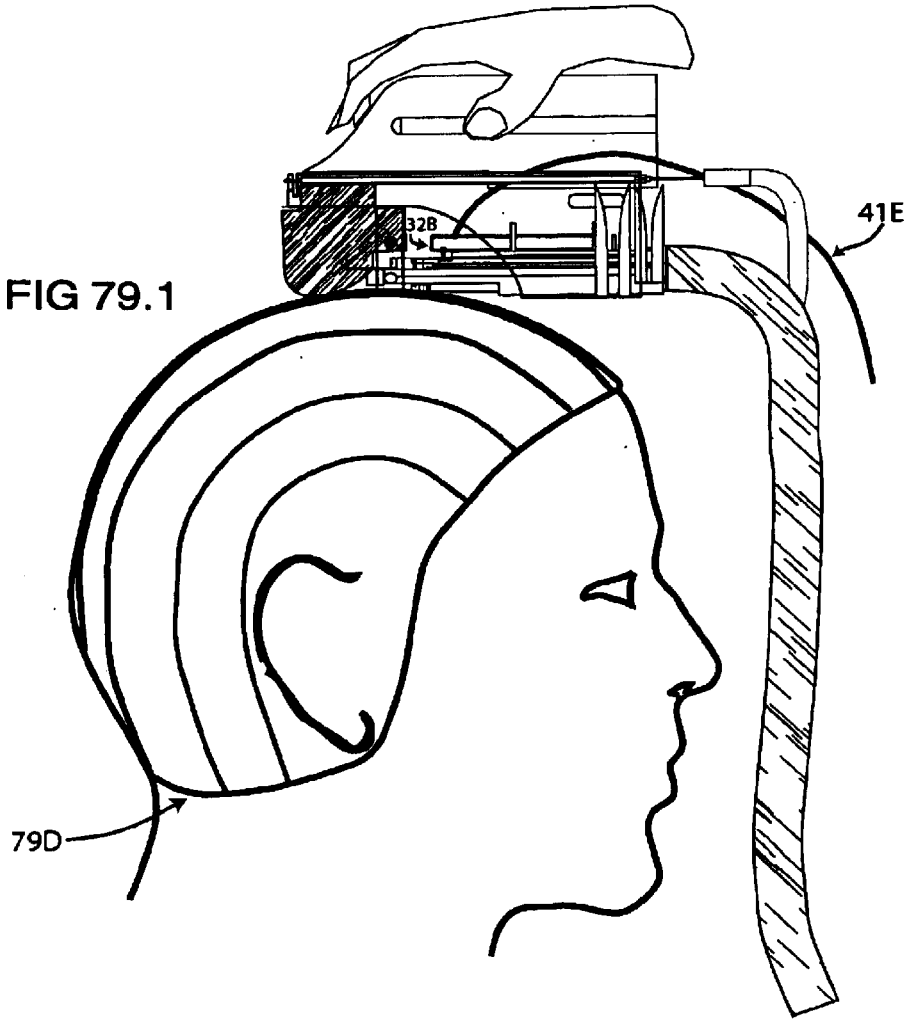
FIG 79.1

FIG 80.2

FIG. 81
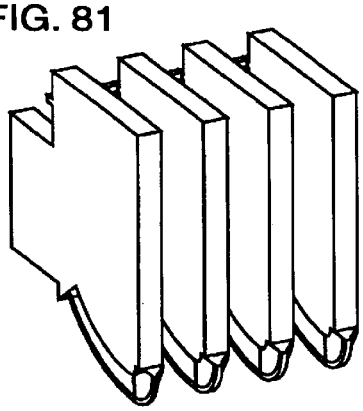
FIG. 81.1
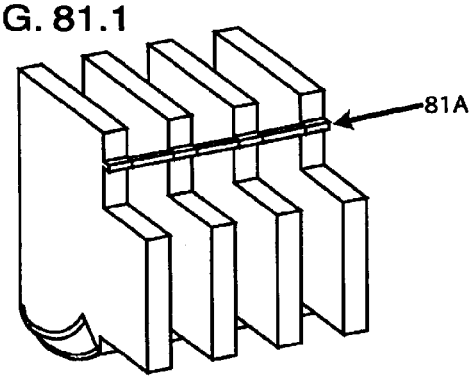
FIG. 82
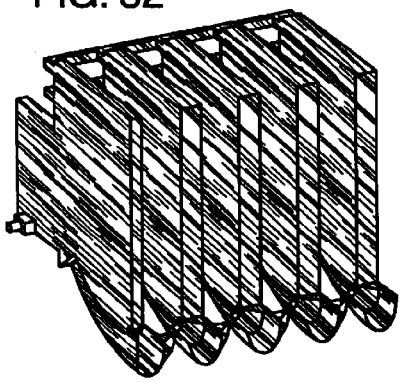
FIG. 82.1
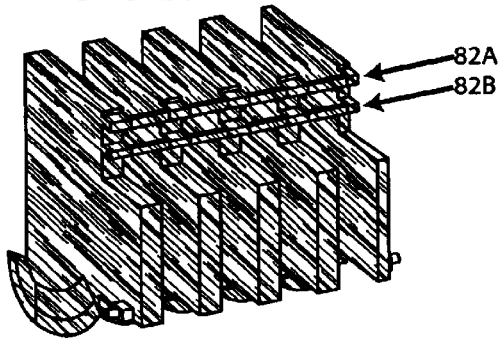

Figure 83
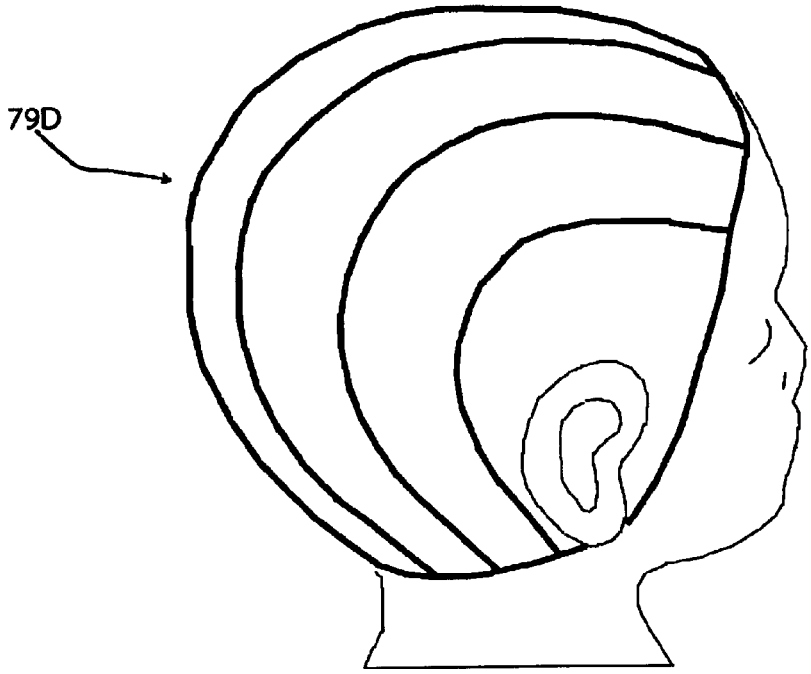
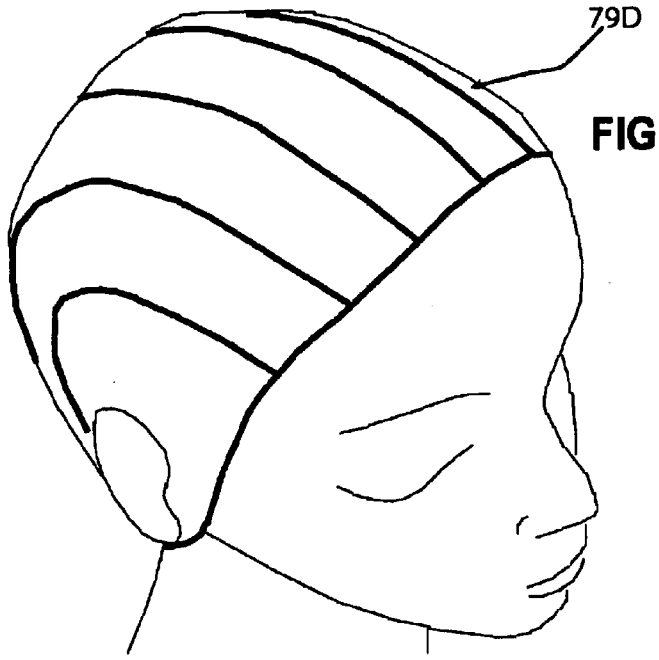
FIG. 83.1

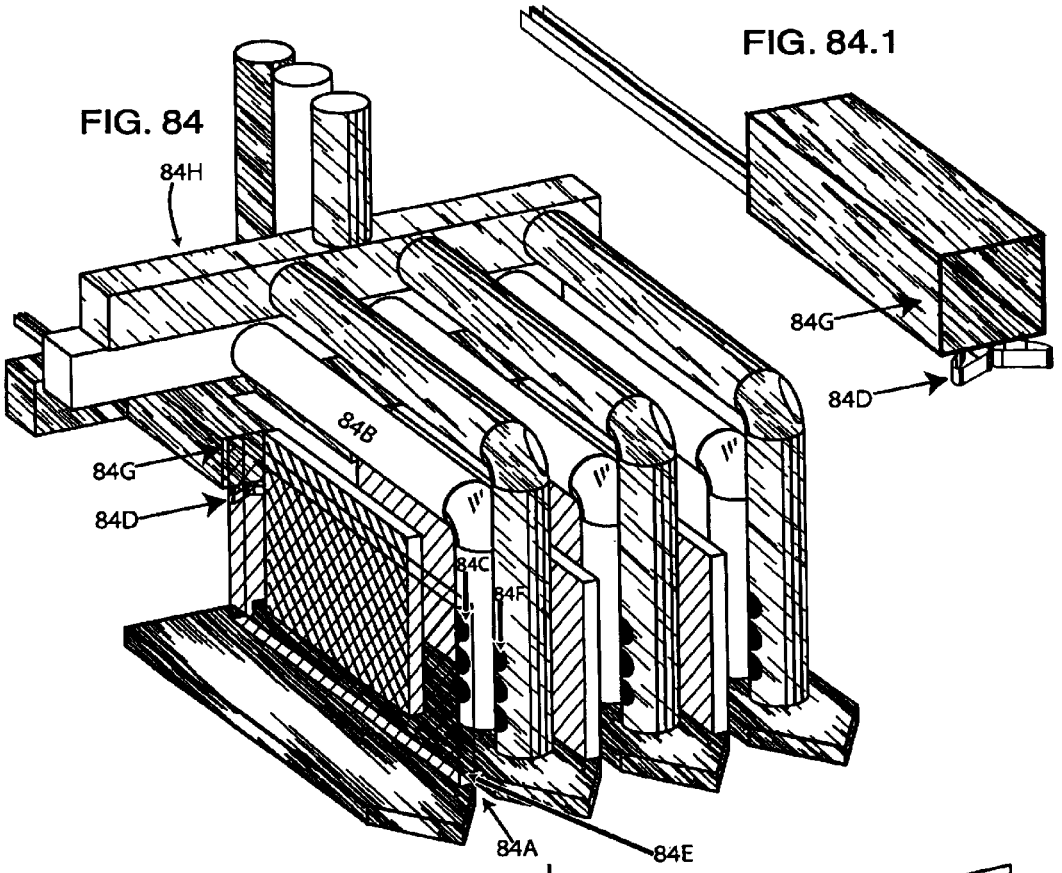
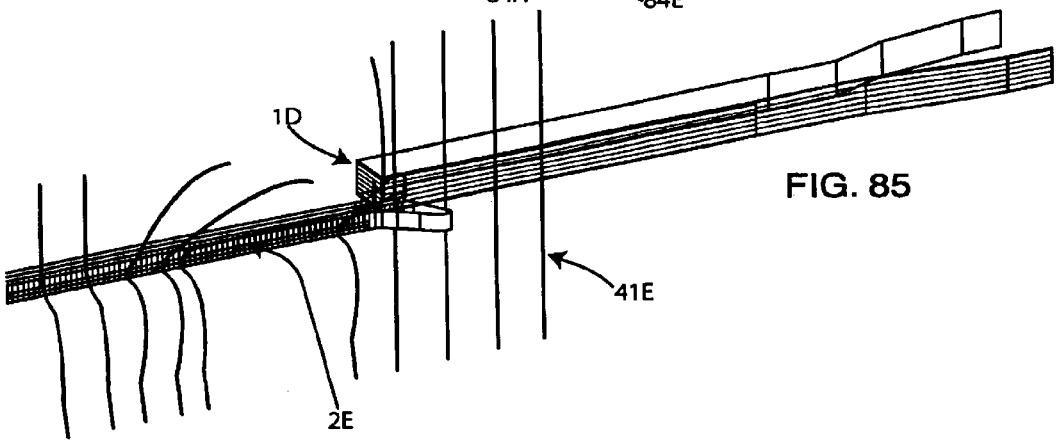
FIG. 85

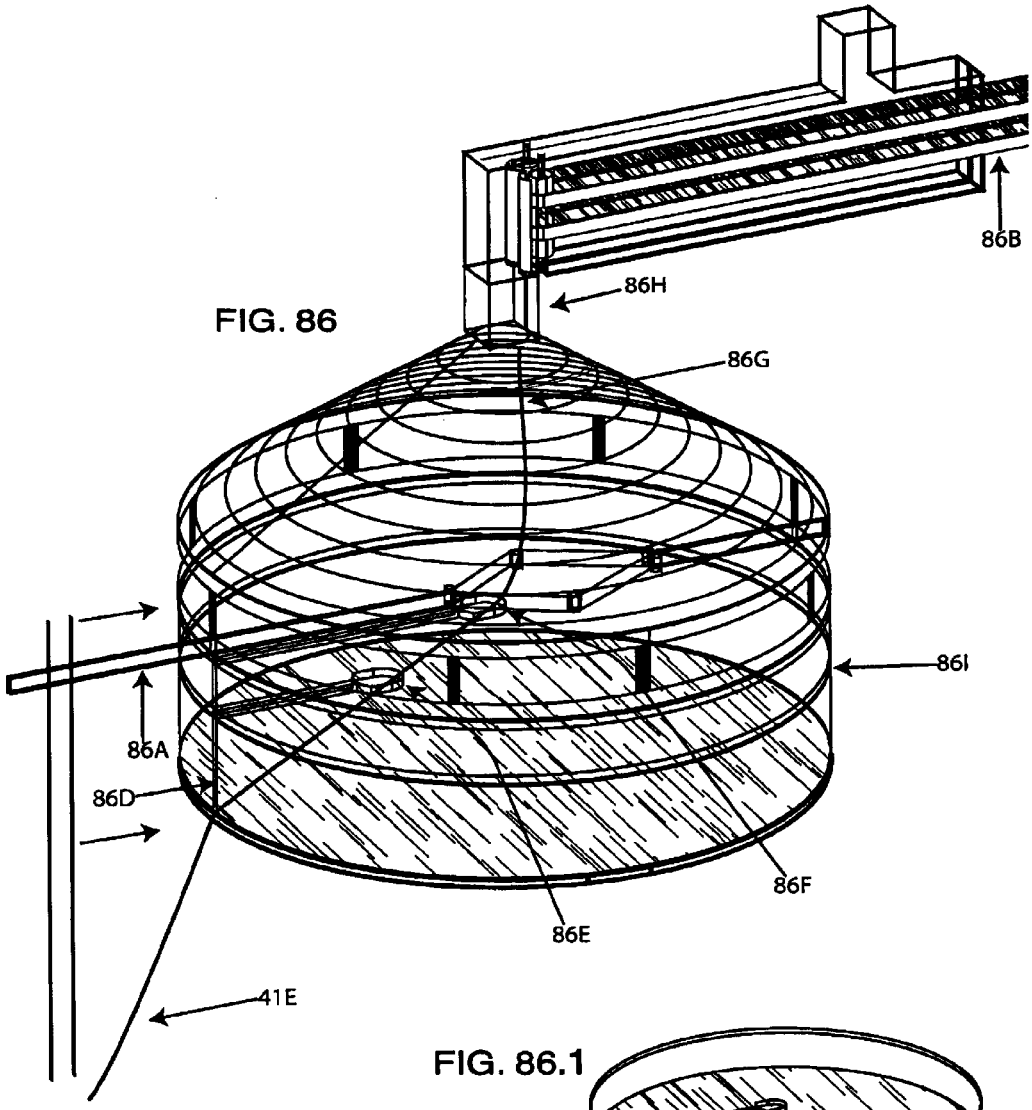
FIG. 86
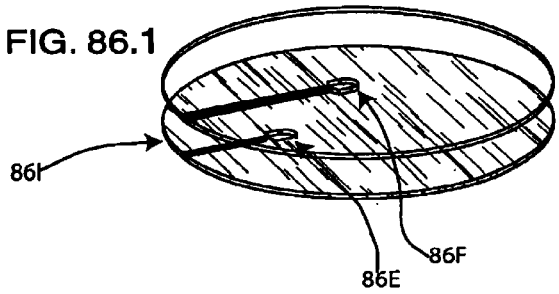
FIG. 86.1

FIG. 87
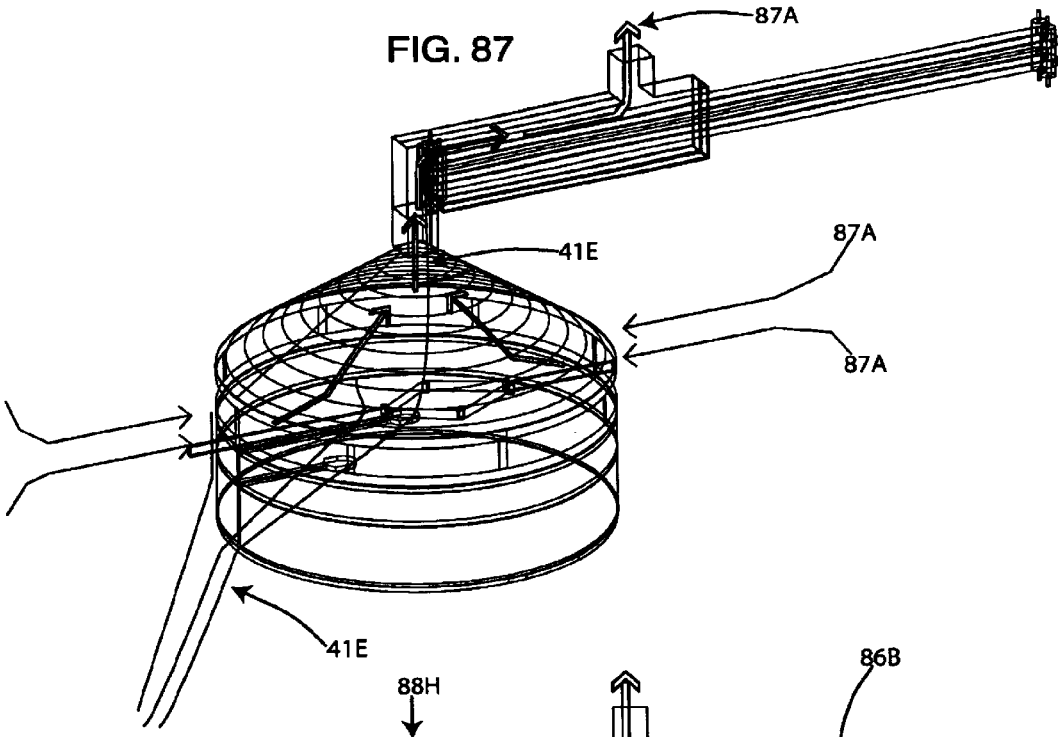
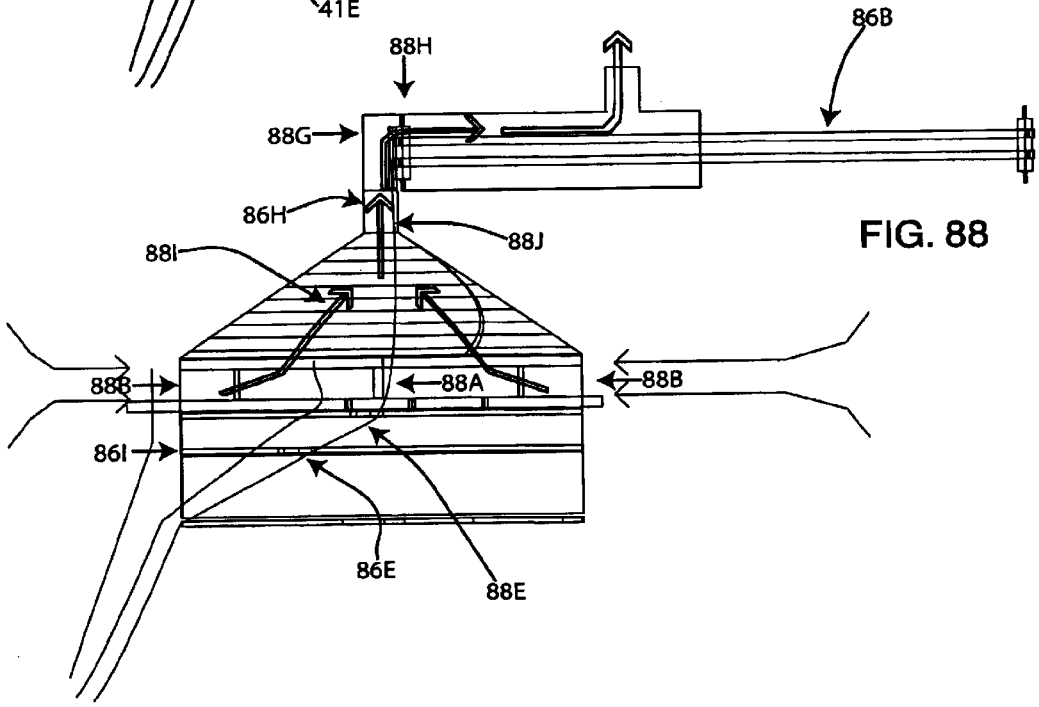
FIG. 88

FIG. 95.1

FIG. 99
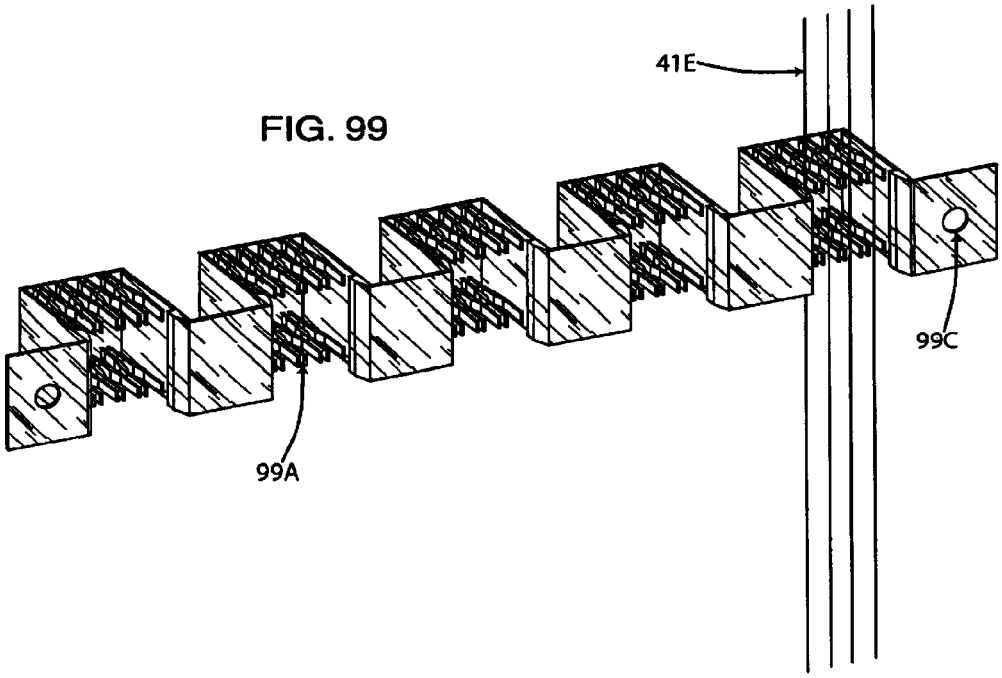
FIG. 99.1
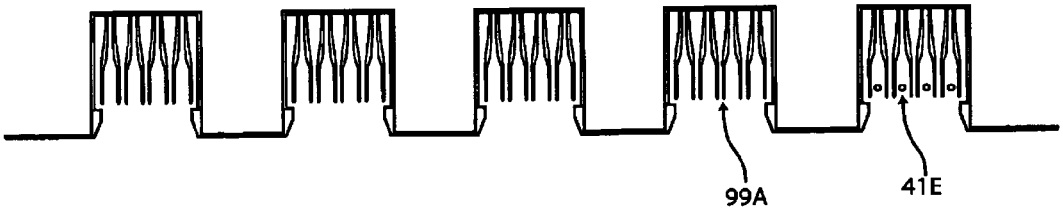

FIG. 102
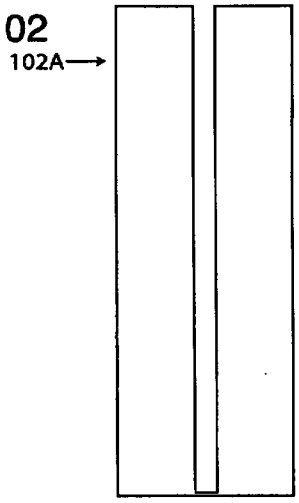
FIG. 102.1
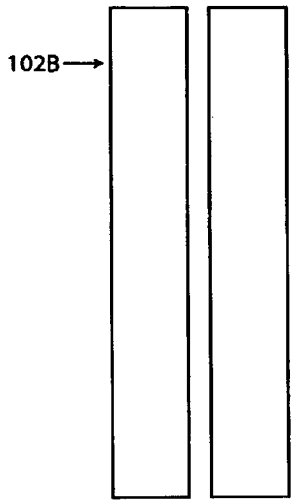
FIG. 102.2
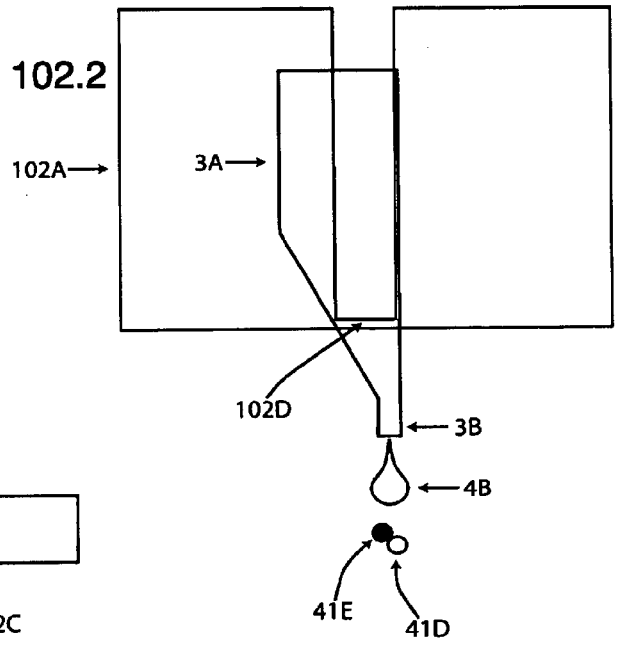
FIG. 102.3
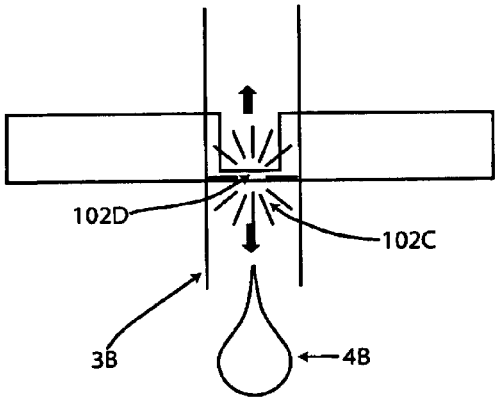

FIG. 103
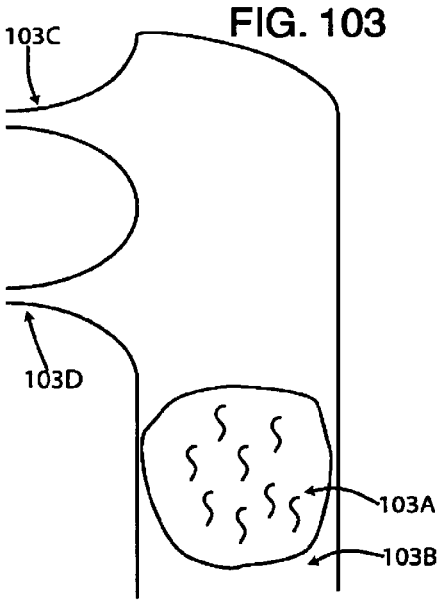
FIG. 103.2
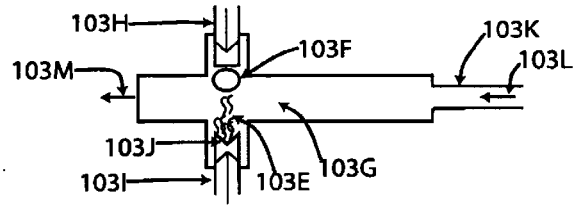
FIG. 103.1
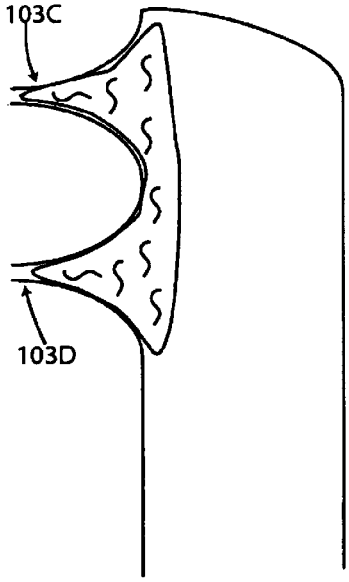

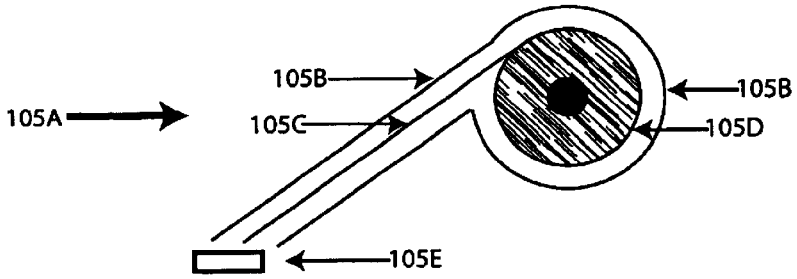
FIG. 105
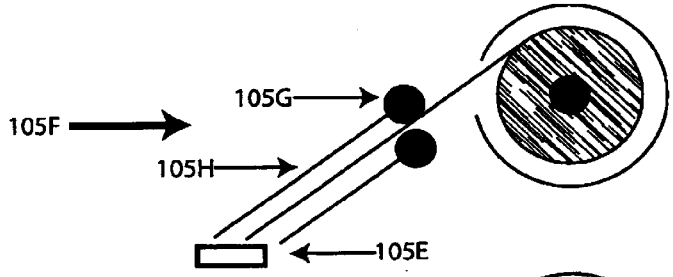
FIG. 105.1
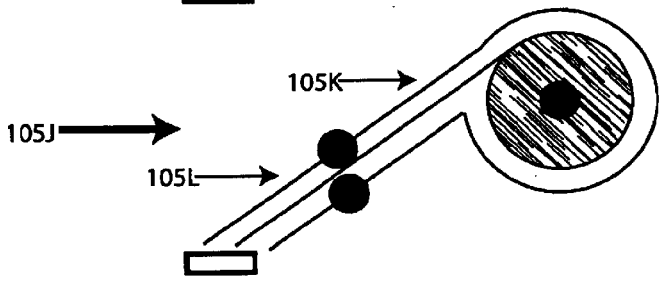
FIG. 105.2
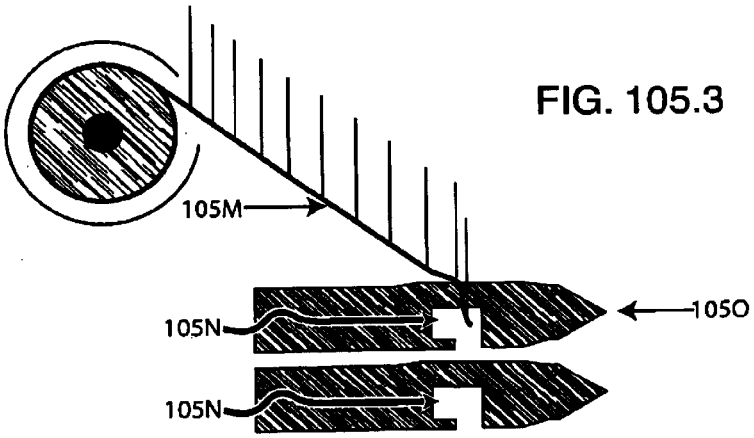
FIG. 105.3

FIG. 106
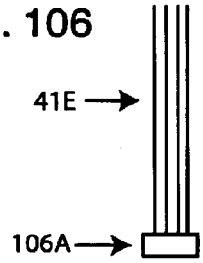
FIG. 106.1
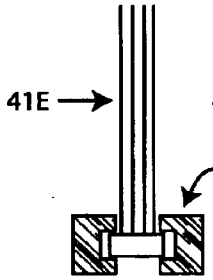
FIG. 106.2
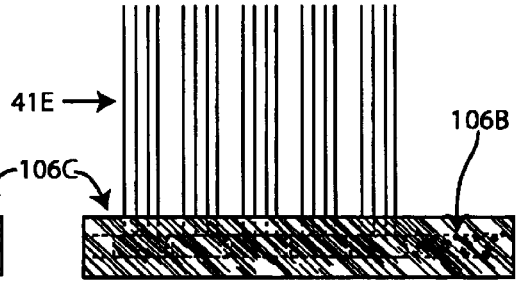
FIG. 106.3
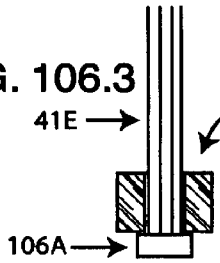
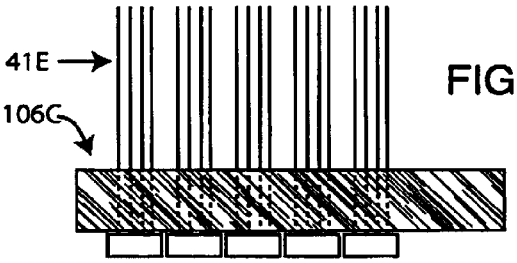
FIG. 106.4
FIG. 107
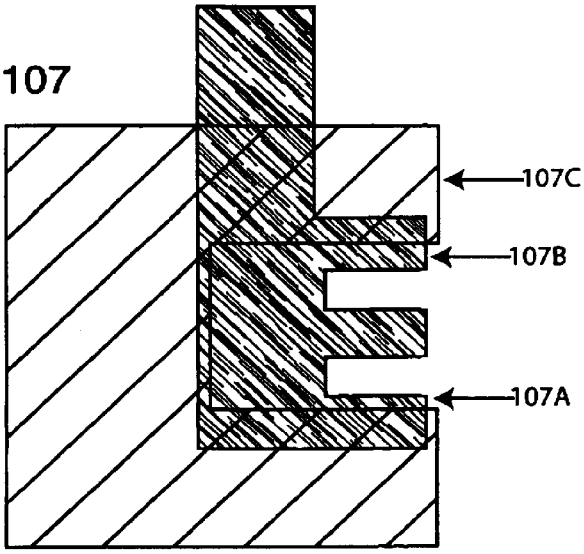

FIG. 108
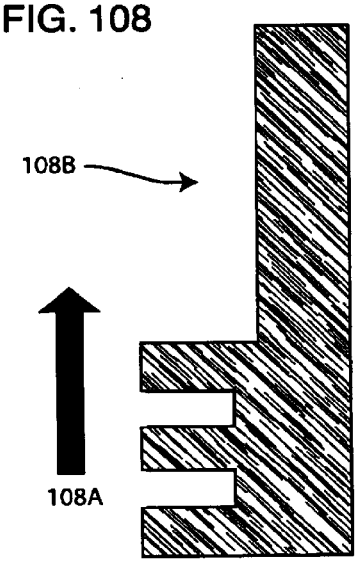
FIG. 108.1
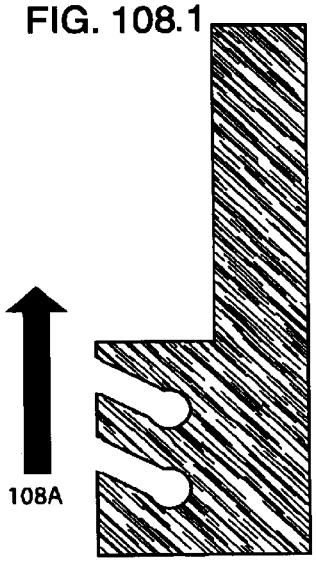
FIG. 109
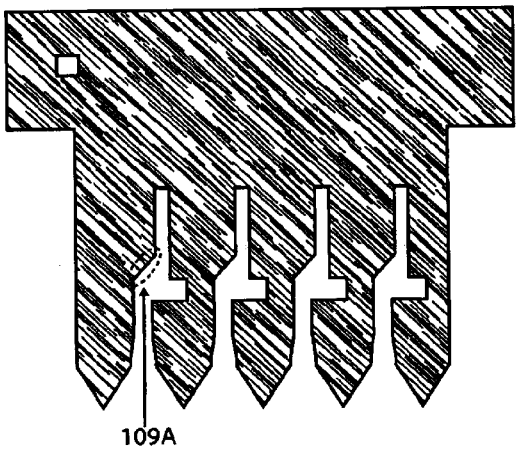
FIG. 109.1
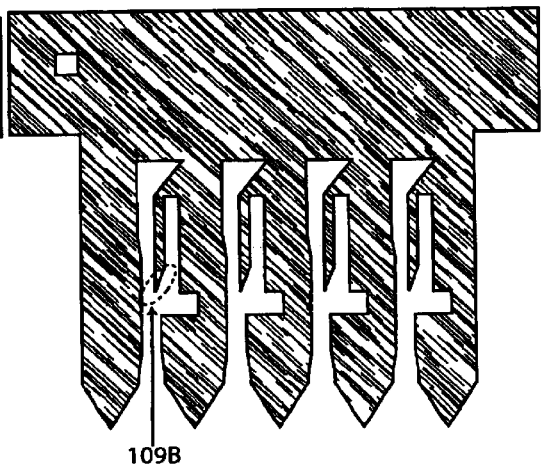

FIG. 110
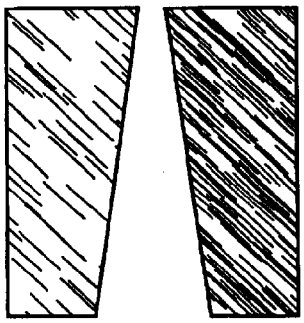
FIG. 110.1
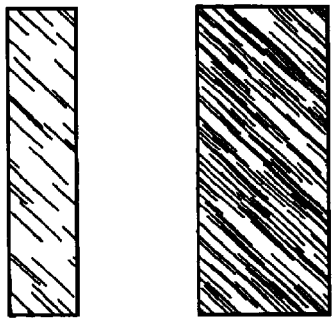
FIG. 110.2
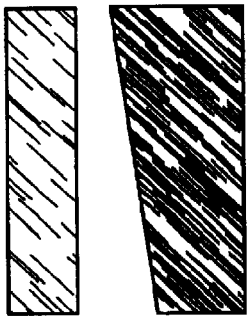
FIG. 110.3
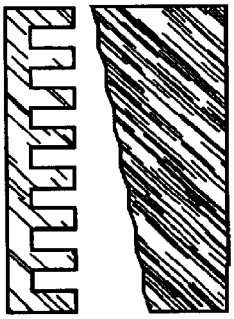
FIG. 110.4
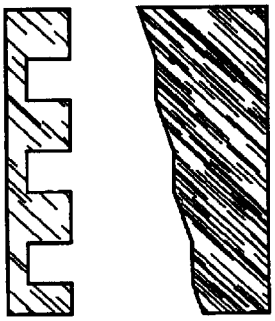
FIG. 110.5
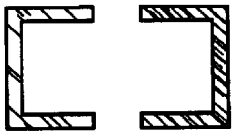
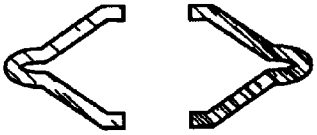
FIG. 110.6

FIG. 111
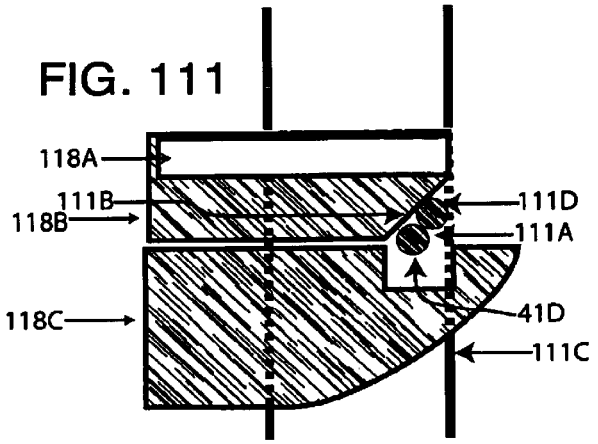
FIG. 112
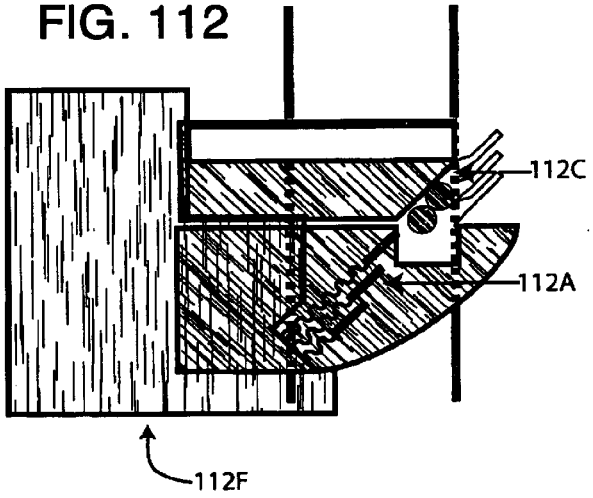
FIG. 112.1
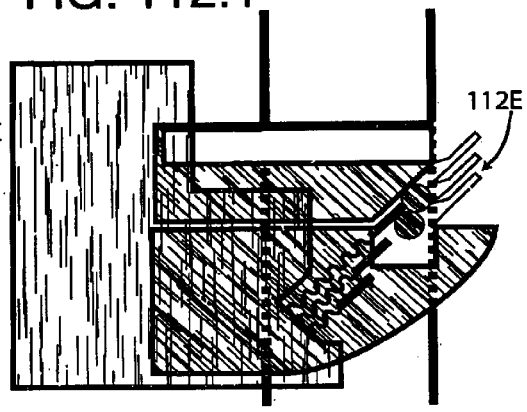
FIG. 112.2
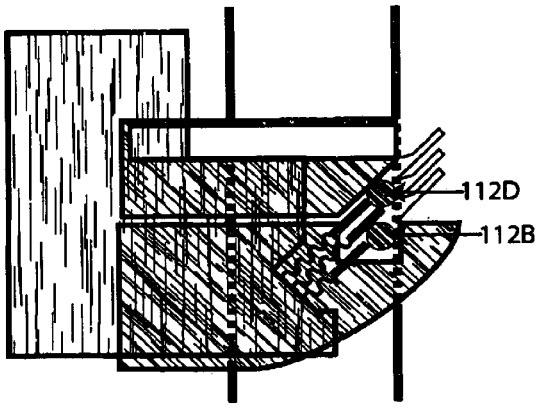
FIG. 112.3
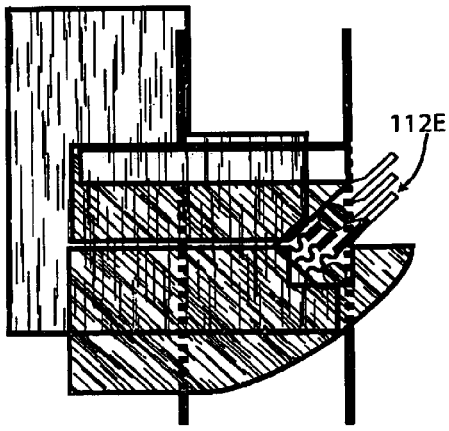

FIG. 113
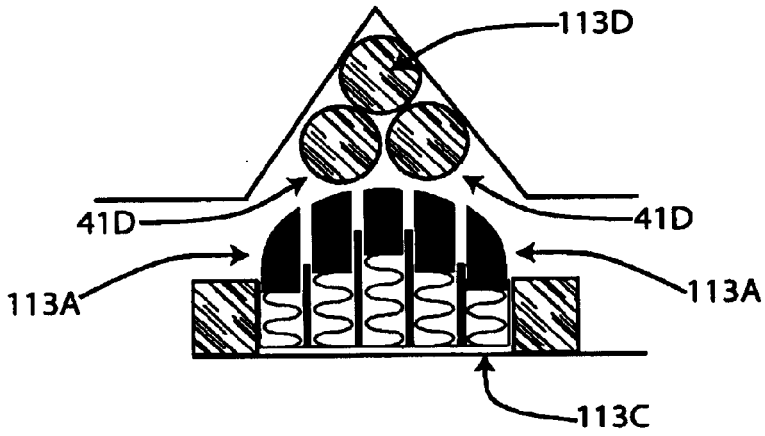
FIG. 113.1
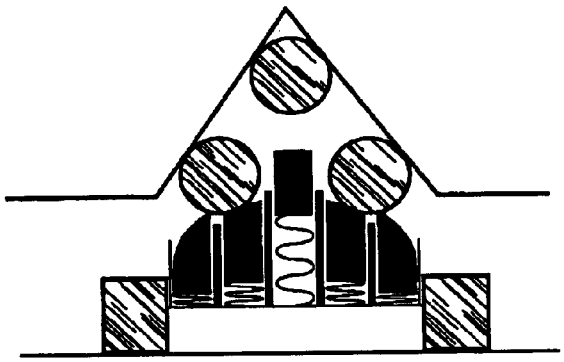
FIG. 113.2
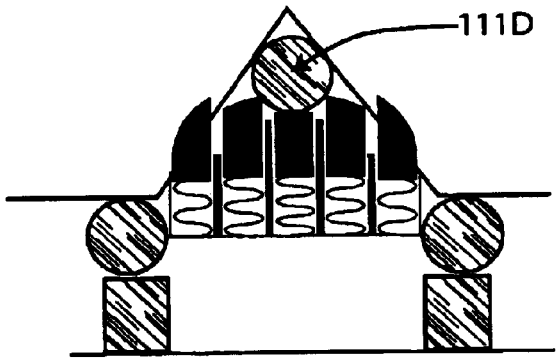

FIG. 114
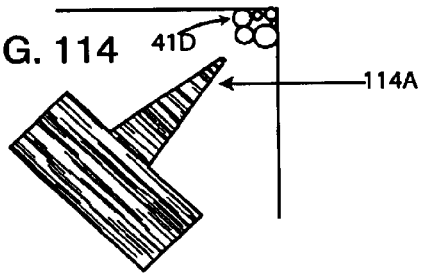
FIG. 114.1
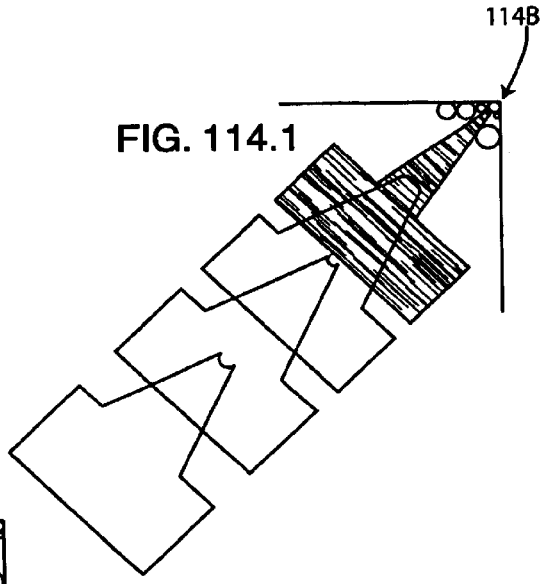
FIG. 114.2
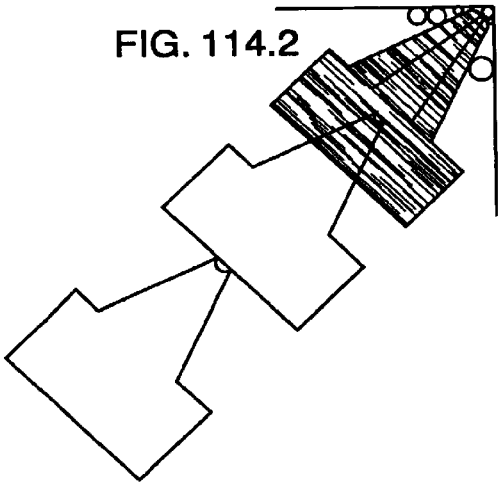
FIG. 114.3
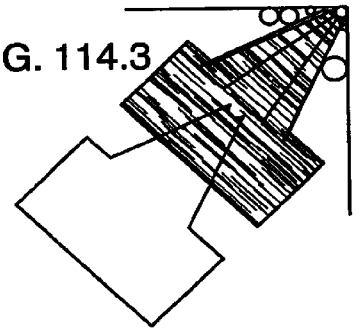
FIG. 114.4
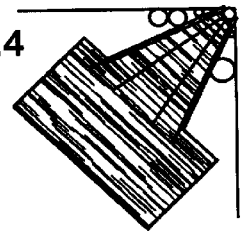

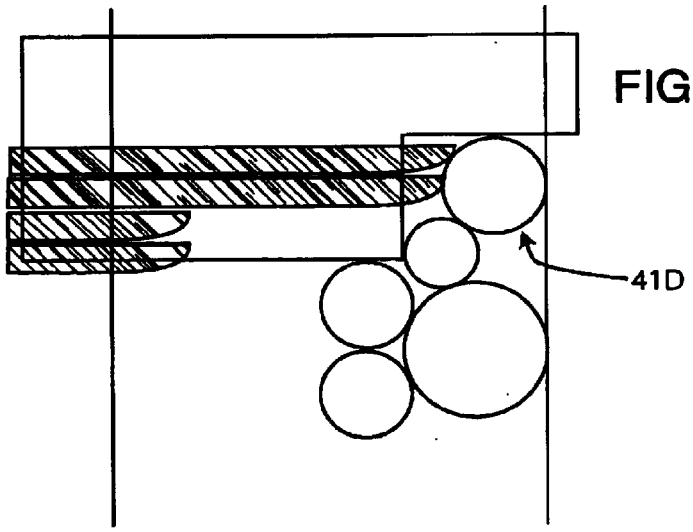
FIG. 115
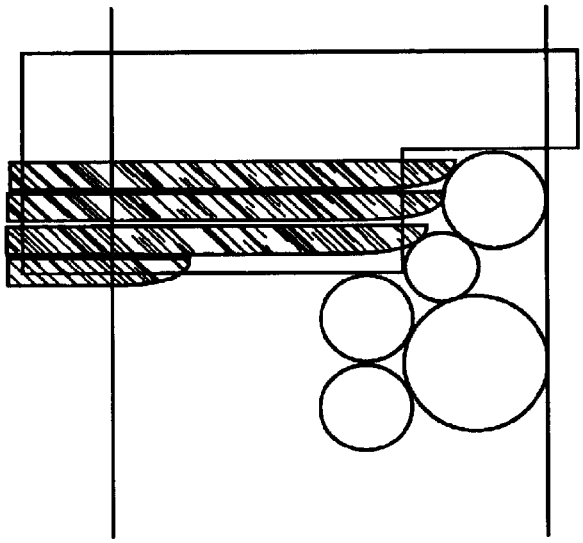
FIG. 115.1
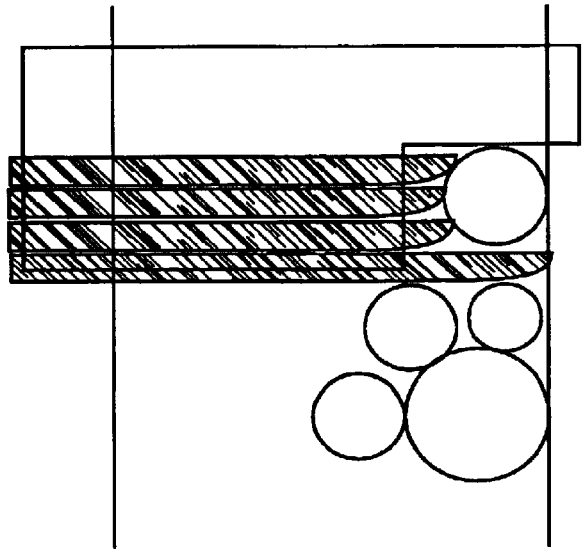
FIG. 115.2

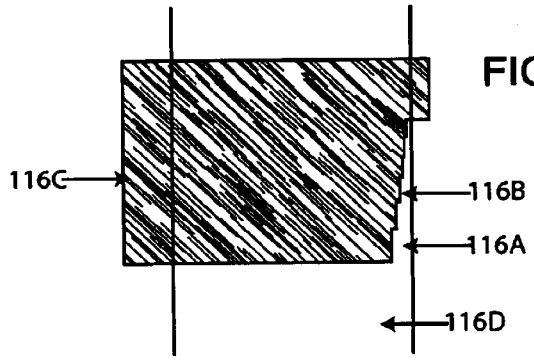
FIG. 116
FIG. 116.11
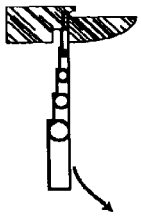
FIG. 116.12
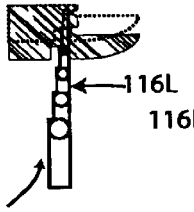
FIG. 116.13
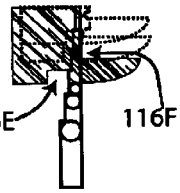
FIG. 116.14
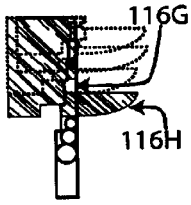
FIG. 116.15
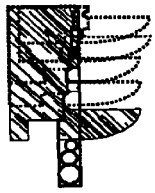
FIG. 116.16
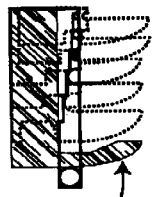
FIG. 116.115
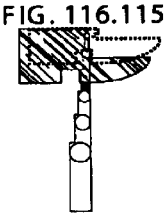
FIG. 116.17X
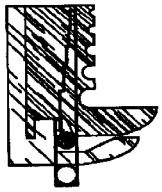
FIG. 116.17
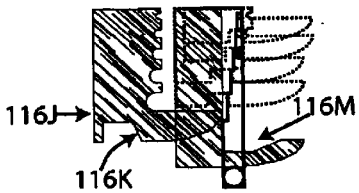
FIG. 116.18
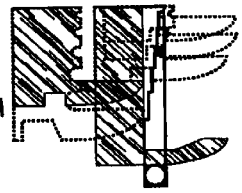
FIG. 116.19
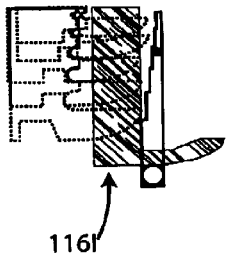
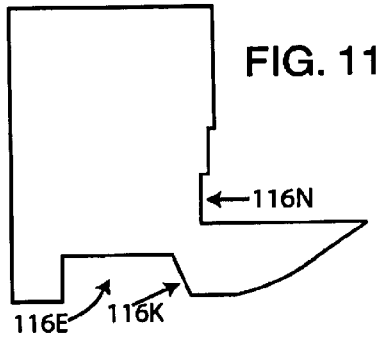
FIG. 116.2

FIG. 117.1
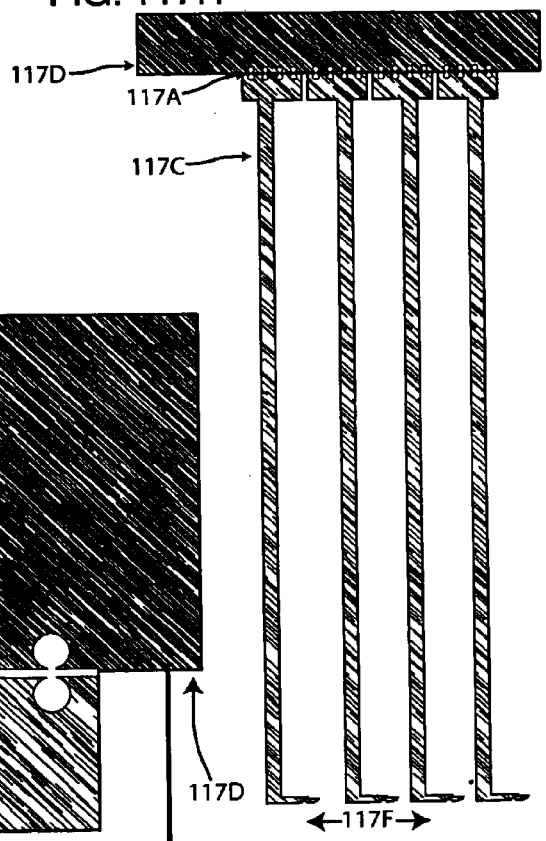
FIG. 117
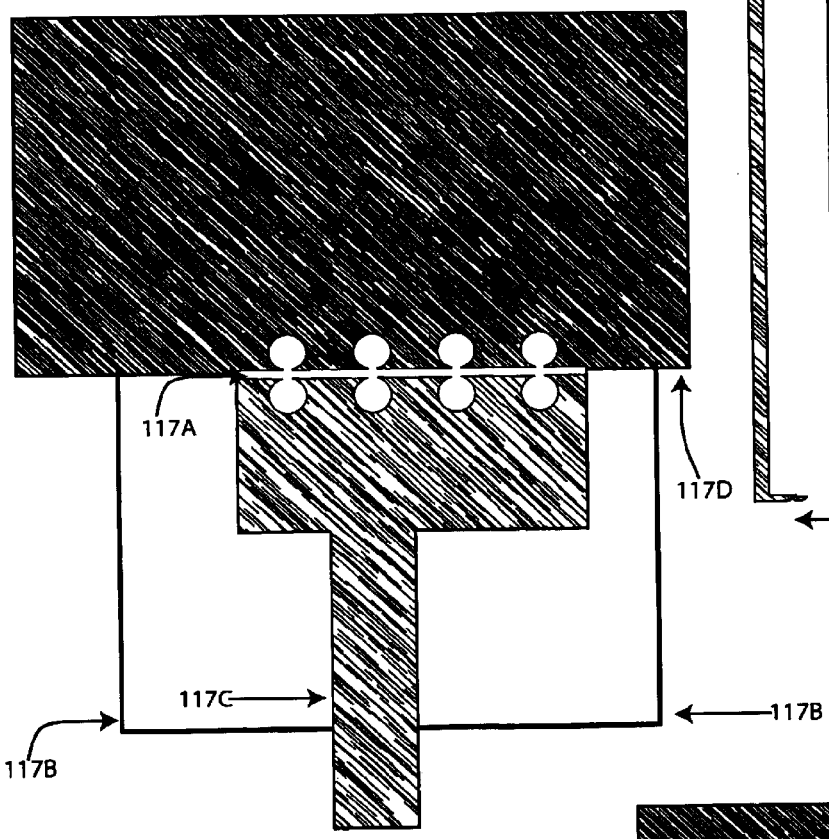
FIG. 117.2
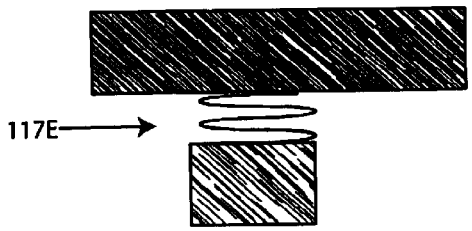

FIG. 118
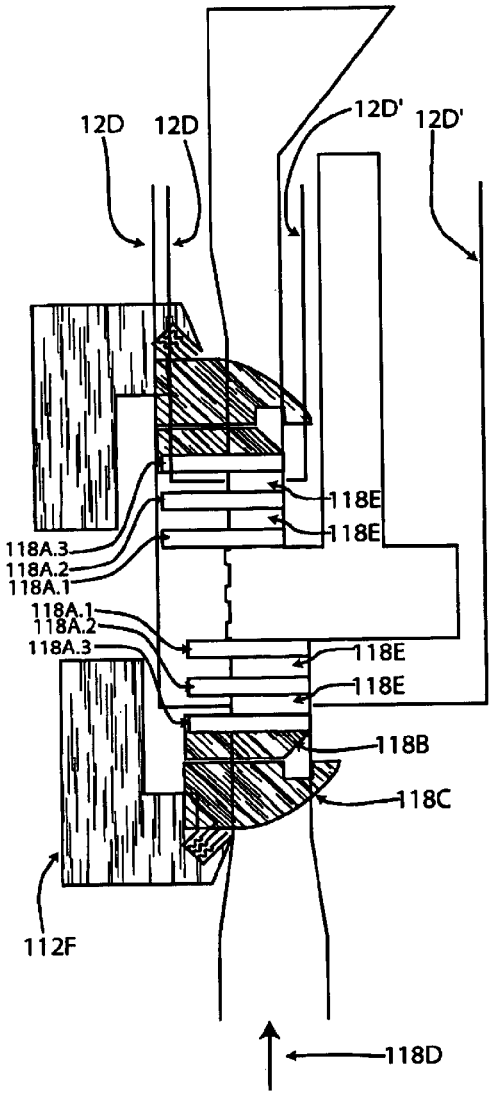
FIG 119
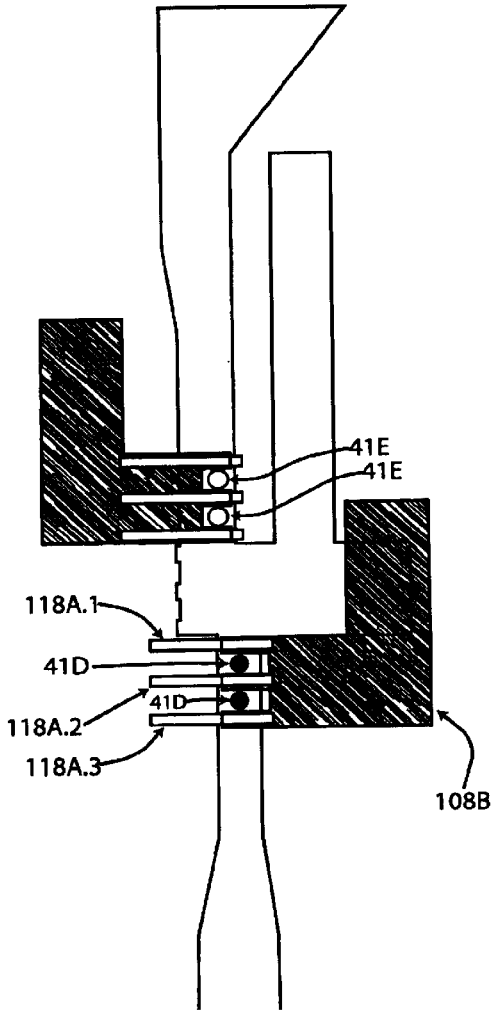
FIG. 118.5
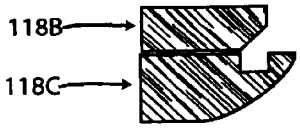

FIG. 120
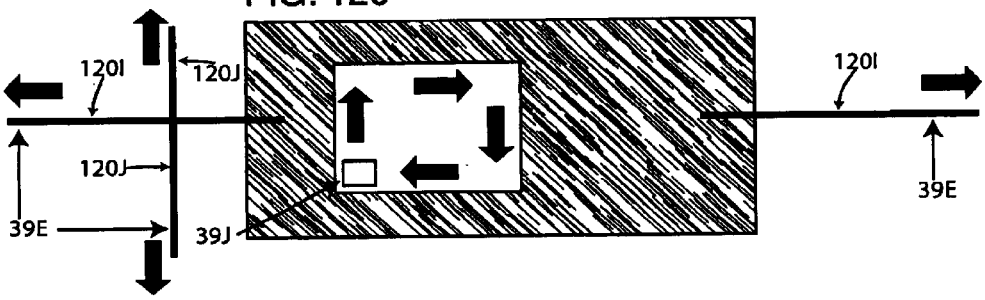
FIG. 120.1
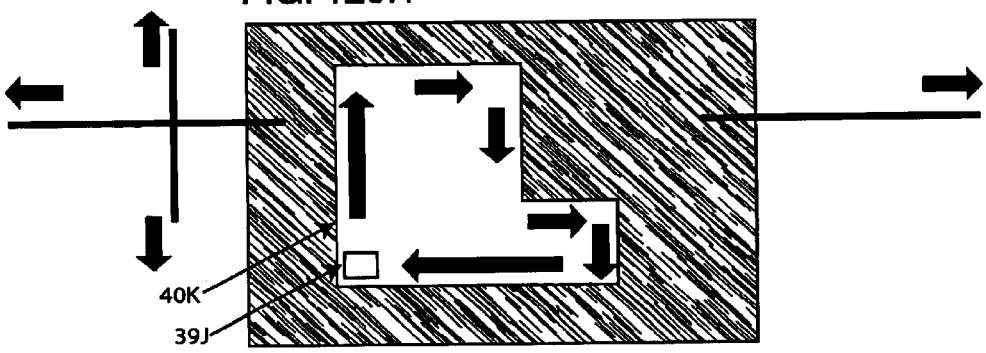
FIG. 120.2
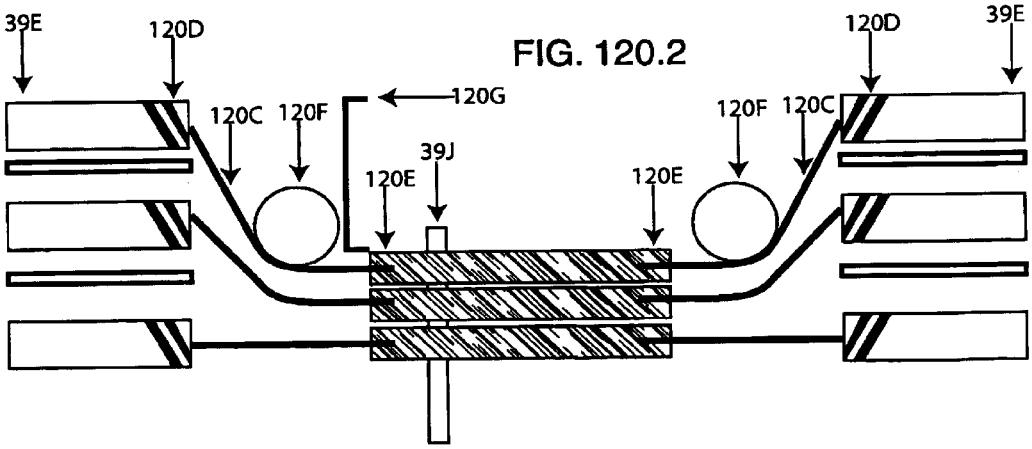

FIG. 121
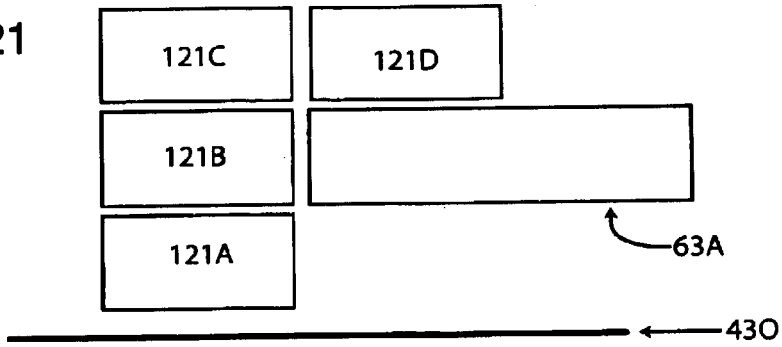
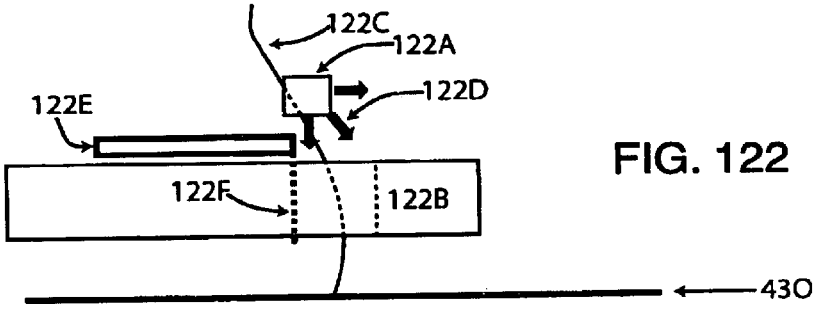
FIG. 122
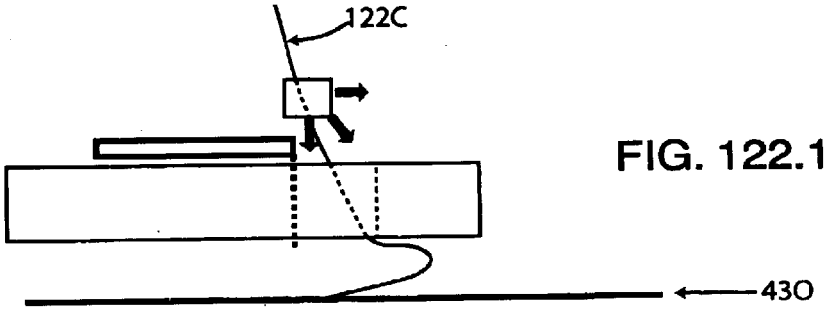
FIG. 122.1
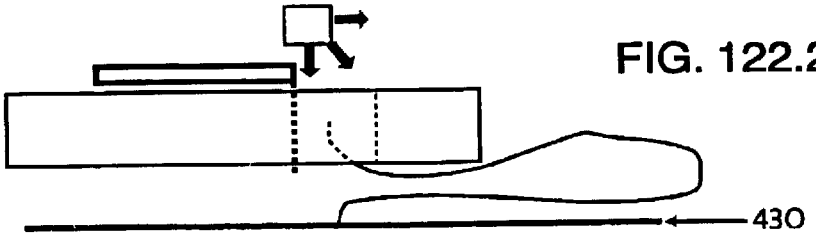
FIG. 122.2

131D
131A
131B
131C
131E
41D 41D
41D
132H
132F
132A
132B
132G
132E
132I
132J

133D'
133D
133A
133A'
133A"

AUTOMATED HAIR ISOLATION AND PROCESSING SYSTEM

This application claims benefit of provisional application 60/063,574 filed Oct. 30, 1997.

TECHNICAL FIELD

The technical field of this invention is the hair-care industry, specifically, the industry responsible for beautification of hair on the human head.

BACKGROUND ART

This invention relates to an electromechanical system that can automatically isolate individual head hairs and mechanically process them in isolation so as to beautify them. For example, by attaching one or a very few hair extensions to one or a very few scalp hairs.

It is well known that isolation of small numbers of skin-attached hairs is useful in the art of hair beautification. For example, highlighting requires the isolation of a small number of scalp hairs so that a coloring agent can be applied selectively to them, and many hair extension application techniques require the isolation of a small number of scalp hairs so that hair extensions can be attached to them. Likewise hair isolation is useful in other hair beautification procedures such as curling the hair.

Several handheld tools that aid in the isolation of skin-attached hairs have been previously developed. For example, U.S. Pat. No. 1,678,891 issued to Walsh on Jul. 31, 1928, discloses a hair waver that uses cooperating combs with isolation comb teeth mounted on a hinged assembly so as to isolate multiple strands in parallel when said assembly is closed. The isolated multiple strands are then waved in parallel by introducing, a second set of moving comb teeth into the isolated strands of hair. One comb tooth is introduced into each isolated strand and moved so as to force said strand significantly laterally against one of the isolation comb teeth so as to form a wave in the hair strand. Thus, multiple hair strands are given separate waves at the same time. To processes a second batch of hairs, the assembly's hinge must be opened and the device must be reoriented on another area of the scalp.

U.S. Pat. No. 5,018,542 issued to Lee May 28, 1991, discloses an instrument for selectively separating strands of hair comprising a comb and handle assembly with a multitude of hooks placed significantly on the opposite side of the assembly relative to the comb's teeth. The comb portion is used to comb out a relatively flat lock of scalp hair. Next, the assembly is flipped over facilitating the introduction of the hooks into the flat lock of hair. The hooks are then moved away from said flat lock carrying with them small isolated locks of hair. Thus, a multitude of hair strands is isolated in separate groups at the same time.

U.S. Pat. No. 4,108,186 issued to Esposto Aug. 22, 1978, discloses a comb for subdividing hair strands. It is a comb that has two lengths of hair channels between its teeth, shallow and deep. When combed into a lock of hair, the lock of hair is divided between the shallow and deep channels. At this point a sliding member is drawn across the channels so as to intersect them and trap all of the deep-channel hairs in the dead ends of the deep channels. This leaves the hairs in the shallow channels isolated and ready for subsequent treatment.

The above three prior-art devices characterize handheld prior-art devices for the isolation of skin-attached hairs.

They all share a common disadvantage in that they can only isolate one batch of hairs at a time before they must be reoriented with considerable manual effort so that they may be brought into contact with another batch. They cannot simply be moved continuously along the scalp as they perform repeated isolation cycles. For example, Esposto's comb traps one batch of scalp hairs at channel dead ends behind a sliding finger or channel obstruction member. However, in order to repeat the process, its operator must release these hairs and manually comb it through hair on a different portion of the scalp.

The present invention eliminates this disadvantage allowing multiple processing cycles to occur without reorientation as the device is moved continuously relative the skin surface. Although the preferred embodiment of the present invention contains a sliding channel obstruction member superficially similar to the sliding finger described by Esposto, the two channel obstruction implementations are quite different. The present invention uses its channel obstruction means to allow a limited number of hairs entry into an isolation area while denying many hairs behind it entry. Unprocessed hairs are forced to wait their turn behind it (behind relative to the direction of hair-flow movement through the system). In essence, unprocessed hairs wait in bunches ready to be nibbled away by the incisive action of the channel obstruction means. This configuration facilitates greatly increased processing rapidity and makes isolating much smaller bunches of hair much more practical. Its continuous mechanical operations are more consistent with automation via a sequencing control means such as a computer than are those of the above prior art devices.

Although the embodiment of this invention described in the greatest detail, herein, is for automated attachment of hair extensions, a variant of it makes possible highly precise automated haircutting. There are automated haircutting devices in the prior art. However, the most similar one we know of is only capable of cutting the hair one length before user interaction is required. This device consists of a relatively conventional electric hair trimmer mounted in a bracket that holds said trimmer portion a fixed height over the scalp while at the same time supplying a vacuum source above said trimmer portion. The vacuum source both holds hairs straight upward so that they all get cut at the same length and carries away hair trimmings. The problem with this system is that it produces a haircut in which every hair on the head is cut to the same length, unlike most professional haircuts which have many lengths, and this length is limited to a maximum far below that required for most women's hairstyles. My hair-isolation-based system will not have these limitations. It can cut hairs to different lengths at different positions on the head, as professional hairstylist would by hand. Also, it can be used in highly precise application of conventional hair-salon preparations including permanent curling formulas, hair relaxing formulas and colorants.

DISCLOSURE OF INVENTION

Automated isolation of one or a very few scalp hairs as a group opens up many hair beautification opportunities that simply are not feasible otherwise. This invention, an electromechanical device, automatically isolates individual head hairs and mechanically processes them in isolation so as to beautify the hair on a person's head.

When I speak of processing individual hairs in isolation, I am referring to one of several mechanical processes. The first is to isolate single hairs growing from a person's scalp and then to bind one or a very few cosmetic hair extension to them. Said hair extensions are bound ideally to the sides of scalp hairs in a position near but not touching the scalp. Said hair-to-hair binding uses a means that is virtually invisible to the eye and imperceptible to the touch. Most preferably, this binding only occurs between a single scalp hair and one or a very few cosmetic hair extensions. Ideally, the binding does not occur between two or more scalp hairs, nor are the hair extensions bound directly to the scalp.

A second way or processing individual hairs in isolation is to reshape their cross-sectional shapes or diameters. This reshaping is desirable because the perceived aggregate texture of a hairstyle depends both on the cross-sectional shape and diameter of each hair. Once individual scalp hairs are isolated in surrounding structures or orifices, they can be processed so as to change their cross-sectional shape and diameter by being drawn through said surrounding structures.

Hair isolation also makes possible application of coloring agents to groups of one or a very few hairs at a time. This is desirable for, at least, two reasons. First, natural hair color is made up of slightly different colored hair strands. Conventional color-application attempts, however, often make the hair appear unnaturally the same color all over. Thus, controlled application of colors to specific isolated hairs is a way of countering this. Second, application of colorants to individual hairs makes possible the use of types of colorants that couldn't be applied to all the hair at once. For example, opaque colorants functionally equivalent to opaque printing inks couldn't be applied to all of the hairs on the head at once. This is because the adhesive binder that is necessary to hold the opaque pigments is so sticky that it would stick many hairs together if applied to them a consolidated group. However, such pigments might be feasibly applied to very limited numbers of hairs in isolation. Additionally, isolated application of other coatings used for hair-care can be applied is the manner, such as hair permanent curling and waving solutions, hair relaxers, and hair conventional hair colorants.

The central processing mechanism of this system takes on a configuration, in many ways, very similar to the front of an electric hair trimmer. This is to say that it has a comb-like structure externally resembling that of an electric hair trimmer, and is run through the hair in a manner similar to an electric hair trimmer. Like an electric hair trimmer, it has open channels, between the tines of its comb-like structure, which allow hairs to move between them. Also like an electric hair trimmer, it is composed of several layers that can slide relative to each other, and in doing so, narrow the hair holding channels in places. In the case of the electric hair trimmer, this channel-narrowing results in hairs within said channels being cut. In the case of my invention, this channel narrowing results in individual hairs being isolated and then processed in various ways. Although electric hair trimmers are usually composed of only two superimposed comb-like structures sliding relative to each other. My device might have twenty or more comb-like layers superimposed on each other, each slightly different in structure and function from the one below it, some moving other remaining stationary.

BRIEF DESCRIPTION OF DRAWINGS

FIG. 1: Floor level of attachment stack. (Top Front Perspective View.)

FIG. 1.1 Floor level fragmentary view of front (Top Plan View.)

FIG. 2: Bend-under belt assembly with hair-flow pathway guide shown as a wire-frame. (Top Front Perspective View.)

FIG. 2.1: Bend-under belt assembly with hair-flow pathway guide shown as a wire-frame. (Top-Left-Side Perspective View.)

FIG. 2.2: Bend-under belts shown in isolation. (Top-Left-Side Perspective View.)

FIG. 6: Nozzle wall level. (Top Front Perspective View.)

FIG. 7: Attachment stack level that encloses a glass prism channel for carrying UV light. (Top Front Perspective View.)

FIG. 12: Hair sensor circuits. (Top Front Perspective View.)

FIG. 12.1: Hair sensor circuits. (Fragmentary View of Rear of Top surface shown in perspective View.)

FIG. 13: Protective level over sensor circuits. (Top Front Perspective View.)

FIGS. 14–14.2: Pencil diagrams to illustrate entrance and pushback gates conceptually by showing sequential movement. (Perspective View.)

FIGS. 15–15.2:. Pencil diagrams to illustrate multiple-pushback gates conceptually by showing sequential movement. (Perspective View.)

FIG. 16: Pincher-tine level relative to the level directly below it. (Top Front Perspective View.)

FIG. 16.1: Pincher-tine level relative to the level directly below it. (Fragmentary View of the front shown from a top front Perspective View.)

FIG. 16.2: A single fragmentary pincher tine shown relative to a single hair-flow-channel guide. The channel guide is drawn as a wire-frame. (Top Front Perspective View.)

FIG. 17: Hairs and hair extensions held together by attachment a bead in each pincher chamber. (Predominately right side perspective view.)

FIGS. 18–18.2: Sequential views of single pincher chamber shown closing around a scalp hair and hair extension in sequential views. (Perspective view.)

FIG. 19: Tine assembly that is a combination entrance gate and channel narrower for scalp hairs shown positioned above underlying hair-flow channel guide. (Top Plan View.)

FIG. 20: Tine assembly that is a combination entrance gate and channel narrower for hair extensions shown positioned above underlying hair-flow channel guide. (Top Plan View.)

FIG. 21: Tine assembly of scalp-hair-multiple-pushback gates shown positioned above underlying hair-flow channel guide. (Top Plan View.)

FIG. 22: Tine assembly of slide-out preventer gates shown positioned above both the underlying hair-flow-channel guide and the tine assembly of scalp-hair-multiple-pushback gates shown by FIG. 21. (Top Plan View.)

FIG. 27: A hair hopper level illustrating the cross-section of spring-pins running through it. (Top Front Perspective View.)

FIG. 27.1: Fragmentary front illustrating key structures of the hair hopper. (Top Plan View.)

FIG. 32; Clip cartridge. (Top Front perspective view.)

FIG. 32.1: Clip cartridge. (Bottom Back perspective view.)

FIG. 32.2: Single hair-extension clip in isolation. (Top Front perspective view.)

FIG. 33: Clip cartridge shown engaged with spring pins. (Top Front perspective view.)

FIG. 33.1: Single clip engaged with single spring pin. (Top Front perspective view.)

FIG. 36.1: Enlarged fragmentary view of frontal region showing function of spring pin and clip relative to the topmost level of the attachment stack. (Top-front-left perspective view.)

FIGS. 37–37.1: Sequential drawings illustrating using a paintbrush brush and finger to illustrate by analogy the importance of the straightening peg. (Top-front-left perspective view.)

FIG. 38: Results of not having a straightening peg illustrated by an enlarged fragmentary view of frontal region showing function of spring pin (without its straightening peg) and hair-extension clip relative to the topmost level of the attachment stack. (Top-front-left perspective view.)

FIG. 39.1: Clip cartridge atop abbreviated attachment stack. (Fragmentary top back perspective view.)

FIG. 40: Illustration of tine-actuation cables shown using two isolated tine assembly levels and the control rod that controls their path of movement. (Top front perspective view.)

FIG. 41: Step series 1 of attachment isolation algorithm. (Top Plan View of entrance-gate-tine-assembly levels relative to the underlying hair-flow-channel guides and cross-sections of both scalp hairs and hair extensions.)

FIG. 54: Step series 7 of attachment isolation algorithm. (Top plan view showing entrance gates being slid back over the channels to block entrance in and out of the attachment area.)

FIG. 55: Step series 7 of attachment isolation algorithm (Top plan view showing the scalp-hair-multiple-pushback gate and pincher having retracted out of the attachment area and the hair-extension-multiple-pushback gate functioning as a pushout actuator as it pushes hairs out of the attachment area.)

FIG. 55.1: Step series 7 of attachment isolation algorithm. (Top Plan View. Attached hairs and hair extensions after they have been pushed out of the attachment area. The pincher is shown retracted into its notch to the right, but all other hair handlers are not illustrated for clarity.)

FIG. 63: The attachment stack as held by the belt buckle. (Top-front-left perspective view.)

FIG. 63.1: The attachment stack as held by the belt buckle showing the relative position of the bend-under-belt assembly. (Left side view.)

FIG. 64: Segment of cable ribbon shown exploded. (Top-front-left perspective view.)

FIG. 64.1: Segment of cable ribbon shown snapped together. (Top-front-left perspective view.)

FIG. 65: Cable ribbon relative to the belt buckle and attachment stack. (Top-front-left perspective view.)

FIG. 66: Fiber optic engagement with belt buckle and attachment stack. (Top-back-left perspective view.)

FIG. 67: Contact-card. (Right Side perspective view.)

FIG. 71.1: Single belt-pulley rib in isolation. (Front view.)

FIG. 71.2: Single pulley-wheel in isolation (Front view.)

FIG. 71.3: Lower portion of pulley-rib in isolation. (Bottom perspective view.)

FIG. 71.4: Single belt-pulley rib with short segments of bend-under belts running through it. (Front view.)

FIGS. 78–78.2: Straightener and attachment stack rotation relative to each other over various surfaces. (Right side schematic view.)

FIG. 79: The attachment system handle unit held by human hand. (Left side view.)

FIG. 79.1: The attachment system handle unit being run over the human head guided by the track cap. (Left side View.)

FIG. 80.1: Schematic depiction of straightener-tine movement relative to a scalp hair. It shows only one fragmentary vertical segment of a stationary straightener tine and one fragmentary vertical segment. (Schematic front view from a slightly left perspective.)

FIG. 80.2: The straightener shown in isolation running over the surface of the scalp. (Top View.)

FIG. 81: The moving set of straightener tines shown in isolation. (Front perspective view.)

FIG. 81.1: The moving set of straightener tines shown in isolation. (Back perspective view.)

FIG. 82: The static set of straightener tines shown in isolation. (Front perspective view.)

FIG. 82.1: The static set of straightener tines shown in isolation. (Back perspective view.)

FIG. 83: Track cap shown in perspective mostly from the back.

FIG. 83.1: Track cap shown in perspective mostly from the front.

FIG. 84: The remover in isolation. (Top-front-left perspective view.)

FIG. 84.1: A single suction nozzle of the remover relative to a bend-under-belt system in isolation. (Top-front-left perspective view.)

FIG. 85: Hair extensions being carried away by bend-under-belt system where a single hair-channel guide is shown as a wireframe. (Left side perspective.)

FIG. 86: Hair-extension-vacuum-belt-transfer unit. (Perspective View.)

FIG. 86.1: Internal levels with dead-end slits inside vacuum-belt-transfer unit. (Perspective View.)

FIG. 87: Hair-extension-vacuum-belt-transfer unit. (Perspective view from right side.)

FIG. 88: Hair-extension-vacuum-belt-transfer unit. (Right side view.)

Figure 93:
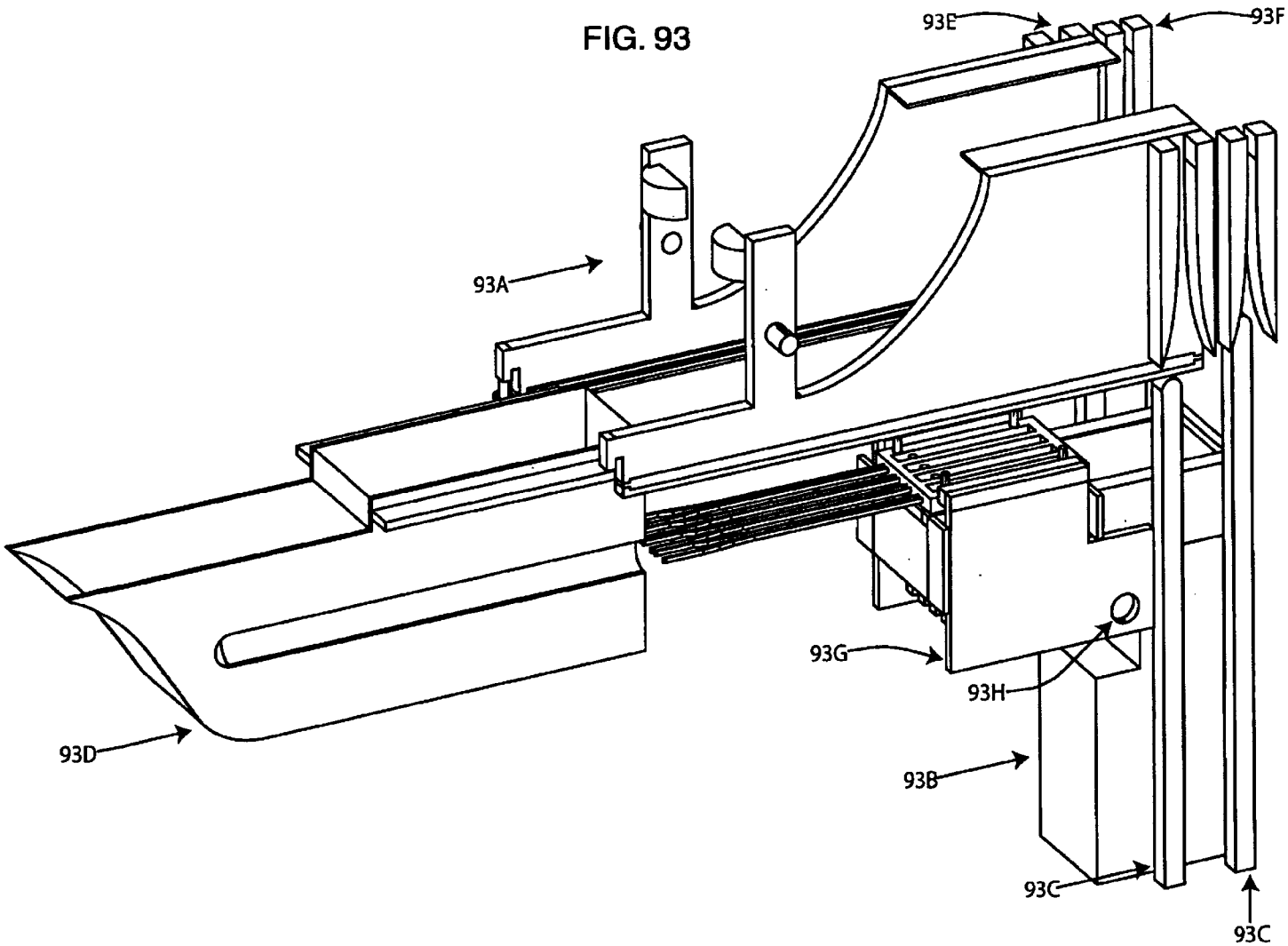

FIG. 93: Canopy of handle unit triggered to slide open as handle unit is lowered onto its dock. (Perspective view from right side.)

Figure 94:
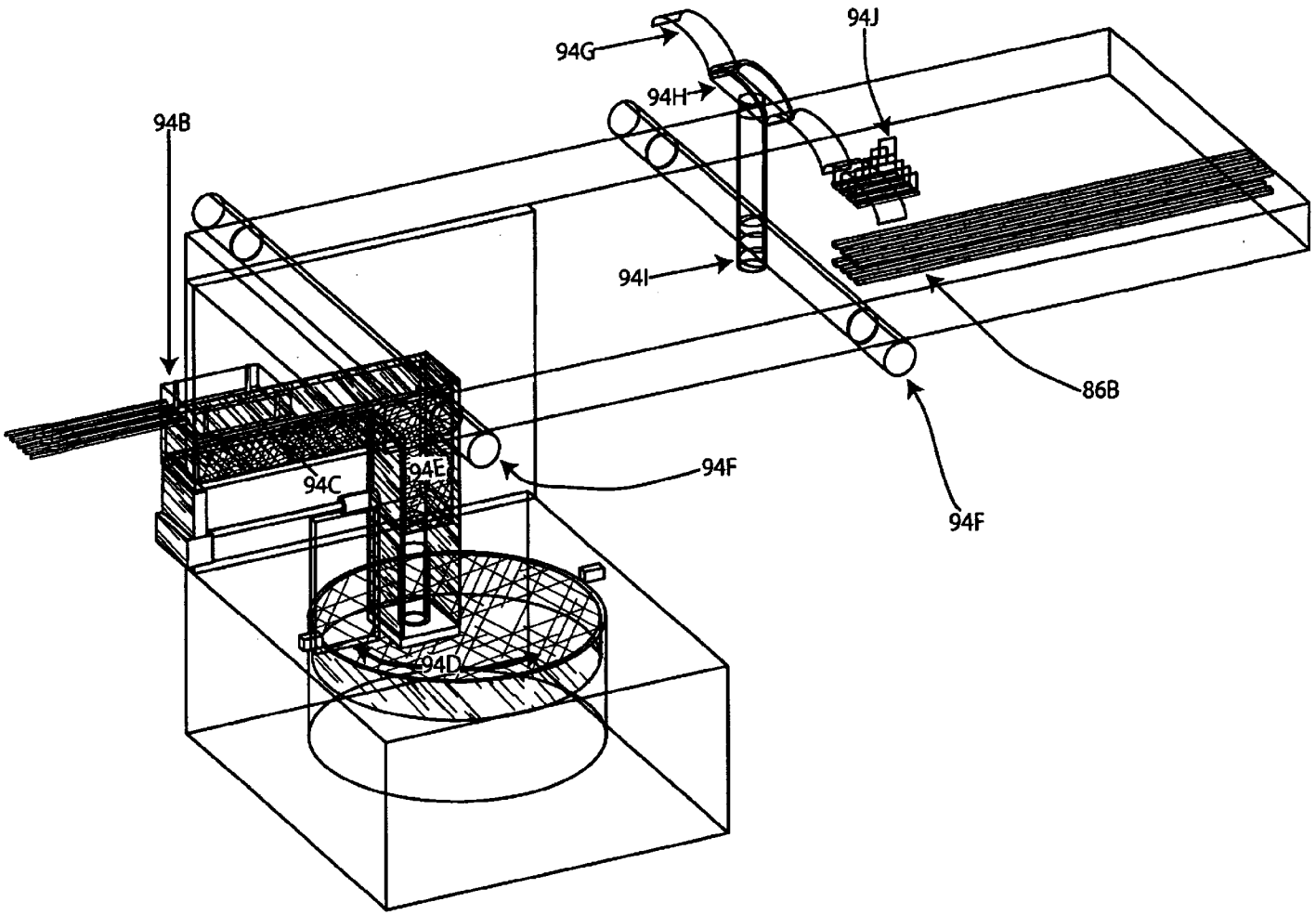

FIG. 94: Reversing clip filler turned in direction of docks. (Perspective.)

Figure 95:
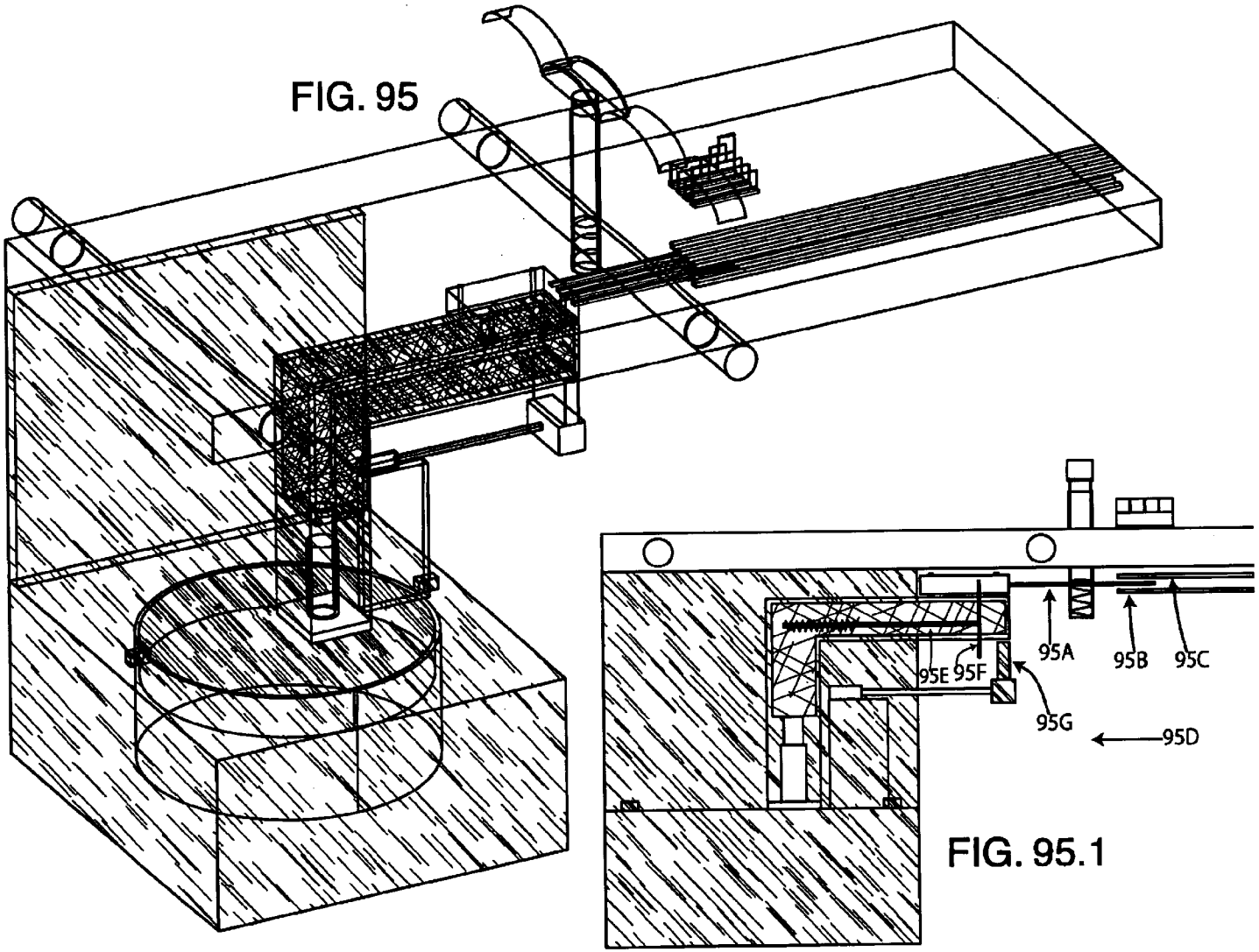

FIG. 95: Reversing clip filler turned in direction of hair extension transport belts. (Perspective view from right side.)

FIG. 95.1: Reversing clip filler turned in direction of hair extension transport belts. (Right side view.)

Figure 96:
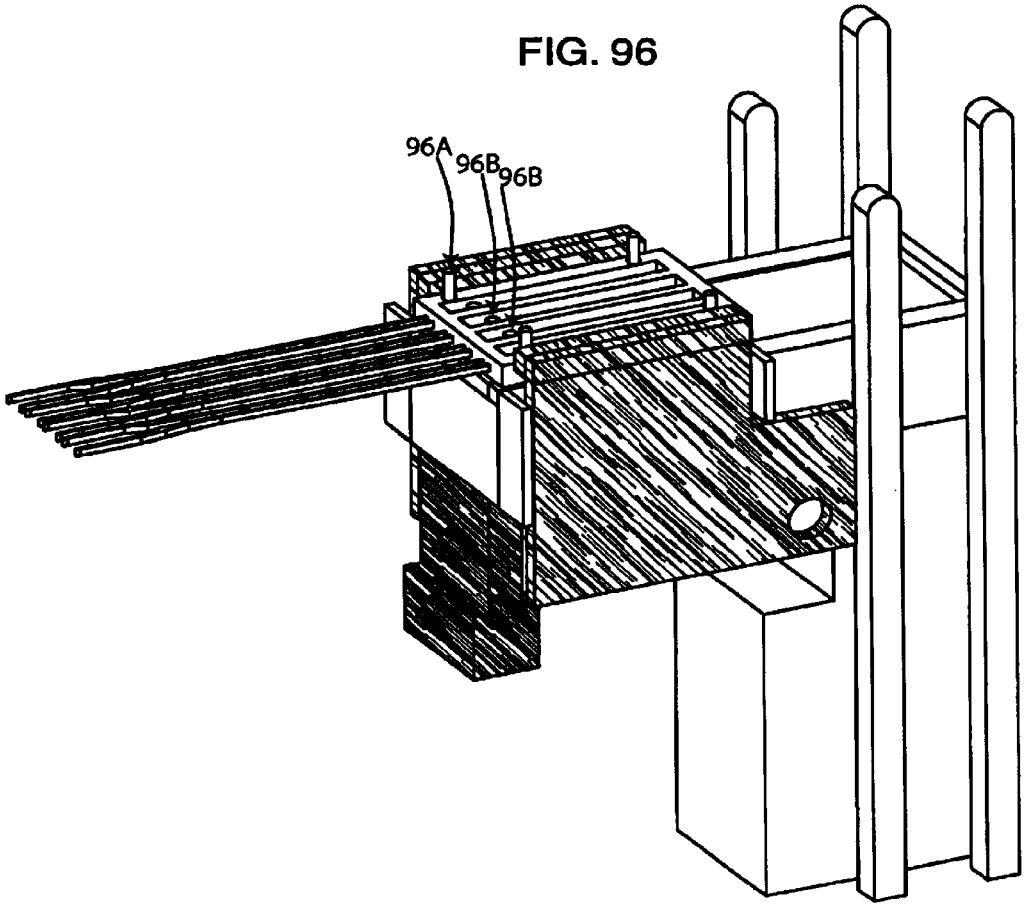

FIG. 96: Clip cartridge sitting atop a single cartridge dock in isolation. (Perspective view from right side.)

Figure 97:
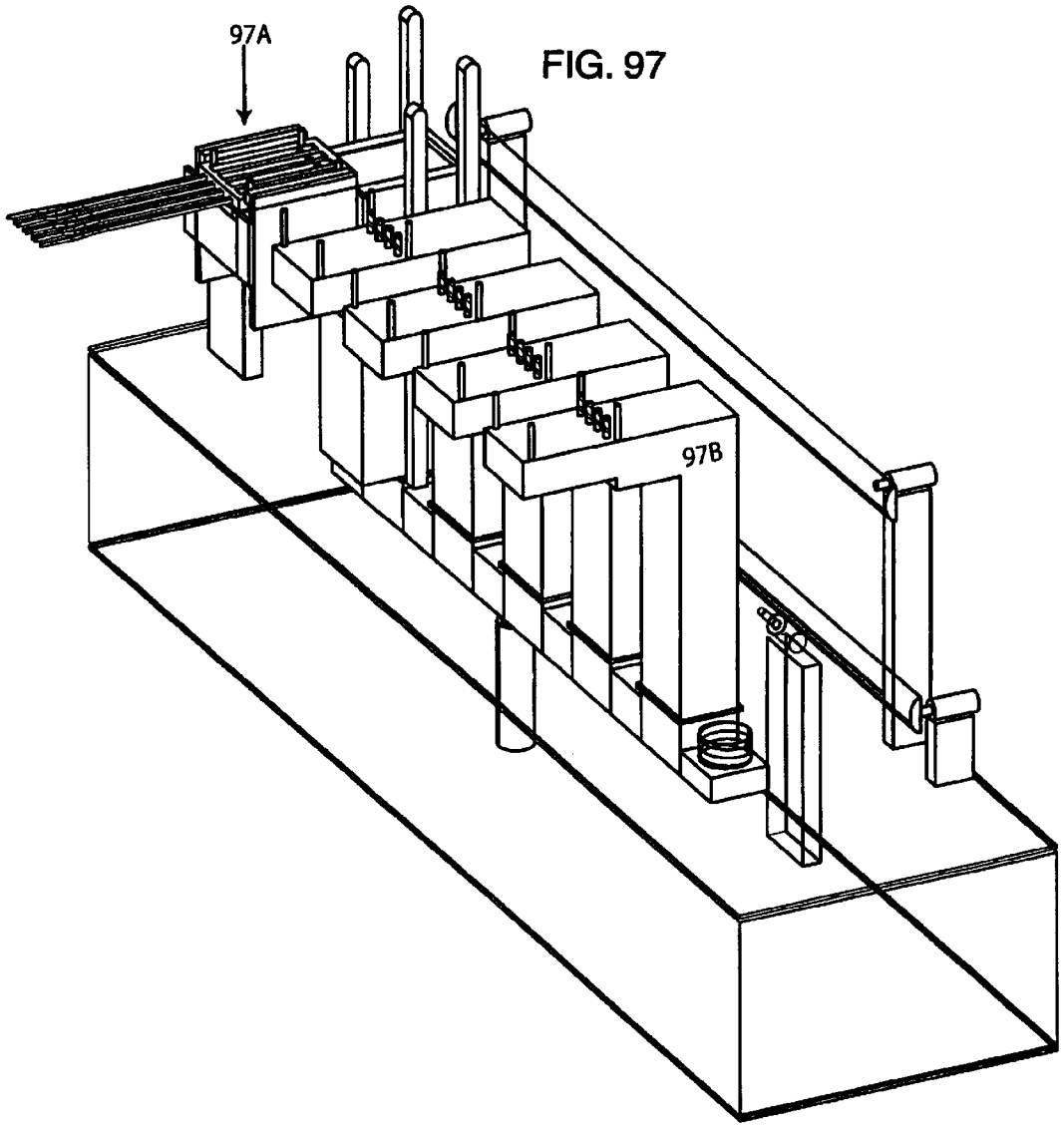

FIG. 97: A set of cartridge docks, most of which have their interior mechanisms exposed. (Perspective view from right side.)

Figure 98:
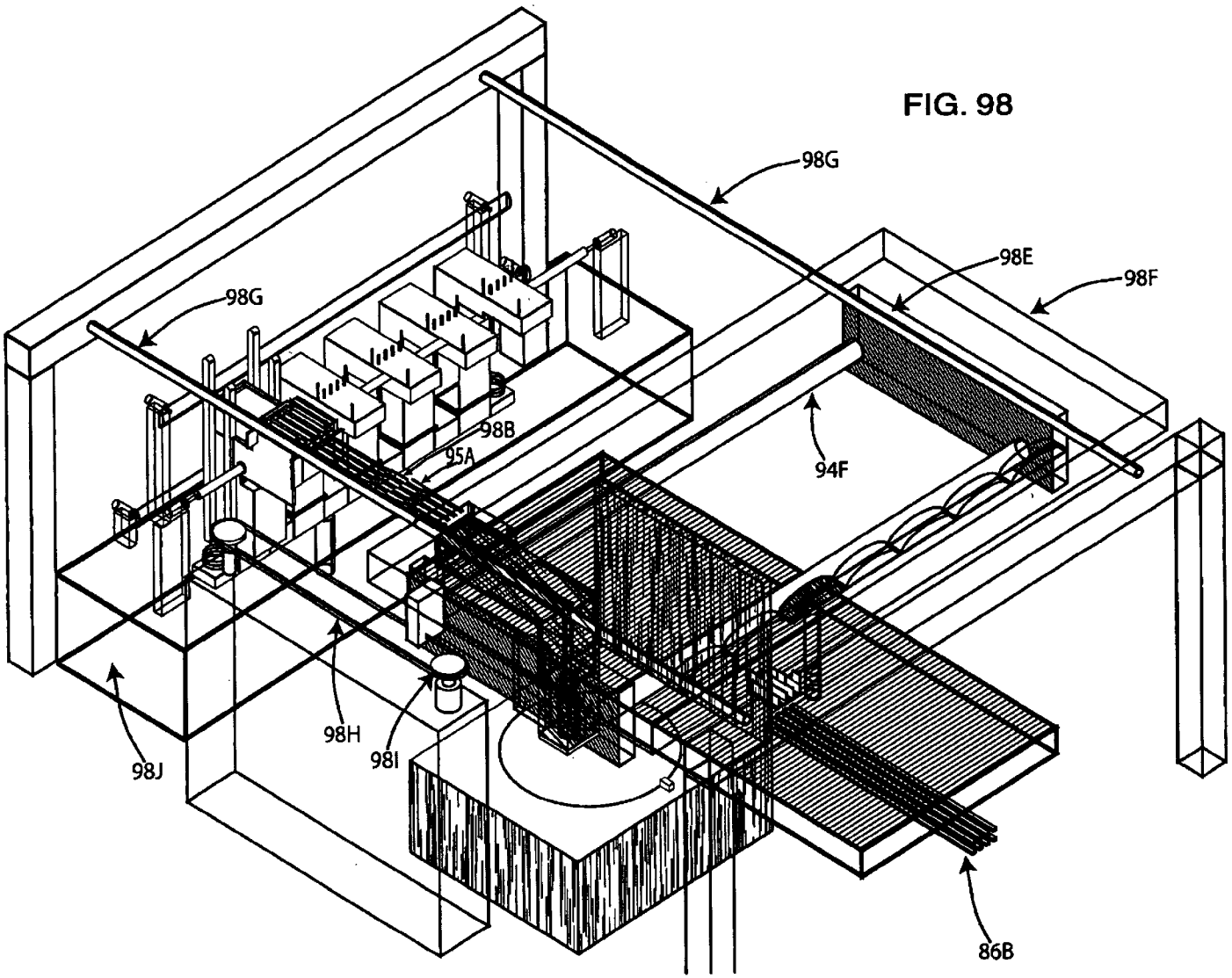

FIG. 98: The reversing clip filler shown relative to a set of cartridge docks. (Perspective view.)

FIG. 99: Hair extension introduction cartridge. (Front perspective view.)

FIG. 99.1: Hair-extension-introduction cartridge. (Top view.)

Figure 100:
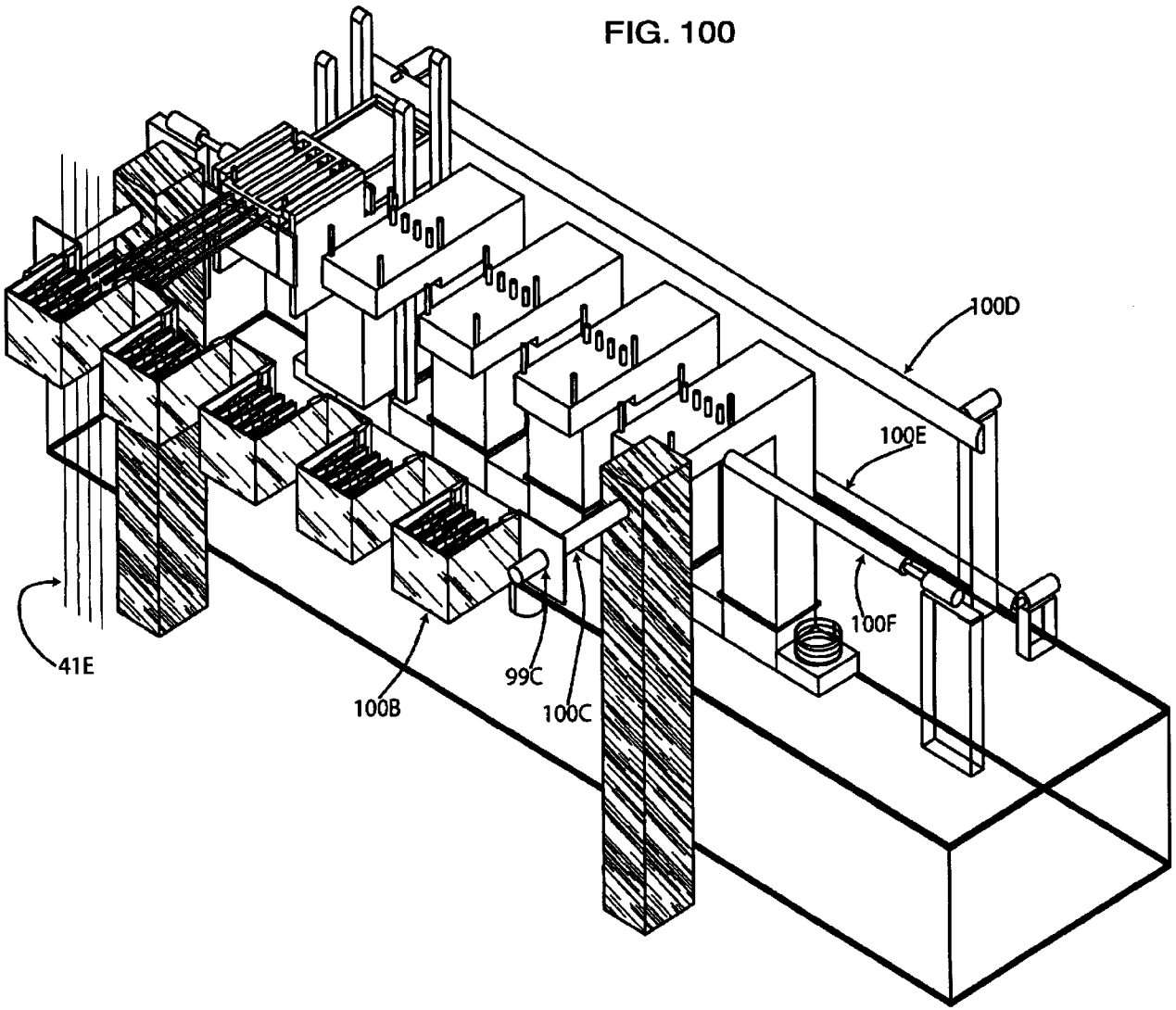

FIG. 100: Hair-extension-introduction cartridge relative to a set of cartridge docks. (Perspective view.)

Figure 101:
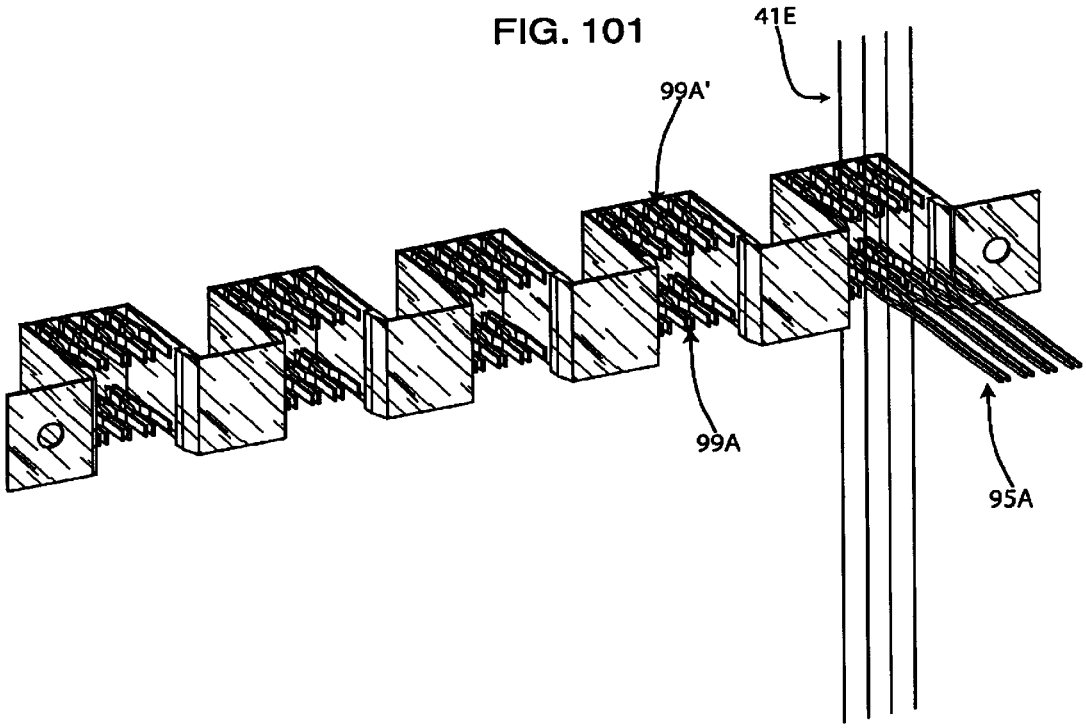

FIG. 101: Hair-extension-introduction cartridge shown relative to the clips of a single clip cartridge. The clip cartridge itself is not shown. (Front perspective view.)

FIGS. 102–102.1: Thermal bubble jet electrical circuit patterns. (Top view.)

FIG. 102.2: Thermal bubble jet electrical structures relative to the nozzle that they drive. (Top view.)

FIG. 102.3: Close up illustration of a vapor burst triggered by an electrical-resistance-heating element at the tip of a bubble-jet nozzle (Top view.)

FIG. 103–103.1: Splitting-nozzle set shown in sequential views as a spitball-like glob of adhesive moves through it. (Top view.)

FIG. 103.2: System that supplies the spitball-like splitting nozzles. (Schematic side view.)

Figure 104:
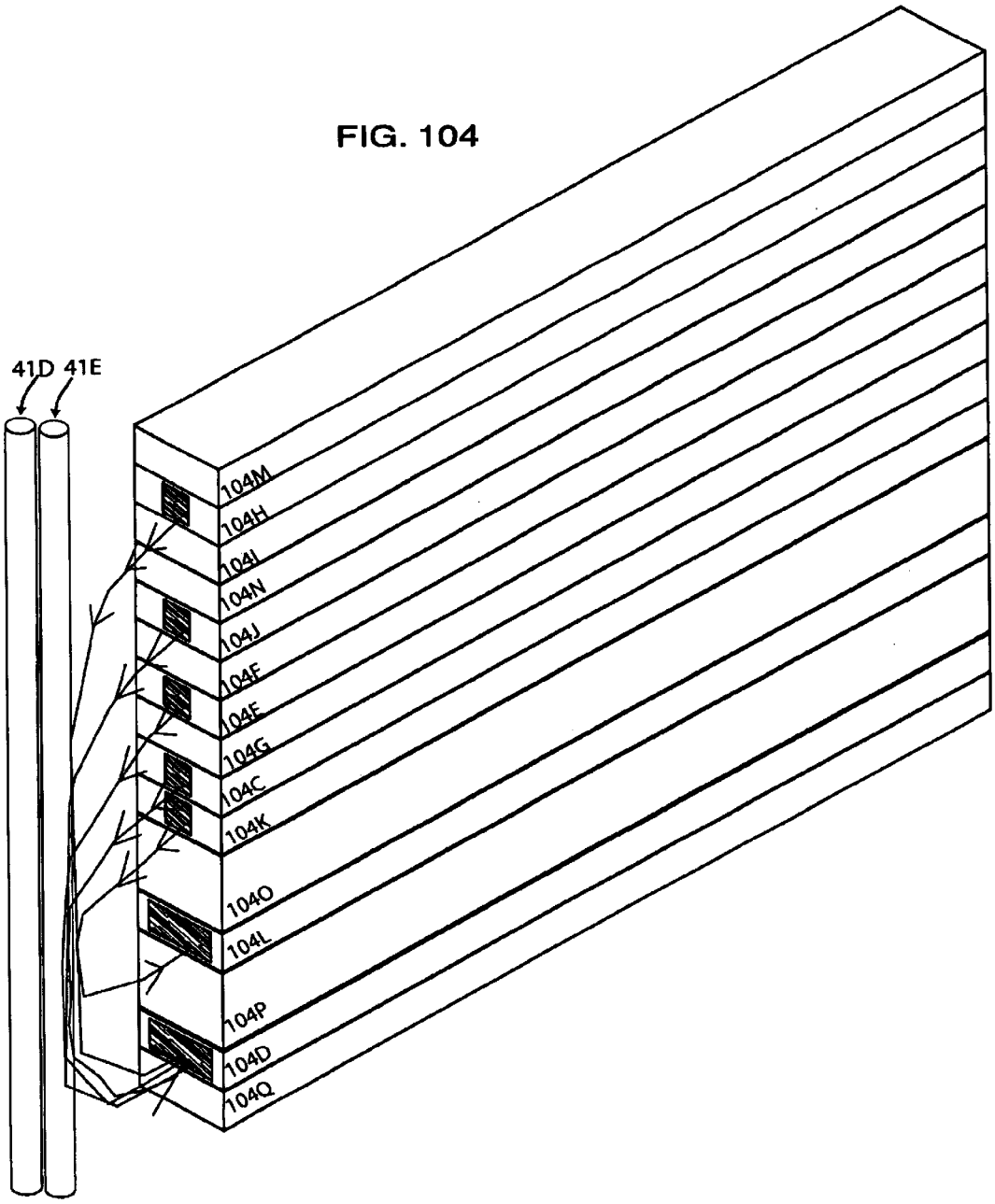

FIG. 104: Attachment-chamber nozzle stack. (Perspective view.)

FIGS. 105–105.2: Hair-extension-supply spool feeding a target area. (Schematic side view.)

FIG. 105.3: Recessed attachment areas in attachment stack tines being fed by a hair-extension-supply spool. (Schematic illustrating top of tines but side of the supply spool.)

FIG. 106: Anchor-unified hair extensions.

FIG. 106.1: Pure-rail-interlock clip for holding anchor-unified hair extensions. (Front view.)

FIG. 106.2: Pure-rail-interlock clip for holding anchor-unified hair extensions. (Side view.)

FIG. 106.3: Pinch-and-slide-along-rail clip for holding anchor-unified hair extensions. (Front view.)

FIG. 106.4: Pinch-and-slide-along-rail clip for holding anchor-unified hair extensions. (Side view.)

FIG. 107: Overhanging structure to limit access to pincher notches. (Top View.)

FIG. 108: Transport-forward gate with regular-shaped notches. (Top View.)

FIG. 108.1: Transport-forward gate with sloped notches. (Top View.)

FIG. 109: Floor level of the hair-pathway-guide structure with tip-trench fronts that are sloped. (Top view.)

FIG. 109.1: A level of the hair-pathway-guide structure with tip-trench fronts that are sloped. It represents a level higher in the stacking order than the floor level illustrated by FIG. 109. (Top view.)

FIGS. 110–110.4: Various pincher shapes illustrated schematically from the side.

FIGS. 110.5–110.6: Various pincher shapes illustrated schematically from the top.

FIG. 111: Pushback gate, entrance gate, and holding gate shown relative to two hair cross-sections in a metering area. (Top View.)

FIGS. 112–112.3: Flexible-finger-isolation-area obstruction means shown sequentially isolating a single hair. (Top View.)

FIGS. 113–113.2: Tapered-end spring fingers shown relative to three hair cross-sections in a metering area sequentially isolating a single hair. (Top View)

FIGS. 114–114.4: Wedge-shaped isolation-area obstruction means shown sequentially isolating a single hair. (Top View.)

FIGS. 115–115.2: Sub-hair-diameter-INTERVAL-spaced-pushback-gate system shown sequentially isolating a single hair. (Top view.)

FIG. 116: Entrance gate with sub-chambers forming a metering area. It is designed for use with the sub-hair-diameter-ACCURACY-spaced-pushback-gate system. (Top View.)

FIGS. 116.11–116.19: Sub-hair-diameter-ACCURACY-spaced-pushback-gate system shown sequentially isolating a single hair. (Top view)

FIG. 116.2: Accuracy-spaced type of pushback gate in isolation. (Top view.)

FIGS. 117–117.2: Tine flexibility joint. (Various top views.)

FIG. 118: Holding gate system shown relative to the flexible-finger-isolation-area-obstruction means. (Top View.)

FIG. 119: Transport-forward gates aligned with holding-area notches formed between the holding gates. (Top View.)

FIG. 120: Movement and control of a typical sliding tine layer illustrated. (Top View)

FIG. 120.1: Movement and control of a typical sliding tine layer illustrated. Shows a more complex movement pattern than FIG. 120 made possible in part by the more complicated shape of its movement-control slot. (Top view.)

FIG. 120.2: Interface of actuation cables with a stack of sliding tine layers. (Front view.)

FIG. 121: Schematic of the straightener's functional zones relative to the attachment stack. (Side view.)

FIG. 122–122.2: Pushdown method of bend-under illustrated schematically in sequential views. (Side view.)

Figure 123:
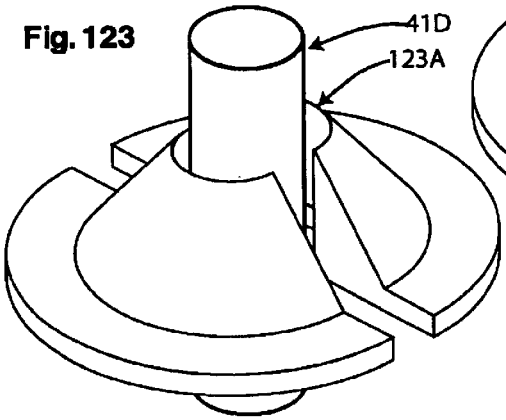

FIG. 123: Cross-sectional reshaping orifice in isolation with a hair at it its center. (Perspective view.)

Figure 124:
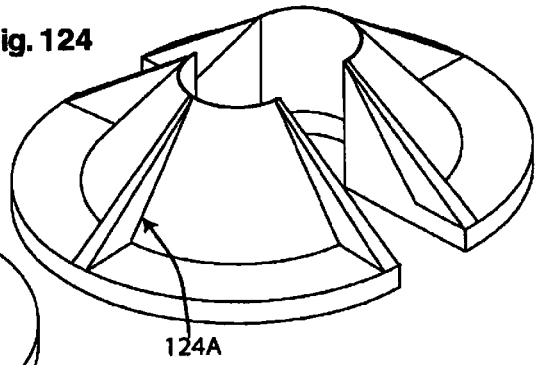

FIG. 124: Cross-sectional reshaping orifice in isolation shown with ridged edges for reinforcement and increased blade life. (Perspective view.)

Figure 125:
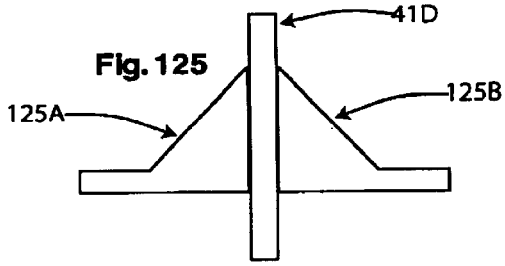

FIG. 125: Cross-sectional reshaping orifice in isolation with a hair at it its center. (Side view.)

Figure 126:
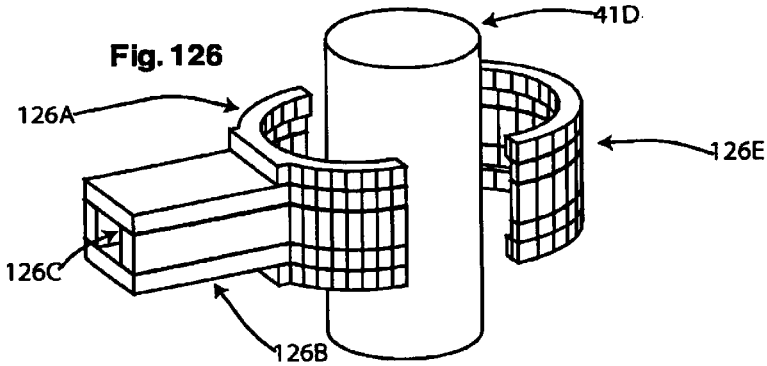

FIG. 126: Coating orifice shown in isolation surrounding a hair. (Perspective view.)

Figure 127:
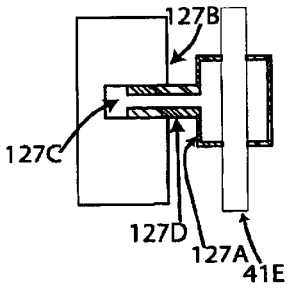

FIG. 127: Coating orifice plugged into fluid supply. (Side view.)

Figure 128:
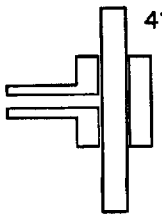

FIG. 128: Coating orifice with constant cross-section. (Side view.)

Figure 129:
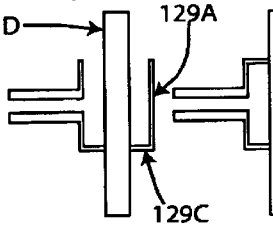

FIG. 129: Coating orifice with narrowed bottom. (Side view.)

Figure 130:
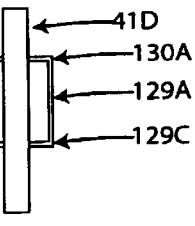

FIG. 130 Coating orifice with narrowed top and bottom. (Side view.)

Figures 131, 132, 133:
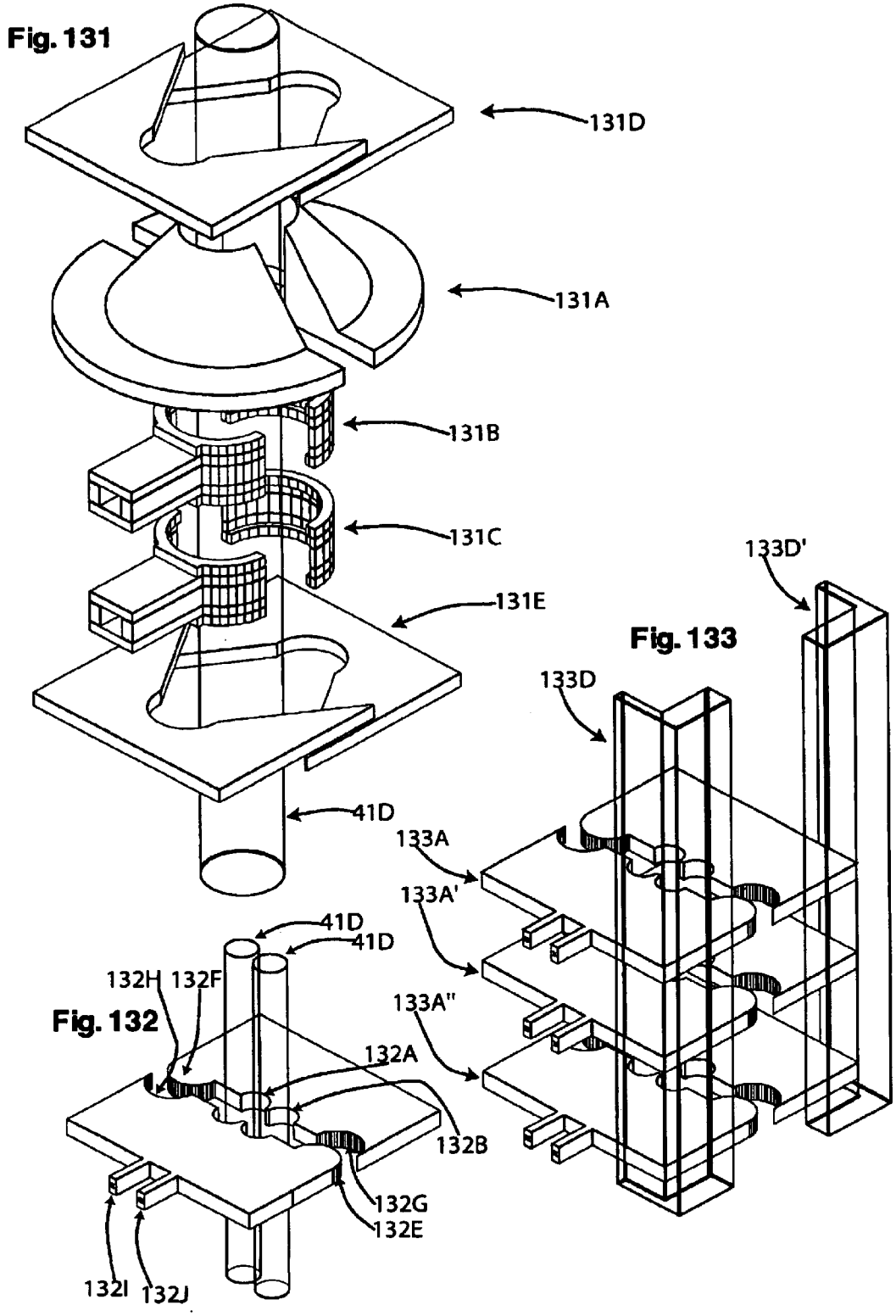

FIG. 131: Centering guides, reshaping orifices, and coating orifices processing a hair being longitudinally drawn through them. (Perspective view.)

FIG. 132: Single coating orifice level illustrating two coating orifices combined onto a single assembly. (Perspective view.)

FIG. 133: Several in-line coating-orifice assemblies attached by vertical supports. (Perspective view.)

Figure 134:
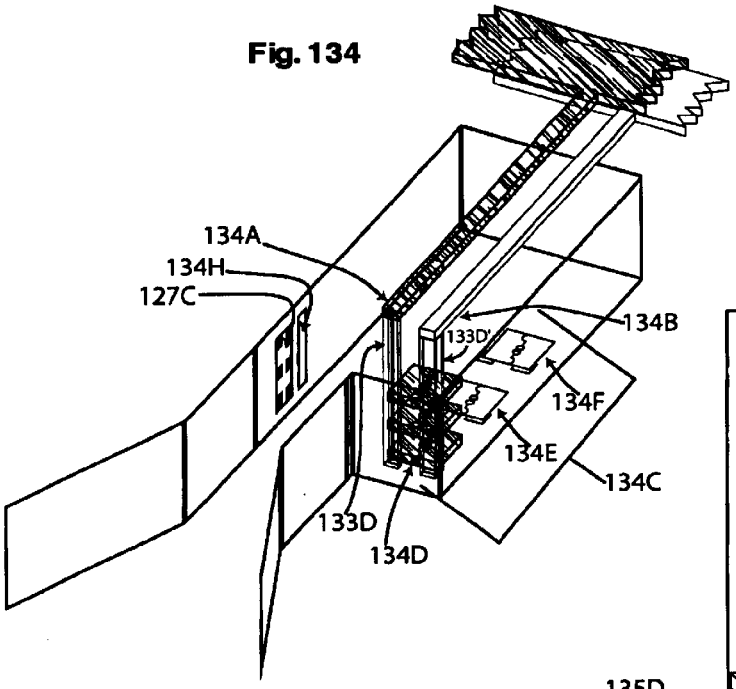

FIG. 134: The vertically supported coating orifices of FIG.133 shown supported by moving tine assemblies. (Perspective view.)

Figure 135:
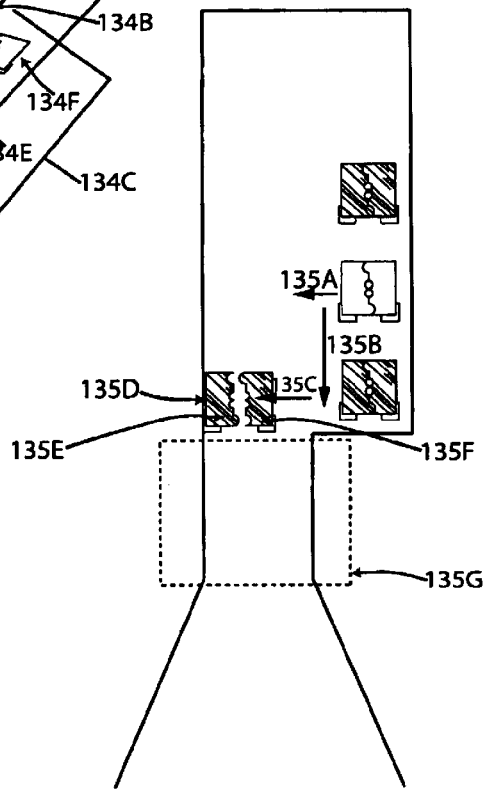

FIG. 135: Schematic movement of in-line orifice assemblies. (Top view.)

Figure 136:
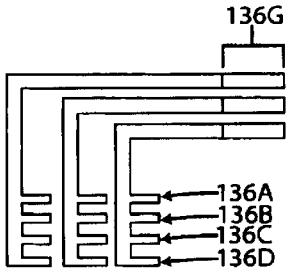

FIG. 136: Nested coating orifices. (Side view.)

Figure 137:
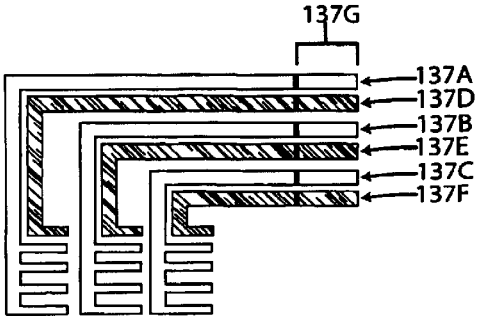

FIG. 137: Coating orifices nested with razor-rimmed carving orifices. (Side view.)

Figure 138:
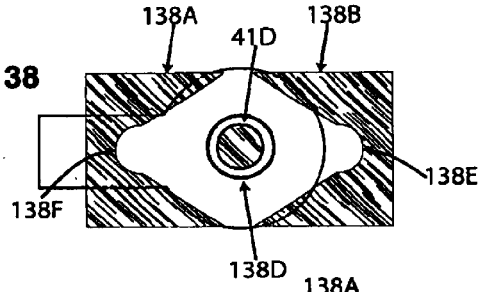

FIG. 138: Hair centering-guide halves surrounding a hair. (Top view.)

Figure 139:
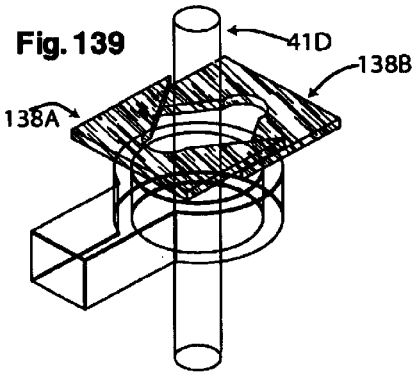

FIG. 139: Hair centering-guide halves surrounding a hair. (Perspective view.)

Figure 140:
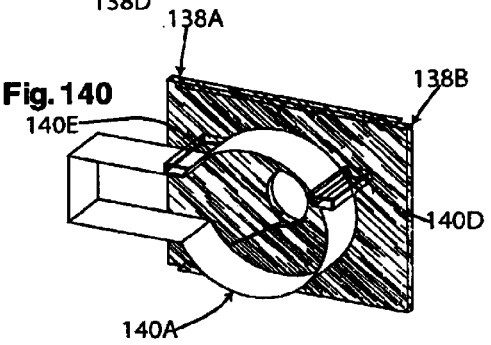

FIG. 140: Hair centering-guide halves with projections on their bottom to control the maximum extent of their movement relative to each other. (Bottom view.)

Figure 141:
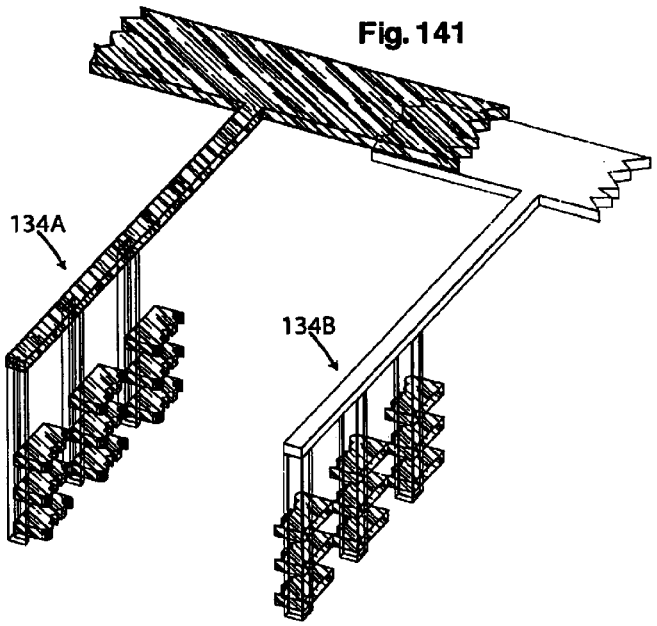

FIG. 141: Tine-supported-orifice halves shown separated as when their pinch is released. (Perspective view.)

Figure 142:
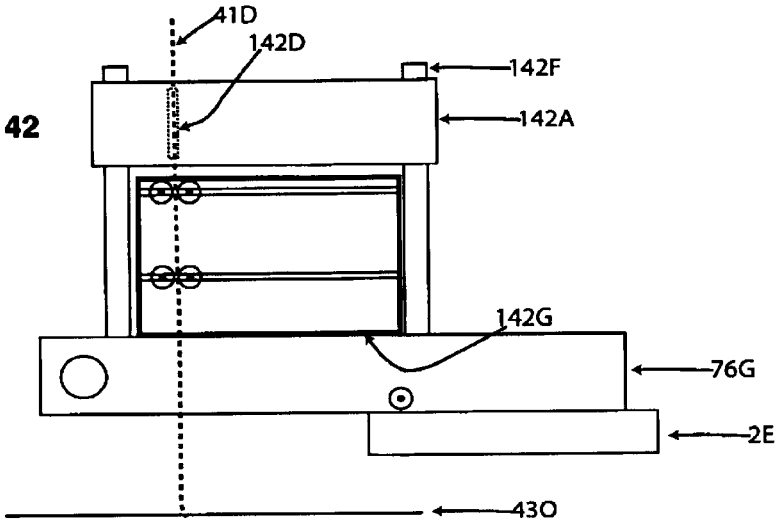
Figure 143:
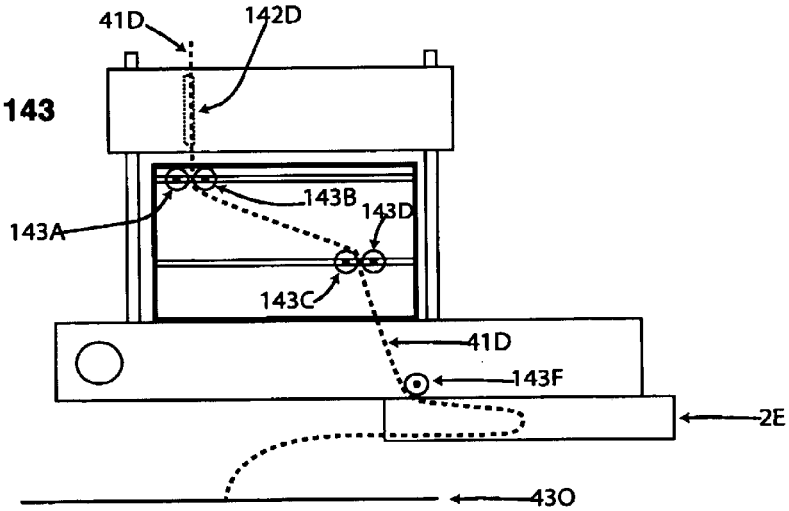

FIGS.142–143: Processing stack elevated away from the scalp surface in sequential views. This elevation allows for a non-creasing hair exit path. (Right side view.)

Figure 144:
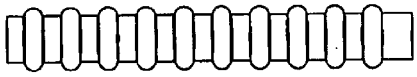

FIG. 144: Convex spinneret cylinder. (Front view.)

Figure 145:
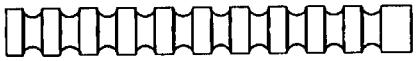

FIG. 145: Concave spinneret cylinder. (Front view.)

Figure 146:
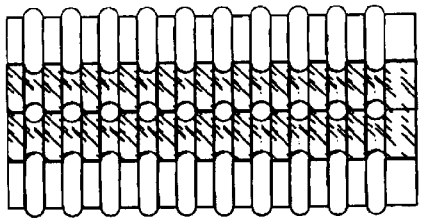

FIG. 146: Convex and concave spinneret cylinders meshed together. (Front view.)

BEST MODES OF CARRYING OUT THE INVENTION

Since this invention is not a mere improvement over a similar prior art device but, rather, an entirely new device, I am not going to be able reference a similar device and merely cite the improvements that constitute my invention. Instead, I am going to pick one embodiment of it and recite. its physical structures in great detail. The embodiment I will pick to do this is used for the attachment of one or a very few hair extensions to one or a very few hairs growing out of the scalp. I will now present an explanation of the physical structures of my invention and how they are intended to interact with each other.

No doubt you've seen electric hair trimmers. You know the type that barbers buzz men's heads with to give them a crew cut. The attachment device I will be describing to you is run through the hair in much the same way that such an electric hair trimmer is. If you've ever looked at an electric hair trimmer, you may have noticed that the cutting blades seem to be a hybrid between scissors and a comb. A comb because the cutting blades have a fork configuration and between each two fork tines there is an empty channel space where hairs can enter. Scissors because the cutting blades are composed of two sharp layers stacked on top of each other that oscillate relative to each other. These oscillations narrow the hair channels causing the hairs in them to be cut.

Just as an electric hair trimmer has comb-like channels through which hairs can flow so too does my hair attacher. Just as an electric hair trimmer has layers that oscillate relative to each other so too does by hair attacher. Of course, my hair attacher has many more oscillating layers than a hair trimmer does. In fact, this embodiment has about twenty layers stacked on top of each other. Each layer is slightly different from the one below it. Some layers oscillate back and forth others don't. But generally the layers are based around a tined-comb-like design that has hair channels that allow hairs to flow through them.

The most complex and challenging part of my invention to understand is this stack of about twenty layers. In general, I call this stack the processing circuit stack because it guides hairs through a planned path during the isolation and hair extension attachment processing. Depending on the context I may also call it similar names like the attachment circuit stack, the attachment stack, the attacher stack, the attacher, and the processing stack. In the case of the first embodiment, I will describe a system whose goal is hair extension attachment; I will call this stack the attachment circuit stack because it guides hairs through a planned path during the process of hair-extension attachment. For short, I may refer to it either as the attachment stack or attachment circuit.

To better understand the attachment circuit, I encourage you to think of a conventional electric hair trimmer as I describe it to you. Remember that the attachment circuit is very analogous to the moving metal cutting-combs of an electric hair trimmer.

I will now begin describing each level of the attachment circuit of the first embodiment. The attachment circuit is composed of many, most likely metal, layers stacked on top of each other. Each layer has a slightly different purpose, and as such a slightly different cross-sectional shape, from the layer below it. I will start describing the lowest level of the attachment circuit and work my way up. In other words, if the attachment circuit stack were a building, I would start at the ground floor and go up one floor at a time. After describing the levels separately in their bottom-to-top stacking order, I will describe. schematically how these layers work together. In other words, I will tell you when and where these layers perform their functions relative one and other. However, that's something I am going to do much later. In the following explanation, each layer's function will be described independently of the others. Don't worry if you. don't fully appreciate the significance of an isolated layer during the following explanation. I'll explain how the layers function together later.

When imagining the attachment circuit moving over the scalp, assume that the hairs are standing straight up like a crop of corn facing an oncoming harvester. The device that causes these hairs to stand straight up will be discussed later.

Description of the Attachment Circuit Stack's Individual Parts

The Stationary Hair Channel Levels

Referring to FIG. 1, notice the lowest level of the attachment circuit stack, shown all by itself from an top perspective view. It primarily has two functions. One is to serve as a protective floor layer for the higher levels in the stack. The other is to serve as a path through which scalp hairs can move. Referring to FIG. 1.1, which is a plan top view with only the front portions enlarged, notice the funneling triangular tine fronts 1A at the front of this layer. They gather hairs together in order to bring them to the area where they will be attached. Although the actual attachment process occurs at higher levels, it occurs directly above the area 1F. How attachment occurs and where the loose hair extensions that are to be attached come from will be discussed later. For now, just realize that once attached, each hair is forced to the right, along arrow 1B, such that it makes it past the corner and then it moves backwards through the exit channel 1G, along arrow 1C, towards the connectivity bridge 1D at the back of the exit channel.

If this were an electric hair trimmer, the top of the hair would simply be cut off and we wouldn't have to worry about how hairs get under the connectivity bridge 1D at the back of the exit channel. I call 1D a connectivity-bridge because it holds all the tines together. Since this is not a hair trimmer, some attempt has to be made to bend the hair tops under the connectivity-bridge at a rate fast enough to keep the exit channel 1G from overfilling with hairs. If overfill was to occur, the hairs which started standing up relatively straight and perpendicular to the scalp would be pushed flat and parallel to the scalp back through their entire path, even in the attachment area 1F. The system would not function properly with hairs lying on their sides in such a manner. Thus, a bend-under connectivity-bridge system is used. It is the goal of this system to bend the tops of hairs under the connectivity-bridge 1D at a faster rate than hairs can build up in front of the connectivity bridge in exit channel 1G.

Referring to FIG. 2, we see a perspective drawing of a bend-under belt system. Notice that a hair channel, which the hairs move through, is shown as a wire-frame. The portion 1G of the drawing is the exit channel. The portion 1A is the funneling front-most portion of the hair channel. Referring to FIG. 2.2, we see a perspective view of the bend-under belt system shown in isolation. Notice how it has a funnel shape 2F at its front that helps gather hairs into it. The trailing portion of is the trailing portion of the system that helps convey hairs farther backwards.

In FIG. 2.1, is a different perspective view from the left side. The lines 2C represent hairs growing out of the scalp 2D. The scalp stands still below, but the system is moved through the hair. Thus, the relative movement of the hair itself is from the front to the back of the system in the direction of the arrow 2H, shown behind the rear end of the exit channel. Because the system doesn't cut the tops of these hairs like a hair trimmer does, the hairs run into a dead end where they meet up with the tine-connectivity bridge 1D. Left to their own, the hairs would start piling up in the exit channel 1G, until it would get so backed up with hairs that the hairs were forced to lie down flat, parallel to the scalp and likely pointing towards the funneling front-most portion 1A.

To overcome this, the bend-under belt system 2E in FIG. 2, is configured as two belts which converge on each other and simultaneously help funnel hairs to their convergence 2F at which point they are pinched and pulled back by the belts. One belt is moving counter-clockwise, the one clockwise; the net effect is linear motion applied to the hairs pinched between the two belts in the direction of arrow 2H.

The belts bend the tops of the hairs under the connectivity bridge 1D, which forms a dead end in front of it. Since the hairs are attached to the scalp, their bottoms can't move. Consequently, as the tops of the hairs are moved by the belts, they are increasingly pulled out of the belts until finally the belts drop the hairs, as illustrated by series of hairs 2C shown in FIG. 2.1. Also, something to keep in mind is that the belts are running relatively fast in comparison to the speed that the attacher is being combed through the hair. As such, hairs don't get a chance to build up in the exit channel in front of its dead end.

FIG. 2.2 shows the bend-under belt assembly alone from a left side perspective view. In FIGS. 2–2.2, I just showed two bend-under belts floating in space; later I'll describe how these belts are supported relative to each other. Although in these drawings the belt portions of the system wrap around the front funneling portion 2F, in practice, said funneling portion may have belts wrapped around it or not. If not, it would just serve as a passive guide to funnel hairs to the moving belt portions behind it. Also note, in these drawings one bend-under-belt pair is shown per hair channel. In practice, several hair channels might share a single belt pair. This would mean that the hairs might be bent under not the very back connectivity-bridge portion of the channel, but instead, the lateral sides or tine portions.

Return you attention to FIG. 1, which is the lowest level in the system. Now that I've explained how hair flows through this level, I want to draw your attention to one more detail. Look at these four holes 1E. A bolt can be run through each and used to line this level up with the levels above, which also have holes.

Figure 3:
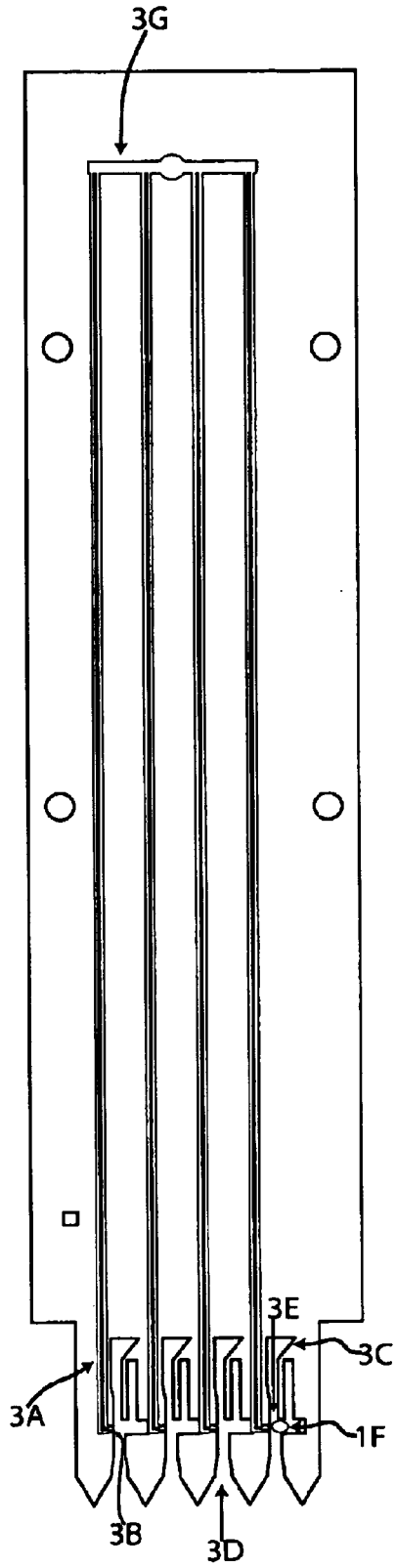
FIG. 3: Nozzle wall level. (Top Plan View.)

FIG. 3 is the next highest level. It is the second level in the stack and is the level of the liquid-polymer-nozzle walls. This polymer is used to form the plastic attachment beads that hold the hair extensions to the scalp hairs. This level has channels 3A that the liquid polymer flows through to reach the nozzles 3B. Functionally, these channels 3A are equivalent to pipes or syringe needles. Notice how they can share a single fluid input line because a manifold 3G at the back of the attachment stack connects each individual tine branch.

Figure 4:
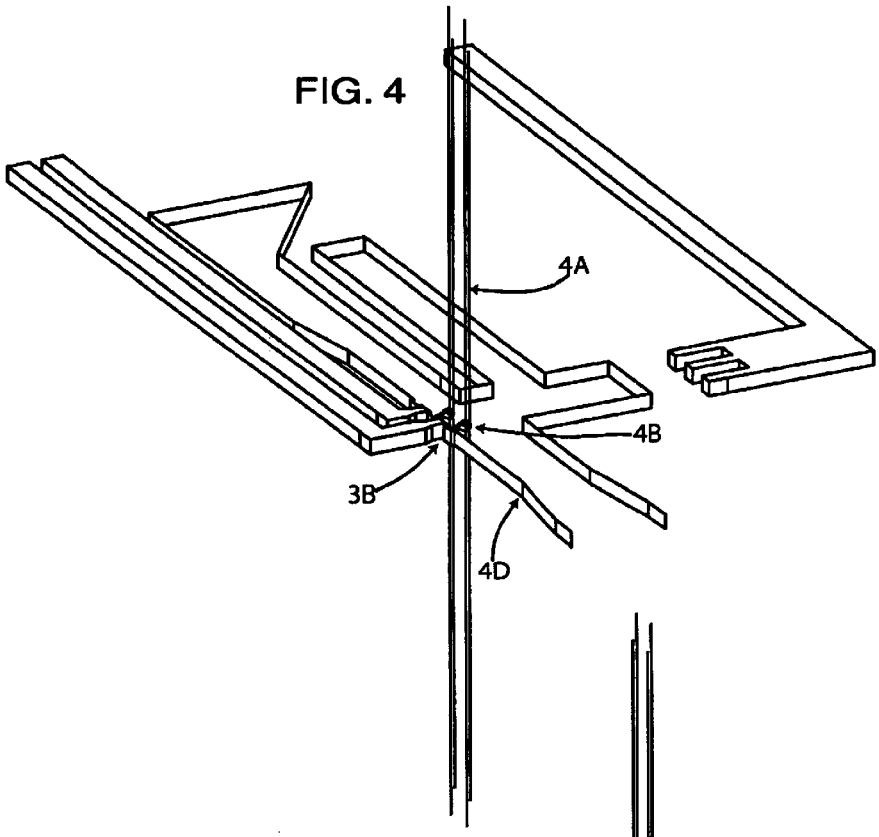
FIG. 4: Functioning of nozzle outputs. (Top Front Perspective View.)

In FIG. 4, an individual set of nozzles is shown from top front perspective. Notice their position relative to the hair channel 4D, and the. similarity between this drawing and FIG. 3. In FIG. 4, we are not so much concerned with the path the hairs take through the hair channel. Instead, notice the very ends of the polymer channels narrow to form nozzles 3B. Like a syringe needle, the liquid polymer can't escape from these nozzles unless it is put under a certain amount of pressure. By delivering this pressure in bursts, individual polymer droplets 4B can be squeezed out that will fly towards each scalp hair-hair extension pair 4A held before said nozzles so as to form a liquid bead around said hair pairs. There are four total hairs shown in this drawing. There are two pairs 4A each with a single scalp hair and a single hair extension.

Figure 5:
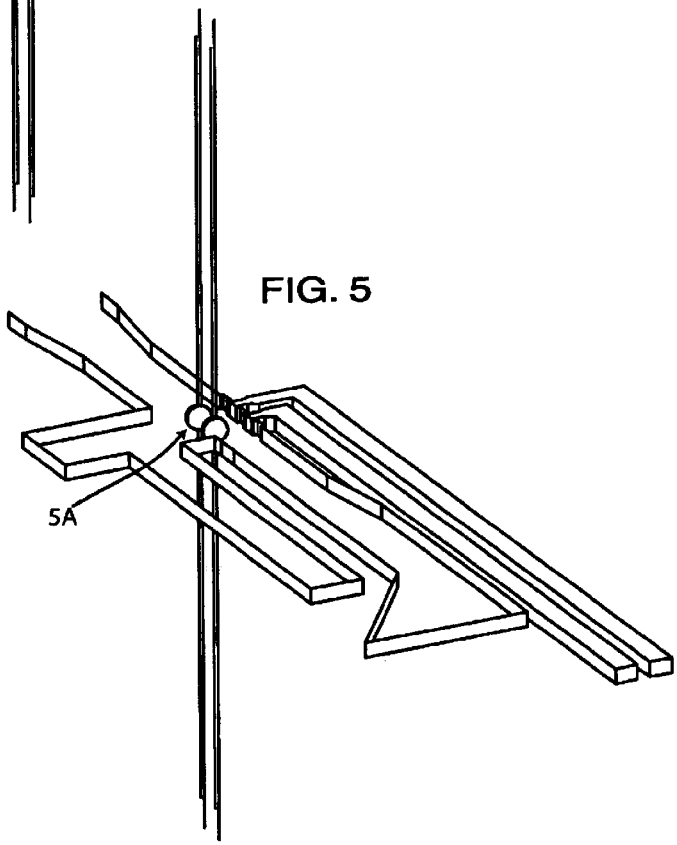
FIG. 5: Functioning of UV outputs. (Top Back Perspective View.)

In FIG. 5 an individual set of nozzles is shown from a back perspective view, the two liquid plastic attachment beads 5A are shown after being applied to the hairs by the nozzles. Each bead is surrounding one scalp hair and one hair extension. How these beads are hardened into solid plastic will be discussed later because this is the function of another level located directly above.

Now back to FIG. 3, recall that this is the second level in the stacking order. Other than the nozzle portion, notice how this layer remains similar to level 1, as shown in FIG. 1. This is because the hair pathway must remain open at this cross-section also.

In FIG. 3, we see a second difference from level 1 is the additional channel 3C. Whereas, the scalp hair enters from the direction of arrow 3D, loose hair extensions enter from the direction of arrow 3E. They meet in the middle, which is the attachment area 1F, shown here encircled by an oval. This additional open area 3C, called the hair extension tip trench, helps form the pathway that the hair extensions flow through. Level one, as shown in FIG. 1, is not open in the corresponding area because it serves as a floor that protects the tips of said loose hair extensions from rubbing against the scalp.

The third level is shown in FIG. 6 and is almost identical to level 1, as shown in FIG. 1. Whereas level one, serves as the floor of the channel that supplies the nozzles with liquid adhesive polymer, level three in FIG. 6 serves as the ceiling to the polymer channel to prevent leakage from the top of the channel. After all, a pipe must be closed on all sides to carry a liquid.

Another difference from level 1 is that this level has an opening 6A that helps form a pathway for the hair extensions. Also, notice the single circular hole 6B at the very back of this layer. It serves as an opening for the fluid polymer input line to plug into the underlying polymer channels.

Once you understand how level two serves as a pipeline to carry liquid polymer, then understanding level 4 in FIG. 7 is easy. It is merely a passageway to carry the ultraviolet light that will be used to solidify the liquid polymer bead. Unlike a liquid that can be transported by an empty pipe, UV light must be carried on the inside of channels formed out of glass or another transparent material 7A. In other words, fiber optics or specially shaped glass prisms that take advantage of the principal of total internal reflection.

Figure 8:
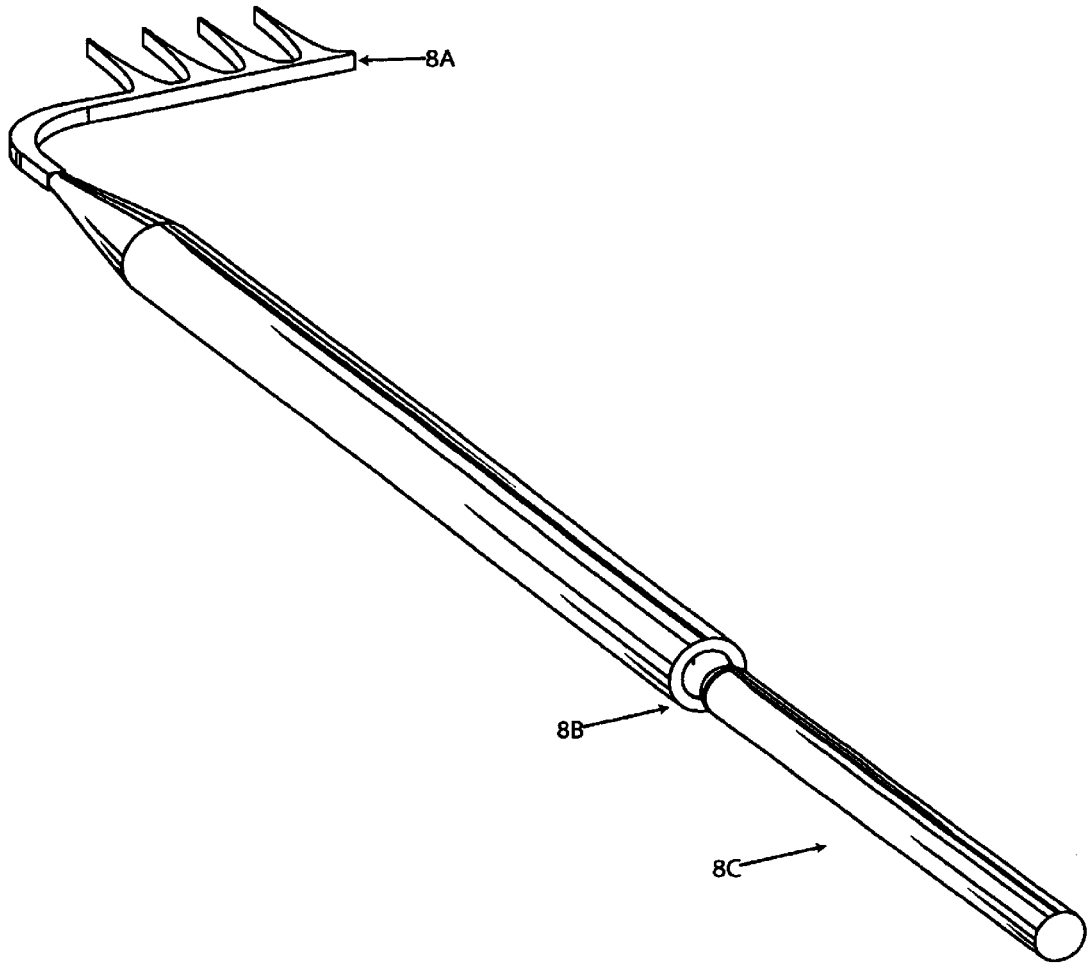
FIG. 8: Glass prism channel for carrying UV light connected to fiber optic cable. (Top Back Perspective view.)

FIG. 8 is a back perspective of such an optical system. Technically, the fork-like portion 8A is a solid prism of glass, not fiber optics. However, for flexibility, fiber optic cables 8C interface with the solid prism at this point 8B at the back. The flexible fiber optics is used as a "light-hose" that brings light from its source several feet away.

Return your attention to level four as shown in FIG. 7. This layer is used to hold in place these specially shaped glass light channels. For simplicity, the glass channels are depicted, as coming to nozzle-like points 7B. In actuality, the ends of these glass channels should be designed such that they best focus light on the polymer bead in front of them. Thus, the actual design of this light pathway will have to be refined by an optical engineer using computer software that predicts the movement of light through fiber optics and specially shaped glass prisms. The optical designer's goal will be to focus UV light on the attachment beads, which are in the attachment areas 1F.

Understand that the areas that surround this glass prism 7A are made of metal or whatever materials the levels of the attachment circuit stack are made. The glass prism 7A is most likely manufactured separately and then placed in an empty pathway carved for it. That is carved into the surrounding material of this level.

Figure 9:
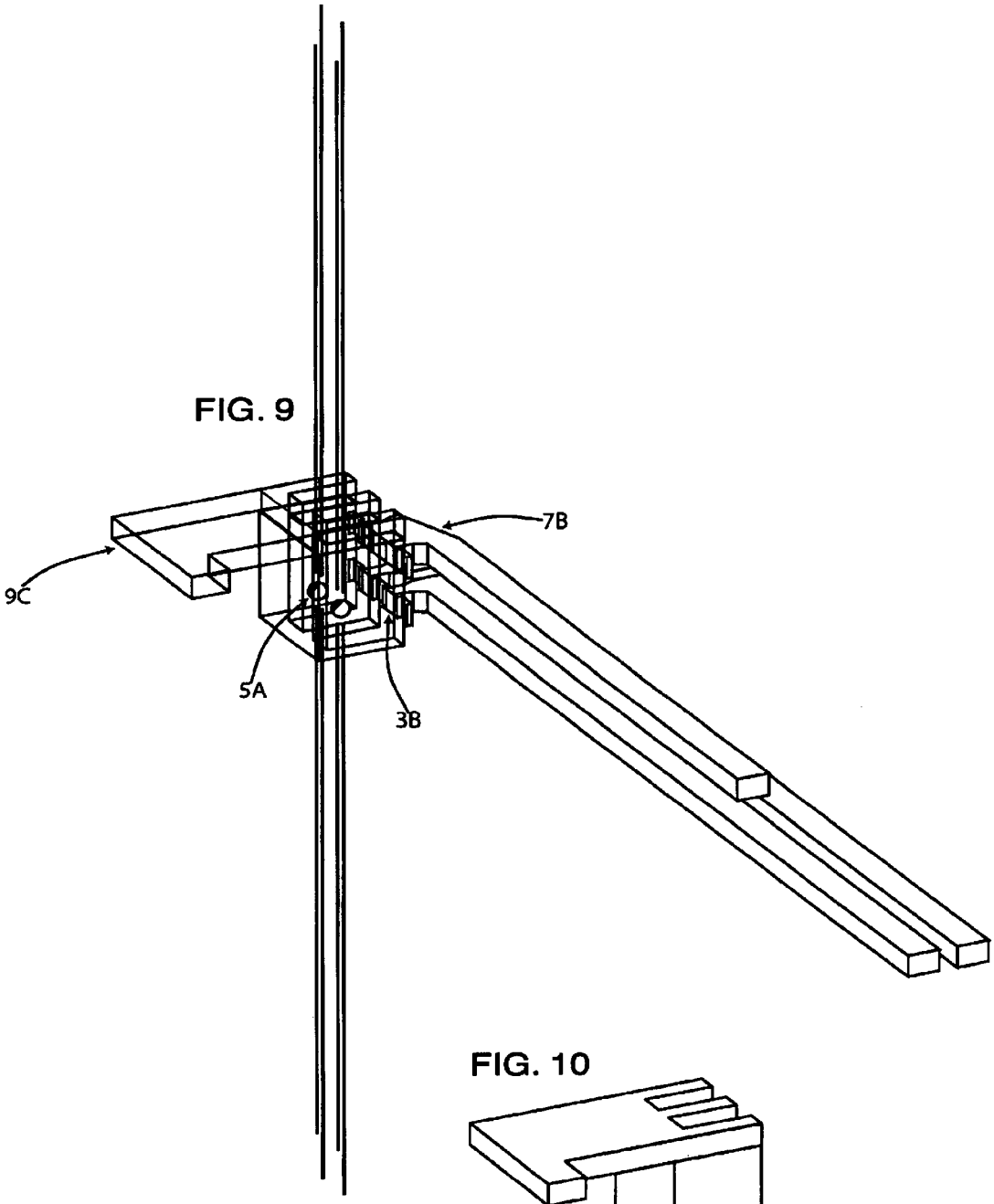
FIG. 9: Pincher function relative to both adhesive and UV light outputs. (Perspective view from back.)

To review look at FIG. 9, the spherical objects 5A are the plastic attachment beads. They were sprayed out as a liquid by the nozzles 3B. Notice the end of the optical channel 7B where UV light is directed at the liquid beads to harden them into solid plastic. We haven't discussed this part 9C yet. This same part is shown in isolation in FIG. 10 and called the pincher.

Figure 10:
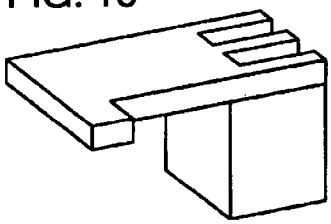
FIG. 10: Pincher structure. (Top Front Perspective View.)

FIG. 10 is the pincher. It moves to hold the hairs together up against the wall where the nozzles and UV outputs are. Whenever a part is referred to as the pincher, it should be assumed to be this part, unless the context suggests otherwise. We'll discuss it more later. For now, notice how the pincher 9C, as shown in FIG. 9, surrounds the polymer beads 5A during their application and hardening. By pressing the notches of said pincher up against the channel wall, where the nozzles are, chambers which I will refer to as attachment chambers are formed.

Figure 11:
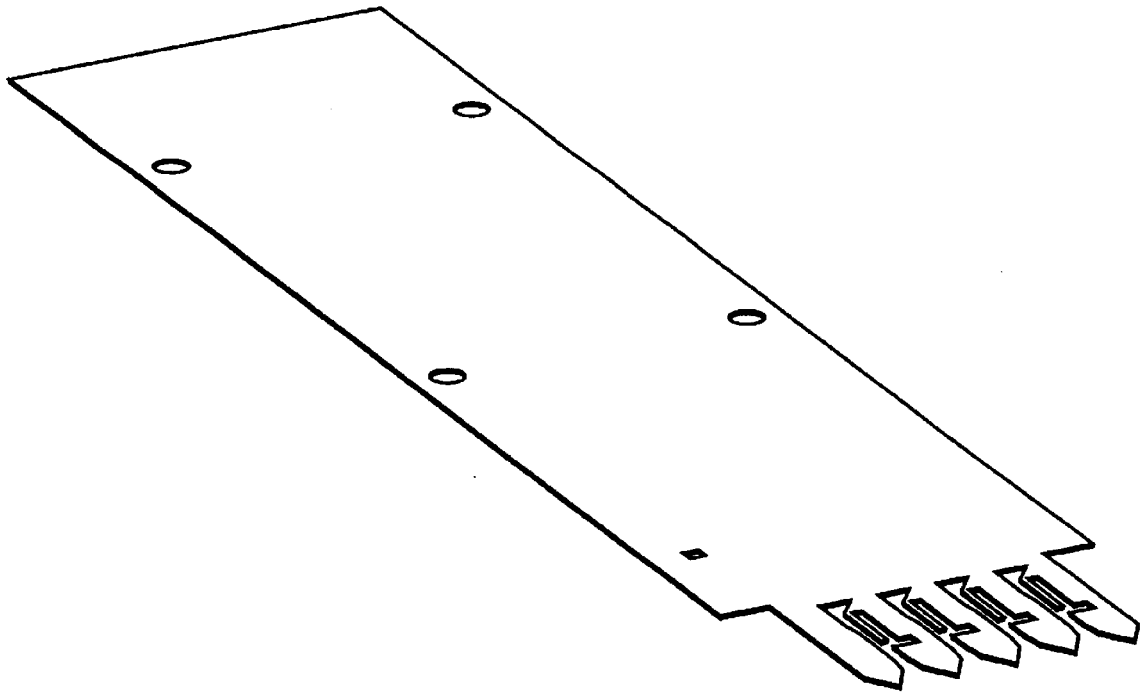
FIG. 11: UV output roof level. (Top Front Perspective View.)

FIG. 11 is level five. It serves as a protective top layer over the optical channels of level 4. In other words, it sandwiches the glass prism of level 4 from the top.

FIG. 12 is level six and is the sensor layer. Electric currents or light will be run across gaps in the channels between two specific points on each hair pathway. For example, electricity could be run between two electrical paths 12D and 12D' to form an electrical circuit that bridges gap 12A. If there is a scalp hair between these specific points, then the electric current or light will be disturbed in a different way than if there is not. This will allow for the detection of when a scalp hair is going to be entering the attachment chambers. Remember that the attachment chambers are positioned in front of the nozzles at 12B. If a scalp hair is not going to be entering one of the attachment chambers, then, ideally, that attachment chamber's polymer nozzle should not be fired. This will prevent the hair extensions released into the attachment chambers without matching scalp hairs to remain unused and unspoiled with adhesive polymer. However, this ideal scenario involving individual control of polymer nozzles may or may not be implemented in practice.

If the sensor layer in FIG. 12 uses electricity, it should be coated with some kind of insulator such as Teflon such that it isn't shorted out by coming into direct contact with an adjacent metal layer. If it uses light, the optical pathways of this layer should be coated with a material less optically dense than themselves. The fragmentary rear of this sensor layer, shown enlarged from top perspective view in FIG. 12.1, has contacts 12C that interface with either electric wires or fiber optic cables. These contacts should not be coated.

NOTE: The sensor currents could be run across the metering areas of a channel. If this is your first time reading this, you won't understand what the metering areas are yet. To understand the significance of the metering areas, you first have to understand the functions of the hair handling tines which lie in higher levels and will be described and later.

The next higher level is level seven and has the configuration as shown in FIG. 11. This level's primary job is to protect the plastic coated sensor layer below it from the repeated rubbing of the hair handling tines immediately above. Remember that we haven't discussed the hair handling tines yet, but they're right above this layer moving back and forth, rubbing on it.

Also, since this is the non-moving level that directly underlies most of the moving hair handling tines, it can be thought of as working with the hair handling tines to help position the hairs while they're being isolated and positioned in the attachment chambers.

The next highest levels (levels eight-fourteen) are where the moving hair handling tines reside. The hair handling tines are used in isolating out hairs and positioning them in place during attachment. And once attachment has occurred, the hair handling tines are used to facilitate the attached hairs' exit. I call these moving layers the hair handling tines because they handle hairs and have a fork-like shape composed of tines. For short, I call the hair handling tines the hair handlers.

Schematic Pencils

Before we discuss the details of the hair handlers, notice the sequential series of drawings shown in FIGS. 14–14.2. In FIG. 14, we've got five horizontal pencils. These horizontal pencils are being pushed against a block by spring 14A. In FIG. 14.1, we see that a vertical pencil has been brought down into the horizontal pencils. Since there is only a distance of about one pencil-width between the block 14B and the vertical pencil, only one horizontal pencil can fit between them. The other four horizontal pencils are pushed backwards into the spring. 14A. In FIG. 14.2, we see the block 14B being lifted and allowing the one horizontal pencil to escape. The remaining horizontal pencils are trapped behind the vertical pencil. Consequently, one pencil has been metered out or isolated, and since the spring continues to push the remaining pencils forward, we can continue metering out pencils one at a time until no more pencils remain.

In the context of the present invention, the vertical pencil that comes down and pushes the horizontal pencils back will be considered a pushback gate. "Pushback" because it pushes backwards the pencils that it doesn't meter out in front of itself. "Gate" because it controls the flow of pencils by getting in their way. The block 14B that keeps the front-most horizontal pencil from moving away, in FIGS. 14 and 14.1, will be considered an entrance gate. "Entrance" because it controls whether the pencils behind it are free to enter the next area along their path. Pushback gates and entrance gates work together. In fact, the distance between a pushback gate and an entrance gate can be used to help determine how many pencils (or by analogy hairs) are metered out at one time. That area between a pushback gate and an entrance gate is considered the metering area. The metering areas are those areas within which the hairs are isolated before being processed. Incidentally, recall that the sensors, in FIG. 12, that check for the presence of hairs in the metering areas. Remember, how I said that you didn't really know what a metering area is. Now you do. The area between a pushback gate and entrance gate is the metering area that they check. Of course, in different embodiments, said sensor might check different points along the channel, even points along the bend-under system.

Obviously, I showed you the pencil metering diagram, in FIG. 14, because my device meters out individual hairs in much the same way that these pencils are metered out. Of course, you may be wondering if hair is too flexible to be metered out this way. The answer is that a hair that is six inches long behaves nothing like a pencil that is six inches long, such a length of hair would flip around uncontrollably. On the other hand, a length of hair that's only one mm long, or less, behaves quite rigidly. Such a short piece of hair can be held in a tweezers and will point straight out not bending in the slightest.

The relevance of a one mm hair's rigidity is that my hair metering device operates on hair cross-sections whose length is little more than one mm, often much less. In other words, since the hair handling tines are made of thin sheets of metal you can stack many layers of them in the thickness of 1 mm.

It is true that these hairs I'm dealing with flip around considerably past the small approximately 1 mm deep length of hair where metering and manipulation is performed. However, in the following discussion of the hair handling tines, I want you to only concern yourself with an approximately one mm long length of a hair that behaves much like a rigid pencil.

Remember that hair-handling tines are so thin that although they are on different levels, they can be thought of as being on exactly the same level. This is generally true except for level eight that has significant vertical depth. We will discuss that later. Even the very top non-moving level (level seven as shown in FIG. 11) which some hair handlers rub against can be thought of as being on exactly the same level as all of the hair handlers.

The previous pencil diagram illustrates the use of pushback gates in a configuration that forms one metering area and as such meters out one hair or one group of hairs at a time. Of course, since the head has about 100,000 hairs on it, it is to our advantage to meter out as many hairs as we can at once. Understand that when I say meter out, this implies isolation of a certain number of hairs, ideally isolated individually. Certainly, if it's our ambition to deal with many hairs at once, we can't settle for metering out large clumps of hair at a time and then attaching hair extensions to these large clumps of hair. Such a strategy, although fast, would reduce the quality of the hairstyle created. Instead, it is my goal to configure the system to have multiple metering areas per channel. Each metering area is capable of isolating one or a very few hairs in it. As such, I will present a system that has two metering areas per channel. However, in practice, the number of metering areas per channel could easily be increased beyond two.

The sequential views in FIGS. 15–15.2 show the pencil metering system modified such that there are, not one, but two metering areas. Rather than just having one vertical pencil descend as a pushback gate, we can use several pencils. In this example, we use three vertical pencils. Notice how there are two metering areas 15A and 15B between these three vertical pencils.

You should understand that two of these three vertical pencils behave both as pushback and entrance gates. All three vertical pencils behave as pushback gates because they are all capable of pushing behind themselves the hairs that they do not meter out. However, the front two vertical pencils 15C and 15D also serve as entrance gates. This is because they get in front of the horizontal pencils that have been metered out and, in doing so, form the front gates of two metering areas. This is what an entrance gate does. It prevents hairs from entering the next area of the system until it lets them. However, the very last of the three vertical pencils is a pure pushback gate. All the pencils behind it have been pushed back out of the way and into the spring 14A. However, none of the horizontal pencils behind it are in metering areas, so it can't be considered an entrance gate.

Although these three vertical pencils act like both pushback gates and sometimes entrance gates, I will refer to such a configuration as a multiple pushback gate. Multiple because it is made up of several pushback gates, not just a single pushback gate as shown in the first pencil diagram FIG. 14.

Multiple pushback gates form notches that hold the isolated pencils. These holding notches allow the pushback gates to also serve as transport-forward gates. This is to say they move the pencils, or hairs, forward from their metering areas into the attachment area. This forward motion is depicted in the diagram by arrow 15F.

The Moving Hair Hander Tine-Assembly Levels

The levels I'm about to discuss are the moving hair handlers. Most of them slide from side to side others can also slide forward and backward. Regardless of the direction a hair handler moves, in this embodiment, it is moved by cables that are attached to it. For example, FIG. 16 is level eight in the stacking order. It is the next higher level in the stack above the level seven, the highest non-moving level I showed you. In fact, level seven is shown shaded darkly below level eight in FIG. 16. Level eight is only the lightly shaded layer on top. Level eight's front-most portion is capable of moving from side to side. Referring to FIG. 16.1 an enlarged perspective front view of only the front-most portions of level eight, there are cables 16A and 16B attached to the connectivity-bridge portion of the moving tine-assembly 16C of level eight. The cable 16A on the left is capable of pulling it to the left, the cable 16B on the right to the right. In either case, it is only the very front piece 16C that is capable of moving. This rear area 16D is part of level eight but doesn't move. Its only purpose is to remain sandwiched between other levels so as to support the stack. Just as it is the purpose of the second floor of a building to be sandwiched between the first and third. This is true of all the moving hair handler levels. Generally, it is only their front most portions that are moved.

In this embodiment, most of the hair-handling tines are thin layers of sheet metal. Level eight, as shown in FIG. 16, is the exception. Whereas most of its surface is just a thin sheet of metal, at its tine tips 9C, it thickens such that it can extend down vertically into the attachment areas of the layers below. Level eight's main purpose is to hold scalp hairs and hair extensions in position while they are being attached together. It does this by moving sideways from right to left. It ends its journey pressed up against left wall 16F of the attachment area. It holds scalp hairs and hair extensions together against this left wall.

Remember that this left wall is where the attachment nozzles and UV light outputs are located. By pinching scalp hairs and hair extensions between this left wall and itself, level eight holds hairs in position during hair extension attachment.

In FIG. 17, we see a more detailed look at the shape of the pincher's notches. Notice how there are two notches 17A. Each notch can form an attachment chamber where one scalp hair and one or more hair extensions can be isolated together. When pinched up against the left wall, these chambers are closed on all four vertical sides such that the hairs cannot escape. In this embodiment, each notch or hair holding chamber has its own corresponding nozzle on the left wall. In FIG. 17, there are two notched hair-holding chambers that correspond to the two nozzles that I showed you earlier. Thus, in this system, each channel has two isolated attachment chambers and will apply two attachment beads per channel at a time.

Notice the notches are somewhat hollowed out in the middle such that the hairs are grasped at the bottom and top but are not touched by the pincher in the middle. Notice how this allows the liquid polymer attachment beads 17B to remain untouched by the pincher.

Another thing to notice about the pincher tips 9C, as shown in FIG. 16.1, is that they project to the left more at the top than at the bottom. This is because its top is in closer contact with the other hair handling tines above it. When these other hair handling tines hand hairs off to the pinchers, we can depend on the hair cross-sections being right between the middle of the notches at the very top of the pinchers because that is where the other hair handlers, directly above, have positioned the hairs. And hairs behave rigidly over short lengths. However, the lower portions of the hairs that extend down near the bottom of the attachment chamber are more likely to flip around and not be exactly where we want them. Thus, the sloped overhang of the pincher, as shown enlarged by FIG. 16.2, functions such that the tops of the hairs get pinched the very first and lower points on the hairs get pinched progressively later such that the last point of a hair to get pinched is the lowest point to get pinched.

FIGS. 18–18.2 show a more detailed representation of the pinching action shown sequentially. These drawings show the pinchers 18A and the left wall 18B getting closer to each other in three progressive steps. Only one isolation notch of the pincher is shown. In practice, the pincher likely has multiple such isolation notches. The pincher is shown in shaded on the right; the wall is shown as a wire-frame on the left. Remember that this wall is where the polymer nozzles and UV outputs lie.

The most important thing to notice about this drawing is that the tops of both the pincher and its corresponding position on the wall slant forward. This causes the higher portions of hairs to get pinched first and the lower portions last. This scheme allows for the wayward scalp hair and hair extension tips to be progressively pushed into the center of attachment chamber from top down. One scalp hair and one hair extension is shown in each step. Please note this means one scalp hair would be attached to the scalp, and thus, it wouldn't truly have a loose tip as shown in this diagram, only each hair extension would. This drawing shows two loose tips to emphasize convergence of the hair and hair extension.

In FIG. 19 we see level nine which serves to narrow the entrance 19A which allows scalp hairs into the attachment area. Level nine is the lighter shaded area, representing a moving tine-assembly. In the background, you can see those underlying layers that make up the hair passageways. Level #9 works with the walls of the underlying passageway 19B as if they were all one layer.

From this top plan view, we can see how this level works with the underlying channel. This tine-assembly layer would normally start out not overlapping the hair passageways at all. This allows more than enough width for more than one scalp hair to fit across each passageway. Of course, we only want to allow one scalp hair into each metering area 19A at a time. So the purpose of this narrowing layer is to be moved out (here from left to right) over the passageway narrowing it such that only one hair can fit across its width.

If you'll remember the pencil diagrams, showing pencils being metered out, you'll recall there was one straight line of pencils. If the pencils, instead, bad been stacked several layers deep, then more than one pencil per metering area would have been metered out. Since we only want to meter out one hair per metering area, it is important to narrow the hair pathway to one hair width.

Now you may ask, "If a narrowed pathway is what you want, why don't you just make the underlying pathway permanently narrowed so you don't need this moving part?" The reason I'm not doing that is because permanently narrowing the pathway to just one hair width is really asking for hairs to get jammed. By allowing the pathway to be narrowed only temporarily, we should be able to prevent hair jamming.

Also, notice that the very end 19C of this narrower actually overhangs the hair channels so much that it doesn't just narrow the hair channels but it actually closes them off. This is because this portion 19C of the narrower serves as an entrance gate to the attachment area so that unmetered hairs don't enter prematurely. I will call this type of hair handler a channel narrowing entrance gate because it both narrows the hair channel and controls entrance into the attachment area. In theory, we could put these functions in two separate tine-assemblies of hair handlers; here I've put them in one. Finally, notice that only the front of this level is shown. This level is really much longer in back, and has holes through it like the previous layers shown. Many of the following layers will be shown truncated in the same manner. Note: In pencil diagram, FIG. 14, the block 14B served as an entrance gate that prevented pencils from escaping prematurely before they were metered out. This is what I mean by "entrance gate."

FIG. 20 shows the next higher level, level ten. This level serves to narrow the entrance that allows loose hair extensions into the attachment area. If you understand what I just said about narrowing the scalp hair entrance, then you already know how this level works. It's the same thing except it's for narrowing the entrance passageway of loose hair extensions instead of scalp hairs. Like the on one scalp hair side, this level is a combination channel narrower and entrance gate in one.

FIG. 21 shows the next higher level, level eleven. It is the scalp hair multiple-pushback gate. It meters out scalp hairs putting one scalp hair into each of its two metering areas 21A, when it slides from right to left. Of course, remember that a multiple pushback gate can have more than just two metering areas. It's important to understand that these pushback gates work with the layers above and below them. For example, the scalp hair narrower in FIG. 19 (which is level nine) has already narrowed the hair pathway to one hairwidth. Next, the multiple pushback gates of this level intersect with the resulting narrowed line of hairs.

You should keep in mind that FIG. 21 shows multiple pushback gates much larger than actual size. To get an idea of actual size, consider that each of the notches 21A is only wide enough to hold about one hair. In other words, the width of these metering notches is little more than one hair.

Although this part has been named a pushback gate, it also serves other functions. I've already mentioned how each pushback gate of a multiple pushback gate can also be considered an entrance gate. But multiple-pushback gates can have still yet other functions. Once their metering areas are filled with hairs, the multi-pushback gate can be moved, in the direction of arrow 21B, straight ahead into the attachment area 21C carrying the hairs it has metered out with it. This function of a multi-pushback gate should be considered its hair-transport function.

Notice that this level has more than just two cables attached to it. It has two that pull it side to side 21D and 21E, and it has two that pull it forwards and backwards 21F and 21G.

In FIG. 22, the topmost lighter shaded level is the next higher level, level twelve. It is the channel-blocking slide out preventer. It's shown superimposed on top of level eleven, the scalp side multi-pushback gates shown in darker shading and which we just talked about. I just mentioned how the multi-pushback gates can be slid straight ahead of themselves to transport the hairs in their metering areas. However, since left to themselves, multiple pushback gates are open on one side, they might be at risk of loosing their metered hairs out of this open side unless something prevents this. That is the purpose of this level. It restrains side to side movement of the hairs in the pushback gates as they're carried forward. By doing this, hairs are at less risk of sliding out of their metering notches during transport. I'll explain this part more later, for now, just understand it keeps hairs in the metering notches, of the pushback gates, while those metering notches are on the move. Its path of motions is to slide only in a forward and backward direction.

Figure 23:
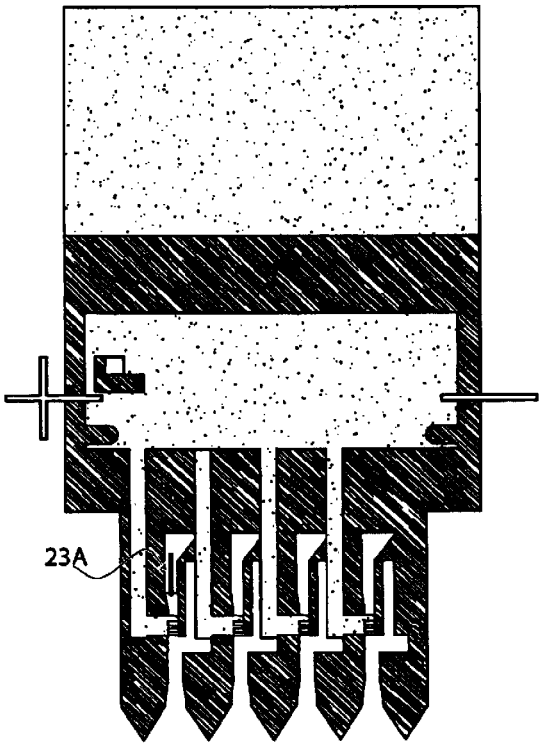
FIG. 23: Tine assembly of hair-extension-multiple-pushback gates shown positioned above underlying hair-flow-channel guide. (Top Plan View.)

In FIG. 23 is the next higher level, level thirteen. This is the hair extension multiple-pushback gate. It meters out hair extensions the same way the scalp hair multiple-pushback gate meters out scalp hairs. It too is analogous to the pencilmetering diagram. A difference is that the hair extensions it deals with come through the hair extension tip trench, in the direction of arrow 23A, while the scalp hairs dealt with by the other pushback gate come from the opposite direction. Recall that the scalp side pushback gate was placed farther forward and on the opposite side of the hair pathway.

Figure 24:
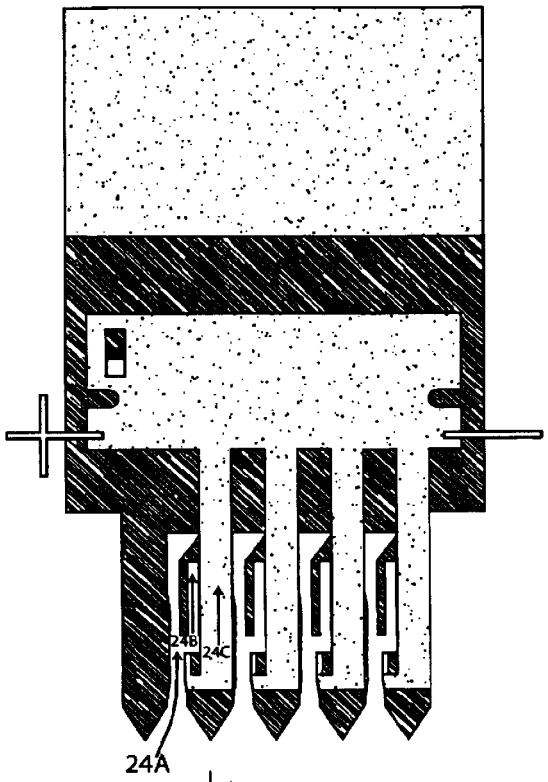
FIG. 24: Tine assembly of hair pullback hooks shown positioned above underlying hair-flow-channel guide. Said pullback hooks help hairs move to the back the exit channel. (Top Plan View.)

In FIG. 24 is shown the next higher level, level fourteen. This is the pullback hook level. After the attached hairs have been pushed to the right and out of the attachment chamber, they still must travel back through the exit channel area before being engaged by the bend-under belts near the back of the channel. After scalp hairs and hair extensions have been attached together in attachment area 24A, they are ejected to the right and move back into and through the exit channel along arrow 24B.

To a certain extent, just the moving of the system over the scalp will cause these hairs to travel to the back of the exit channel. However, in this embodiment, we must be absolutely certain that exiting hairs under no circumstances can backtrack and return to attachment area 24A. Further still, we want attached hairs to reach the bend-under system as soon as possible. This way their most extensive tips are pulled clear of the attachment circuit as soon as possible so as to free up room for more hairs to enter the attachment system. That is what this level's responsibility is. It moves backwards along arrow 24C in order to pull hairs back with it.

Figure 25:
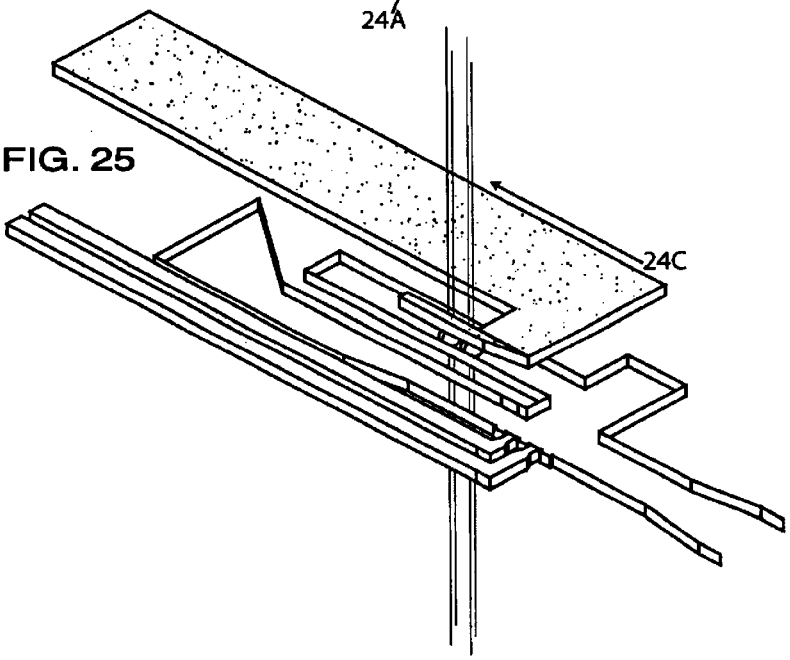
FIG. 25: Single hair-flow channel shown in isolation illustrating the function of the pullback hook relative to the underlying hair-flow-channel guide. (Perspective view from a left-front-top angle.)

FIG. 25 shows a side perspective of the pullback hook in action. This level is comprised of a hook that pulls everything in the exit channel to its very back where it can be engaged by a bend-under belt. This hook moves backwards, in the direction of arrow 24C, at the end of every attachment cycle carrying exiting hairs with it. This hook is the highest moving hair handler in this embodiment. Note: Of course, to do its job a functional equivalent of the pullback hook could be used. For example, the hook doesn't have to be closed on the left side because the underlying exit channel would prevent hairs from slipping out of it from the side anyway.

The Spring-Pin Levels:

The next five highest levels fifteen through nineteen, shown FIGS. 26–30, should be considered together as a single group. This group of levels has two general purposes. First, the back of this set of levels contains spring-loaded pins whose duty it is to engage the hair clips, which hold the hair extensions. These spring-loaded pins push these clips forward towards the attachment area.

Look at FIGS. 26–30. Notice how each of these levels is almost identical to the others except that we see different cross-sections, such as 27H, of the darkly shaded part as shown in FIG. 27. The cross-sections make up a part called a spring-pin assembly, which is on the inside of these top five levels.

Figure 26:
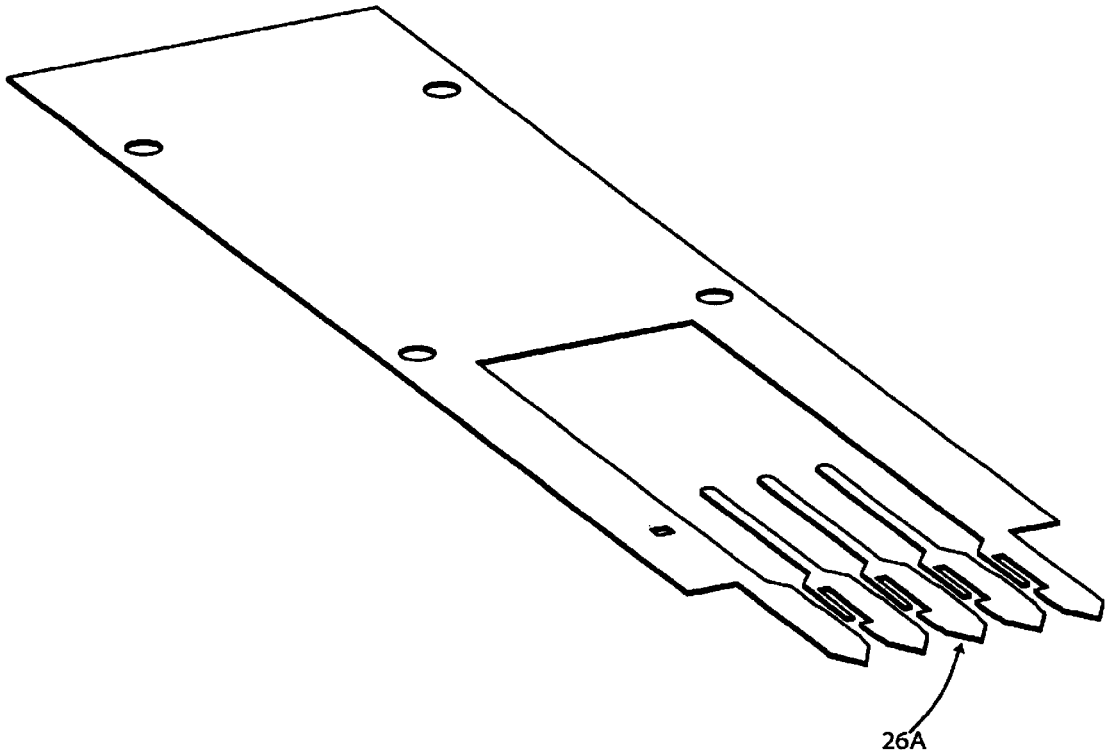
FIG. 26: Typical level of the hair hopper. (Top Front Perspective View.)

Referring to FIG. 26, note that the central front funneling tines 26A of these levels are shown as unattached and floating in space. In practice, at least one of these levels would have connectivity bridges holding these regions together as shown by the second layer 34E from perspective top view in FIG. 34. As such, most of the central front funneling tines in these layers would not have connectivity bridges of their own but would be connected vertically to a layer that does. The reason for this is to prevent the hair extensions from having to bend over a connectivity bridge at a point too close to their holding clips (to be discussed later), because their bend angle might be too sharp.

Figure 29:
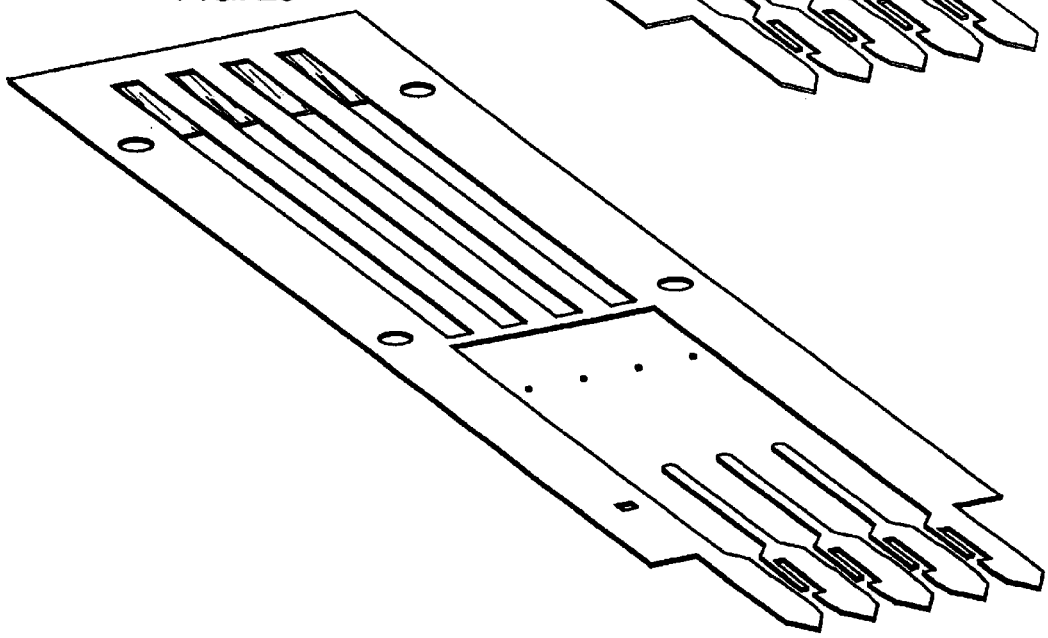
FIG. 29: A hair hopper level illustrating the cross-section of spring-pins running through it. It represents the level stack on top of that depicted by FIG. 28. (Top Front Perspective View.)
Figure 30:
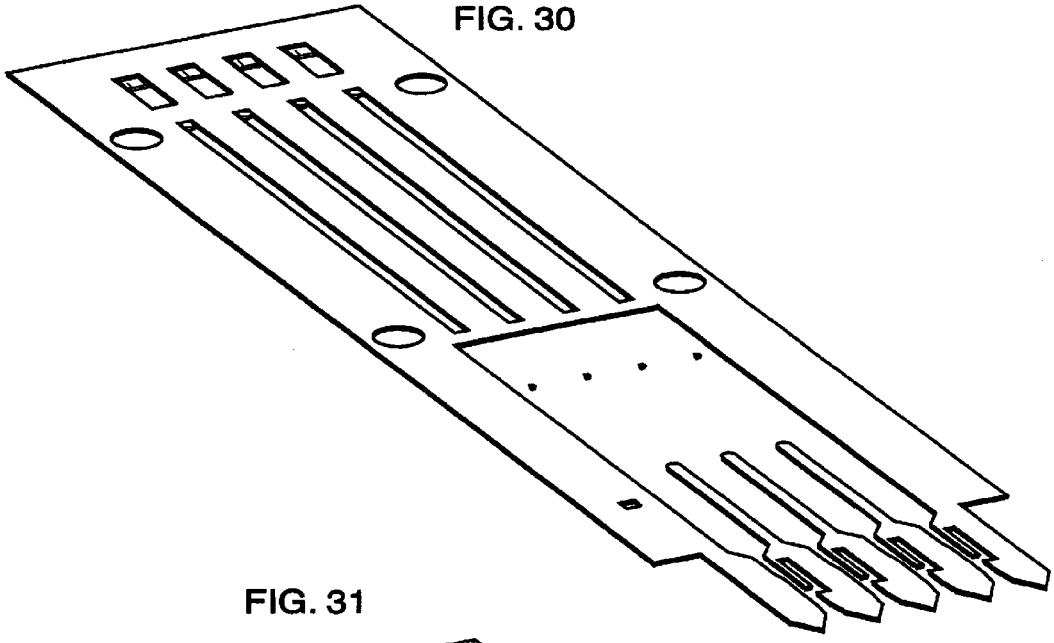
FIG. 30: A hair hopper level illustrating the cross-section of spring-pins running through it. It represents the level stack on top of that depicted by FIG. 29. (Top Front Perspective View.)
Figure 31:
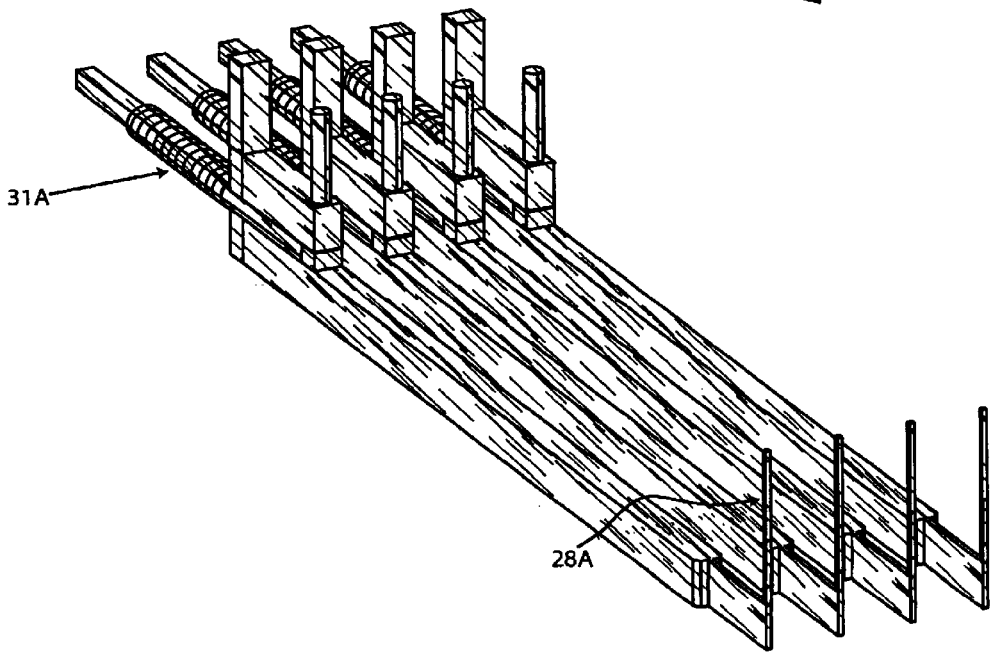
FIG. 31: Spring-pin assembly shown in isolation. (Top-front-left perspective view.)

If we were to take the spring pins out of the stacked layers which support and hold them, said spring-pin assemblies would look as they do FIG. 31. Notice the springs 31A at the back of each of the four shown spring-pin assemblies, they push each pin forward. Notice how the shape of the spring pins corresponds with darkly shaded cross-sections shown in FIGS. 26–30.

Cartridge & Clip Alone

Referring to FIG. 32, the hair-extension-holding clips 32A are held together in clip-holding cartridges like 32B. Each cartridge has as many clips as the attacher has channels. Each clip should have a spring-like resilience that allows it to hold hairs in its interior by pinching them. This same assembly turned upside down is shown in FIG. 32.1, notice that the clip-holding cartridge has open slots 32C on its bottom. (The corresponding slots on the top of the cartridge are open in the same manner.) Referring to FIG. 32.2, notice that each clip has a wide interior 32D in the front that narrows to a dead end 32E and then spreads back apart again towards the rear 32F. This dead end can be achieved by simply thickening the interior edges of the clips towards each other or by placing a flexible webbing means there. This dead end, or the flexible webbing composing it, will usually have a funnel shape or V-shape so that the very last hairs to be used lie directly in the center of the clip and straight in front of the straightening peg (to be described later). The reason a dead end is helpful is so that the back portions of the clip can help provide spring force. By doing so, the rearmost hairs in the clip will not be held much tighter than the front most hairs in it.

Cartridge & Pins

Figure 34:
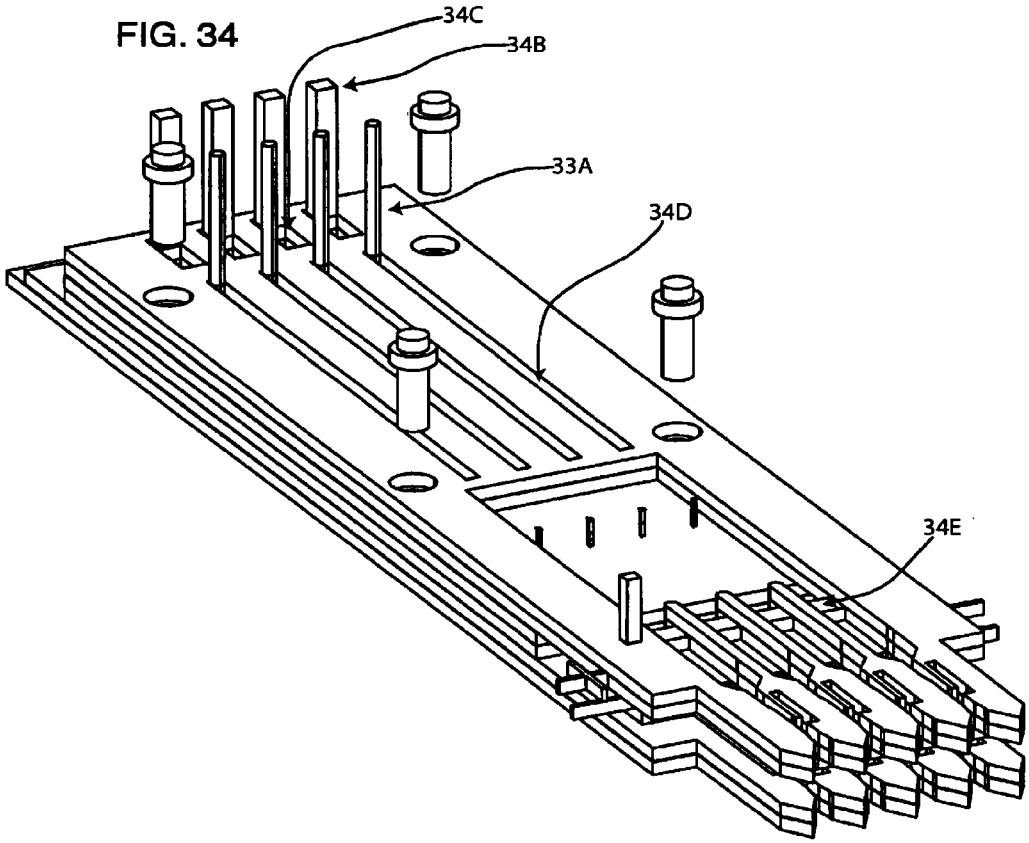
FIG. 34: Abbreviated attachment stack showing only the most representative levels. (Top front perspective view.)

In FIG. 33, each slot 33C, and its corresponding slot on the bottom of the clip-holding cartridge 32B, is wide enough to allow the vertical portion, or clip-engagement pin 33A, of a spring-pin in FIG. 33.1 to stick up through it and mate with the spring-pin-receiving hole 33B of its corresponding clip inside said cartridge. In FIG. 33.1, the isolated spring-pin and clip off to the side shows how the spring pins and clips mate inside the cartridge. This is to say that the pin 33A is designed to stick though a hole 33B in the hair extension holding clips. Thus, pin 33A is a clip-engagement pin. This is to say that the pin 33A you see sticking up from the top of the attachment stack in FIG. 34 is designed to stick though a hole in the hair extension holding clips. Thus, pin portion 33A is itself a clip-engagement pin.

Simplified Aggregate Stack

Also in FIG. 34, notice the rectangular tabs 34B that extend up at the very back. These tabs are part of the spring-pins and can be used to pull them backwards. Remember that since these pins are spring-loaded, left to their own, they will move forward. These tabs are used to pull the spring-pins back to a standard contracted position. This standard contracted position, where all pins are pulled to the very back, makes loading and unloading clip cartridges possible. This is because all of the spring-pins are lined up exactly with each other, at the very back of their slots.

Note: To save space, the rear slots 34C, the ones the rectangular tabs move in, have been scaled much shorter than they likely would be. Really, their length would more likely be equal to the forward slots 34D in front of them, the ones the round clip-engagement pins 33A move in, because these tabs are connected to and must move the same distance as the clip-engagement pins do.

Cartridge with Rubber Band

Figure 35:
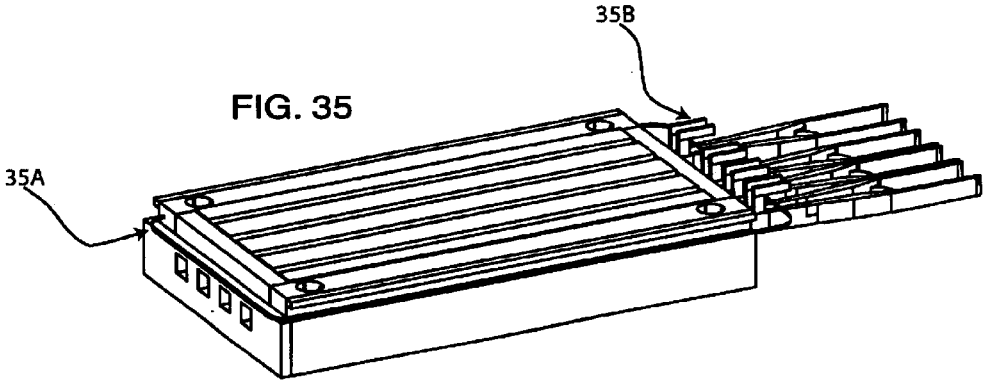
FIG. 35: Clip cartridge with rubber band. (Top left perspective view.)

As stated before, the spring-pin receiving holes 33B of the clips, as in FIG. 33.1, should be lined up with each other before their cartridge is loaded or unloaded atop of the attachment stack. To see how this can be done, refer to FIG. 35. The clip-receiving holes of the clips are lined up by rubber band 35A that encircles the cartridge and pushes all of its clips backwards, as far as they will go. Notice how said rubber band surrounds the cartridge and fits into a groove. Notice the rubber band fits into hooks 35B on the clips that it pulls backwards. Thus, the clips are pulled back as far as they will go so that they are lined up with each other, and the same can be said of the spring-pins, in the attachment stack (achieved by a mechanism described later). Consequently, the pin-receiving holes of the clips and the spring-pin-clip-engagement pins match up perfectly. This makes taking one cartridge off the clip-engagement pins and putting another on easy. Please note the springs of the spring pins will be strong enough to overcome the rubber band and push their clips forward despite it.

Clip & Peg

I told you that levels fifteen through nineteen, shown in FIGS. 26–30, have two purposes. I have explained the first purpose, refer to FIG. 36 to see the second and FIG. 36.1 to see an enlarged front of this level. This second purpose is that the fronts of these levels contain funneling channels 36A that serve to stabilize the hair extension tips 36B hanging down from the clips. This way the hairs hang in thin lines waiting to get into the attachment area 36C. Without these funneling channels, these hair extension tips might flip around from side to side. Perhaps, this side to side movement would lead to hair extension tips hoping from channel to channel or worse yet bunching up before entering the attachment area. I call the funneling area 36A the hair extension hopper. It is part of the hair-extension-tip trench and guides and funnels the hair extension tips into narrowed portions of said trench. Each clip may have a straightening peg 36D behind it that extends vertically through its channel. Notice that the straightening peg 36D is just slightly thinner than the most narrow portion 36E of the funneling hair channels of hair extension tip trench.

Paintbrush Obstacle

Scenario 1:

To get a better intuitive understanding of what this straightening peg does, imagine guiding the bristles 37A, in FIG. 37, of a paintbrush down a trench only slightly wider than the brush. You should imagine this trench as having two vertical walls 37D and 37E. If you hold only the handle of the paintbrush, then should the bristles encounter an obstacle 37B in this trench, its bristles will bend backwards when you apply enough forward pressure.

Scenario 2:

In the second scenario shown by FIG. 37.1, imagine the same situation except that you put your finger 37C down into the trench behind the bristles of the brush. In this case, you can press the bristles with all of your strength into the obstacle and they will not bend. The straightening peg serves the same purpose as your finger.

FIG. 38 illustrates what might happen to the hair extension tips 38A if there were no straightening peg. Notice how the tips curve excessively backward. The purpose of the straightening peg is to prevent this. If the tips were allowed to curve excessively backward, the clip 38B might advance forward without moving the hair extension tips forward with it.

Clip & Peg

Referring once again to FIG. 36.1, the clip is shown with its straightening peg 36D. Since the tips are kept relatively straight, the hair extension tips can be pushed forward with greater spring force than they could be otherwise.

Spring Pin Isolated

As you can see from FIG. 31, the straightening peg 28A is part of the springpin system. An alternative approach would be to attach a straightening peg to each clip rather than making it part of the spring pin. Of course, such an approach would be at a disadvantage because each clip would be more complex and difficult to manufacture. And since there are more clips, because they are removable, than there are spring-pins it is best to attach the straightening peg to each spring-pin, not to each clip.

It may be undesirable to extend the straightening pegs down below level fifteen as shown by FIG. 26, because if they were any lower, they could come in contact with the fragile hair handling tines. In fact, in the previous drawings (FIGS. 26–30), the straightening peg doesn't extend below level sixteen as shown by FIG. 27. In these drawings, portions of straightening pegs are shown as short segments. In particular, notice the short straightening-peg segments as illustrated by 28A in FIG. 28. Just as FIG. 26 is the layer below FIG. 27, FIG. 28–30 represent increasingly higher adjacent levels. Notice how the peg segment 28A in FIG. 28 also extends up through the higher levels as shown by FIGS. 29 & 30.

Of course, it is desirable for the spring-loaded clips to advance the hair tips towards the attachment area but they must not advance faster than the hair extensions in them are used. Referring to FIG. 27.1, the channel obstruction 27A helps keep the hair extension clips from advancing faster than the hair extensions in them are used. It does this because the hair extensions hanging down from the clips are forced up against it. This design only allows the spring-loaded clips to advance when the front-most hairs in them are attached and pulled from the clip by the bend-under system.

A second purpose served by said channel obstruction is to prevent scalp hairs from advancing to the point where they actually start pushing the cartridge clips backwards away from the attachment area. Remember that the scalp hairs are coming from the direction of arrow 27B.

As shown in FIGS. 27 and 27.1, in this particular embodiment, said channel obstruction is only placed on level sixteen. It is not placed on the levels above it because this wouldn't give exiting hair extensions an area to overhang the channel obstruction without holding the cartridge back. It is not placed under this level because directly beneath is the attachment area, and the hairs must have enough clearance above them to bend under channel obstruction 27A in order to enter the attachment area. You might not completely understand these two concerns now but it will become apparent when I explain exactly how hairs flow through the system. The actual placement height and thickness of the channel obstruction 27A is something that must be calibrated empirically during prototyping. In other words, when I refer to only placing it on level sixteen that is something specific only to this set of drawings. This is not to say that couldn't be placed on more than one level or a different level number so long as the above concerns are taken into account.

To Review

Simplified Aggregate Stack

FIG. 34 is a diagram of the attachment stack. It's simplified in that it doesn't contain every level that the attachment stack would have in practice. Instead, to keep things simple, it only shows several representative levels. The following are some overall points about the system:

I. The Attachment Stack is Likely Made of Sheets of Metal:

A. Most of the levels that I have described are very thin pieces of sheet metal. Some of them have a thickness similar to that of a piece of paper. Of course, since they're composed of metal, they're much stronger and more rigid than paper. The sliding hair handlers are especially thin, except for level eight that has tips that extend vertically downward into the attachment area. The sheets of metal can be shaped into the cross-sections I've described above using various methods:

1. Photochemical etching—A technology similar to that used in making microchips, only neither as expensive nor accurate. Photo etching involves coating a sheet of metal with a substance that hardens on exposure to light. A pattern is optically projected on the surface, and the surface is developed. Those areas on the surface that were exposed to light remain protected after developing. Those areas of the surface that weren't exposed to light have only bare metal that is susceptible to chemical etching. Thus, shapes can be etched into the metal sheet by exposing it to an acid. Photochemical etching will provide sufficient accuracy to fabricate most of the layers of this invention.

2. Photo-resist electro-forming- A highly accurate additive fabrication method that depends on depositing an electrolyte on an electrically charged pattern. It can form sheets of metal with features having tolerances of one micron or tighter. This level of accuracy will not be needed for most cross-sections of this invention. Thus, its added expense over photochemical etching is unjustified for most levels of this machine. However, there maybe a limited number of levels that could benefit from the accuracy of electro-forming.

3. Laser cutting—A laser beam can be used to cut metal precisely and accurately. However, laser cutting is generally too slow to use to cut each level from a blank piece of sheet metal for production purposes. Rather, laser cutting should be used to cut tabs off parts produced by photochemical etching or electro-forming.

4. Molding—Some parts like the glass optical prism fork shown in level four, as shown in FIGS. 7 and 8, might be manufactured by molding.

5. Laser Chemical Vapor Deposition (LCVD)—LCVD is an emerging technology that promises to allow small parts to be formed directly from the vapor phase by using a laser beam. It promises to be highly accurate but is not commercially available yet. In vapor phase deposition, a certain cross-sectional shape is projected using high-energy light or electron beams. In the future, it might prove to be an effective means for producing the stack levels. This technology is known to produce extremely pure and extremely strong materials.

6. Any other analogous technology can be used to manufacture this invention. The above five examples are only possibilities.

II. Holding the Levels of the Stack Together:

The above methods describe ways of forming patterns for individual cross-sectional layers. However, these individual layers must somehow be attached. There are several ways that this can be done, including but not limited to:

A. Bonding with adhesives—This method would use a thin film of adhesive applied between the surfaces of the various levels of the stack. Although a relatively easy method, adhesives are probably not reliable enough for this application. For example, the polymer adhesive this system uses to attach hairs together might itself degrade the adhesive.

B. Welding—Welding would most likely be done with laser beams. For example, two or more thin layers of metal can be welded together by hitting the surface of one of them with a laser beam. This is probably the most reliable way attaching various levels of the stack to each other. It allows for a durable hermetic seal, which is especially useful for forming channels that carry liquid.

C. Bolting—Otherwise loose layers can have holes that run through them that allow them to be held together by bolts. Realistically, bolts would probably used in combination with a means such as welding. The bolts could be slide through holes 1E in FIG. 1 and homologous holes through other parallel levels.

The hair handlers that need to slide relative to each other will be attached by running a rod through them. However, this rod and hair handler assembly will not prevent the layer from sliding relative to each other.

Figure 39:
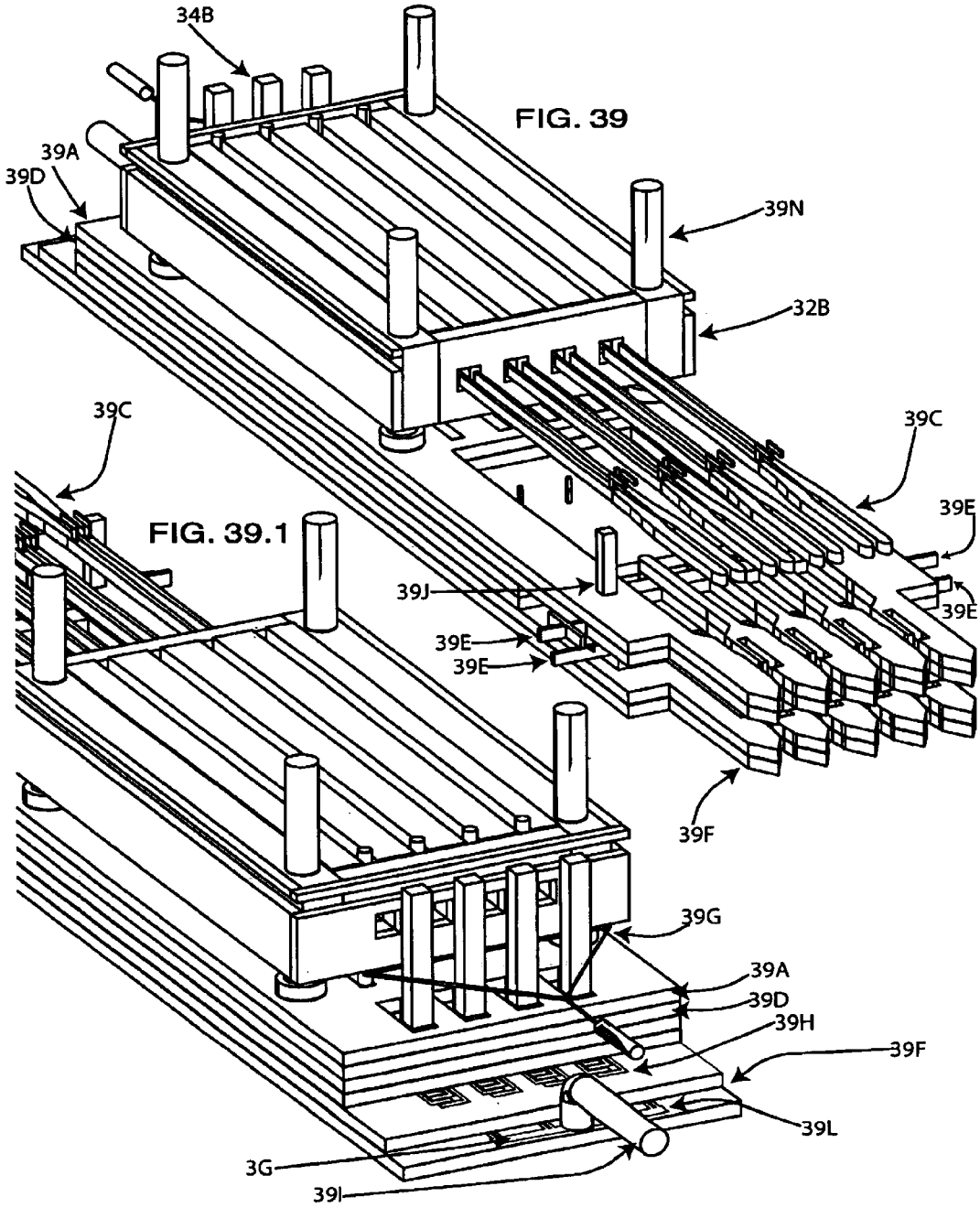
FIG. 39: Clip cartridge atop abbreviated attachment stack. (Top front perspective view.)

Referring to FIG. 39, the bolts 39N used to hold the layers together may have elongated heads that can be slid through holes in the clip cartridges 32B. This will help position the removable clip cartridges atop the attachment circuit stack. Of course, these elongated clip cartridge engagement rods 39N don't have to be bolts running through the entire stack, instead, they could just be attached near the surface.

III. Attaching Peripheral Components to the Attachment Stack:

The functions of the attachment stack are aided by various external components attached to it. The following is a recitation of how some of these peripheral components attach:

Referring to FIG. 39 we see a perspective front view of an abbreviated hair extension attachment stack, the hair extension clips 39C are held by the clip cartridge 32B. The hair extension clips 39C extend from the cartridge and allow the tips hair extensions (not shown) which they hold to extend below, perhaps in dangling manner.

Figure 36:
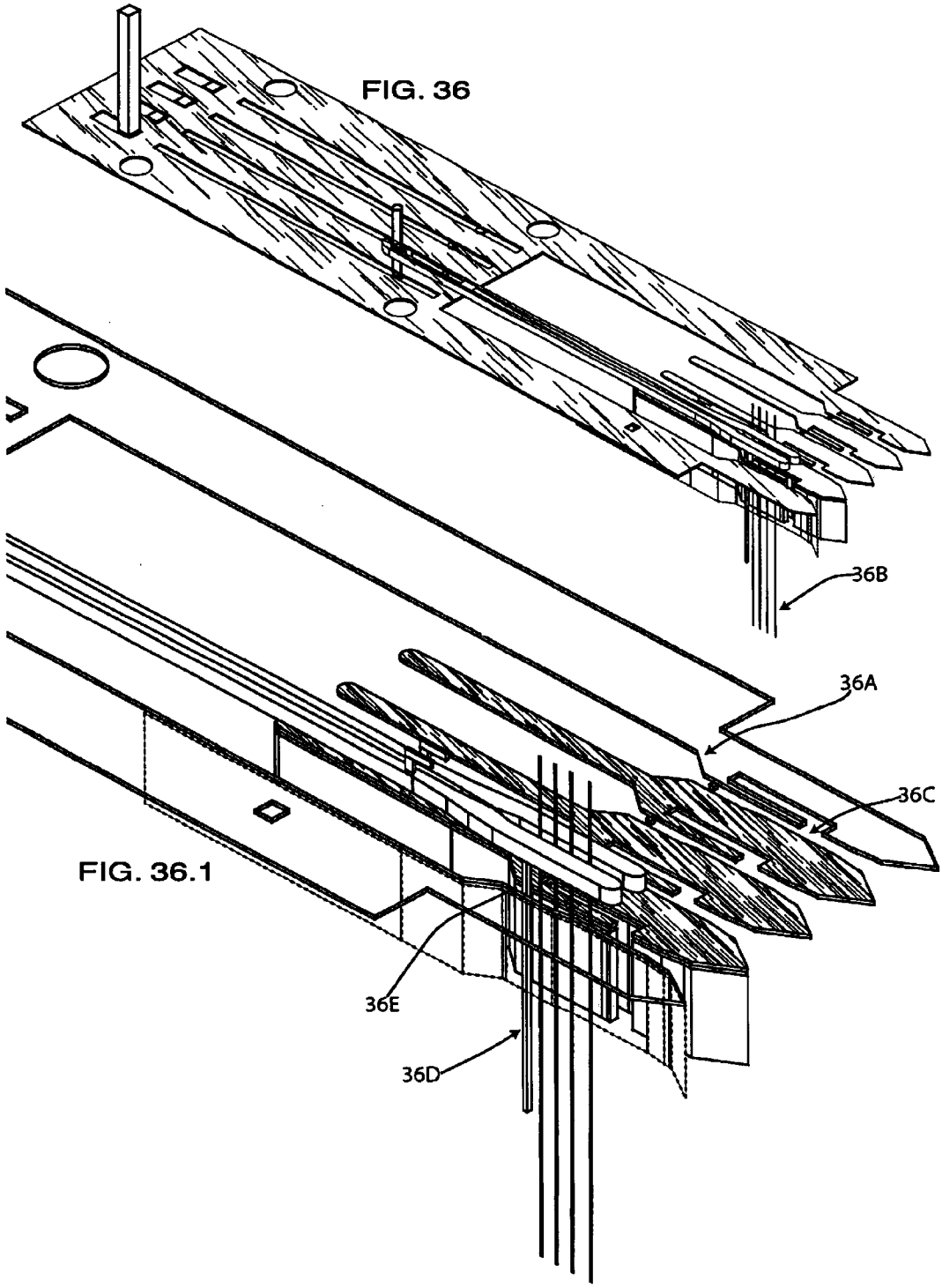
FIG. 36: Function of spring pin and clip relative to the topmost level of the attachment stack. (Top-front-left perspective view.)

The funneling areas 36A, in FIG. 36.1 guide these hair extension tips in individual channels. I call the areas of these layers that guide and funnel hair extensions the hair extension hoppers. In FIG. 39 and FIG. 39.1, the hair hopper levels are represented in abbreviated form by the top two stacked levels 39A and 39D.

In FIG. 39, the cables 39E slide the hair handlers sideways and forward and backward. They lead off to devices that pull on them causing them to move. (I'll say more about this later.) Of course, the hair handlers are at the same levels as their cables. In this embodiment, the layers where the moving hair handlers are need not have funneling fronts, so there is nothing but air space at the fronts of their layers. The moving hair handlers are important because they move hairs around and put them where we want them.

In FIG. 39 and FIG. 39.1, below the hair handlers are the lower stationary hair channel levels where the nozzles reside, represented in abbreviated form by the two lowest stacked levels 39F. It is in these lower levels where the polymer adhesive is applied to the hairs.

In FIG. 39.1 we see a perspective back view of the attachment stack, notice the spring-pin-pullback cable lasso 39G around the rectangular spring-pin tabs. This configuration makes it possible to pull all the spring pins to the back of the cartridge, thereby, pulling all the hair extension holding clips to the back of the cartridge in line with each other. Referring to rearview in FIG. 39.1, hair extension holding clips 39C are pulled to the very back of their cartridge and lined up with each other. This is achieved simply by pulling the lasso-shaped cable 39G backwards. In FIG. 39, the lasso pulls the spring-pin tabs 34B that it surrounds backwards. Simultaneously, this causes the hair extension clips to be pulled backwards. Ideally, this lasso cable leads to an actuator, such as a solenoid, that pulls it backwards when the system's computer tells it to.

In FIG. 39.1, notice that the sensor circuits extend to the very back where their contacts are exposed on surface 39H. This is where the electric wires or fiber optic cables come in contact with the sensor circuits.

A liquid adhesive is used to attach the hairs together. The back of level three (in unabbreviated version but the lowest level in FIG. 39.1), shown as surface 39L, is where the liquid adhesive is introduced into the attachment stack. The outline of the manifold pathways 3G can be seen in FIG. 39.1. Really, the liquid adhesive manifold would be concealed under level three in the unabbreviated version, and only a single adhesive input hole would be seen. A hose 39I carrying the liquid polymer adhesive will be attached to this single hole in level three (unabbreviated version) The liquid adhesive will then be carried sideways and then forward to the attachment nozzles by the manifold pathways 3G, which really are formed into level two (unabbreviated version).

Actuator Cable Interface with Hair Handlers:

Referring to FIG. 40, the sliding hair handlers are attached to actuator driven cables 40A and 40B. Remember that the hair handlers are thin sheets of metal. An actuator is any device that moves something back and forth. A solenoid is one type of actuator.

Before, I describe how actuator driven cables such as 40A and 40B, in FIG. 40, move only the front portion of a level. The front portion, of course, being a hair handler tine-assembly. The issue we will concern ourselves with now is how these cables are attached to the levels that they move without interfering with other levels. For example, how the cable attached to one hair handler tine-assembly sheet 40C stays out of the way of the levels above and below it, such as hair handler tine-assembly 40D below. Since it is expected that these actuator driven cables will be attached to the top (or bottom) of a sliding hair handler tine-assembly, the areas of cable attachment like 40E will as such be thicker than the rest of the layer to which it is attached. As such, a cable clearance notch 40F has to be cut in the overlying hair handler assembly 40C above the point of cable attachment 40E. This is to allow the cable to fit between the two sheets of metal, which compose the hair handler tine-assemblies 40C and 40D, while at the same time allowing these two sheets of metal to lie surface to surface.

These cable clearance notches 40F will have to be wide enough to allow adequate clearance margins 40G around the cables as they and the sheets of metal they're attached to move around. Remember that these sliding hair handlers not only might move side to side, but some of them also can move forward and backward. As such, the cable clearance notches must be adequately large in order to leave margins like 40G for movement in several directions between cable attachments like 40E and edges of clearance notches like 40F.

The spacing scheme shown here assumes that the thickness available in cable attachment area 40E will be no greater than the thickness of one tine-assembly level. In other words, we are assuming that the attached cable 40A is no thicker than the sheet metal of which the sliding hair handler tine-assemblies are made. Thus, cable clearance notches can be just one sheet tine-assembly thick. This allows for the cable attachments and cable clearance notches to be alternated between two positions, per hair handler tine-assembly side. For example, the left side of these hair handlers will have cable 40A with notch 40F above it and a second cable 40H attached to tine-assembly 40C at a second cable-attachment position 40J. Of course, if there had been a third hair handler tine-assembly stacked above level 40C, it would have had to have a cable clearance notch over position 40J. This would allow all cable attachments on this side to be alternated between just two cable-clearance-notch positions.

However, if the cable attachments were thicker than one layer of sheet metal, then the clearance notches would have to be made thicker. In other words, they would be made through several layers of sheet metal above them to allow for the clearance of just one attached cable. Should this become necessary, cable attachments would have to be alternated between more than two positions per cable-attachment side.

Alternatively, using cable/hair handler interface sheets would allow thicker cables to be used while still alternating attachment notches between just two positions. In such a configuration, the thick solenoid-driven cables are not attached directly to the sheet metal of the hair handlers, but instead, are attached to thin flexible sheets. These thin sheets then go on to attach to the sheet metal of the hair handlers. Since these interface sheets are no thicker than one sheet of the hair handlers, their clearance notches can be alternated between just two positions, even though the solenoid-driven cables themselves may be much thicker than just one hair-handler-tine-assembly level. Please note the cable attachment points. could be placed anywhere on a hair-handler tine-assembly, including direct attachment to the tines or back of the assembly.

The distances the hair handlers slide must be controlled very accurately. Because we are dealing with such small distances, the solenoid-driven cables themselves are not likely to be accurate enough. In order to achieve accuracy in movement, a movement control rod 39J will be used. Movement control rods not only keep the sliding layers in place but, also, control their path and distance of movement. For example, tine-assembly 40D represents level eight, which is the pincher that moves form side to side pressing hairs between its notches up against the left wall. By pressing up against the edges of this slot 40K, the control rod 39J controls how far the tine-assembly moves from side to side. There are some parts that move not only in two directions, but four. Their control rods and slot sides control the paths of their movements in a similar fashion.

In FIG. 39, the control rod 39J is shown relative to the rest of the attachment stack. In this embodiment, it runs through the thickness of the entire attachment stack. However, it serves its purpose solely in the levels of the moving hair handlers.

Numerical Dimensions of the Attachment Stack:

I want to make sure you have a good understanding of the size of the attachment stack. The following lists some information about its dimensions:

-It's about as wide as the head of a razor 1–1.5 inches (2.54–3.81 cm) and, or perhaps, as wide as an electric hair trimmer which is 1.5–2 inches (3.81–5.08 cm).

-Each channel in it is about the width of an electric hair trimmer's channels, anywhere from 0.5 to 1.5 mm (0.0197–0.059 inches).

-The attachment stack drawings, which I've been showing you, are simplified. They only have four channels. In practice, the system would have about 15–25 channels, not just four.

-The length the attachment circuit stack will depend largely on how long, the hair extension holding clips have to be made. I would expect that stack's length to be between 4–8 inches.

-I would estimate that the height of the stack (from its lowest level to its top level where the bottom of the clip cartridge rests) to be less than 1 inch (2.54 cm).

-The above physical dimensions are only guidelines to understanding the first embodiment of the system. However, they should in no way be construed as limitations.

Remember that FIG. 39 shows a version of the attachment stack that is simplified, in that it only shows about six representative levels. The actual attachment stack would have closer to twenty levels. After all, earlier about twenty different levels were described individually.

Hair Handler Movement Sequence

I have just finished explaining the physical structure of each part of the attachment circuit stack individually. Now, I will explain how the various hair handlers of the attachment circuit stack work together. I will give you a better idea of exactly how and when they move relative to each other. In the following description, note that most of the drawings represent cross-sectional views of the attachment stack. The cross-sections run parallel to the layers of the attachment stack. The hair extension cross-sections are represented by lightly shaded circles, and the scalp hair cross-sections by darkly shaded circles.

Step Series #1

In FIG. 41, we see that the channel narrowing entrance gates 41F and 41G, respectively for the scalp hairs 41D and the for the hair extensions 41E, have been moved over to narrow their channels. They will likely make this move exactly at the same time. They also serve as entrance gates by preventing hairs from prematurely entering the attachment area.

Recall, the purpose of the channel narrowing entrance gates is to temporarily narrow the channel down to one hair-width in metering areas 41A and 41B, while preventing the hairs from making unauthorized entry into the attachment area. Notice the connectivity bridges 41C of the hair-handling-tine assembly Step Series #2

Figure 42:
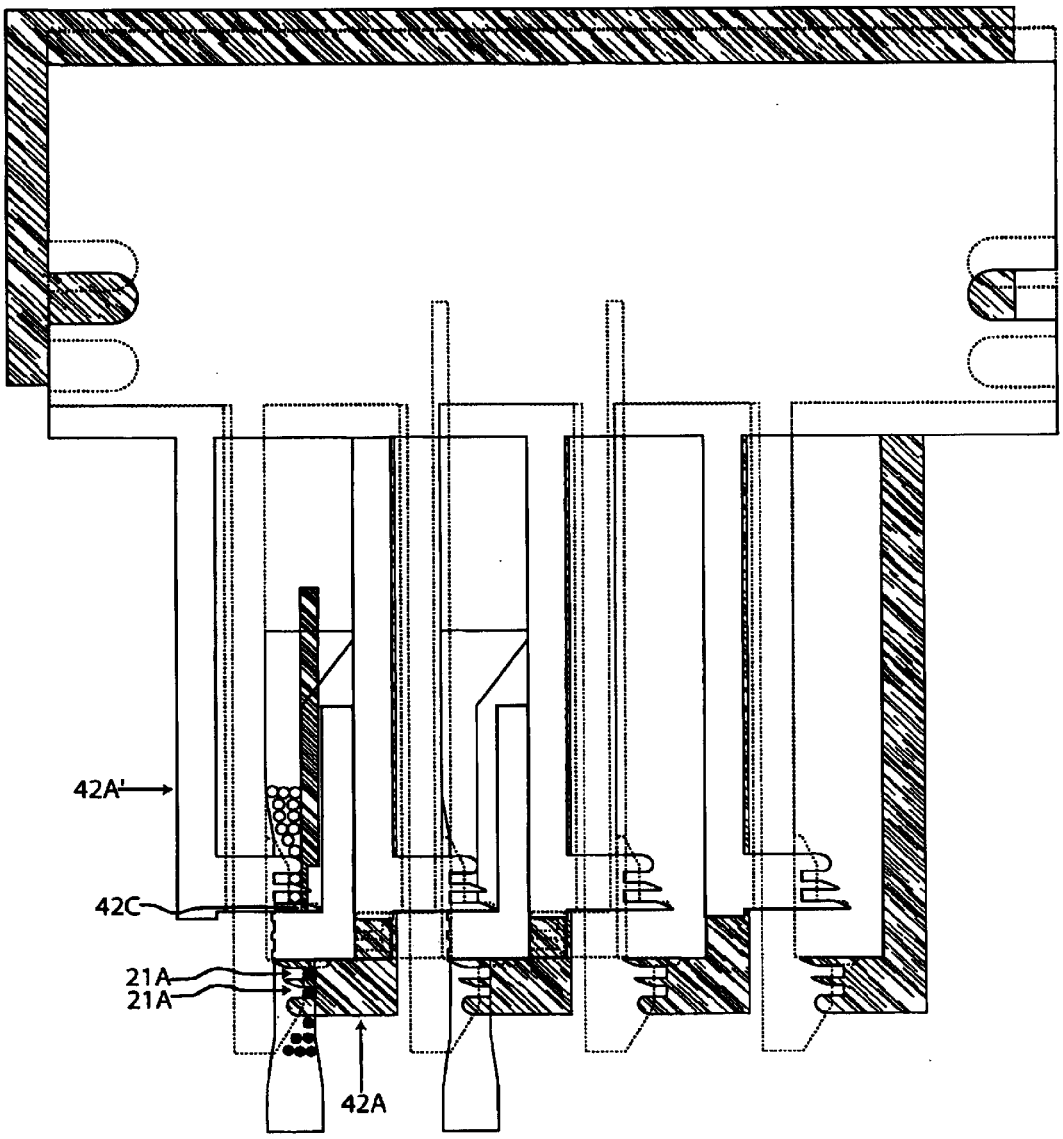
FIG. 42: Step series 2 of attachment isolation algorithm. (Top Plan View of multiple-pushback-gate-tine-assembly levels relative to the underlying hair-flow-channel guides and cross-sections of both scalp hairs and hair extensions.)

In FIG. 42, the combination entrance gate/channel narrowers have already been moved over the hair channels in the previous step. As such, in this step, they are only shown as outlines. In this step, the pushback gates 42A, both one for the scalp hairs 42A and one for the hair extensions 42A', are moved over their channels in order to close a specified number of hairs into their metering area notches 21A. Both pushback gates may move exactly at the same time. Notice how each pushback gate has two metering area notches, each which grabs one hair.

Figure 43:
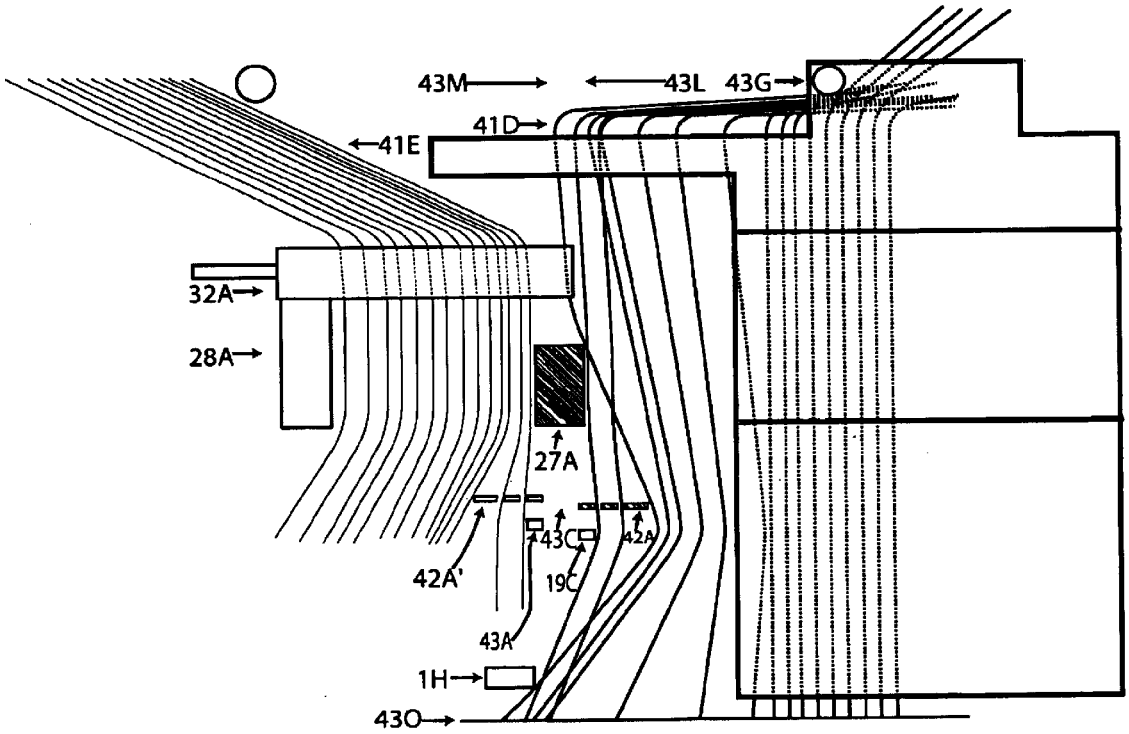
FIG. 43: Step series 2 of attachment algorithm. (Left side view through the center of a representative hair-flow pathway.)

Now look at FIG. 43, it shows what's happening in this step to the hairs from the left side of the channel plan view. Notice how we can see the hair extension entrance gate 43A and scalp hair entrance gate 19C. They prevent both the hair extensions and scalp hairs from entering the attachment area 43C prematurely. Also, notice that that the hair extension multiple pushback gates 42A' and the scalp hair multiple pushback gates 42A. The tensioning hair straightener 43G is straightening the scalp hairs 41D. The hair extensions 41E are being held by hair extension clip 32A. There is a straightening peg 28A shown behind the hair extensions. The channel obstruction, previously shown as 27A in FIG. 27, is shown here in FIG. 43 as 27A. The scalp hairs extend upwards from scalp 430. The obstruction 1H represents the forward edge of the floor level of the hair extension tip trench. The tip trench is the channel that supplies the hair extensions. Sometimes scalp hairs won't get processed until their follicles have already passed under and past the attachment area, in which case such hairs might have to bend around obstruction IH.

Figure 44:
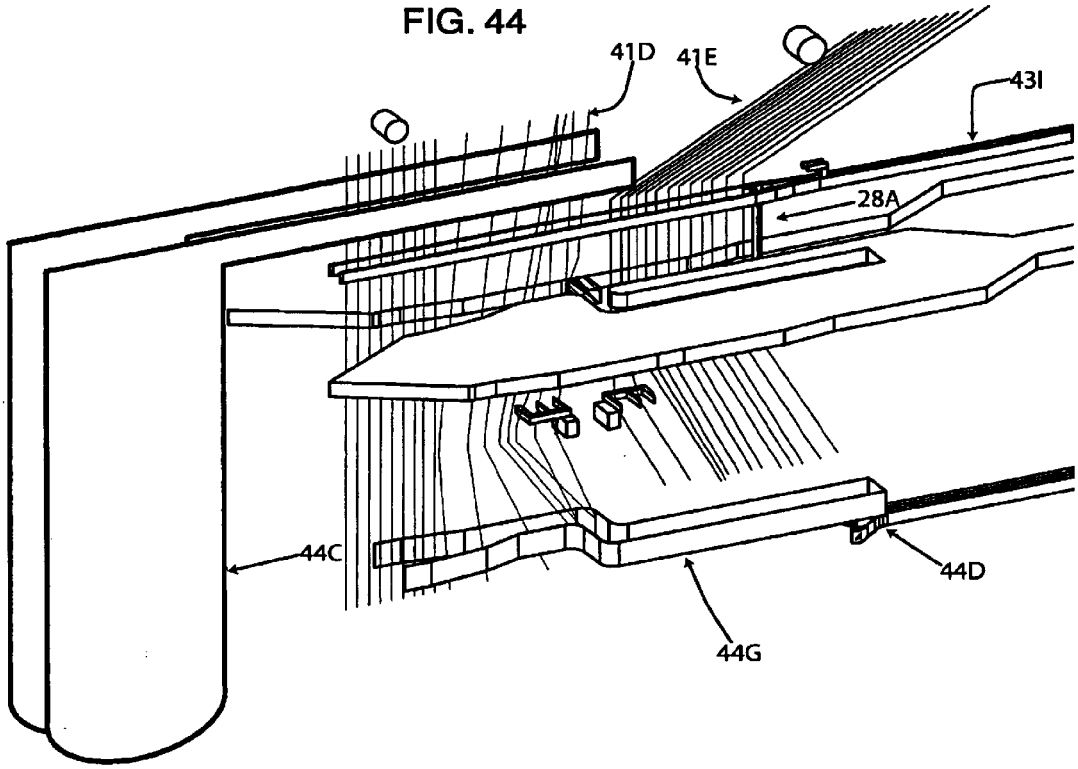
FIG. 44: Conceptual illustration of scalp hair and hair extension metering illustrating the most relevant structures of a hair-flow channel from a right side perspective view.

In FIG. 44, the previous side view is shown in a perspective view. Notice how the hair extensions 41E are hanging down from the hair extension holding clip 43I. Notice the straightening peg 28A below the clip 43I. It keeps these hair extensions from curving excessively backwards. Device 44C in front is the tensioning scalp hair straightener. I have not described exactly how it works, for now, just think of it as functionally equivalent to human fingers which pinch the scalp hairs 41D and lift them straight up away from the scalp. The scalp hair straightener ensures that the scalp hairs stand straight up, like rows of corn facing an oncoming harvester. The bend-under system 44D is shown in this drawing. The wire-frame outline 44G represents the lowest levels of the hair channel pathway of the attachment stack.

When looking at the side view in FIG. 43, keep in mind that the lightly shaded lines represent hair extensions 41E hanging down from where they're held by clip 32A. The hair extension ends are loose, so its helpful to think of them behaving much like the bristles of a paintbrush. This is to say that the clip 32A holds the hairs together much like the metal crimp of a paintbrush.

Figure 45:
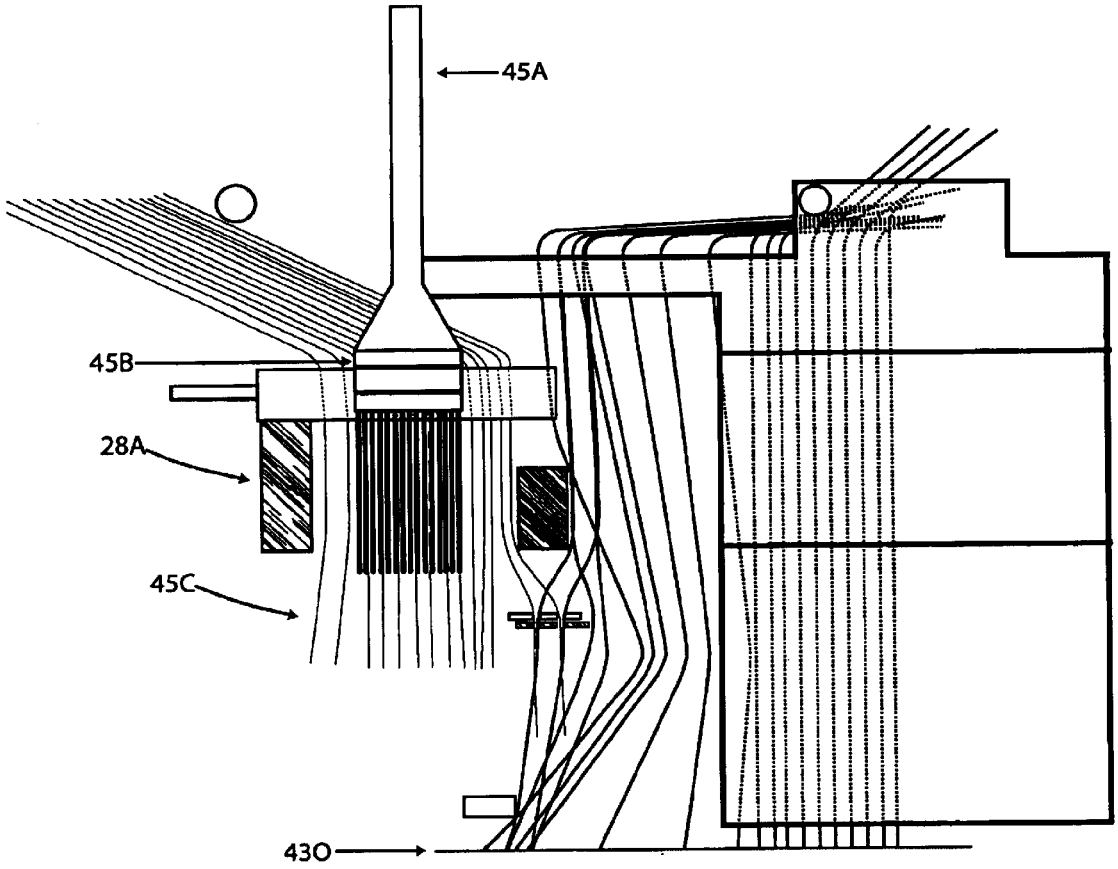
FIG. 45: Visual analogy comparing bristles of paintbrush to hairs in a holding clip shown from a left side view through the center of a representative hair-flow pathway.

In fact, FIG. 45 shows a paintbrush 45A superimposed on the clipped hair extensions with homologous regions of the two aligned. Like paintbrush bristles, the hair extension tips 45C are free to move about within certain limits. But also like a paintbrush, to a large extent these tips want to point straight downward. Also, notice the straightening peg 28A and the darkly shaded channel obstruction. You know the obstruction that prevents the hair extensions from advancing faster than they're attached. The hair extension clip, straightening peg, and channel obstruction together functionally serve like the sides of metal paintbrush crimp 45B.

Since only a limited number of hairs are to be metered out at a time, the small delicate hair handler gates only let a specified number past them at a time. If you can imagine yourself manually taking a small straight pin and using it to count out one bristle from a paintbrush at a time, then you'll have a good intuitive understanding of how the pushback gates count out hair extension tips. In FIG. 43, lines 41E show the hair extensions and they move in the direction of arrow 43M.

The scalp hairs are shown as by lines 41D and move in the relative direction of arrow 43L. The main difference between scalp hairs and hair extensions is that the scalp hairs are held under tension between the scalp and the straightener, 43G, but the hair extensions 41E are only held by clip 32A. For now, think of the tensioning hair straightener 43G as two human fingers pinching hairs and pulling them straight up away from the scalp. We will discuss the design of the straightener in detail later. The scalp hairs, in contrast to the hair extensions, behave less like paintbrush bristles and more like little ponytails. being held are under tension. Once again, if you can imagine yourself using a straight pin to count out hairs one at a time from a pony tail held under tension, then you'll have a good intuitive understanding of what the pushback gates do to the scalp hairs.

Look at FIG. 42. By running an electric current or light beam across the channel at each metering area 21A, we can ascertain whether or not they have scalp hairs in them. If they don't have scalp hairs in them, then their corresponding attachment nozzles need not be fired. That is to say if there is not a scalp hair in a metering area, then the one nozzle that corresponds to it need not shoot out a bead of adhesive. However, this strategy is probably needlessly complex because it requires each nozzle to be independently controlled. Most likely the simpler scheme of firing all nozzles in the system at once will be used.

Step Series #3

Figure 46:
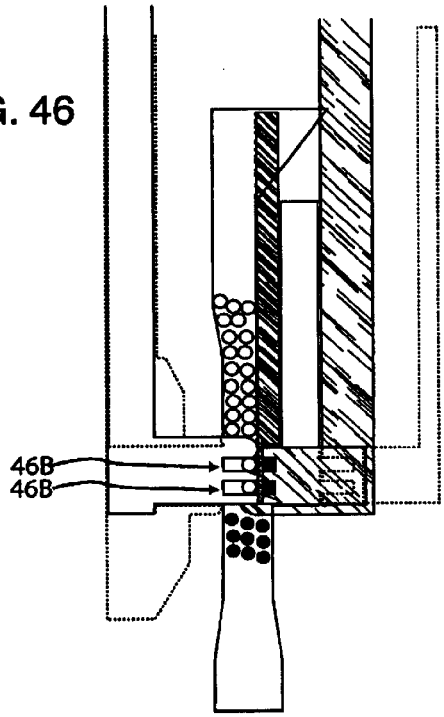
FIG. 46: Step series 3 of attachment isolation algorithm. (Top plan view of multiple-pushback-gate-tine-assembly levels relative to the underlying hair-flow-channel guides and cross-sections of both scalp hairs and hair extensions. The multiple-pushback gates have moved the hairs and hair extensions in their notches into the attachment area.)

In the previous step, as shown by FIG. 42, neither pushback gates 42A nor 42A' nor slide out prevention gate 42C had been moved into the attachment area yet. In this step, as illustrated in FIG. 46, both the pushback gates and slide-out prevention gate have slid over the attachment area. This slide out preventer's purpose is to prevent hair extensions (and two a lesser extent scalp hairs) from falling out of the open sides of their pushback gate metering notches before the pushback gates come to rest lined up with each other. The slide out preventer should be moved forward, as shown, into the attachment area slightly before, or at the same time as, the pushback gates are.

Also in this step, both pushback gates have been moved straightforward in order to carry the hairs they had metered out into the attachment area. Notice how the two hair extensions in the hair extension pushback gate's notches 46B match up perfectly with the two scalp hairs in the scalp hair pushback gate's notches 21A. When pushback gates move hairs from the original metering area location to the attachment area, they are functioning as transport-forward gates.

Figure 47:
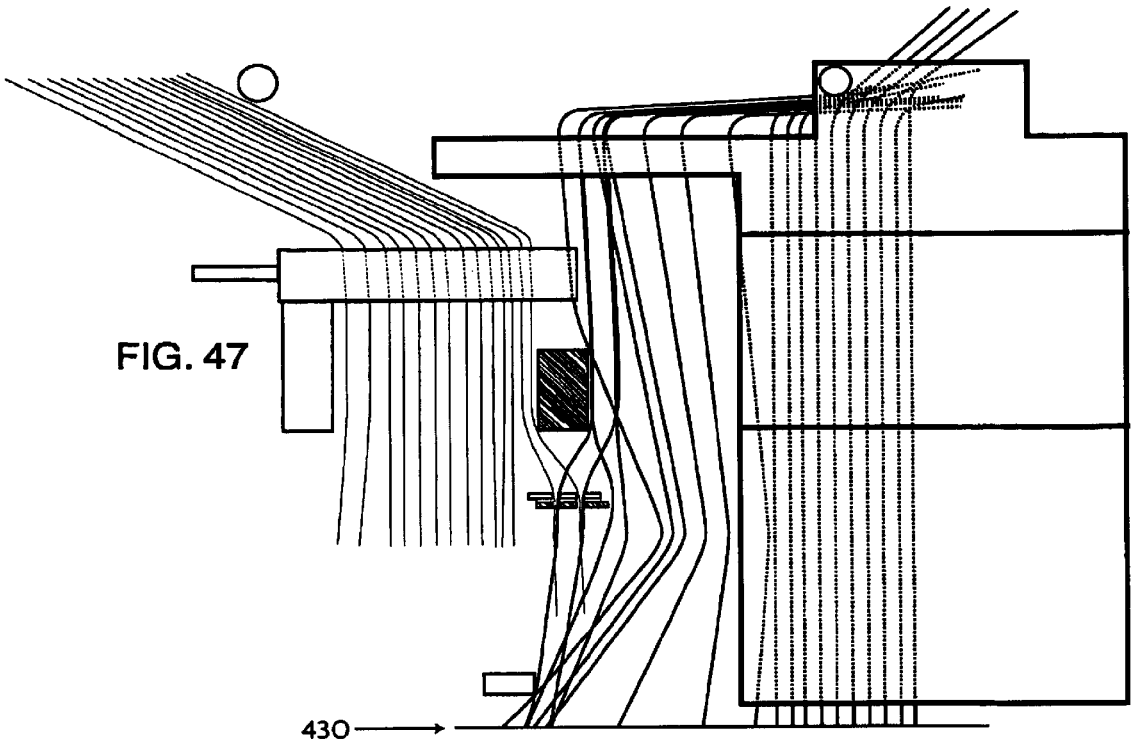
FIG. 47: Step series 3 of attachment algorithm. (Left side view through the center of a representative hair-flow pathway. Same step as shown in FIG. 46 except from the side.)

In FIG. 47, notice what this step looks like from a left side plan view. The hair extensions are lined up with the scalp hairs in the attachment area, because both the scalp and hair extension pushback gate notches line up.

Step Series #4

Figure 48:
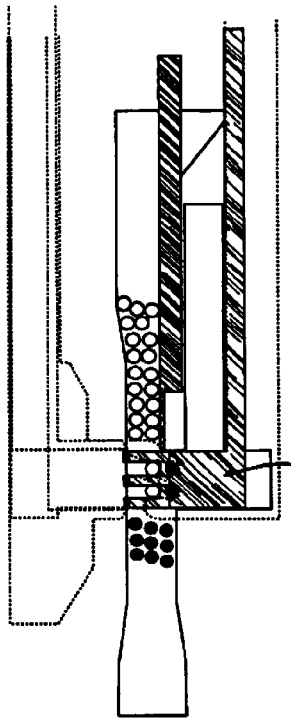
FIG. 48: Step series 4 of attachment isolation algorithm (Top plan view showing hair channels at a point when the pincher is moving over the attachment area so as to close hairs and hair extensions together into individual attachment chambers.)

Referring to FIG. 48 which is a top plan view, this step begins with the slide out prevention gate being moved back to its original position, so that it no longer blocks the hairs from escaping from the open sides of this pushback gate notches. Of course, it doesn't need to block them anymore since the pushback gate notches are lined up and, as such, block hairs from escaping from each other. Look closely, the pushback gates are harder to see because only their outlines are shown; they are not shaded because they do not move in this step.

The second part that does move in this step is the pincher 9C. Notice how the pincher has two notches in it that line up perfectly with the two hair holding notches of each of the pushback gates. It begins (or at least continues it journey) from the right to the left. Along its journey it pushes both the hair extensions and scalp hairs together in front of the left wall of the attachment area. Here, they are held still and close together in front of the adhesive polymer attachment nozzles in this wall.

Refer back to FIG. 16.2 in order to see a three-dimensional picture of the pincher. Recall that its top is slanted forward such that it comes in contact with the hair extensions near where they are being held by the pushback gates, before the lower portions of the pincher do. The mechanics behind this is illustrated by the series of drawings in FIGS. 18.0–18.2. Since it's slanted design pinches the higher portions of the hair extensions first, it lets its lower levels pinch the hair extensions progressively later, guiding any wayward lower hair portions into alignment with the notches above them.

(Schematically from the SIDE—First Half of Step #4 only:)

Figure 49:
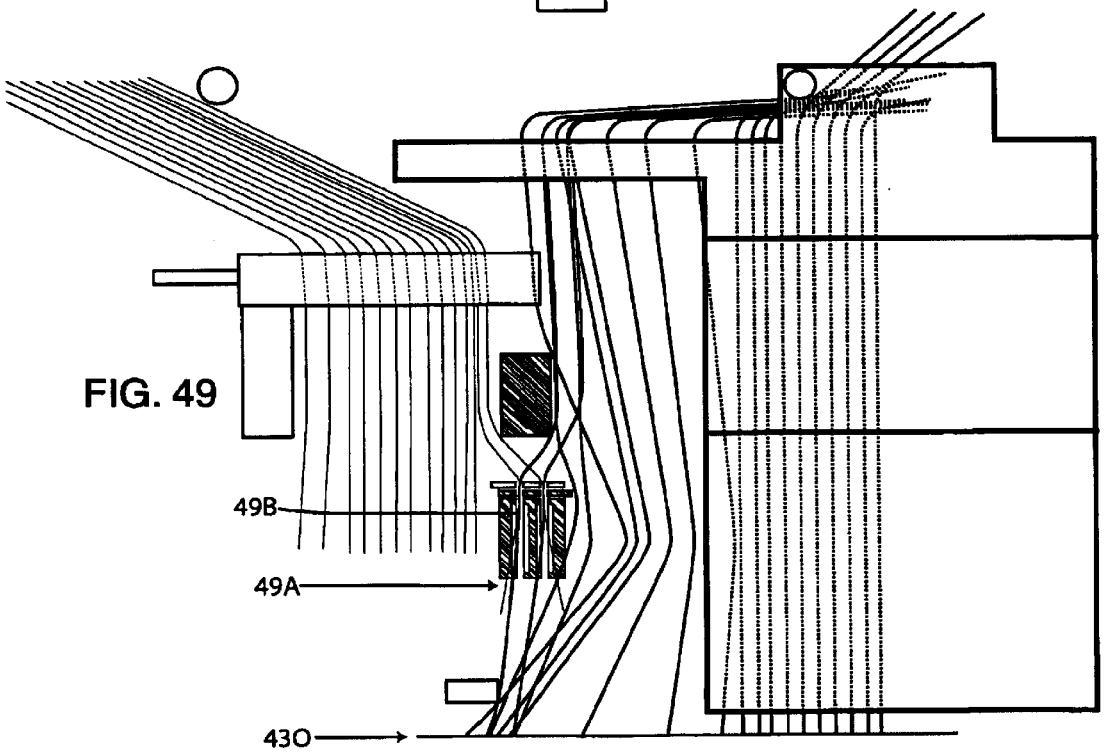
FIG. 49: Step series 4 of attachment algorithm. (Left side view through the center of a representative hair-flow pathway during the first half of step series 4. The pincher has begun its journey but has not completely pulled the wayward hair extension tips together with their corresponding scalp hairs.)

FIG. 49 illustrates the very beginning of this step from the left side. In this drawing, the pincher is on its way but has not completed its journey to left. Notice how the lower portions 49A of the hairs extending below the pushback gates are not completely held together unlike their higher portions 49B, which are held more closely by the pushback gate notches above the pincher.

(Schematically from the SIDE—Second Half of Step #4 only:)

Figure 50:
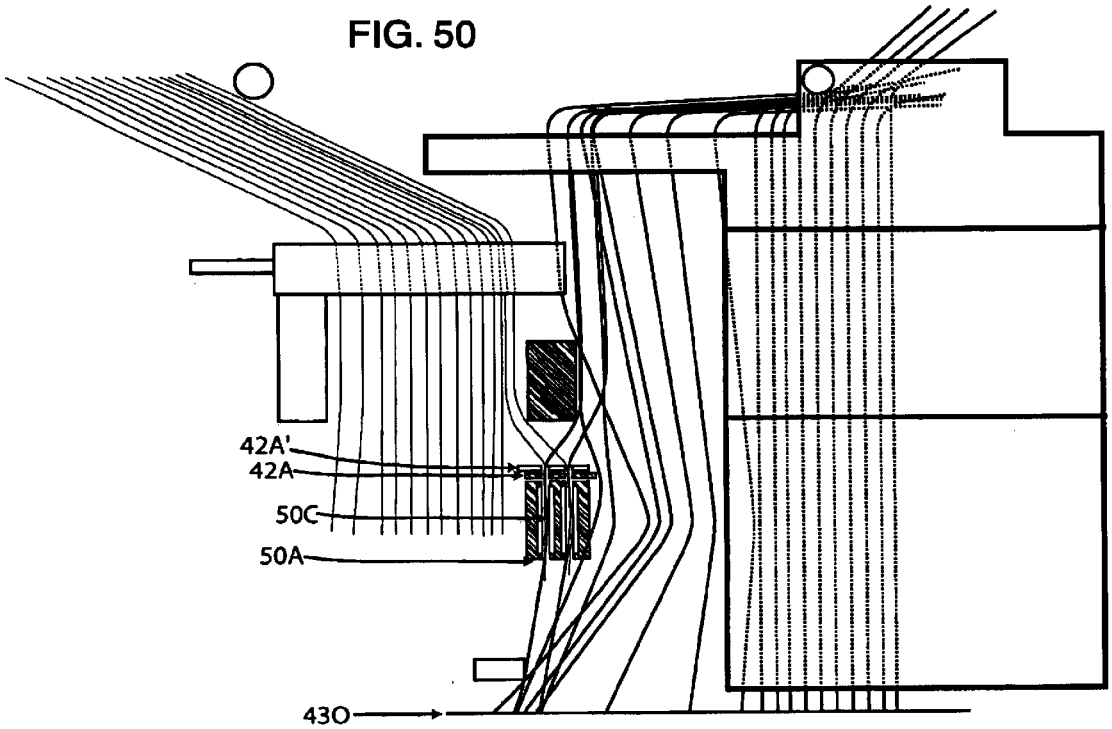
FIG. 50: Step series 4 of attachment algorithm. (Left side view through the center of a representative hair-flow pathway during the second half of step series 4. The pincher has ended its journey and has completely pulled the wayward hair extension tips together with their corresponding scalp hairs.)

In FIG. 50, we see the second half of this step from the left side. The pincher has moved farther leftward. We can see that the previously wayward hair portions 50A have been brought into alignment with the pushback gate notches 42A and 42A' above them. Because of the shape of the hair pincher, it pinches the hairs together at a point near 42A, above the attachment nozzles, and a point near 50A, below the attachment nozzles. Notice how the pincher chambers are relatively wide in the middle near area 50C, such that they form empty chambers around the little bundles of pinched hair. These empty chambers are carved out in order to give the attachment bead room to form around the hairs.

Brake on Straightener Activated in this Step

At this point, there should be something that clamps down on the scalp hairs while the attachment beads are being applied so that attachment system can't be moved during this time. The part of the system that is most capable of doing this is the tensioning hair straightener. Since we haven't discussed the straightener in detail, just think of it as two human fingers capable of pinching hairs and pulling them straight up away from the scalp. The straightener should clamp down before the pincher has reached its left most position. This will prevent the attachment system from being moved forward in the hair until the attachment beads are in place. In essence, the straightener is functioning as a brake.

Preferably, the straightener should brake after pinching together and pulling hairs up, not just after pinching before pulling hairs up. This strategy will ensure that during the attachment process proper all scalp hairs are pulled tight.

Step Series #5

Figure 51:
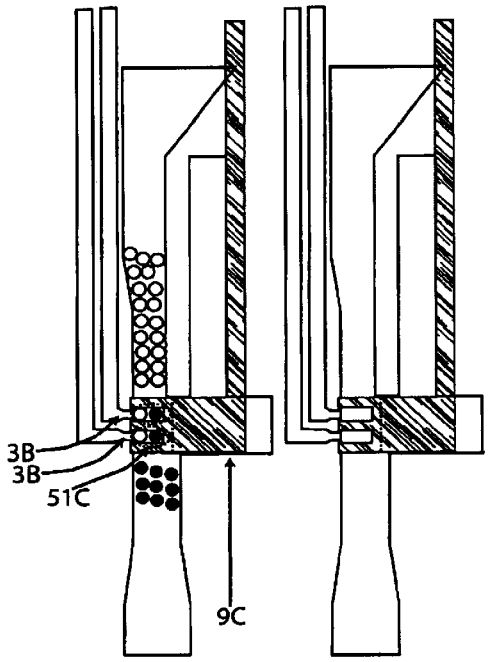
FIG. 51: Step series 5 of attachment isolation algorithm. (Top plan view showing hair channels at a point after the polymer-adhesive nozzles have each shot a burst of liquid polymer adhesive onto the hair and hair extension in each attachment chamber.)

In this step, FIG. 51 shows the pincher 9C is up against the left wall. The polymer adhesive nozzles 3B shoot a burst of liquid polymer at the hairs held together and centered in the hollow attachment chambers in front of them. The attachment chambers are formed when the pincher notches are pressed up against the left wall of the attachment area. These dotted line circles 51C represent the liquid attachment polymer surrounding the hairs and hair extensions.

Figure 52:
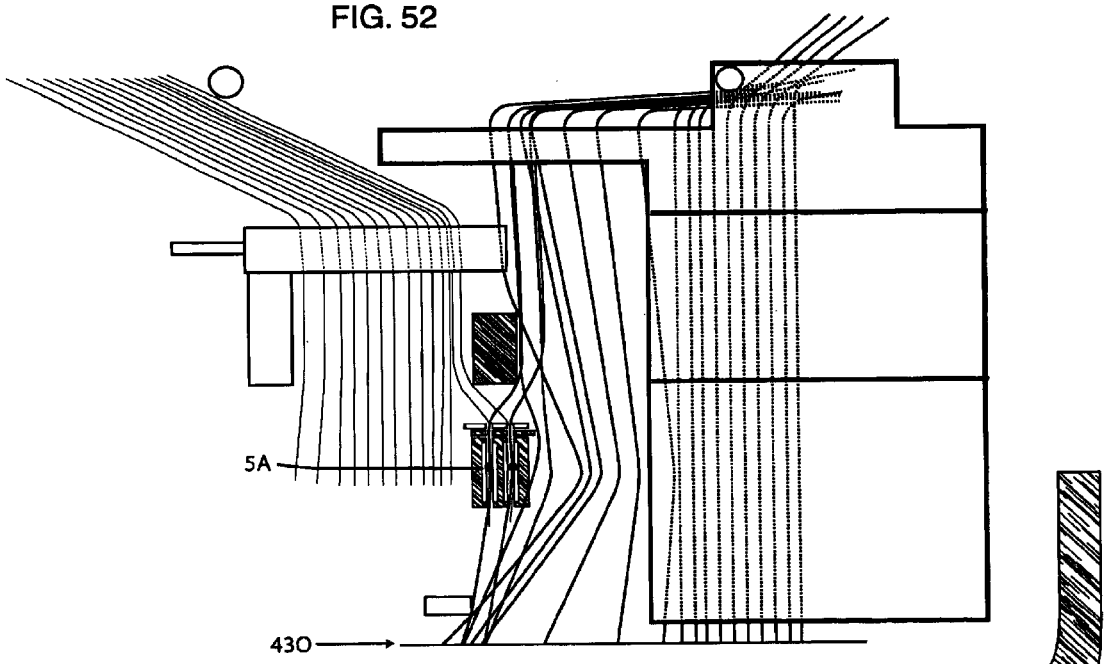
FIG. 52: Step series 5 of attachment algorithm (Left side view through the center of a representative hair-flow pathway showing the actions as shown in FIG. 51 from a different perspective.)

In FIG. 52, this step is illustrated from the left side. Notice these newly formed attachment beads 5A, shown as dark circles.

Step Series #6

Figure 53:
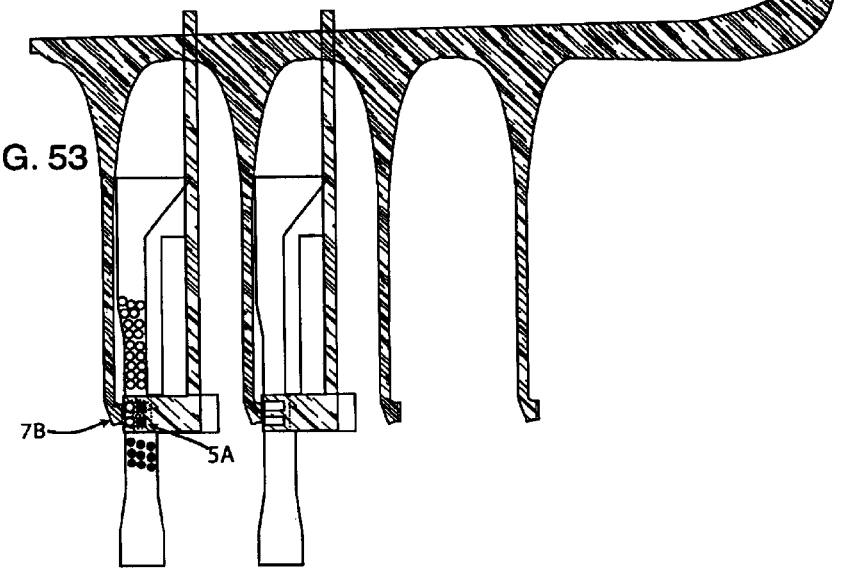
FIG. 53: Step series 6 of attachment isolation algorithm. (Top plan view showing hair channels at a point at which the UV optical pathway is used to solidify the liquid polymer beads on the hairs and hair extensions before them.)

In FIG. 53, notice the UV optical pathway 7B. This UV light source hits the liquid polymer beads 5A with a flash of intense UV light in order to harden them.

Step Series #7

Release Brake:

At this point, the straightener should release its pinch on the scalp hairs. This will allow the attachment system to advance forward over the scalp.

Pushout:

We've attached the scalp hairs and hair extension together but we still have to help these attached hairs exit the attachment system. The following explanation will explain this step. This step is best explained by using two different drawings.

Schematically from the TOP—First Half of Step Series #7 only:

In FIG. 54, the first thing that happens is that entrance gates are slid back over the hair channel, blocking entrance to the attachment area, if they hadn't been already. Next, the scalp hair pushback gates move to the right, placing them where they are in this drawing.

Schematically from the TOP—Second Half of Step Series #7 only:

In FIG. 55, we can see that the hair pincher has also moved from left to right. Although the way I've broken it down into two drawings might suggest the pincher doesn't move until the scalp-hair pushback gates have moved, this is not the case. Really, I just drew them as separate steps for clarity. Ideally, the pincher and the scalp-hair push back gates would start their journey to the right at exactly the same time. Referring to FIG. 55.1, the pincher ends its journey to the right by retracting into this pincher-retraction notch 55A, which has been formed into the right hair channel lower stationary levels. Remember that this pincher has a portion that hangs down vertically into the stationary channels as can be seen in FIG. 16–16.2.

The scalp-hair pushback gates after moving to right, as they did in FIG. 54, retract straight back away from the attachment area, to come to rest where they are in FIG. 55.

The hair-extension pushback gates move to the right, from where they were in FIG. 54, to come to rest in line with exit channel 1G, as shown in FIG. 55. Notice that when it moves to the right, it pushes the hairs in its notches to right also. The pushback gate is functioning as a pushout actuator in this step because it is pushing hairs out of the attachment area. Notice how the attached hairs 55B have been pushed so far to the right that they are lined up with exit channel 1G.

Figure 56:
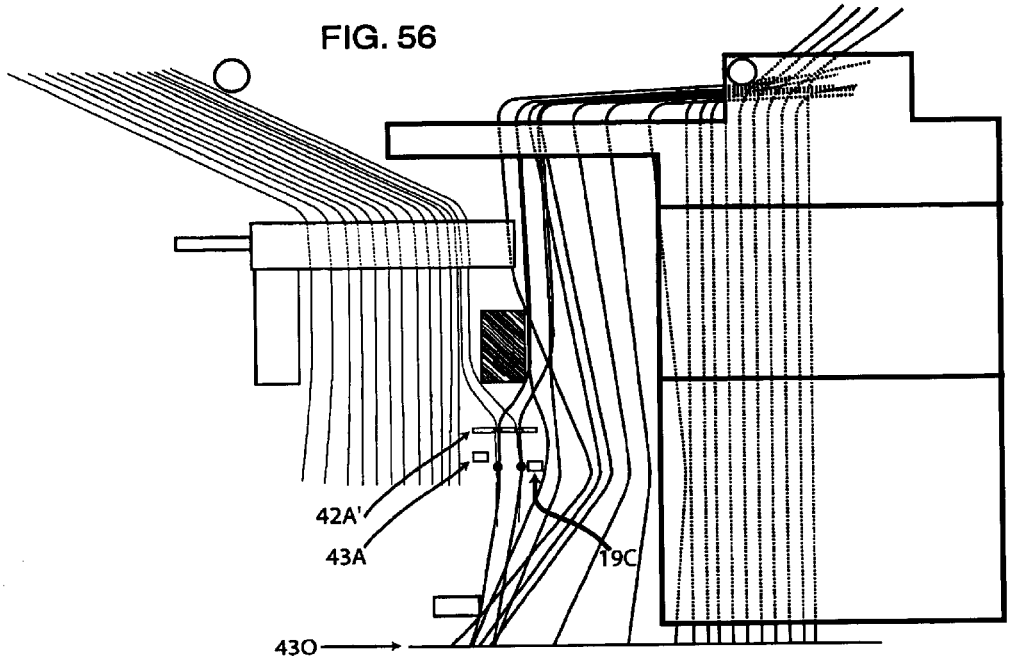
FIG. 56: Step series 7 of attachment algorithm illustrated from left side view through the center of a representative hair-flow pathway.

Schematically from the SIDE—Both Halves of Step Series #7:

The left side view of this series of steps is shown in FIG. 56. Notice how the entrance gates 43A and 19C have returned to a position where they block entrance to the attachment area. Also, notice that the scalp-hair scalp push-back gates and the pinchers are no longer in contact with the hairs, that's why they're not drawn in this diagram. Only the hair extension pushback gate 42A' is still in contact with the hairs. The hair extension pushback gate is functioning as a pushout actuator in this step. It pushes the attached hairs out of the attachment area to the exit channel.

Step Series #8

Figure 57:
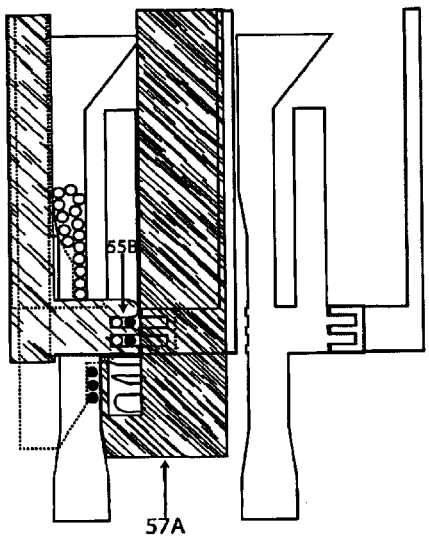
FIG. 57: Step series 8 of attachment isolation algorithm. (Top plan view showing hairs pushed completely out of the attachment area but still in the notches of the hair-extension-multiple-pushback gate. At this time, the pushback gate begins to move towards the exiting hairs.)

In FIG. 57, slightly before the hair extension pushback gate ends its journey to the right, the pullback hook 57A begins its journey timed to meet up with the pushed out hairs as soon as they have moved far enough right to allow them to be pulled back into the exit channel. This is to say that, ideally, the pullback hook should come into contact with the pushed out hairs 55B slightly before they have completely ended their journey to the right.

Step Series #9

Figure 58:
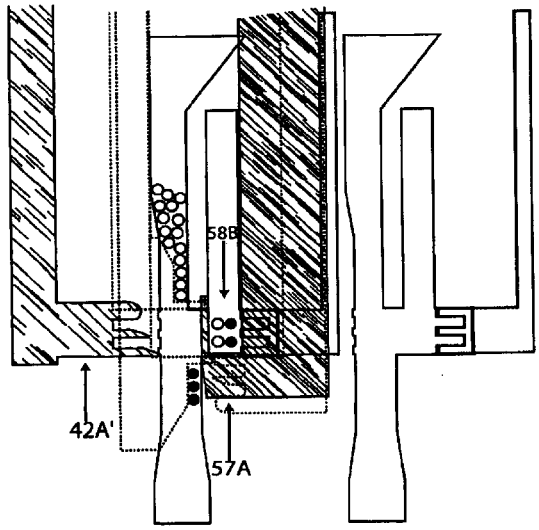
FIG. 58: Step series 9 of attachment isolation algorithm. (Top plan view showing the exiting hairs clear of the hair-extension-multiple-pushback gate and surrounded by the pullback hook at the beginning of the exit channel and heading towards its back.)

Schematically from the TOP—First Half of Step Series #9 only:

In FIG. 58, once the pullback hook 57A has surrounded the exiting hairs 58B, the hair extension pushback gates 42A' are free to move back to the left, to where they are shown in this drawing.

Figure 59:
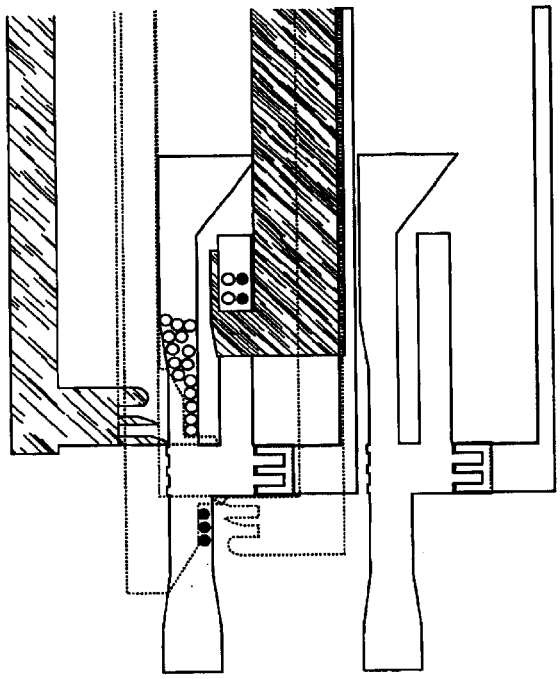
FIG. 59: Step series 9 of attachment isolation algorithm. (Top plan view showing the pullback, hook as it and the exiting hairs near the end of the exit channel.)

Schematically from the TOP—Second Half of Step Series #9 only:

As shown, in FIG. 59, the pushback gate doesn't stop its journey back. It continues straight back away from the attachment area, pulling the exiting hairs farther and farther back in the exit channel until they are engaged by the bend-under system. Once the exiting hairs are engaged by the bend-under system, the pullback gate is free to return to its original starting position. Also, notice that the hair extension pushback gates have returned to their original position.

Figure 60:
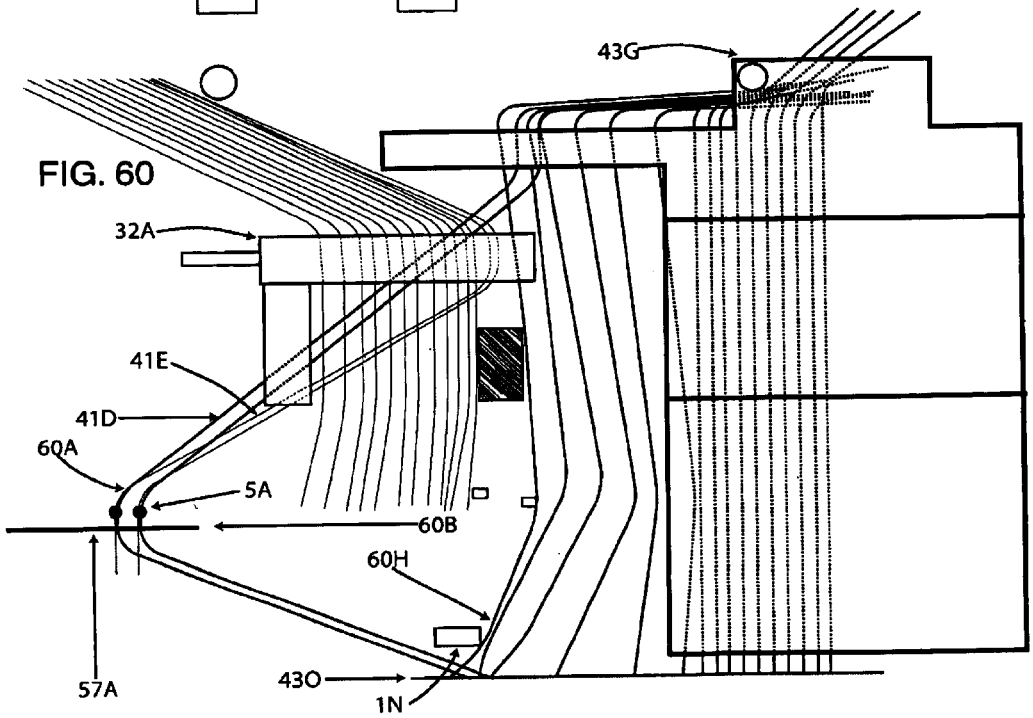
FIG. 60: Step series 9 of attachment isolation algorithm. (Left side view through the center of a representative hair-flow pathway illustrating the step shown by FIG. 59 from a different perspective. It shows how the exiting hairs and hair extensions are pulled from the straightener and hair-extension-holding clip respectively.)

Schematically from the SIDE—Both Halves of Step Series #9:

FIG. 60 shows this series of steps from a left side plan view. The exiting hair bundles 60A are being pulled back in this direction of arrow 60B by the pullback hook 57A. At the back of the exit channel, the hair bundles 60A will be handed off to the bend-under system, which will continue this backwards pulling motion of the hair bundles 60A. This allows the pullback hook 57A to move forward returning to its starting position. Notice how the attached scalp hairs 41D, shown as darkly shaded lines, and the attached hair extensions 41E, shown as lightly shaded lines, are being pulled out of the tensioning hair straightener 43G and hair extension clip 32A, respectively. Since the hair extensions 41E are attached to the scalp hairs by the attachment beads SA, they move with the scalp hairs. If the hair extensions were not attached, their tips would most likely bend over the pullback hook 57A and they would not be pulled from their holding clip.

In FIG. 60, the front edge of hair-extension-channel floor is denoted by 1H. This same front edge is also shown by 1H in FIG. 1. Referring again to FIG. 60, notice how scalp hairs 60H that originate under this floor 1H bend around it, even if their higher portions have not been allowed into the attachment area yet. This is fine because the pincher will tend to push the scalp hairs 60H that underlie the attachment area out of its way. This way these hairs will be pushed below or to the side of where the attachment process occurs. Thus, these scalp hairs will not interfere with the attachment process but, instead, will wait their turn.

Restart the Cycle Again:

We can restart the cycle again even before the pullback hook has returned to its original position or even reached the back of the exit channel. WE DO NOT HAVE TO WAIT FOR THE HOOK TO DO THIS BEFORE STARTING THE NEXT CYCLE THE NEXT CYCLE CAN START BEFORE THE HOOK FINISHES ITS BUSINESS AND RETURNS TO ITS STARTING POSITION.

Why is it Possible to Bring Addtional Hairs into the Attachment Area Before Hairs from the Past Cycles have Completely Cleared the Attachment System? the Answer Follows.

Figure 61:
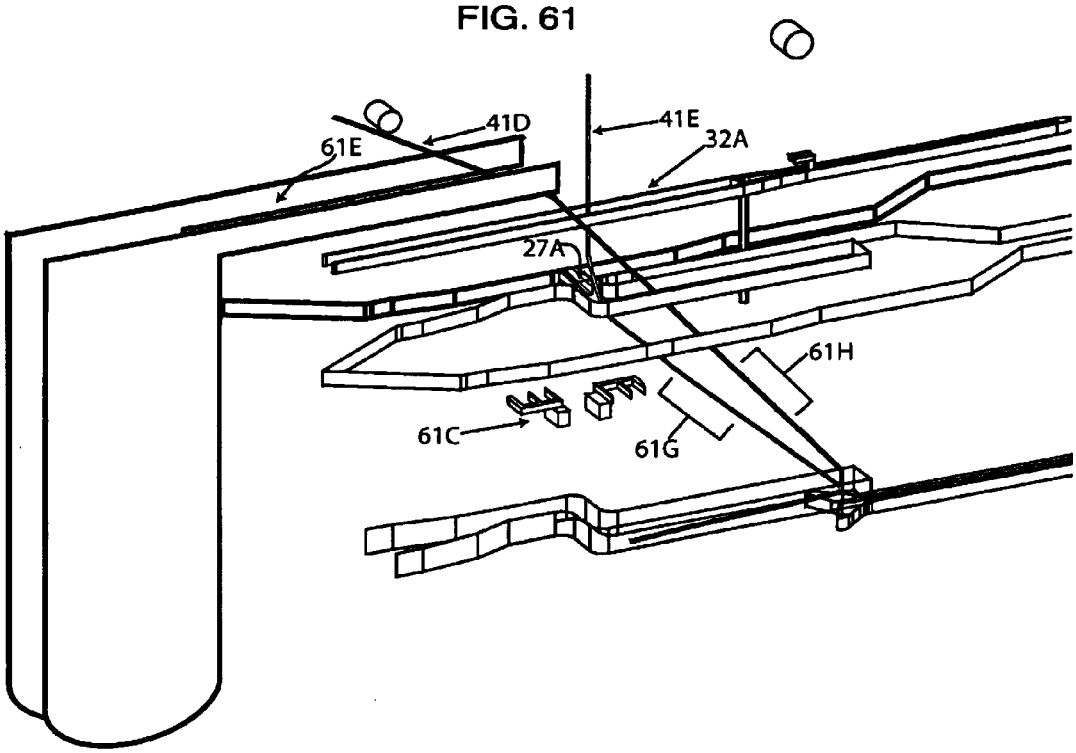
FIG. 61: Illustration of how a scalp hair is pulled from the straightener and a hair extension from its clip by the bend-under belt system. (Right side perspective view.)

FIG. 61 shows the mostly same thing, as FIG. 60, only in perspective view from the right side. The pullback hook is not shown in FIG. 61. This is because the exiting hairs have already been engaged by the bend-under system, and they no longer need the pullback hook. Notice that when the attached hair extensions 41E and attached scalp hairs 41D are pulled backwards, tension causes their lower portions 61G and 61H, respectively, to rise up at an angle. And in doing so, the attached scalp hairs and attached hair extensions get out of the way of the unattached scalp hairs and unattached hair extensions behind them, even before they are entirely pulled from the hair straightener channel 61E and hair extension clip 32A, respectively. This makes it possible for the spring-loaded hair extension clip 32A to advance forward pushing its front-most unattached hair extensions into the channel obstruction 27A, even before the attached hair extension has completely exited the clip that holds it. Also, notice how the exiting hairs 41E and 41D have been pulled clear of the functional areas 61C of the hair handling tines, so that the hair handling tines are free to meter out, and position more hairs for attachment. For visual clarity in this diagram, no unattached hair extensions or scalp hairs are shown behind the attached ones.

Note: The functional areas of the hair handling tines are defined as those specially-shaped areas of the hair handling tines, usually at their very ends, that actually touch and manipulate the hairs and hair extensions. Further, in a more abstract sense, the definition of functional area can be extended to the sides of the hair channels that actually touch and guide the hairs and hair extensions. Also, discrete areas with a specific function, such as nozzles, intakes, and dipole ends of a sensor gap, can be considered functional areas.

You may be wondering if the tops of the attached hair extensions and scalp hairs 41E and 41D, which haven't yet cleared their clip 32A and hair straightener channels 61E, respectively, won't get held up when they press against the dead end at the hair extension channel obstruction 27A.

Figure 62:
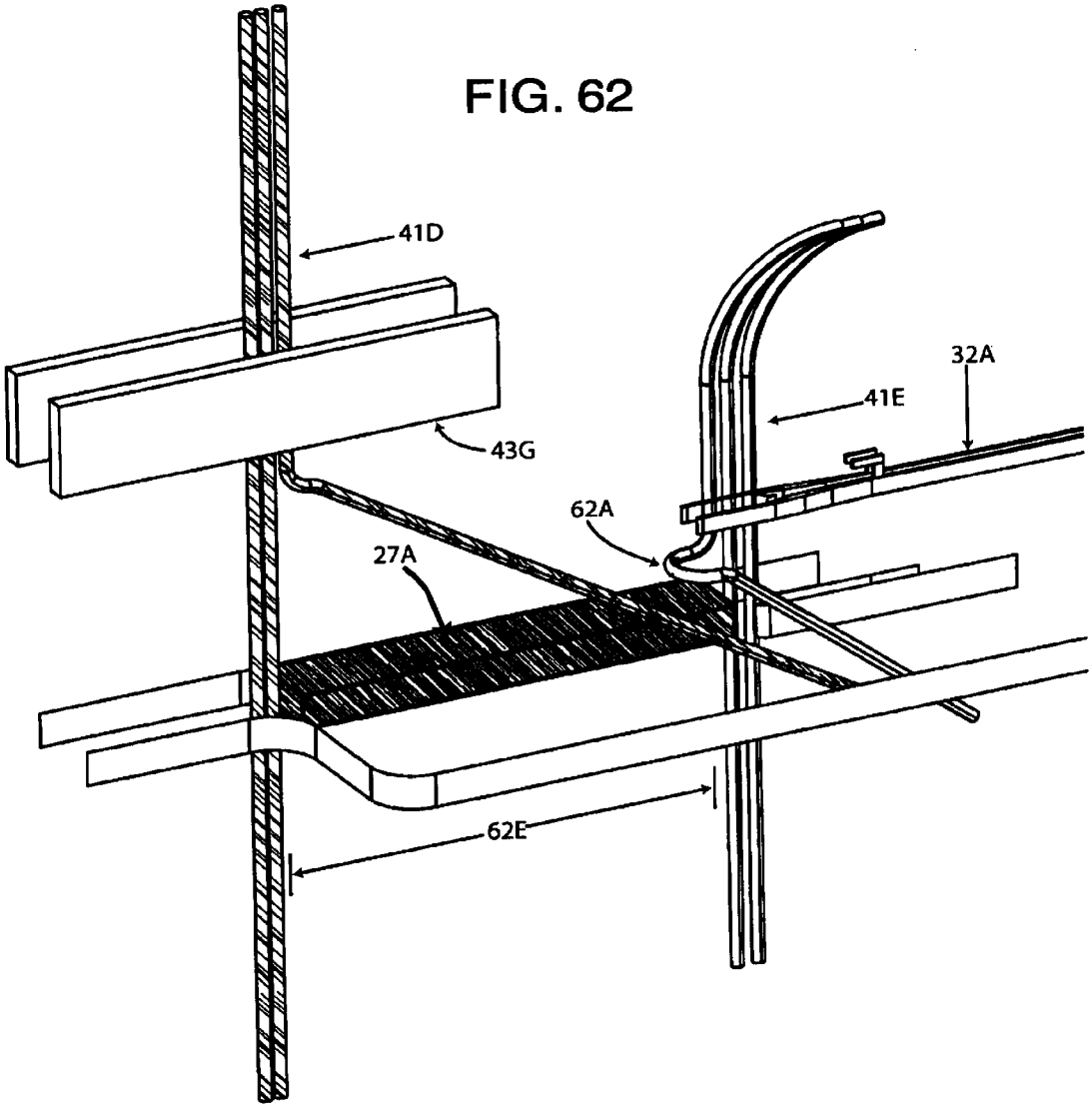
FIG. 62: As in FIG. 61 but focusing more closely on how hairs and hair extensions exit the straightener and holding cartridges, respectively. (Right side perspective view.)

The answer is no. Attached hairs and hair extensions will move around the hair extension channel obstruction 27A. To further understand how they move around it, take a look at FIG. 62. It's similar to FIG. 61, only it's a close up of the area near the channel obstruction. In FIG. 62, the exiting hairs and hair extensions that are being pulled out of the straightener 43G and clip 32A are under tension and, as such, they do not want to hang straight down, but instead, they want to become more parallel with the clips. In doing so, they are forced to move up at an angle closer to the bottom of the hair extension clips. Notice how the exiting hair extensions have a bend 62A that overhangs the hair extension channel obstruction 27A. As such, the exiting hair extensions do not press up against the hair extension channel obstruction, but instead, overhang it. This leaves the unprocessed hair extensions 41E (two shown) behind, to come in contact with both the channel obstruction 27A and the hair handlers located at the level of 62E below.

Because of this configuration, the unprocessed hair extensions 41E are free to be pushed forward into the dead end 27A, which also means they've been pushed forward far enough to be engaged by hair handlers located at the level of 62E, such. as the pushback gates.

Also, notice how a similar process is occurring with the upper ends of the scalp hairs 41D. A darker-shaded scalp hair has been attached to a lighter-shaded hair extension and it is pulled around to right of the channel obstruction 27A. This way the unprocessed scalp hairs, such as those two behind, are free to be engaged by the hair handlers, even before those ahead of them entirely exit the system. Thus, the cycle is free to start again, even though attached hairs and hair extensions from previous cycles have not completely cleared the system.

Recall, the reason we use this hair extension channel obstruction 27A is to prevent the hair extension clip 32A from advancing forward faster than the hair extensions 41E in it are used, and to prevent the scalp hairs 41D from interfering with said clip. Also note, that while the attachment adhesive is being applied by the nozzles, the pushback gates would be free to return to the metering areas along the channels and isolate more hairs at this time. This could be made possible by introducing a dedicated pushout actuator, so that the hair extension pushback gates don't need to serve this dual purpose.

How the Attachment Stack and the Peripheral Structures Connected to it are Supported.

A simplified version of the attachment circuit stack is shown in isolation in FIG. 34. However, the attachment stack can't function in complete isolation, as it's shown. Instead, it must be connected with cables, belts, and wires that support its functions. Also, it ideally should somehow be connected to a handle such that it can be moved over the scalp by a human hand. (Or in a more ambitious embodiment by a mechanical means such as a robotic arm.)

Up to this point, I have described the entire attachment circuit stack, and some peripheral structures connected to it. Now, I will discuss how these peripheral structures are themselves supported, and how a human hand can most ideally hold the attachment stack.

In FIG. 63, the entire attachment stack is shown as a single object 63A. Its individual layers have been omitted. The first thing that is connected to the attachment stack 63A is the surrounding gray structure 63B. I've named it the belt buckle because like a man's belt buckle it's rigid, planar, and attached to a longer flexible structure. The longer flexible structures that the belt buckle is connected to include cables, wires, and a linear chain of ribs that supports the bend-under belts. However, these trailing flexible structures are not shown in FIG. 63. They will be discussed later.

Notice how the attachment circuit stack 63A is seated in the center of the belt buckle 63B. To keep the attachment stack 63A and belt buckle 63B together the same bolts 39N that run though the stack's layers to help hold them together also may run through the floor of the belt buckle in order to secure the stack to it. Notice how the portions of these bolts 39N directly above the top of attachment stack have widened collars. You should assume that the bottoms of these bolts are extended through a planar floor in the bottom of the belt buckle and threaded so that nuts (not seen) can be screwed on them.

Previously, I mentioned longer flexible structures that extend from the back 63D of the belt buckle. Although not shown here, the flexible structures all lead to the support base unit. By support base unit, I mean the centralized equipment that provides support service to the hand held attachment system. For example, the type of vacuum cleaner that has a flexible hose leading from a big heavy box, where its motor and bag reside, to a small hand held nozzle could be said to have a support unit. Of course, the support unit would be the big heavy box where its motor resides because it provides suction to the handle unit. In a similar manner, the handle held attacher system could be said to have a support unit. This support unit serves various functions each of which will be described in turn below.

Solenoids/Actuators:

I have already mentioned that the hair handling tines are sliding layers that must be moved back and forth. The power to slide them back and forth is delivered through cables connected to solenoids or some other form of actuator.

As discussed earlier, there are multiple sliding hair handlers in the attachment stack, each with at least two attached cables. Two cables because the cables must be grouped in opposing pairs that PULL in opposite directions. With this many cables, each attached to its own solenoid or spring; the cables could easily get entangled with each other if some effort isn't made to isolate them from each other.

Manufacturers of bicycle brakes isolate individual brake cables in flexible tubes. Ideally, the inside surfaces of these tubes has a low coefficient of friction so that it can guide the cable around bends without generating a great deal of friction.

The actuator cables used with the attachment stack will also be isolated in tube-like structures whose internal surfaces have a low coefficient of friction. However, since there will be many such tubes required, we will use a flexible structure that has the cross-sections of many tubes parallel to each other such that they form a tube ribbon. In order to get the cables into this tube-ribbon, it may be helpful to configure the ribbon as having two snap-together halves. Referring to FIG. 64, the two halves 64A and 64A' of the cable ribbon are shown before they're snapped together around the cables 64C. FIG. 64.1 shows the cable ribbon halves snapped together. This diagram shows just one short length of such a tube-ribbon 65A, but remember the tube-ribbon is a long and flexible structure made up of many such segment-lengths.

FIG. 65 shows how two tube-ribbons 65A can be used to carry actuator cables to the attachment stack. Notice how the actuator cables 65C and 65D extend out of their tube ribbons up along the length of the belt buckle at which point they are guided around corners 65B on the belt buckle and attached to their corresponding sliding hair handler layers, in the attachment stack. The cables 65C, which are guided around corners whose curvature lies in a plane parallel to the top surface of the attachment stack, are used to slide the hair handling tines back and forth in a sideways manner. The cables 65D, which are guided around corners whose curvature lies in a plane perpendicular to the top of the attachment stack, are used to slide hair handling tines in a front and back direction.

Cables and Wires which Serve as Conductive Pathways:

Various types of energy might be conducted along pathways between the support base unit and the attachment stack. For example, ultraviolet light could be conducted along fiber optics in order to supply the attachment stack with the UV it needs to harden the adhesive polymer beads. Either light, which requires fiber optics, or electricity, which requires conductive wires, must be carried in sensor circuits in order to detect the presence of hairs. Also, if individual polymer adhesive nozzles are configured to operate independently of each other, then the best way to achieve this is to use electricity to power the ejection of liquid adhesive beads. The most likely ways electricity would be used, in this manner, is to cause a vapor burst by heating up a liquid with electrical resistance or the actuation of a piezo-electric device in the nozzle regions. Certainly, in such configurations, there would have to be many individual wires to form independent electrical circuits.

In the case of delivering UV to the polymer hardening system, one bundle of fiber optics would be sufficient. This is because it's fine if all UV outputs are turned on at once. FIG. 66 shows an example of such a single fiber optic cable bundle 66A. Notice how said bundle interfaces with the back of the UV conductive prism 66B. In FIG. 66, a side of the belt buckle has been made transparent so that the UV conductive prism in its interior can be seen.

However, in the case of isolated circuits, whether they are for sensors or jet nozzles, many different wires or fiber optic cables will have to be used. At the point where these cables or wires reach the attachment stack, they will have to be connected to it at precise points that match the wires up with their corresponding circuits in the attachment stack. FIG. 67 shows how this could be done. Multiple cable or wire ribbons 67A should be connected to a contact card 67B. The wire or cables attach to the top surface of the contact card. Electricity or light from these wires or cables is conducted through independent conductive patches that run vertically though the contact card.

Figure 68:
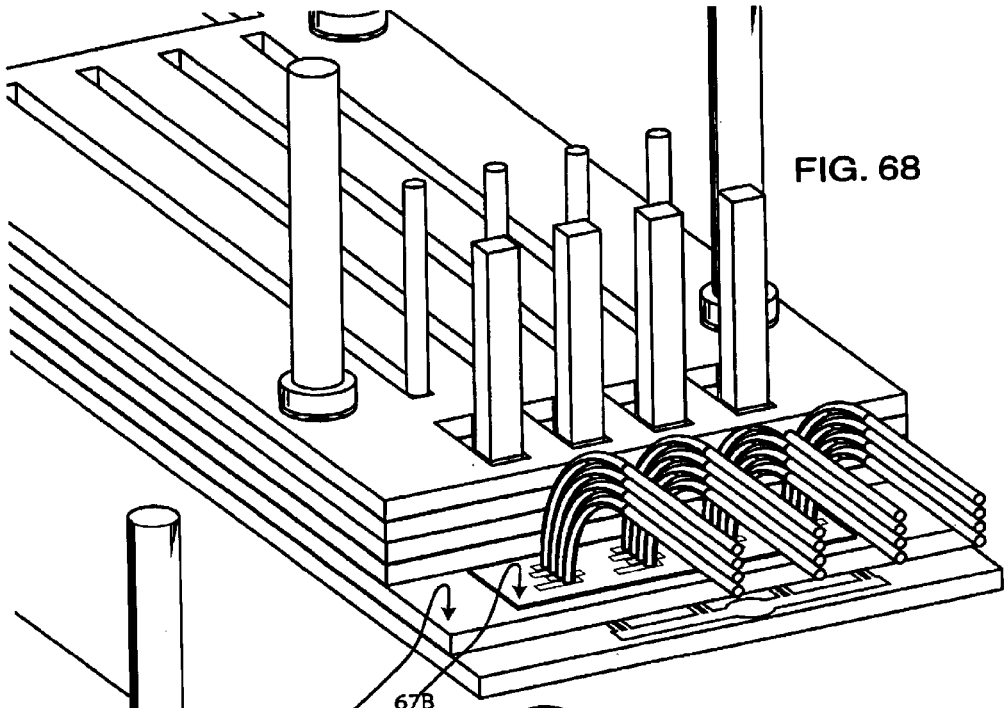
FIG. 68: Contact card connected with attachment stack. (Top back perspective view.)

Referring to FIG. 68, the contact card 67B is shown mated with the matrix of circuit contacts on surface 68A which extends from the back of the attachment stack. Notice how the contact card allows all the wires to be attached as a unit to the circuit contacts on the attachment stack. Whether optic cables carrying light or wires carrying electricity, the contact card approach should be applicable.

Figure 69:
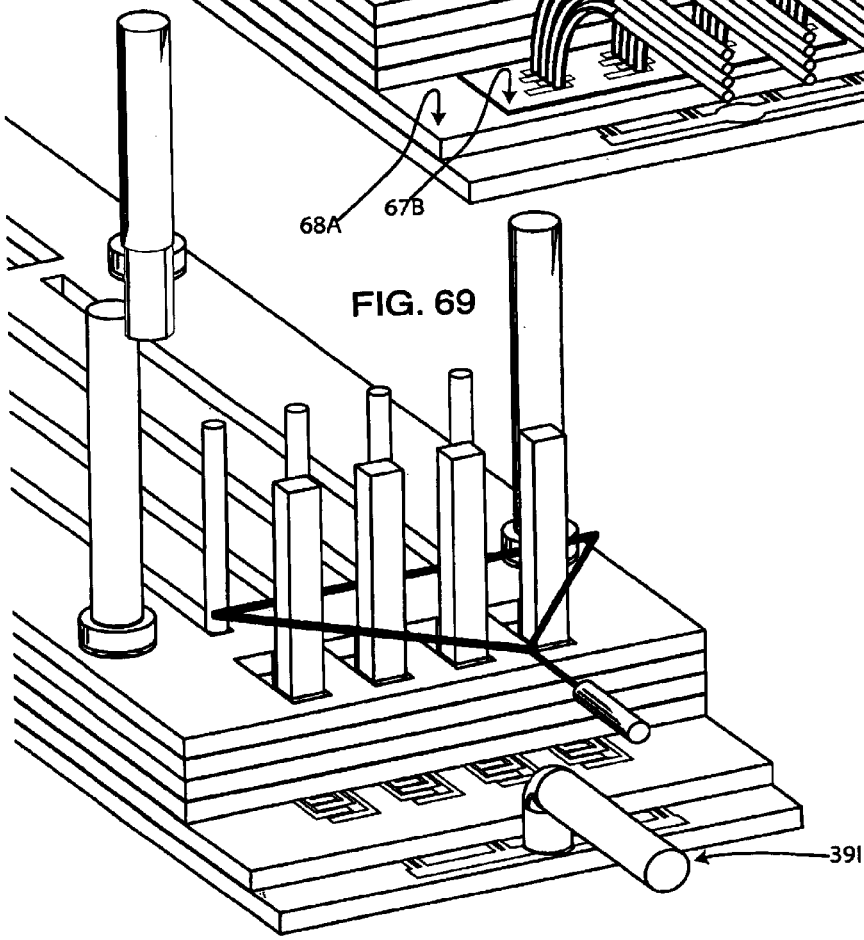
FIG. 69: Adhesive supply line connected with attachment stack. (Top back perspective view.)

Hoses to Carry Gases and Liquids:

Referring to FIG. 69, the adhesive liquid polymer is delivered to the attachment stack by hose 39I, which runs from the base unit to a hole in the back of the attachment stack. Assuming individual control of the jet nozzles is either not necessary or achieved by using individual electrical circuits, then only one hose will be needed to carry liquid polymer to the attachment stack. Within the attachment stack, the liquid polymer from this one hose will be distributed among the individual polymer nozzles.

If individual control of the polymer nozzles is achieved by giving each nozzle its own line whose pressure bursts are generated by a pneumatic means in the base unit, then it would be necessary to lead individual hoses to the attachment stack. These individual hoses would ideally take on a ribbon configuration and interface with the attacher stack with a contact card configuration. However, individual pneumatic control is probably not the preferred embodiment to use.

In an embodiment which requires gas or another liquid to be blown or sucked, then further hoses connecting the attachment stack with the base unit will be used. In such an embodiment, additional levels with hose-receiving holes would extend from the back of the attachment stack in a similar stair-step pattern.

Figures 70, 71:
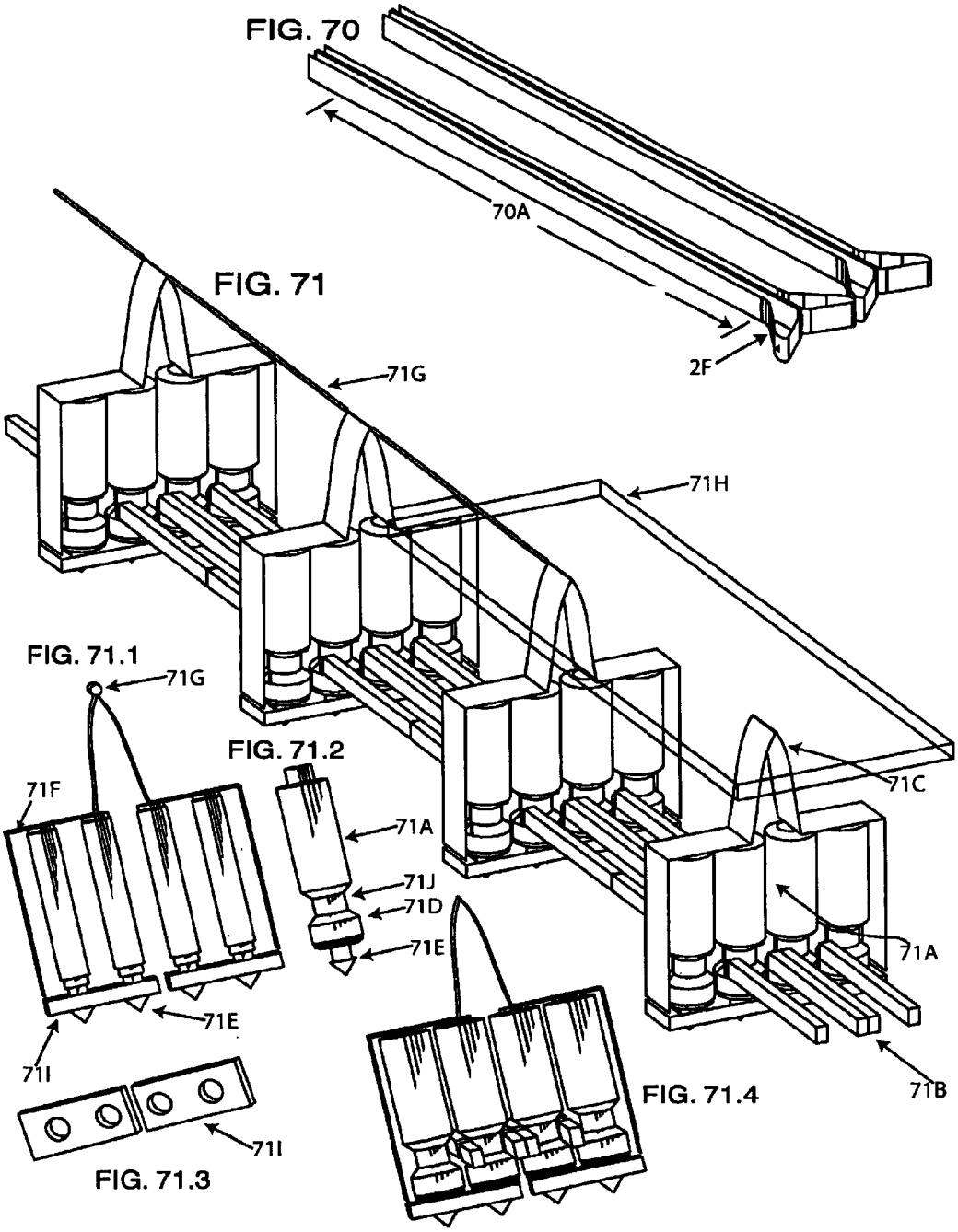
FIG. 70: General form of bend-under belts shown in isolation. (Top-front-left perspective view.)
FIG. 71: Belt-pulley ribs shown supporting trailing segment of bend-under-belt assembly in isolation (Top-front-left perspective view.)

Belt Pulley Ribs Support the Bend-Under Belts:

Previously, in FIGS. 2–2.2, I introduced bend-under belts as a way to prevent hairs from piling up in the attachment system. However, I didn't explain how these belts are supported. I will do that now. FIG. 70 shows two bend under belt pairs. Each bend under belt pair is composed of two opposing belts pinched together and moving in the same linear direction. The two belts of each pair converge at 2F where they pinch hairs between them and carry those hairs with them. Although no support structure is shown in FIG. 70, any support structure for such belts should ideally have the following qualities:

1. It should pinch the two belts together.
2. It should hold the belts in a way that they are free to move with very little friction.
3. It should hold the belts in a way that they don't fall loose of whatever is holding them.
4. It should neither obstruct the movement of hairs carried by the belts nor prevent the hairs from falling free of the belt assembly when said hairs are pulled from said belt assembly under tension.

FIG. 71 shows a short segment of a support structure with such qualities. It's made up of joined ribs. I call each rib a pulley-rib. Each rib has got these four cylindrical structures 71A, which pinch the two belts together in the middle 71B of the assembly. Notice how this arched shape 71C has a spring-like quality that helps pinch the belts together in the middle. This allows the belts to pinch hairs. between them and carry the hairs. Further, in FIG. 71.2, the cylinders 71A widen near their tips 71D so as cradle the belts, in a notch 71J, and prevent them from escaping. Finally, if you look closely, you'll see that the cylindrical objects 71A have a second cylinder 71E running through their hollow centers, which serves as an axle. This allows the cylinders to act as rollers that convey the belts with very little friction. Naturally, the inner surface of these rollers and outer surface of their axles should both be made of a low coefficient of friction material such as Teflon or even employee bearings.

Referring to FIG. 71.1, four of these axles 71E and the arched shaped spring means 71C are molded as one plastic rib 71F. Many of these plastic ribs are joined together as a single molded part by a long flexible rod 71G. This long flexible molded part is attached to or molded as a single part with a portion 71H of the belt buckle. In order to hold the belt rollers 71A, in FIG. 71.2 in place, planar parts 71I (FIGS. 71.1 and 71.3) with ideally chamfered holes could be snapped onto the tapered tips of the axles 71E under the rollers. Segments such as these should be placed along the length of the belt assembly to hold its belts in place along its route between the base unit and the attachment stack.

Figure 72:
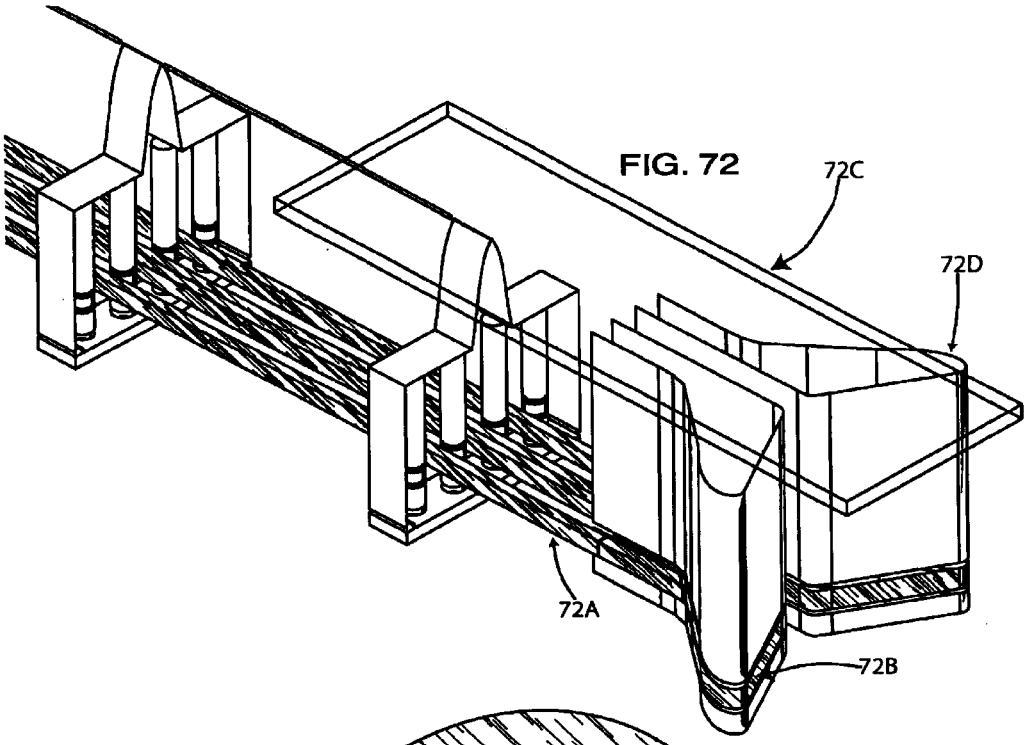
FIG. 72: Bend-under belt assembly's funneling front relative to its pulley ribs. (Top-front-left perspective view.)

The previously described pulley-rib support structure supports the two belts in areas where they are pinched together and parallel, such as along arrow 70A in FIG. 70. However, the converging funnel-shaped area 2F needs a different kind of belt support structure other than the pulley-rib type. The funnel-shaped area needs belt supports that look more like those shown in FIG. 72. This support cradles the belt 72A in its notched shaped area 72B while it guides it around in a curving funnel shape.

We've discussed how these components support the belt, but what supports these supports themselves? The answer depends on the point along the length of the belt assembly. For example, in FIG. 72, the funnel shaped support 72D and a few of the pulley-ribs behind it are connected such that they hang down from bottom 72C of the belt buckle support structure. The bottom of the belt buckle is shown as a transparent block 72C, in this drawing.

In FIG. 63.1, the belt buckle assembly is shown from a left side plan view. The object 2E is the bend-under system assembly. Notice how the bend-under assembly 2E extends down from the very bottom of belt buckle 63B. Since the belt buckle is itself rigid, it holds those pulley-ribs attached to its undersurface in a straight inflexible path.

However, the belts are most likely driven by motors in the base unit, which are most likely several feet away. Consequently, the belts should ideally be connected to the base unit in a flexible manner. Thus, the pulley-ribs that pinch the belts together should be attached to each other in a flexible manner where flexibility is needed. As such, individual pulley-ribs are connected together as shown in FIG. 71. Notice how the individual pulley-ribs are connected at their tops by a flexible rod structure 71G. As a result, the belt assembly is inflexible directly under the belt buckle undersurface 71H but extends from the belt buckle as a flexible structure that leads to the support base unit.

Figure 73:
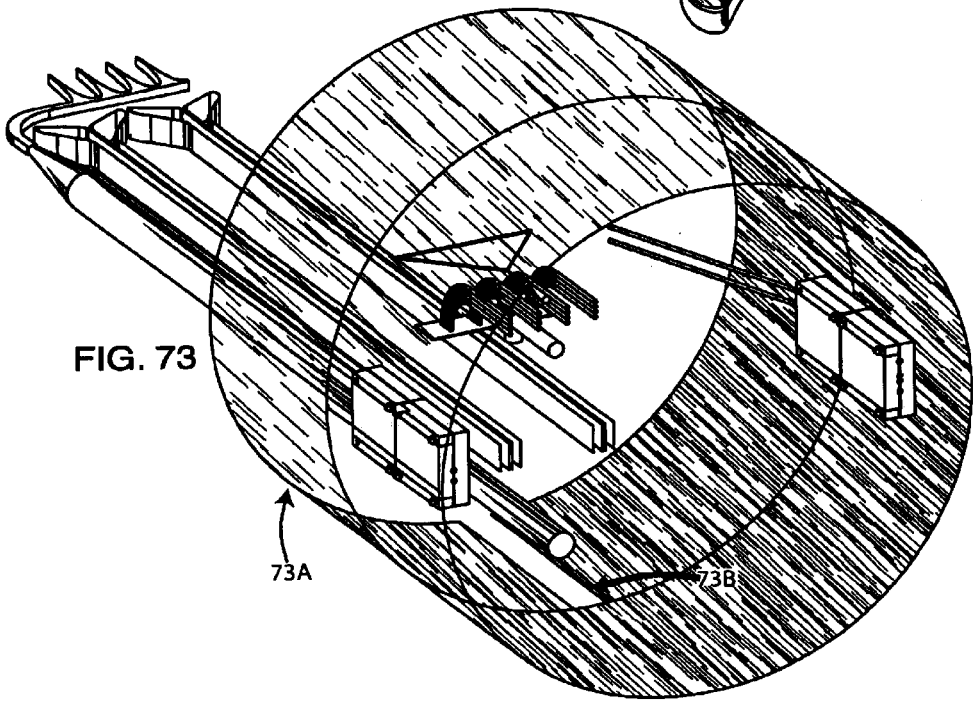
FIG. 73: The various structures that connect to the attachment stack shown relative to each other with the attachment stack made invisible. (Top back perspective view.)

Above, many flexible means of connecting the base unit with the attacher handle unit were described. In FIG. 73, many of these things are shown all together. To increase clarity, the attachment stack is invisible in this drawing. However, you should think of everything shown as connecting to or near the attachment stack. In order to consolidate these various hoses, cables, wires and belts, we could run them all though one large flexible enveloping hose 73A that surrounds them all. This enveloping hose 73A is shown as an outline. Although this drawing only shows one short segment of it, really, it is a long flexible structure very likely several feet long.

Either the enveloping hose should remain open with a slit on its underside 73B, as it shown here, or the bend under belts must remain outside of it until a sufficient distance from attachment stack where the hairs carried by the bendunder belts have been dropped. This is to say the scalp hairs in the bend-under system should be free of obstructions between themselves and the surface of the human head.

Figure 74:
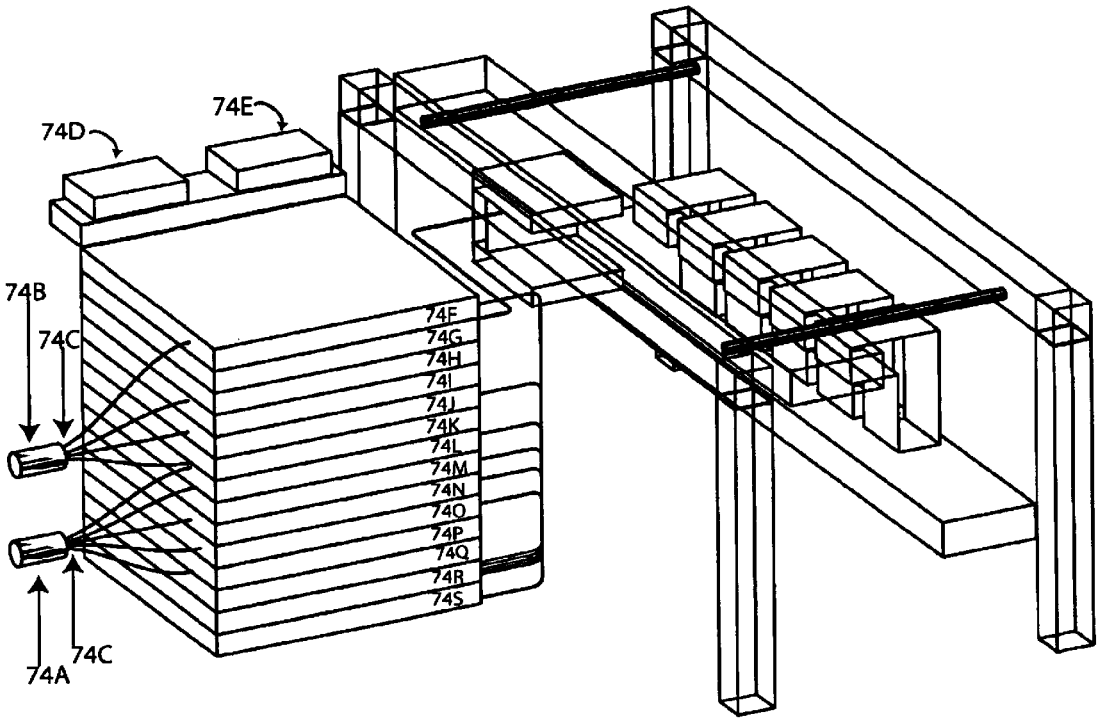
FIG. 74: Base unit that contains the support equipment for both the attacher and remover handle units that are connected to it. (Top-front-right perspective view.)

In FIG. 74 of the base unit, we see enveloping hoses 74A and 74B coming in from both the hair extension attachment and removal (not discussed yet) units, respectively. Also, we can see the various flexible lines 74C including hoses, cables, wires, and belts coming back out of their enveloping hoses and going to the functional areas of the base unit that serve them. The various levels of the base unit represent different functional areas within it. The structure to right of the base unit has yet to be discussed. For now, just realize it is where removed (from the head) hair extensions are taken and placed into clip cartridges held before them on docks. This filling of clip cartridges is accomplished by a mechanism that moves from one docked cartridge to the next, most likely laterally.

Additionally, the base unit has the following components:

74D: HOME Reversing Filler
74E: Advance Filler 1 notch
74F: Passageways for Remover's Suction Hoses
74G: OUTPUT belts for Transferred Hairs (to filler) & Wheels
74H: Vacuum Hair Transfer Chamber
741: INPUT belts for Removed Hairs & Drive Wheels
74J: Remover's Solenoids
74K: Remover's belt passageway & Drive Wheels

Figure 75:
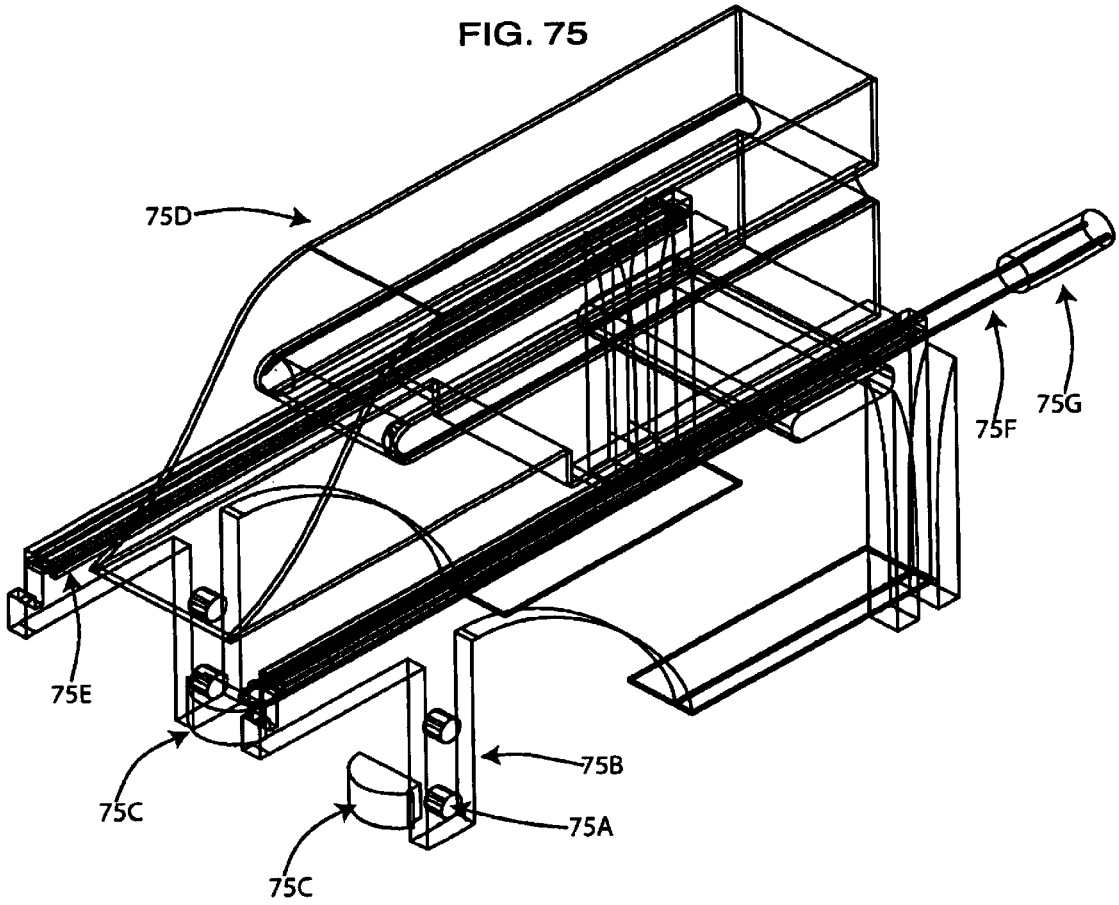
FIG. 75: Handle unit's outer frame. (Top-front-right perspective view)

74L: Attacher's adhesive hose passageway
74M: Attacher's Solenoids for Sliding Tined Channels
74N: Attacher's Sensor & Jet Electric Wire. Passageway
740: Attacher's UV Fiber Optics passageway
74P: Attacher's Pullback Belt's Drive Wheels
74Q: Belt Drive Motors and Primary Pulley System
74R: Vacuum Source/UV Source/Control Electronics
74S: Shelf for insertion of containers of UV Adhesive Handle Structure for the Attachment Stack-Belt Buckle Assembly:

Previously, I've described the attachment stack and the belt buckle that supports it, but the user must hold the belt buckle itself. FIG. 75 shows a perspective view of the handle unit outer-frame. The handle unit outer-frame may also be referred to as the handle unit or handle although handle unit might also refer to the entire handle unit assembly belt buckle, attachment stack, and all. It is the handle unit that the user will use to hold and move the attachment stack assembly through the hair. Notice the lower holes 75A through the stilts 75B of the handle unit. The peg 63F, shown in FIG. 63, projects from the belt buckle and inserts into the lower holes 75A, shown in FIG. 75, in order to attach the belt buckle to this handle. This peg-in-hole connection serves as a rotational hinge. Ideally, the centers of these pegs should lie along a line that intersects the attachment areas of the attachment stack. This will ensure that the attachment areas are held the correct distance above the scalp regardless of the rotational angle of the belt buckle. Alternatively, the belt buckle might be attached to the handle structure by a flexible yielding means such as spring rather than a hinge. Ideally, this yielding means would allow the belt buckle to follow the shape of the scalp while keeping the attachment area at a relatively constant distance above the scalp.

Also, notice these humps 75C in front of the lower peg connection hole. Their purpose is to push hairs out of the way so said hairs don't get caught in the peg-in-hole connection area.

Notice the top of the handle unit is a separate piece. This separate piece forms a canopy 75D that can slide on tracks 75E. Notice that this picture shows a cable loop 75F delivered inside of a tube 75G. This cable loop is used to automatically open the canopy when changing hair extension cartridges. Since the canopy slides forwards to open and backwards to close, it sweeps the long ends of the stored unattached hair extensions backwards and out of the way of the user's hands and front of the attachment stack. In other embodiments, the canopy might move out of the way rotationally (especially forward) or simply by being removed. Although embodiments that have no protective canopy are a possibility, it is best to make sure the long ends of the unattached hair extensions have a concave notch or compartment to reside in that keeps them out of the way of the user's hands and the front of the attachment stack.

Figure 76:
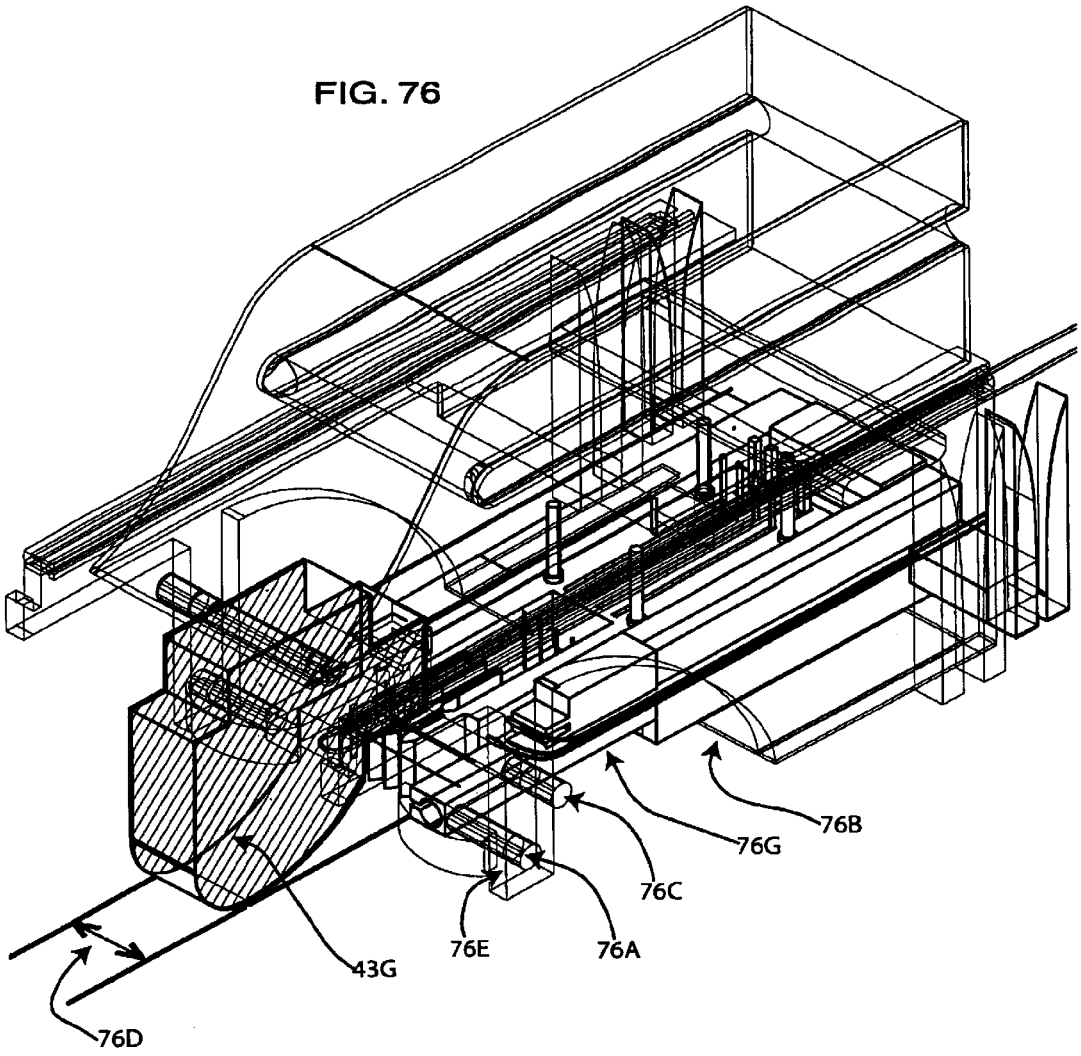
FIG. 76: Belt buckle attached to handle unit. (Top-front-right perspective view)

In FIG. 76, the belt buckle is shown attached to the handle unit. Notice that the peg-in-hole connection 76A permits the belt buckle to rotate relative to the handle. However, the belt buckle is prevented from rotating too far downward past horizontal the by shelves 76B which project inward from the bottom of the handle under the belt buckle 76G.

Figure 77:
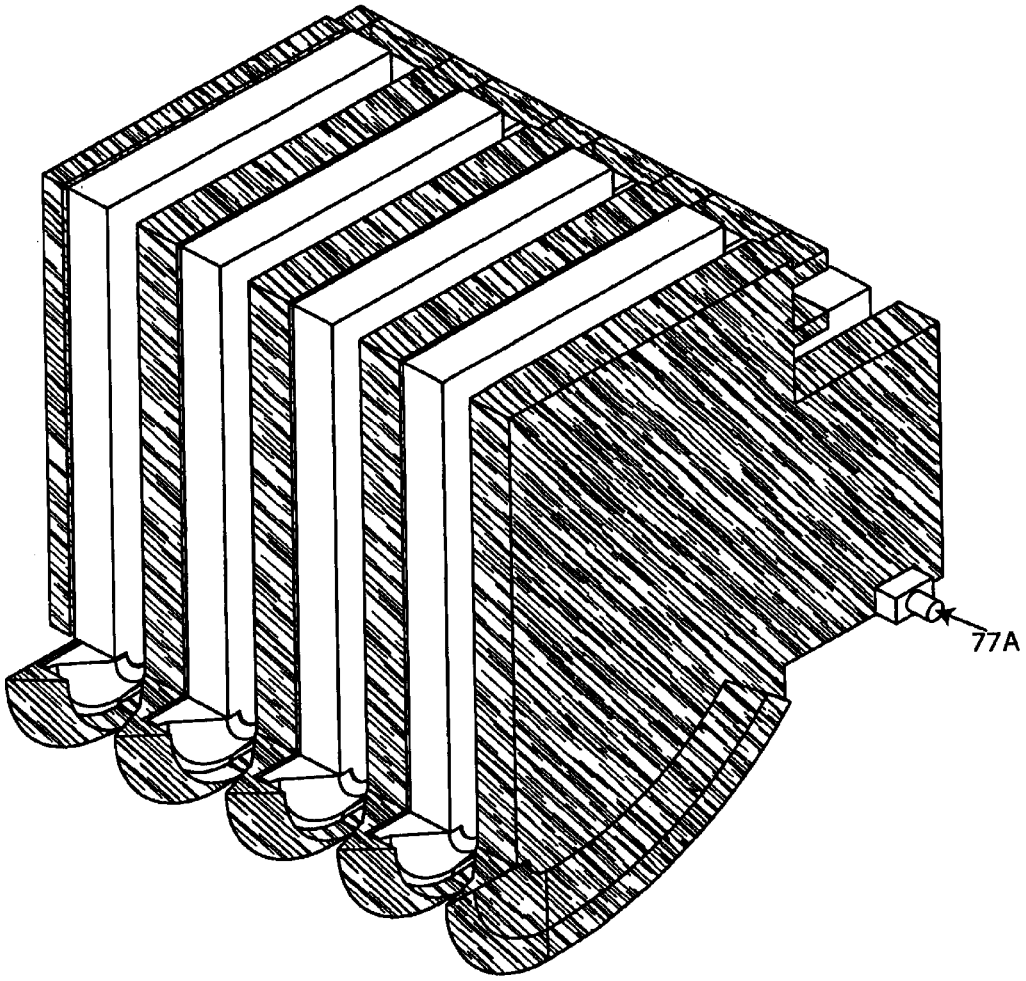
FIG. 77: Hair straightener in isolation. (Top-front-left perspective view.)

Although I still haven't explained how the tensioning hair straightener works, FIG. 77 shows what its exterior looks like. Notice how the straightener has a peg 77A, similar to the one the belt buckle has. Said peg will allow it to be rotationally attached to the handle unit.

In FIG. 76, the straightener's peg connects to the handle through the second set of holes 76C that lie above the holes used by the belt buckle to connect. Just as the belt buckle's peg in hole connection allows rotation, so too does the straightener's.

FIG. 78 illustrates how both the attachment stack-belt buckle assembly 76G and the tensioning hair straightener 43G rotate to follow the curvature of the scalp 78C. FIG. 78 shows relative position over flat scalp areas, FIG. 78.1 over convex scalp areas 78C" and FIG. 78.2 over concave scalp areas 78C". Especially, notice how some part of the straightener always maintains contact with the scalp. This allows the straightener to grab even hairs that are lying flat on the surface of the scalp and lift them straight up and perpendicular to the scalp, like corn in a field. Also, notice that the portions of the belt buckle near the pivot 63F always remain the same height above the scalp although the rearward portions might have a great deal of height variability.

FIG. 79 shows the entire handle unit being held by a human hand 79A. Notice the tensioning hair straightener 43G and the belt buckle assembly 76G. FIG. 79.1 shows how the handle unit is held by a human hand and guided over the scalp between the tracks of the track-guide cap 79D. In FIG. 79.1, notice the hair extension clip cartridge 32B and the hair extensions 41E that it is holding.

Scalp Hair Tensioning Straightener.

Figure 80:
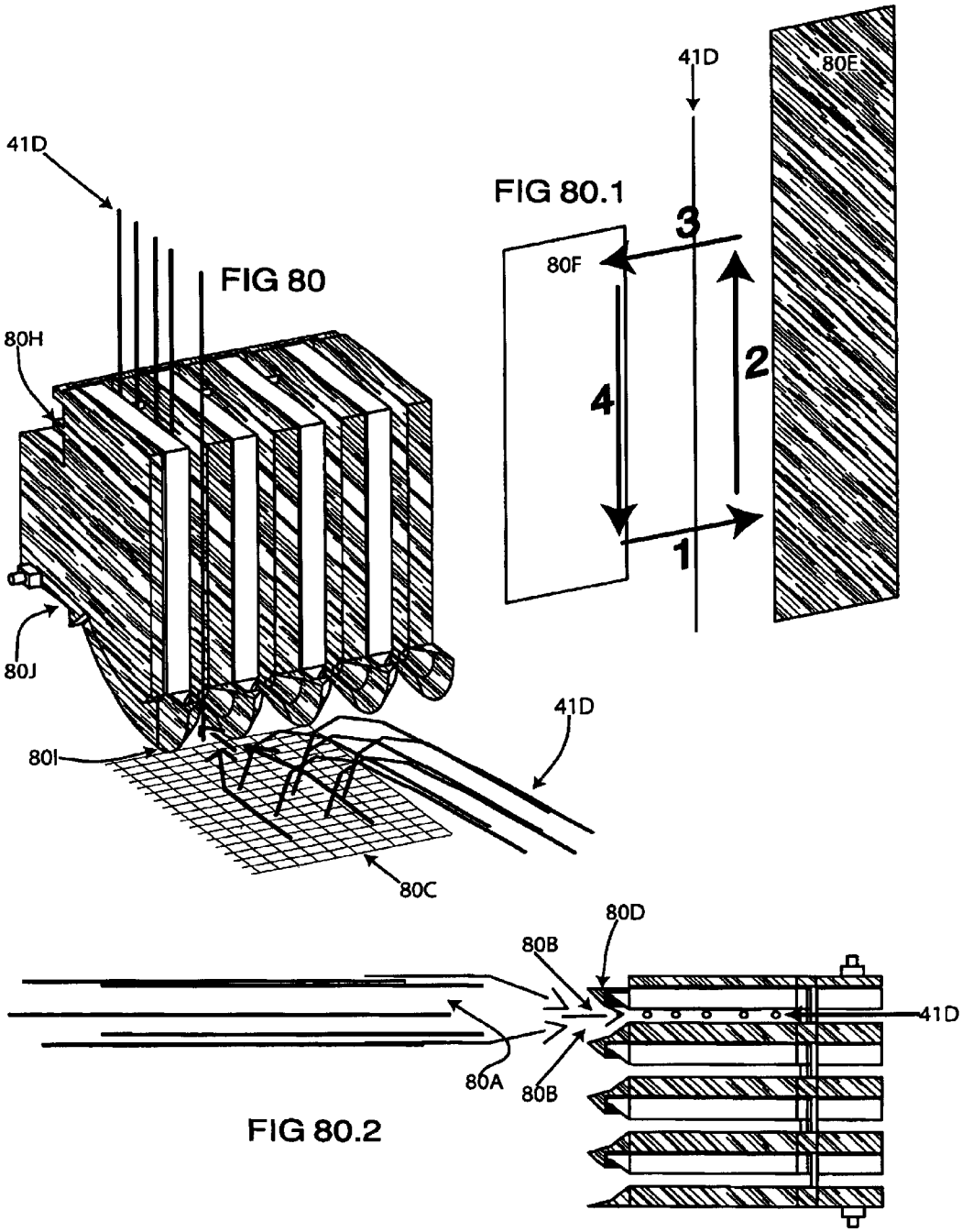
FIG. 80: The straightener shown in isolation running over the surface of the scalp. (Top-front-left perspective view.)

FIG. 80 illustrates the tensioning hair straightener itself. It picks hairs 41D up and, under tension, straightens them away from the scalp.

In the plan top view in FIG. 80.2, notice that the straightener has funneling channels. As these funneling areas 80D narrow, scalp hairs 41D are forced between them into the narrow pathways, as shown by the arrows 80B.

In the perspective view in FIG. 80, once again, notice how its front encounters the scalp hairs 41D first and funnels them into thin channels. The scalp is represented by 80C. Also, notice how the straightener is composed of lightly-shaded tines and darker-shaded tines.

The perspective largely front view in FIG. 81 shows only the lightly-shaded tines alone. In the largely rear view in FIG. 81.1, we can see that all the lightly-shaded tines are connected to each other, by a connectivity bridge 81A at their backs.

The largely front view in FIG. 82 shows only the darker-shaded tines alone. In the largely rear view in FIG. 82.1, we can see that all of the darker-shaded tines are connected to each other, by two connectivity bridges 82A and 82B at their backs.

Thus, in FIG. 80, all the lightly-shaded tines can be moved as a unit while all the darker-shaded tines remain stationary as a unit. The exact actuation mechanisms that move the tines are a detail that's not important for this discussion. What is important is the path that the tines are moved along.

FIG. 80.1 illustrates the movement scheme that is used to get the tines to first pinch and then lift hairs up straight. As the arrows indicate, the darker-shaded tines 80E remain still. The lightly-shaded tines 80F are moved sequentially along the pathway indicated by the arrows #1–4. First, the lightly-shaded tines 80F are moved towards the darker-shaded tines 80E as the bottom arrow #1 indicates. This narrows the channels and pinches hairs 41D between the lightly-shaded tines 8OF and darker-shaded tines 80E. In order to lift the hairs, the lightly-shaded tines are raised up along the arrow #2. In order to repeat the process, the lightly-shaded tines must back away from the darker-shaded tines and then lower, as shown by arrows #3 and #4. This is a process that occurs repeatedly and rapidly so that hairs do not have time to fall back down while the lightly-shaded tines are backing away and lowering themselves.

Please note, that the tines 80E themselves needn't move and in this particular embodiment don't, although in other embodiments both sets might move. In this embodiment, since the tines 80E don't move, it is they that rest on the scalp. As shown, tines 80F might be nested within tines 80E so that tines 80E never touch the scalp. Alternatively, tines 8OF at their lowest positions might touch the scalp.

Referring to FIG. 80, the connectivity bridges 80H, which hold the straightener's tines together, are placed up where they're out of the way of the lower portions of the hairs which are being pulled straight. The connectivity bridges are a certain height above the scalp. Hairs longer than this height will only be pulled straight to the height of the connectivity bridge, which is all that's necessary. Portions of hairs that are longer than the bridge is high will be forced to bend under the connectivity bridge rather than being pulled straight. This too is acceptable. We don't need each entire hair to be straight, only the area near its roots where we're attaching a hair extension to it.

Also, notice that only the portion 80I towards the front of the straightener is low enough to touch the scalp. We only need one point of the straightener to touch the scalp where it can pick up any hairs lying flat against the scalp. After the hairs have been picked up away from the scalp, they will continue to be pinched, held, and straightened by trailing portions 80J of the straightener, which needn't touch the scalp. The main reason that the straightener is so far above the scalp in its back regions is because the attacher circuit stack and its belt buckle must be able to fit under the rear end of the straightener. Remember that the purpose of this straightener is to feed the attachment stack with straight hairs held under tension. To do this, it has to run in front of the attacher and it will do its job better if it also overhangs the attachment stack so that hairs remain straight under tension all the way back until they're attached.

Of course, there are other ways of straightening hairs away from the scalp, other than a device exactly like the one shown. For example, a vacuum nozzle could be placed over the hairs to suck them straight up. Similarly, air-blowing nozzles could be placed near the scalp to blow hair straight up. The problem with these other methods is that they're likely to pull the dangling hair extension tips upward which is undesirable. Furthermore, hairs that are being blown or sucked by air currents, typically, could not be put under as much tension or held as stable as hairs could be by a direct contact mechanical straightener. Holding hairs under tension is especially crucial for tightly curled hair.

Also, don't forget that this straightener might be used to clamp down on hairs and prevent forward movement of the attachment system during the application the adhesive polymer beads.

Use of a Track-Cap to Guide Overhead Movement

Before hair extensions are attached or removed, a set of tracks is placed on the head. FIGS. 83 and 83.1 shows what these tracks look like on the scalp. These tracks might be made out of a rigid plastic that has been custom-molded to fit a specific person's head. Alternatively, the tracks could be pre-manufactured in several standard sizes. Notice that these tracks are all attached into a single piece that can be placed on the head like a helmet. Thus, I give such a set of tracks the name track-cap. The tracks are all spaced the same width from each other at all points. Their spacing width is equal to the width of the attachment circuit stack, or its processing swipe width to be more exact. The exact method used to custom form these tracks to the human head isn't important right now. For now, just know that, if a custom fit is desired, we form a flexible plastic to the contours of a specific person's head and then chemically treat it such that it becomes a rigid plastic that retains its shape. Once this track-guide cap is formed it can be used many times on the same person.

Notice how the areas between the tracks form several rows over the scalp. Recall that the attachment circuit stack holds the hair extensions it is going to attach in clip cartridges. The system will likely use one clip cartridge for every track-row of scalp. This is to say, every time the attachment stack gets to the end of a track-row, it is picked up off of the scalp and its hair-extension cartridge should be near empty so it will be removed, and a new full hair extension cartridge will be placed on the attachment stack; the system will be run through the next row of scalp.

As shown in FIG. 76, because the belt buckle and handle are wider than the attachment stack itself, their width will also be greater the track's width 76D. For this reason, the vertical portions 76E of the handle will serve as stilts, which lift the outer margins of the belt, buckle above the tracks.

The tensioning straightener 43G should be made to fit precisely between the tracks such that it can fit down between the tracks and touch the scalp. The straightener should fit snuggly between the tracks so that the fit between the tracks and straightener guides the entire handle unit over the scalp. Additionally, a snug fit will allow the straightener to scrape any hairs pressed up against the tracks away from them and into it. In practice, the straightener might be just slightly wider than the inner-surfaces of the tracks. This way it will push the tracks slightly apart allowing any hairs whose roots originate under the tracks more direct access to the attachment stack. In other words, such hairs will not have to bend around the tracks in order to enter the attachment stack.

The Hair Extension Remover

I've discussed how the hair extensions are attached to the scalp hairs by the attachment circuit stack. I've discussed how the attachment stack is held by a part named that belt buckle which itself is held by a handle. However, once attached, the hair extensions will grow out away from the scalp and need to be removed and re-attached near the scalp again. I have invented a removal device to perform this function. From here after, I will usually refer to this device as the remover. Below, I will describe how the remover functions.

FIG. 84 is a perspective drawing of the remover, in isolation. Recall how I described the attachment stack in isolation. That is to say, I described how it worked before showing how it was attached to the belt buckle, a handle, or even any of the cables that supply it with power. I'm going to do the same thing with the remover. The remover, like the attachment stack, will likely be held by a belt buckle which itself will be held by a handle. Alternatively, the remover might attach directly into the handle unit without the aid of a belt-buckle in a similar way that the tensioning straightener does. In any case, FIG. 84 in isolation from most structures that surround and support it. For now, just know that the structures used to support it and move it through the hair are very similar to those used for the attachment stack.

The first thing to notice about the remover is that, like attachment stack, it has funneling channels in front. Thus, as it is moved through the hair, it funnels the hairs down into these narrowed passageways or hair channels 84A. Although it is not shown in FIG. 84, ideally, the remover has a tensioning hair straightener itself that is in front of and overhangs it. As such, most optimally, the hairs that enter the remover are pulled straight up under tension. They're not just flipping around in its hair channels.

In order for the remover to detach the hair extensions from the scalp hairs, in this embodiment, the remover is going to apply a solvent to the hairs. This solvent will be applied along the hair shafts from a point little above where we expect the attachment beads to be to a point down near the scalp. However, since the solvent requires several minutes to work, the remover will have to make two passes through the hair. The first pass is to apply the solvent. The second pass is to wash the solvent off and carry away the freed hair extensions.

First Pass—Application of Solvent:

On the first pass, pipe 84B squirts solvent out of nozzle holes 84C. Alternatively, said nozzles holes might be configured as a single continuous vertical slit. The solvent moves out of the nozzles to the left and gets on the hairs that are moving through the narrowed passageways 84A. Although the solvent might be a liquid, it may be preferable to use a solvent with the viscosity of a gel or semi-solid paste. The advantages to using a gel are that it does not evaporate as fast as a liquid and that it stays where it is put it. As such, you can think of the solvent as being applied to the hairs in a long flat continuous bead or ribbon much like what comes out of a caulking gun or toothpaste tube, only flatter.

After the solvent bead is applied, the hairs encounter bend-under system 84D that bends them under the connectivity bride of the remover. However, unlike the attacher's bend under system, which is ideally placed as close to the scalp as we can get it, the remover's are placed a significant distance above the scalp. More specifically, most optimally, the remover's bend under system is placed above the area where the solvent has been applied to the hairs by nozzles 84C. This way the bend under system only touches portions of the hairs above where the solvent was applied to them. As such, the solvent will not be greatly disturbed.

To help contain the solvent and washing fluid, the remover's channels 84A have walls 84E ideally higher than any of the nozzles 84C. Please note the solvent output might be entirely integrated into these hair channel walls. They are just shown as separate in FIG. 84 for illustrative purposes.

Second Pass—Washing and the Removal of the Hair Extensions:

After waiting several minutes for the solvent to completely dissolve the adhesive that holds the hair extensions, the remover will make a second pass. On the second pass, pipe assembly 84H squirts a washing fluid out of nozzles 84F, most likely water and a shampoo or detergent. This washing fluid washes the solvent off the hairs. As the washing fluid is applied, these square nozzles 84G vacuum it up before it has a chance to escape and make a mess. Of course, the hairs themselves will be pulled towards said vacuum nozzles 84G. Since the hairs are perpendicular to the vacuum nozzles, they won't be sucked into the nozzles but, instead, will just lie flat on the surface of the vacuum nozzles. However, the hairs won't stay there for long. Notice how the bend under system 84D juts out slightly in front of the vacuum nozzles 84G. Of course, the detached hairs will be pulled away by the bend-under system. More specifically, they'll be pulled backwards and under the vacuum nozzles 84G. Although this happens to both scalp hairs and hair extensions, they meet take a separate route soon after this point.

The scalp hairs, in the remover's bend under belts, take the familiar path described for scalp hairs in the attachment system; I will briefly describe this path again. Referring to FIG. 2.1, once engaged by the bend-under belts, the scalp hairs are bent under the connectivity bridge lD and, because they're attached to the scalp, dropped. Of course, in this version of the remover, the connectivity-bridge at the back of the channel should be assumed to be the vacuum nozzles 84G, as shown in FIG. 84.

However, something else happens to the hair extensions. As FIG. 85 shows, since the hair extensions 41E are not attached to the scalp, there's nothing to pull them out of the bend-under belt assembly 2E. Consequently, the bend-under-belt system pulls said hairs under the hair channel dead end ID and just carries them away. I'll explain exactly what happens to the carried-away hair extensions later, for now, just know that they're headed for a system that's going to put them in the hair extension clip cartridges used by the attachment system. In other words, they're recycled. However, in a simpler embodiment, the hair extensions could simply be disposed of.

Hair Extension Recycling System (Optional)

Once removed from the scalp, the hair extensions can be recycled and used again. When this happens, the hair extensions are transported away and processed through several steps that ready them for reuse. Ultimately, the hair extensions will be loaded into the hair extension clip cartridges that are used with the attachment system.

I've explained how the remover removes hair extensions and transports them away using what I have referred to in the past as bend-under belts. In the context of this discussion, we will call the bend-under belts that lead from the remover the first transport belts, because they are the first belts to transport the hair extensions away from the remover off to another component of the system.

The device shown, in FIG. 86, is called the hair extension vacuum belt transfer unit. The first transport belts 86A take the hair extensions to this device which transfers said hair extensions to a set of second transfer belts 86B in such a way that the hair extensions are all grabbed at the same distance from their tips. This is to say that when the remover removes hair extensions, we cannot expect the first transport belts 86A to grab them all at the exact same distance from their tips. Therefore, we use the vacuum belt transfer device to line up the hair extension tips and then let a second set of belts 86B carry the lined-up hairs away. Aligning hair extension tips evenly is important because, when we load the clip cartridges for the attachment system, we will want all the hair extensions to hang down about the same distance from the clips in order for the hair attachment system to function reliably.

The vacuum belt transfer unit works in the following manner. First the belt set 86A which is a first transport belt system, and is likely the tail end of the bendunder belt system that comes from the remover, brings hair extensions to the vacuum transfer unit. The hair extensions 41E dangle below the first transport belts 86A and are pulled through this small slit 86D in the side of the unit. As such, the lower end of each hair extension lags behind and gets slightly held up at 86E where slit 86D dead ends in the lower platform 861 while the higher tip of the hair does not get caught up until the slit 86D dead ends at 86F in the higher platform. This means the highest tip of hair extension 41E advances farther forward than its lower portions. Also, in the area 86F where the higher platform dead ends, the first transport belts diverge, so that they stop pinching the hair extensions. Consequently, the belts drop the upper tip 86G of the hair extension 41E. However, the hair extension does not fall downwards because there is a vacuum being applied from above. Specifically, the vacuum is introduced through this passage 86H. FIG. 86.1 shows an isolated view of the internal platforms levels and their dead-end slits.

Thus, as shown in FIG. 87, air is sucked through the vacuum transfer unit in such a way that it takes the paths depicted by arrows 87A. This causes the hair extension 41E which is no longer being pinched by the first transport belt system to be sucked upward tip first. It is very important that the hair extension is sucked up tip first, not all at once as a tangled ball or middle first as an inverted U-shape.

FIG. 88 is a side plan view of the system that I will use to illustrate why the hair extension gets sucked up tip first. Because the tip has been released at 88A and there are air intake openings 88B encircling the sides of the wall on the same level, the tip is subject to air flowing past it, as shown by the arrows 88I. This air flowing past vacuums the tip upward. However, the lower platform level 86I doesn't have any air intakes and is fairly well sealed off from the airflow occurring above it. Furthermore, since the dead end in this lower platform occurs back at 86E, the lower portion of the hair extension is held back in a manner that further shields it from the air flow of the vacuum. Thus, the lower portion 88E of the hair extension experiences no direct lift from the vacuum. Only the higher portion 88J of the hair extension gets pulled upwards by the vacuum tip first. The lower portion 88E of the hair extension that lags behind actually acts as somewhat of an anchor that holds relatively still allowing the vacuum to pull the upper tip straight up under some degree of tension. Of course, as the upper tip of the hair extension is pulled up, the lower portions of the hair extension are sliding up from below following in said tip's path. The important thing is that the lower portions of the hair extension are following in the tip's path. The lower portions are not being sucked up ahead or at the same time as the tip. Consequently, the hair extension always points vertically upwards.

As the tip gets pulled higher and higher, it moves up this passage 86H. Because of the aerodynamics of the system, all tips will move to the center of the passageway 86H as they are pulled up. However, they are not pulled up indefinitely. At point 88G, the movement of the air currents is no longer upward but switches to horizontal. This, of course, forces the tip of the hair extension to move horizontally into belts 88H. These are the second transport belts. Owing to the aerodynamic forces, all hairs will be forced to take nearly identical paths. Thus, they will be pulled sideways at the same point, and as such, the second transport belts 86B will pinch all hair extensions at the same distance from their tips.

Figure 89:
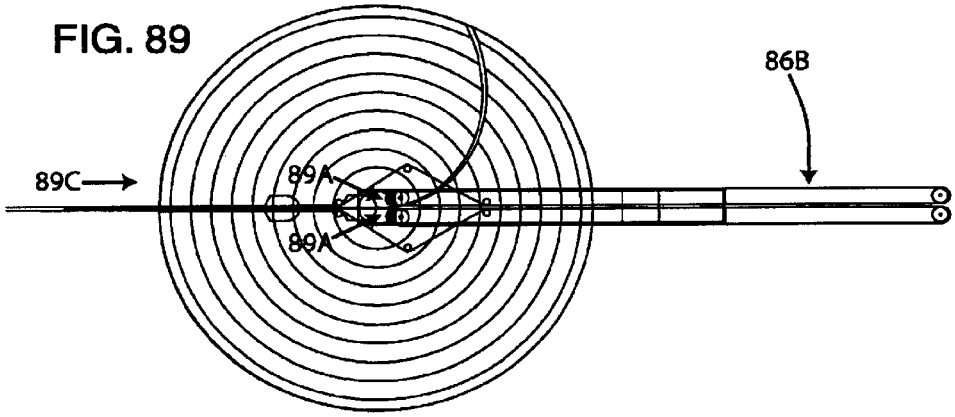
FIG. 89: Hair-extension-vacuum-belt-transfer unit. (Top view.)

FIG. 89 shows a top plan view of the vacuum belt transfer system. The thing to notice here are the darkly shaded funneling shields 89A in front of the second transport belts 86B. Their purpose is to help funnel the hair extensions into the middle of the two pinching second transport belts so that there's no chance that a hair extension will fly off to the side and not get pinched. Recall that they hair extensions are coming from the direction of arrow 89C.

Figure 90:
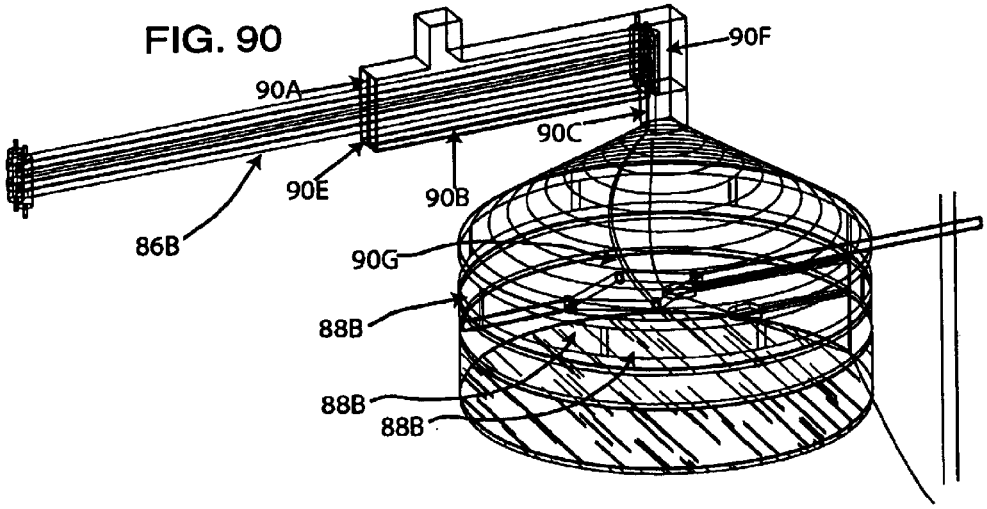
FIG. 90: Hair-extension-vacuum-belt-transfer unit. (Perspective view from left side.)

Referring to FIG. 90, which is an off-back perspective view of the unit, notice that there is a vertical slit present at point 90A, and continuous with it is a horizontal slit present at point 90B which continues to become a vertical slit at 90C. These slits are very thin so as not to disrupt the air flow by allowing great quantities of air to be sucked in through them, instead of through the designated air intakes 88B below. This slit series might have a resilient material on its edges to act as a seal and further reduce air intake through it. The purpose of this long continuous slit is to give the hanging ends of the hair extensions a place where they can exit and still remain oriented largely vertically downward. In contrast, if these slits weren't present, the lower portions of the hair extensions would be forced to bend to horizontally and be dragged along floor 90E that underlies the second transport belts 86B. If this were to happen, the trailing hair extension tips would get too close to the entrance 90F of the second transport belts.

Undesirably, such trailing tips might themselves get vacuumed upwards and pinched by the second transport belts. In other words, the same hair extension would be pinched twice by the belts. This must not happen. Only the upper leading tips of hair extensions should be pinched by the second transport belts. Otherwise, the hair extension clips will be loaded improperly. To ensure that the trailing tip does not get engaged by the belts, the continuous slit at 90A, 90B & 90C is further extended downward through slit area 90G on the side of the vacuum transfer unit's dome.

Figure 91:
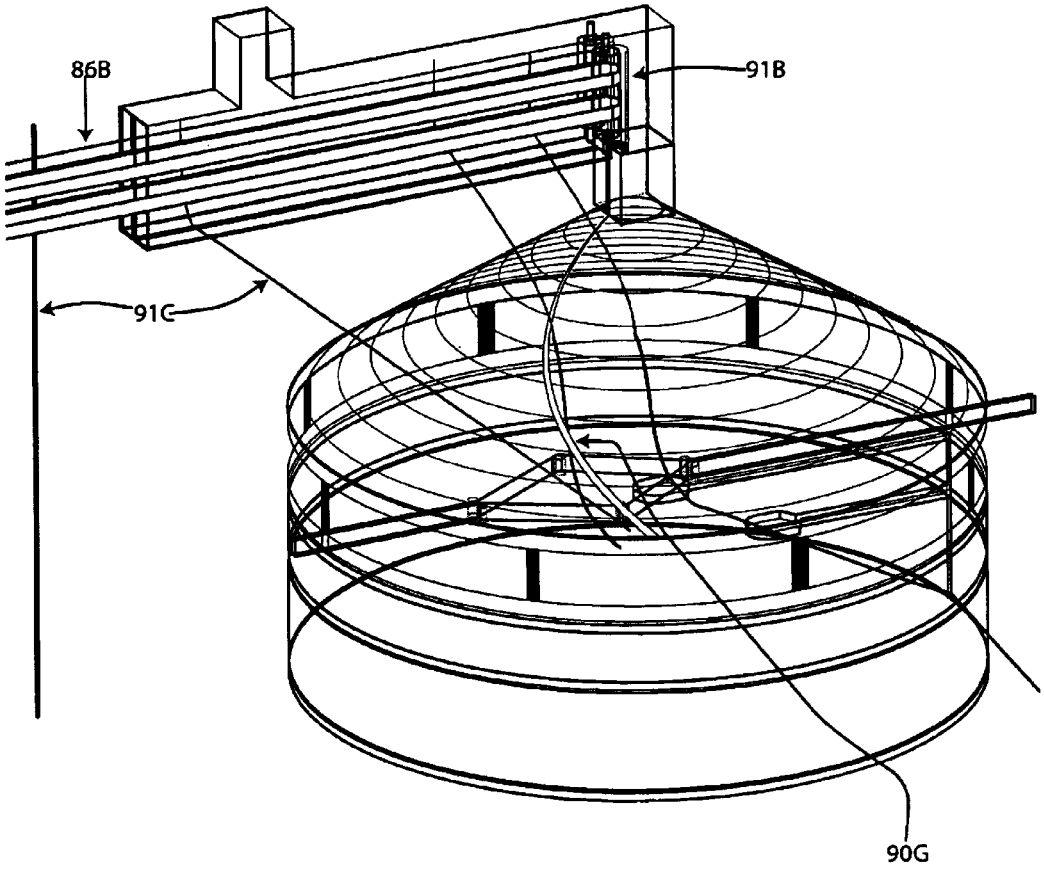
FIG. 91: Hair-extension-vacuum-belt-transfer unit. Illustrating hair extension being pulled from system by the secondary-transport belts. (Perspective view from left side.)

In FIG. 91, the purpose of slit 90G, that goes down the side of the dome, is to pull the lower portions of the hair extensions increasingly farther away from the vacuum and pinching belts, which are at 91B. As the leading ends of the hair extensions 91C are moved away by the second transport belts, the trailing ends are forced to follow the dome slit 90G in order to relieve tension. Ideally, this dome slit takes a spiral, rather than straight path, down this side of the dome. The purpose for this spiral path is to make it more difficult for the hair extensions to backtrack up the slit under the pull of the vacuum. Instead, the trailing tips of the hair extensions are held safely away from the vacuum where they cannot be pulled into the second transport belts. Eventually, each hair extension will be pulled entirely from the system, as illustrated by this series 91C of hair extensions.

Note: Both the lower platforms with dead ends and exit slit are optional. They are all means of shielding the trailing portions of the hair extension from a vacuum engagement mechanism. All that's really required is an assembly of a vacuum and conveyance which flows air over said conveyance means, such as belts, and an initial hair conveyance means, such as belts, to release the hairs in the proximity of said assembly. Optionally, any means which (to some degree) shields the trailing (or relative to description only, lower) portions hair extensions form air currents while preferentially allowing their leading (or upper) portions greater exposure could be used. Finally, engagement mechanisms that use some other hair straightening means, like those mentioned in this document, are a possibility. For example, a functional equivalent of this system that uses electrical charges to attract the hairs to the second conveyance system is a possibility.

You should note that there would likely be one vacuum belt transfer unit like this for each bend-under belt pair leading from the remover. FIG. 84 shows a remover which has three bend-under belt pairs, and as such, it will have three vacuum transfer units, each like the one 84I just finished describing. However, several first transport belts coming into a vacuum transfer unit with one set of second transport belts is a possibility.

The bend-under belt pairs were renamed the first hair extension transport belts when discussed with reference to the vacuum belt transfer units. Of course, the first hair extension transport belts could be supported by the pulley-rib system previously described and illustrated in FIG. 71. Such a pulley-rib system allows flexible movement of each belt pair it supports. This means that the remover handle unit and the vacuum belt transfer unit could be flexibly connected.

Further still, it is likely desirable that the lower end of each hair extension that was bonded to each scalp hair is the same end that is bonded again after recycling. For this to occur, the bonded end of each removed hair extension must be made the leading end that gets pinched in the vacuum belt transfer unit. To make this possible, the hair extensions removed from the remover must be flipped upside down before being introduced into the vacuum belt transfer unit.

The flexible nature of the belt pulley-rib system makes this possible. Each flexible belt pair is simply twisted 180° along its path from the remover handle unit to the vacuum belt transfer unit.

During a 180° flip, there' is risk of the hair extensions getting tangled with the belts. This risk could be reduced by isolating the regions above the belt from those below by means of planar shelves that extend outward laterally on both sides of each belt pair. Ideally, these planar shelves should be independent of the belts but pressed against said belts. Said planar shelves should be supported between the protective sides of the pulley-ribs and should be flexible themselves.

Another place that the pulley-rib configuration could be used to achieve flexibility is the second transport belt system. Referring to FIG. 91, the hair extensions 91C are carried away on the second transport belts 86B to their next processing station. The next processing station is likely Reversing Clip Filler, which is discussed below. Since the Reversing Clip Filler moves from side to side like the head of a dot matrix printer, a portion of the second transport belts which leads to it must be made flexible, or at least movable, in order to follow its movement. This flexibility can be achieved by using a chain of flexible pulley-ribs like those described earlier. Recall, I said that the bend-under belts that lead from the attacher were made flexible by using a pulley-rib configuration, and went on to describe these pulley-ribs in detail.

Figure 92:
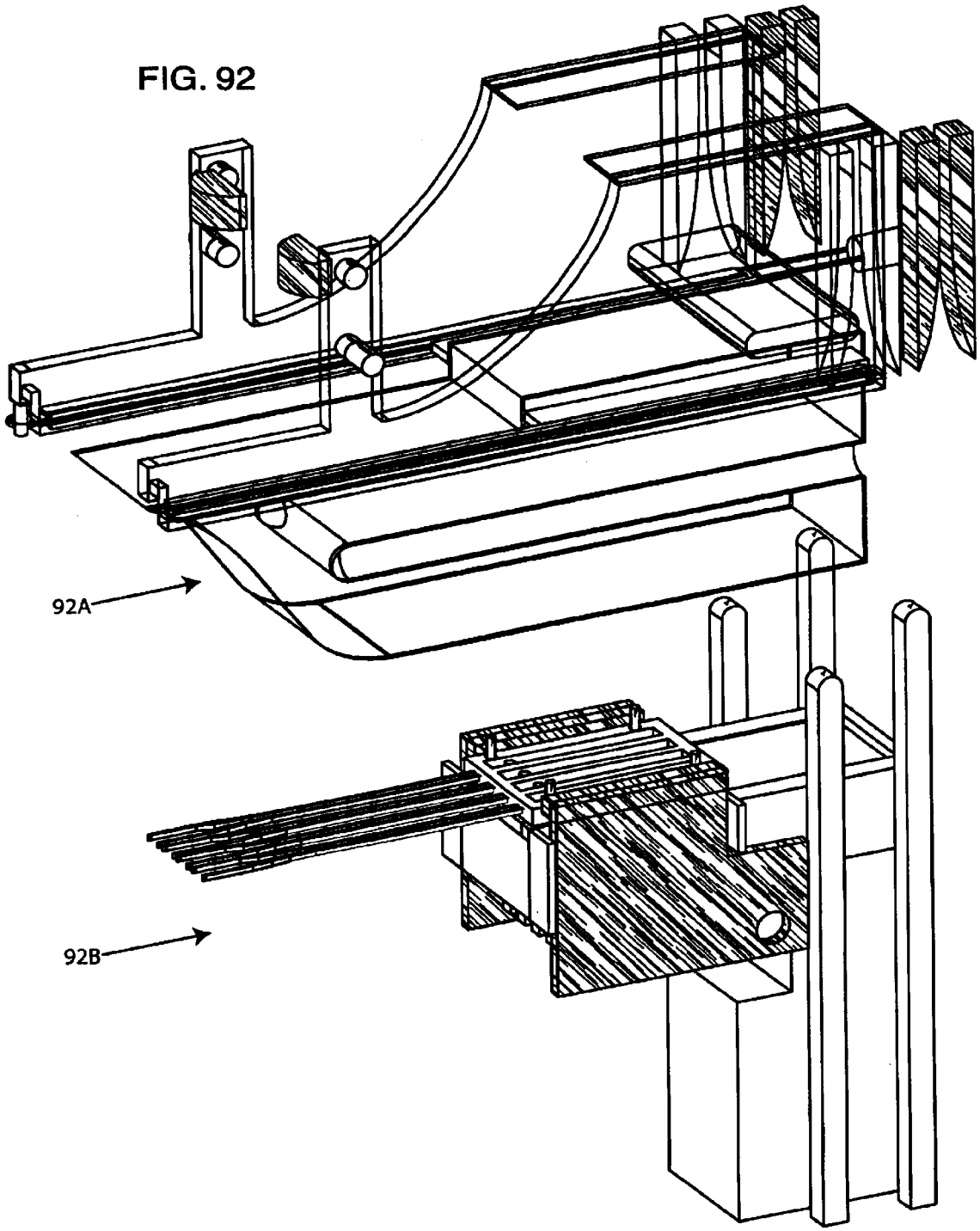
FIG. 92: Handle unit. being lowered onto dock. (Perspective view from right side.)

Changing the Hair Extension Clip Cartridges on the Attachment Stack Using the Docks I have explained how the vacuum belt transfer unit readies hair extension for reuse in clip cartridges. I will now discuss how these clip cartridges are held on docks and, from there, loaded onto the attachment stack. In FIG. 92, we see the attachment system handle unit 92A turned upside-down over a dock 92B that holds a hair extension clip cartridge. For visual clarity, the attachment stack, straightener, and most, but not all, of the belt buckle belt buckle have been made invisible in this drawing.

In FIG. 93, the attachment system handle unit 93A has been brought farther down over dock 93B. Notice how the attachment handle unit 93A slides down these pins 93C. These pins align both the attachment handle unit and belt buckle with the dock. This is achieved because both the lower portion of the handle unit outer-frame and the belt buckle each have their own pair of pin interlock slots 93E and 93F, respectively. Notice that although the belt buckle's pin interlock slots 93F are shown, the belt buckle itself is not. Furthermore, as the attachment handle slides down these pins, a switch is triggered that causes the top canopy 93D of the attachment handle to slide open. This exposes the top of the attachment stack. Although the attachment stack is omitted from this drawing, recall that the top of the attachment stack is where the clip cartridges attach for use. Thus, this configuration brings the clip cartridge on the dock in contact with the top of the attachment stack. The clip cartridges are designed to lock onto the top of the attachment stack. Perhaps, the clip cartridges will be made magnetic so that they are attracted to the metallic attachment. stack. How ever it is done, the clip cartridges are attracted away from the docks and onto the top of the attachment stack. At which point, the attachment handle is raised back up off the docks, and its top slides closed again. The attachment system is now loaded with hair extensions and is ready to be run over the scalp.

When the clip cartridge is emptied, the handle is brought back down over the dock where it originally picked up the cartridge. This time the process is reversed. The empty clip cartridge is attracted away from the top of the attachment stack and back onto the docks. This is likely achieved by the cartridge-pinching structures 93G on the sides of the dock moving inwards and grabbing the clip cartridge. Now, the cartridge-free attachment stack is ready to pick up a full cartridge from another dock. Note: The cartridge pinching structures might be made to move in and out by running a threaded rod through their threaded holes 93H and turning it. Of course, the left and right cartridge-pinching halves will have to be threaded in opposite directions so that they will move in opposite directions.

Filling Replacement Clip Cartridges with Hair Extensions on the Docks

I have described how the clip cartridges are held on docks so that they can be utilized by the attachment system, and how vacuum belt transfer unit feeds the second transport belts with hair extension all grabbed at the same distance from their tips. The following discussion centers on what happens in between these two points. In other words, how the clip cartridges are filled with recycled hair extension.

FIG. 94 shows the Reversing Clip Filler. It is where the second transport belts bring the hair extensions. In fact, the second transport belts 86B are shown entering it. Notice that there are four sets of second transport belts 86B shown. Each set composed of four belts, two upper and two lower, just as they were when they left the. vacuum transfer units. Since this particular drawing shows four sets of belts, we are assuming that they have come from a remover that has four bend-under belts, which means its part of a system that also likely has four separate vacuum belt transfer units.

Notice that there are clips being held by irremovable clip cartridge 94B. This irremovable clip cartridge has a similar configuration to the ones used by the attachment stack, however, this particular clip cartridge 94B can neither be removed from its position on support 94C nor used on the attachment stack. As shown, these clips are empty of hairs. However, this inverted-L-shaped support 94C has a turntable 94D under it that can swivel it around towards the second transport belts 86B. This is why I call it the revering clip filler. It is capable of reversing the direction its clips are facing in order to facilitate filling its clips up with hair extensions from the second transport belts 86B.

When the irremovable clip cartridge is swiveled around towards the second transport belts, the reversing clip filler looks as shown in FIG. 95. Referring to the plan side view in FIG. 95.1, notice how the clips 95A fit between the lower level 95B of second transport belts and the upper level of second transport belts 95C. The reason for this configuration is to ensure that as the transport belts feed the clips 95A with hair extensions that those hairs are being held at a point above and below the clips. This keeps the hair extensions straight and under slight tension when they enter the clips. In contrast, if the system had belts only above or only below the clips, the hair extension tips might bend into a horizontal position rather than being feed in a vertical position into the clips. The hair extensions move along the second transport belts in the direction indicated by arrow 95D. Similar to the hair extension clips in the attachment system, these hair extension clips 95A are also likely mounted on spring-pins or a functional equivalent. Consequently, said clips are filled with hair extensions by the transport belts, they are pushed progressively backwards away from said transport belts. Thus, their filled areas are pushed out of the way of the second transport belts that are filling them. Tabs 95F are the part of spring-pin assembly 95E that extends downward and can be pulled back by spring-pin pullback actuator 95G. A similar arrangement could be used on the docks in order to pull their all their spring pins back, thereby, lining them up at the back of the cartridge during cartridge transfer to the attachment stack's top.

After the clips are filled, they are turned back away from the second transport belts, as shown in FIG. 94. Notice that the interior of the support contains a mechanism 94E. One of its purposes is to loosen and tighten the grip that the clips have on their hair extensions. I'll go into the importance of this later on below.

The rods 94F serve as tracks that the reversing filler hangs down from and moves along. Really, these two rods are much longer than shown in this drawing. Remember, I said that the reversing filler moves from side to side like the head of a dot matrix printer. It is these rods that it moves along.

The notches 94G are not part of the reversing filler but are part of an independent stationary level that overhangs the reversing filler. Hump 94H is part of the reversing clip filler and moves with it. The hump is being forced up into the notches 94G by its spring 941. This set up allows the reversing filler to be moved precisely one notch over to the side. This is important because the reversing filler is going to have to line up with another part called the clip cartridge docks.

Although similar to the ones used on the attachment system, the irremovable clip cartridge 94B is not removable and cannot be used on the attachment system. Instead, it has to transfer its hair extensions to another clip cartridge that is removable and can be used on the attachment system. These other clip cartridges, which are removable, are held on the clip cartridge docks.

FIG. 96 shows an individual clip cartridge dock. Its purpose is to hold a removable clip cartridge so that the cartridge can be filled and transferred to the attachment system, as previously described.

In practice, several docks are placed side by side in line as shown in FIG. 97. The exterior of all five of these docks looks like the one on the far left-hand end that has clip cartridge 97A atop it. These other four docks have their exterior's removed in order to show the internal part 97B, which is the internal clip cartridge loosening and pin retraction assembly. I am not going to go into detail now, just know that this part 97B is moved up and down to loosen and tighten the hold the clips have on their hair extensions. It does this by forcing tapered-headed spring-pins extra far into the rear holes of the hair extension clips. This assembly also allows the various clip cartridge engagement pins to retract downwards from the cartridge. To increase simplicity, all five internal parts are likely connected below by a connectivity bridge so that they can be actuated by a single actuator or share a single set of springs. In practice, all five of these docks would have a clip cartridge 97A atop, like the far left-hand dock on the end does. Each of these clip cartridges must be filled with hair extensions by the Reversing Clip Filler illustrated in FIG. 94.

Referring to FIG. 98, the clips 95A of the Reversing Clip Filler are moved toward the clips 98B on the docks. For perspective, also, notice the following the second transport belts 86B that fill the clips of the Reversing Clip Filler with hair extensions, and the clip filler's own irremovable clip cartridge. In this picture, the clip filler's clips 95A are turned away from the second transport belts 86B that fill them with hair extensions. For visual clarity, the drawing has not been complicated by adding hair extensions to the reversing clip filler's clips, but you should imagine hair extensions hanging down from said clips.

Recall that I said that the reversing clip filler could move from side to side like the head of a dot matrix printer. In FIG. 98, the two rods 94F serve as the tracks that the clip filler slides from side to side on. Notice how the clip filler hangs down from below said rods 94F. Said rods are themselves supported by these by two rectangular structures 98E. Said rectangular structures hang down from the block 98F. Notice that said block 98F has two rods 98G running through it. Said rods 98G serve as tracks that the block can slide forward and backward on. Thus, the reversing clip filler is not only capable of moving side to side, but it is also capable of moving forward and backward. In fact, the belt 98H shown on these two wheels 98I represents the pulley system that moves the clip filler forward and backward. After the Reversing Clip Filler itself has been filled with hair extensions, it rotates around towards the clip cartridge dock assembly 98J and then is moved forward towards them.

When the Reversing Filler is moved forward towards the clip cartridge resting on its leftmost dock, its clips give their hair extensions to the clips of the clip cartridge on the dock. The result is that this removable clip cartridge on the leftmost dock has been filled with hair. extensions and is ready to be picked up and used by the hair extension attachment system. Although not shown for visual clarity, the hair extensions hang downward from these clips. The filled hair extension clip cartridges on these docks are picked up by the attachment system, as previously described.

To facilitate this hair extension transfer, the grasp of each hair clip, in the clip cartridges both on the docks and Reversing Clip Filler, can be loosened by a mechanism internal to the cartridge supports. Referring to FIG. 94 for the reversing clip filler, this type of loosening mechanism is shown as 94E. Referring to FIG. 97 for the cartridge docks, this type of loosening mechanism is shown as 97B. Such a loosening mechanism works by forcing spring-pins with tapered heads up into the hair extension clips, thus, forcing their sides apart. When such a mechanism moves upwards the clips loosen, and when it moves downward, they re-tighten. To transfer hair extensions to the docks, first the docks loosen their clips. Once the reversing clip has advanced its clips fully forward, the clips on the docks are re-tightened, those on the reversing clip filler are loosened and the Reversing Clip Filler backs away. Thus, making the hair extension transfer complete.

In FIG. 98, to the right side of the leftmost clip cartridge dock, are four other clip cartridge docks. In this drawing, they don't look like the leftmost dock because their exteriors aren't shown. However, in practice, these four docks look just like this one on the left, each with its own clip cartridge atop. Recall, I told you that the reversing clip filler is capable of moving sideways, like the head of a dot matrix printer. The reason why it can move to the side is so that it can move itself into alignment with the clip cartridges on the neighboring docks in the same manner.

There are two things to consider about the system I've just described:

1. First, the cartridge docks aren't filled directly by the second transport belts. This is because most people have hairstyles where the hairs on their head are different lengths at different places. When we remove hair extensions from the scalp, we want to be able to put them back on the scalp at approximately the same place so the hairstyle remains the same. We want to do this while being able to comb the remover the same direction through the hair as we do the attachment system because this makes use of the system easier. However, if we move the remover the same direction over scalp as the attachment system and then just directly fill the clip cartridges with the hair extensions. The first hairs it removed will be the last hairs into the cartridges and, as such, will be the last to be re-attached. In other words, the hairs will be applied to the wrong area of the scalp.

The solution is to use the second transport belts to fill one set of clips, namely the clips on the reversing clip filler. This means the hair extensions in the reversing clip filler are in backward order. However, when the reversing clip filler rotates around and transfers its hairs to a clip cartridge on a dock, the hairs are once again reversed. Consequently, they are now in the appropriate order to be used by the attachment system. Of course, if we weren't concerned with putting hair extensions back on the head in exactly the same position they came from, then we would use the second transport belts to directly fill the dock clips, omitting the Reversing Clip Filler. In this scenario, the second transport belts, would move laterally as the Reversing Clip Filler does, but deliver their hair extensions directly to the dock clips.

2. There's a second point I'd like to make. I said the attachment system will probably have narrower and, thus, more channels than the remover. Since this would mean that there are more clips that need to be filled than second transport belts, how do all the clips get filled?

The short answer is that when the second transport belts are filling the clips of the reversing filler, we move each second transport belt side to side slightly. This way each belt fills more than just one clip. Referring to FIG. 94, each in the set of four tabs 94J supports a pulley roller (not shown) beneath itself which supports the extreme terminal ends of a second transport belt 86B. By moving said tabs 94J side to side, using an actuator for each, the second transport belts can be rhythmically moved back and forth so that each independent second-transport-belt assembly fills several clips evenly with hair extensions. Note: The tabs are staggered longitudinally relative to each other so that actuator mechanisms, whose axes of movement and shafts are perpendicular to each tab 94J, can be staggered longitudinally between the tabs.

Using New Hair Extensions Instead of Recycled:

I have described how recycled hair extensions are removed from the scalp and placed in the clips on the clip cartridge docks, but how do new hair extensions get introduced into the system? By new, I mean hair extensions that were not removed from the client's head.

Instead of using the reversing clip filler, an introduction-cartridge is used to fill the docked clip cartridges with new hair extensions. FIG. 99 shows a drawing of an introduction-cartridge. Notice how it's made up of two long rows of hair extension clips 99A joined together. For visual clarity, only the clips on the very rightmost end are shown holding only a very few hair extensions 41E. In practice, every single clip would be holding many hair extensions. Notice the two holes 99C in the far lateral sides of the introduction-cartridge. Most likely, this cartridge is molded out of plastic and disposable. FIG. 99.1 shows a plan top view of the same.

In FIG. 100, we, once again, see the clip cartridge docks. Again, I'll remind you that the exterior of every cartridge dock looks like the one on the leftmost end. The holes 99C in the sides of the introduction-cartridge 100B are shown being slide over introduction-cartridge-alignment pins 100C attached to the cartridge dock assembly. This pin-in-hole interface will line the introduction-cartridge up with all of the individual cartridges on the docks. As the introduction-cartridge's clips are brought towards the docks, they transfer their hair extensions to the cartridges on the docks. To facilitate this, the loosening and tightening process of the clips on the docks might be triggered. This could be triggered by a manual button or when the introduction-cartridge touches a switch as it slides over the pins 100C. The assembly that holds pins 100C might either be temporarily moved into position or placed so laterally to the docks that it does not interfere with the operation of the Reversing Clip Filler.

Referring to FIG. 101, notice how the introduction-cartridge is composed of two rows of clips. The set of clips 95A floating in space represent the clips of a docked hair extension cartridge. The lower row 99A of introduction-cartridge clips holds the hair extensions below the docked-cartridge's clips. The upper row 99A' holds the hair extensions above the docked-cartridge's clips. This configuration keeps the hair extensions relatively straight as they're forced into the cartridge's clips. If the introduction-cartridge just had one row of clips, the hair extensions might arc backwards when they come in contact with the docked-cartridge's clips.

Referring to FIG. 99, the front of the introduction-cartridge might have a capping structure (not shown) that snaps onto the front of it in order to help hold the introduction-cartridge's hair extensions in its clips. This cap needn't only block forward escape of the hair extensions, but also could have internal slots that fit over each holding clip. Said slots could have narrowing interiors that would pinch together the clips in order to tighten their grip on the hair extensions during storage.

Referring back again to FIG. 100, the long switch bar 100D gets triggered when the attachment system handle unit is brought down far enough to touch it. It triggers a circuit that apprises the system that the hand unit is being brought down onto the docks. The system response will likely include opening the canopy 93D of the handle unit as shown in FIG. 93. Back to FIG. 100, the lower long switch bar 100E gets triggered when the handle unit is brought down all the way onto the docks. This apprises the system that the handle unit attachment system is completely docked. This triggers actions consistent with either placing a clip cartridge onto the docks or removing one from the docks. The system computer will likely act in an alternating pattern in respect to this. For example, the first time the handle unit is brought down onto a dock it will be assumed that a clip cartridge needs to be picked up and the second time that it needs to be put back on the dock. A clip cartridge may be delivered from a dock to the top of the attachment stack by loosening the cartridge-grabbing mechanism 93G, as shown in FIG. 93. The body of the clip cartridge will most likely have enough magnetic character that it will be attracted to the top surface of the metallic attachment stack. Since the cartridge holding pins 96A, in FIG. 96, and the clip-engagement pins 96B on the top of the docks line up perfectly with those on the attachment system, all pins on the dock will probably be designed to descend (actively by actuator or passively on springs) beneath and out of the cartridge allowing those on the attachment system to enter from the top taking their place. Recall part 97B in FIG. 97. It most likely supports the cartridge holding and clip. engagement pins, thus, its descent makes their descent out the cartridge possible. The cartridge, with the grabbing mechanism loosened, will remain magnetically attracted to the attachment stack when the handle unit is moved away from the docks. To remove a cartridge from the attachment system handle unit, thereby, putting it on the docks, the process is simply reversed. The cartridge-grabbing mechanisms are tightened on the cartridge overcoming the magnetic attraction it has to the attachment stack, thus, holding said cartridge onto the docks. Referring to FIG. 100, we see the threaded rod 100F that runs through all the threaded holes of the cartridge-grabbers on docks. When said rod is rotated, such as by an electric motor, all the grabbers on the docks either tighten or loosen.

Notes:

-The bend-under systems might serve more than one hair channel and bend hairs under areas other than the tine-connectivity bridges. For example, it may bend some hairs under the sides of tine-assemblies.

-Instead of using cables that pull the hair handler assemblies, other types of actuators could be used including direct attachment of rigid moving actuation rods -The construction of the so-called attachment stack, or any other analogous processing embodiment, does not have to be out of sheets. For example, levels fifteen through nineteen shown in FIGS. 26–20 could be configured as one or two molded parts that surround the spring-pin assembly.

-The channel obstruction 27A in FIG. 27.1 is optional because hair handlers and opposing scalp hairs will likely keep the hair extensions from advancing too fast.

-The one-to-one attachment chamber to nozzle relationship is optional. Sometimes one type of output nozzle can be shared across several chambers.

-The support base unit doesn't always have to be so big that it needs to be placed several feet away. It could be small enough to be incorporated into the handle unit.

-Both the handle unit and belt buckle are optional because the attachment stack could be held directly by hand, albeit it less than ideal. Also, the attachment stack could be connected to a handle means by a structure very different than the belt buckle. For example, the attachment stack or any analogous processing stack or system could be mounted on a handle unit in one of, but not limited to, the following ways:

--Mounted on a fulcrum, so that it moves rotationally

--Mounted on a spring or other flexible mechanism, (or portions of the processing system itself made from deferrable materials), so that in can move in one or more of the following ways:

---Vertical retraction away from, and advancement towards, the scalp

---Horizontal retraction away from, and advancement towards, the scalp

-Using sloped notches or a slide-out preventer to prevent hairs from escaping during transport might be unnecessary.

-Whenever we speak of a hair-pinching means, such as for the bend-under system, the tensioning hair straightener, or the transport belt system, we should realize that for pinching another hair-engagement means might be substituted. For example, using hooks, electrical-charges, or an otherwise sticky surface are such examples of ways to engage hairs. Also, the belts needn't always be configured in pairs to engage hairs. For example, they might either use a non-pinching-engagement means or they might pinch hairs between themselves and a stationary surface.

-The tensioning hair straightener is optional. For example, the hair could be held straight by a human hand.

-The bend-under system is optional and not absolutely the only way of getting hairs past obstructions associated with the processing system. For example, this too could conceivably be done manually.

-In many cases this document uses relativistic descriptions. For example, frequently the left wall is referenced as the position where the nozzles are or toward which the pinchers slide. This does not mean that in all embodiments this will be the case. Left wall of the attachment area is just used as a reference to orient the reader. This is true of many directions given to describe the system. For example, transport-forward is relative to the particular destination; specific level numbers in the stack are relative to this discussion only; the stacking order of the hair handlers and some of the other levels can usually be varied; pushback doesn't have to be back in all embodiments; the various functional areas of the stack can be rearranged in different configurations. For example, hair handlers can be placed in different levels such as below the nozzle outputs; fluid nozzles can be placed in different positions other than the left wall, for example, they could be placed on a back wall of the attachment chamber below the hair-extension-tip trench; the tip trench floor can itself be thickened to accommodate nozzles or for any other reason. In other words, various functional areas can be moved around in many ways relative to each other in accordance with their functions. Sometimes they can be omitted or substituted for other functional areas.

-The use of the word "stack" in attachment stack (or any analogous processing stack) is mostly used as a relativistic way of making the description of the system more vivid to the reader. However, functionally equivalent systems might be configured which are not constructed as stacks. For example, using micro-machine technology to put many hair-handler functional areas on the same level is an example of this.

-All processing stack (processing systems) can be configured with only a single channel by itself.

-The bead-forming liquid polymer can be any functional equivalent adhesive or substance.

-Metering area may refer not only to the area between a pushback gate (or functional equivalent) and an entrance (or equivalent), but also, the area where the metering function originally take place, even if said hair handlers associated with said metering function later move to a different position later. Although metering areas are likely formed between pushback and entrance gates, this doesn't have to be the case. Instead, they any area where a limited number of hairs are isolated, usually to ready them for further processing.

-Sometimes the functional areas of hair handlers are referred to as gates or hair-handling gates.

-Nozzles are any form of fluid (gas or liquid) output or even gas-suspended solid particle output. For example, the word nozzle does not always indicate that the output opening is on a projecting part. Sometimes the word nozzle can even be applied to intakes into which things are sucked.

-Sometimes hair handler functional areas perform multiple-functions that could be split among multiple hair handlers and the converse is true. The familiar attachment-area pincher with its sloping front used to bring wayward hairs together could be split up into a stack of several pinchers placed on different levels; ideally, triggering progressively lower levels progressively later. Some of these lower levels could even be placed below the stationary levels of the attachment stack.

-Use of a track-cap is optional.

-This first-described embodiment above has certain optional features that aren't necessary and also lack certain other possible enhancements. If the system can perform without a certain functional part, even less effectively, then this part should be considered optional.

Refirnments and Ideas Concerning the Attachment Stack Iteslf (and other Types of Processing Stacks by Analogy)

[[Attachment Refinements]]

Applying Adhesives in the most Optimal Manner

Previously, discussions about adhesive application suggested that it should be applied to the hairs in spherical beads rather than a thin coating. Although beads do have real advantages over coatings, such as increased peel strength, the main reason beads were used in the previous discussions is because they are more visible in the diagrams. In practice, it is better to use long thin coatings rather than beads. Elongated volumes of adhesive are the better on two accounts: 1. They are much harder to see than beads. 2. Because they are hard to see, they can be made longer than spherical beads. Their additional length provides more protection against slipping free. Although peel strength is less than with spherical beads, this seems less of an issue anyway.

*Nozzle Flow Systems*

Several different types of nozzle systems can be used to apply the adhesive or any other fluid substance to the hairs. Some of these systems for controlling nozzle flow are described below.

Vapor bubbles generated in the adhesive or other fluid itself by small heating elements, usually powered by electrical resistance, could be used to propel said fluid out of a nozzle. In FIG. 102.2, notice how the beat generating resistance means 102D is placed near the tip of the nozzle 3B. In FIG. 102.3, notice how it generates an explosive force 102C in the directions shown by the arrows. In order to generate electrical resistance, the resistance-heating element 102D needs to have a higher electrical resistance than the electrical circuits supplying it. This can be achieved by making the heating element narrower, thinner, or out of a material with a higher electrical resistivity than the rest of the circuit. In order to construct an assembly where the heating element is thinner or made from a different material, it could be constructed using at least two layers. In FIG. 102, the first layer 102A forms the heating element itself, in FIG. 102.1; the second layer 102B is used to reduce the resistivity of the overall electrical circuit in all areas except the area where localized heat is desired. Possibly, light carried by fiber optics could be used as an energy source to generate the necessary heat in the appropriate area.

A second means of controlling nozzle flow is to use individual lines each connected to its own individual macro-actuator or macro-valve. By macro, I generally mean a separate part that is too large to be incorporated within the attachment stack itself.

An alternative version of this configuration could use many nozzles that share a common line to a single macro-actuator or macro-valve. In this case, the nozzles will probably not be individually controlled but, instead, will all fire at once.

A hybrid between the two previous configurations would be all or many nozzles sharing a common line to their own macro-liquid supply but are individually controlled by micro-pumps or micro-valves within the layers of the attachment stack. These micro-pumps include:

1. Vapor bubbles from heating elements
2. Micro-actuators (such as Sandia's Laboratories micro-steam engine actuator)
3. Piezo-electric means like those used by some ink jet printers.

These micro-pumps will generally require an electric current in order to function. For manufacturing concerns regarding "micro-wires," see the electromagnetic pathways section below.

These micro-pumps or micro-valves might be placed anywhere along the fluid supply line between the fluid supply reservoir and final fluid output nozzles in the attachment area. Further still, micro-pumps or valves placed in or near the attachment stack might be supplied with adhesive by a macro-pumping means. Such a macro-pumping means, when used with a micro-pump or valve means, would place the fluid under enough pressure to carry it against gravity to the micro-pumps, however, little enough pressure so that it can't exit the nozzles unaided by the micro-pumps.

If needed, especially for high viscosity adhesives, an air-in-line system powered by a base unit that generates pressurized airbursts between each droplet of liquid fired from each output nozzle. Of course, airbursts would be used in order to push fluid through the supply lines to the nozzles. For example, an air compressor that releases pressurized air bursts into the supply line when solenoid valves open. Airbursts used between each liquid droplet ensure consistent droplet size and prevent trailing strands of adhesive (or other liquid) between each output nozzle and the hairs it is wetting. Referring to FIG. 103, each isolated fluid supply pathway or tine of the attachment stack generally has several nozzles that share it. Likewise, several of these supply tines themselves usually share a single adhesive supply line from the base unit. For this reason, the amount of liquid introduced into the lines should be approximately equal to the number of nozzles times greater than the desired size of a single output droplet. This volume of liquid will first be divided among the supply tines and then the several nozzles on each tine. This division among two (splitting) nozzles on a single tine is shown by in FIGS. 103 and 103.1. In FIG. 103, a volume of fluid 103A is being shown pushed down the line by pressurized air 103B behind it. Representing FIG. 103 at a slightly later moment is FIG. 103.1 that shows volume of fluid 103A being divided equally between the two attachment area nozzles 103C and 103D. In practice, there are likely more than two nozzles used per attachment area. Further still, before this volume of liquid even reaches these attachment area nozzles, it has to be divided in a similar manner by a manifold means at the back of the attachment stack, which connects the individual tine supply lines together. Referring to FIG. 3, such a manifold is illustrated by 3G.

This fluid division system is the most ideal way to deliver fluids that are slurries rather than solutions. For example, an adhesive that has grains of sand or fibers mechanically mixed in with it. If such a slurry were delivered to the nozzles using a liquid-in-line system that does not separate small volumes of fluid between bursts of gas, then it would be delivered in an unpredictable manner. This is because the liquid in the slurry would tend to flow around the solids in the slurry. At first, this would lead to the output of undesirably liquid-rich droplets. With continued use, supply-line blockages caused by the trailing solids would result.

A system that uses the fluid division air burst system to deliver a solids-containing slurry must introduce the components of the slurry into the line in special manner. For example, as illustrated by FIG. 103.2, the solids 103E and liquids 103F should be independently introduced into a mixing chamber 103G. The liquid portion 103F should be introduced through a valve 103H. The solids portions should be introduced using metering device 103I. It is very likely that this metering device will take the form of an actuator that pushes a specified amount of solids 103E into the mixing chamber 103G. This metering actuator may have a notch 103J that can be filled, most likely via hopper, with a specific volume of solids 103E. To facilitate mixing, this mixing chamber might be vibrated externally as an entire unit or internally, such as by repeated vibrating of the metering actuator 103I. Once all the components are together in the mixing chamber, a third input valve 103K connected to the mixing chamber should supply the pressurized airburst that moves the volume of mixed slurry through the supply line. Arrow 103L represents the direction of the introduced pressurized airburst into the mixing chamber, arrow 103M represents the direction of air-forced mixed slurry out of the mixing chamber into the supply lines and ultimately to the splitting nozzles 103C and 103D. Overall, FIG. 103.2 can be thought of as a system that supplies the spitball-like globs of slurry to the splitting nozzles.

The above system shows air-bubbles being introduced between volumes of adhesive at a mechanism in the line before the attachment stack is ever reached. It is also possible to introduce the pressurized gas bubbles near the nozzles in the attachment stack. When introducing gas bubbles near the nozzles, liquid behind the air introduction point is going to be pushed backwards. For this reason, the pressurized bursts should always be introduced at a narrowed area of the nozzle such that the back-lying liquid has a greater surface area to offset the pressure compared to the surface area of the narrowed nozzle output. This will prevent the back-lying liquid from being pushed excessively far backwards in the supply line. This bubble. introduction point will likely be placed at a point homologous to the location of the heating element in FIG. 102. In 102, gas may be introduced at said bubble introduction point by vapor generated by a heating element. However, there are other ways gas could be introduced at this "bubble point."

Alternatively, referring again to FIG. 102, an external supply of pressurized gas could be introduced at this point. The independent gas supply pathway can be run parallel to the adhesive supply channel either in a higher, lower level or even the same level in the attachment stack. This independent gas supply pathway's gas source might be pressurized gas in the base unit or vapor generated by heating a fluid in said independent gas supply pathway.

****Nozzle Stack

In the first embodiment, the attachment stack was shown as has having only one level of nozzles that output only one type of liquid, namely an UV curable adhesive. The only other output level shown was for UV light. This previous configuration was presented first mainly because it was the best embodiment for illustrative purposes. However, we can imagine other embodiments that have several levels of nozzles that output liquid. These various output nozzles on different levels work together to facilitate attachment of hair extensions to scalp hairs. For example, a two part adhesive system where one level of nozzles outputs an adhesive and another level of nozzles outputs an accelerator fluid that hastens the cure of said adhesive. When both parts combine on the hairs held in front of them, the adhesive will harden rapidly. In a similar manner, one level of nozzles could apply a durable but slow curing adhesive means, while another set of nozzles follows this with a fast hardening but much less durable adhesive means. Ideally, the faster curing adhesive means would be applied over the slower curing adhesive means, so that it would not only attach hairs together but also temporarily serve as a protective coating that prevents the slow curing adhesive from escaping. An example of a pair of a slow and a fast curing adhesive is a cyanoacrylate, a slower strong adhesive, and a wax/rosin mixture that hardens rapidly upon cooling. However, to optimize the use of such a multiple nozzle level system, additional nozzle levels should be added and used in accordance with a precise algorithm.

FIG. 104 is a perspective representation of the stack of nozzles and intakes present in a single attachment chamber. Although no attachment chamber walls are shown, the two long cylinders represent a scalp hair 41D and hair extension 41E held together in an attachment chamber. Each output nozzle will typically, but not always, have a width thinner than each attachment chamber and will be centered on the left wall of each attachment chamber. Alternatively, the vacuum intakes will usually have a width equal to several attachment chambers, and will be shared by the several attachment chambers in a single attachment area.

These attachment chambers are formed by the notches in the pincher shown in FIGS. 9 & 10, being pressed up against the left wall 16F, in FIG. 16, of the attachment area 1F, in FIG. 3. Thus, the nozzles that we are discussing are arranged in a vertical stack along the left wall of the attachment area.

Adhesive will generally be applied in a manner that forms a thin film along a length of the hairs that are being attached together. In order to do this, after a liquid, such as an adhesive is applied to the hairs, one or more nozzles may blow a certain amount of air or gas into the attachment chambers. Air blown into an attachment chamber will move through it along a largely vertical line. This will flatten the liquid along the surfaces of the hairs, without the need for atomization. Alternatively, instead of blowing air, a vacuum intake could flatten the applied adhesive by generating high velocity air currents that flow past the adhesive. Any excess adhesive that cannot be flattened will be sucked into the vacuum intake. Naturally, blowing and sucking could be used together.

As shown by FIG. 104, cyanoacrylate adhesive is output onto the hairs from level 104C. Under the force of a vacuum 104D, it is spread down a certain length of the hairs until any excess is pulled into the vacuum intake. Next, a hot wax/rosin liquid is applied in a similar manner from level 104E. This wax/rosin must be kept hot in order to remain liquid. In order to maintain its temperature, a closed circuit heating channel level 104F is placed below the wax/rosin level. The closed circuit heating channel is composed of liquid passageways much like those described for the nozzle outputs. However, the closed-circuit channels are not open on their ends but form a loop that returns their heating liquid to the base unit. In other words, hot water will typically be pumped from the base unit through a closed-loop.

Each tine will have its own closed-loop, but these loops can share a single delivery line similar using a scheme similar to that previously shown FIG. 3 for the adhesive outputs. However, the return sides of the loops cannot be connected together on a single manifold-level, as shown in FIG. 3, because such a connection would intersect with the delivery sides of each tine. To solve this problem, the return loops could be commonly connected by forming a manifold into a different level of the attachment stack itself. However, more ideally, this second level of common connection manifold will be placed on a different level by forming it as separate molded part that splits the single return line into multiple branches before connecting to the attachment stack. Thus, by straddling the delivery loop tines, these multiple output branches could be plugged as a unit into the individual return loop holes (one per tine) on the attachment stack. Note that in this description of the connection scheme, the configuration of delivery and return can be interchanged.

Notice that below the wax/rosin level is a level 104G made of a thermally insulating material that prevents the wax/rosin level's heat from escaping to levels below.

Once the wax/rosin liquid is applied to the hair it must be rapidly hardened by rapid cooling. This is best achieved by application of a cool liquid through nozzle level 104H. This cool liquid can be chilled water or even a chilled organic solvent such as acetone. Notice how the chilled coolant is kept cold by a closed-circuit coolant loop level 104I. Notice how the chilled hardening coolant is applied by an output nozzle on its level and sucked along the length of the hairs by the (universal disposal) vacuum intake level 104D. The chilled coolant will likely be able to harden the wax/rosin in a fraction of a second.

The end result is that the wax/rosin by coating the exterior of the hair bundle is both holding it together and holding in the liquid cyanoacrylate that requires several minutes to become hard. Thus, the attached hairs will be able to leave the attachment chamber without getting cyanoacrylate on anything.

During this process, the walls of the attachment chamber, despite likely being coated with a non-stick substance, are likely to get coated with adhesive and wax/rosin themselves. In order to prevent build up, they might be washed with hot cleaning fluid. The cleaning fluid will be supplied by an output nozzle 104J in the stack and sucked up by vacuum intake 104D. The cleaning fluid used should be hot enough to remelt the wax/rosin, and of a chemical nature so that it keeps the wax/rosin dissolved even it even if it were to cool down. An oil is an example of a fluid that can do this. Also, the cleaning fluid should have the ability to dissolve liquid cyanoacrylate adhesive. Adding a powerful organic solvent such as acetone to the cleaning fluid will allow it do this. Alternatively, two separate output nozzles with two separate types of cleaning fluid could be used. In fact, the chilled coolant output nozzle 104H could be filled with acetone itself. Although chilled acetone is capable of dissolving wax/rosin, it will harden wax/rosin much faster. Thus, the chilled acetone can be applied quickly to harden the wax/rosin coating on the hairs without dissolving it off. Although not shown in this drawing, the vacuum disposal intake could itself be kept heated with a closed-loop system. Realize that the cleaning fluids are typically not introduced into the attachment chambers until after the attached hairs have left them. The attachment chambers might be cleaned in this manner every fraction of a second when no hairs are in them. This period of time will be called the cleaning phase.

This drawing shows three of the most optional levels. The first of these optional levels, level 104K, applies a slurry of adhesive mixed with sand or other particles. The purpose of these particles is to increase the peel strength of the attachment. However, such a slurry might not provide an entirely invisible attachment. For this reason, this peel-strength increasing formula should only be applied to a short length of the bundle of hairs. More specifically, it should be applied towards the top of all adhesive applied. At the top of the attachment bead, it will protect the entire attachment bead from being peeled apart. The lower-lying length of adhesive, without strengthening particles, will serve to further strengthen the shear strength of the attachment, while remaining invisible. In order to apply the slurry to only a short segment, a special slurry output nozzle 104K placed extremely close to a dedicated slurry vacuum intake 104L is used. This dedicated slurry vacuum intake would only be activated immediately after the special slurry is applied. Further features of note in FIG. 104 are the roof level 104M, thermal insulation level 104N, optional spacing level 104O, spacing level 104P, and floor level (perhaps thermally insulative) 104Q.

The algorithm described above is not the only way attachment can be done. There are similar but different algorithms that can be used to attach hairs. For example, a simpler stack that does not have all of the components present in this stack can be used. For example, a stack with only an adhesive output nozzle and a wax nozzle could be employed. In such a set up, the system might flood the entire attachment chamber with cyanoacrylate adhesive, or another suitable adhesive, and then apply negative pressure in the cyanoacrylate nozzle in order to suck the excess back into it. This would leave only a thin coating of adhesive on the hairs. This process could be repeated for the wax/rosin nozzle or even the cooling nozzle if used. Further still, a cleaning fluid nozzle that functions in a similar manner might be introduced. However, in order to avoid using contaminated cleaning fluid, its nozzle most likely would not suck back but, rather, there would be a separate vacuum intake or the fluid would simply be allowed to escape from the system. Similarly, the stack might be configured slightly differently if a different type of adhesive was used. For example, a permanent adhesive that hardens based on cooling it (likely a thermoplastic) wouldn't require a temporary protective coating.

Additionally, refinements can be made concerning the application of cyanoacrylates and similar adhesives. These adhesives cure rapidly upon exposure to water and other some other chemicals. This is desirable from the standpoint that they'll achieve a certain amount of bonding strength faster. However, if cured too fast, these adhesives will not be as strong. Thus, I propose the following technique to take advantage of their fast-cure property without loss of bonding strength. After application of a cyanoacrylate (or similar adhesive) to the hairs in the attachment chambers, using another nozzle set, apply an cure-accelerating substance, such as water, using another nozzle set. This cure-accelerating substance might be applied as small drops, as atomized in an air (or gas) steam, or as a true vapor in a gas stream, for example steam in air. However, ideally, only enough accelerator is applied to cure a thin protective coating on the surface of the adhesive bead leaving the internal portions uncured. This thin protective coating will give the adhesive bead additional strength during the temporary protective coating application phase. In other words, preventing permanent adhesive disruption by the temporary protective-coating application itself. However, since only a thin layer of the exterior will have been cured, it will only remain this way for a very short while, perhaps, only a fraction of a second. After this short period, the uncured portions below it will redissolve the coating. Now, with the temporary protective coating encircling it, the once again liquid permanent adhesive is free to cure more slowly and strongly. Finally, including substances in the protective coating that aid the permanent adhesive cure is a possibility.

Shut Down Between Users:

When the machine is shut down between users, the adhesive nozzles could be temporarily capped and protected from the environment, such as by one of the following methods:

1. Allow excess wax into the attachment chambers. Reopen the attachment chambers with a stream of hot oil/acetone cleaning fluid, or any other heated or solvent-type fluid.

2. Allow the adhesive at the nozzle tips to cure, but then, reopen them with a flood of cleaning solvent from the cleaning solvent nozzles.

3. Simply use negative pressure to pull the liquid backward in the nozzles. Thus, there will be air bubbles at the tips of the output nozzles. These bubbles would protect the liquid in the nozzles from the environment.

4. Use negative pressure to pull the liquid backward in the nozzles. Allow a certain amount of air into the nozzles, but at some point during this process, use another level of nozzles to introduce an inert fluid, such as liquid oil or gaseous nitrogen, into the attachment chambers. This inert fluid will be sucked up by the adhesive outputs and other outputs that are undergoing negative pressure. The end result will be that certain outputs, such as those for adhesive, will have the liquids that they contain protected by an inert fluid at their most exterior nozzle tips. And if necessary to protect the adhesive from the inert liquid itself, there will be a small air bubble between the two.

5. Use negative pressure to pull the liquid adhesive all the way back to its supply reservoir. Perhaps, construct the supply lines of Teflon or inject a washing fluid into said lines in order to lessen any residual adhesive in the supply lines.

*Means of Increasing Attachment Peel-Strength*

When talking about the strength of a hair-to-hair-extension attachment, we have two types of strength to consider. The first is tensile-shear strength. This type of strength is measured by attaching two hairs with their shafts parallel to each other, and then pulling on alternate ends of the hairs from opposite sides of the attachment point. Cyanoacrylate adhesives provide extremely good tensile-shear strength attachments. So good that a scalp hair will usually be pulled from the scalp before its attachment fails. The second type of strength is peel-strength. This type of strength is measured by attaching two hairs with their shafts parallel to each other, and then pulling both hairs apart hairs from the same side of the attachment point. In other words, peeling them apart in a wishbone fashion. Compared to their tensile-shear strength, cyanoacrylate adhesives provide very low peel-strength.

Low peel-strength is not altogether undesirable. Most importantly, hair extensions attached to the head would not be expected to experience significant peel-forces under normal conditions. This is because for the hairs to experience great peel-forces a person would have to grab the hairs in the same manner that they would grab a wishbone. Specifically, they would have to use two hands to pinch hairs that are close together on the scalp and then pull their hands apart, while maintaining their grasp. The only time a person would typically be expected to do something like this is while braiding the hair.

Finally, low peel-strength is desirable from the standpoint that it acts as a safety mechanism. If somebody is braiding the hair in an overly aggressive manner, it is far more desirable for the hair extension attachments to fail rather than breaking the natural hairs growing out of the scalp.

Despite the advantages of low peel-strength, should a higher peel-strength be desired, the following methods can be used to increase peel-strength:

****Increasing Peel-Strength by Mechanical Manipulation of Hair Shafts

A laser or mechanical means could cut small holes in scalp hairs or hair extensions in order to allow the adhesive more intimate contact with them. Such a laser system could be configured in a tine pattern, as the UV outputs were in the original embodiment, and placed as a layer in the attachment stack or even adjacent to spinneret holes in order to process hair extensions the moment after they have been extruded in the manufacturing process (see discussion on hair extension manufacturing). If a mechanical part is used to make small perforations through scalp hairs or hair extensions, it could be configured as a moving tine structurally similar to the pincher placed either in the attachment stack or hair extension manufacturing process.

Regardless of whether a laser or mechanical part, if used in the attachment stack, it should cut notches or small holes through hairs or hair extensions near the area where adhesive is to be applied to them. The attachment stack's algorithm might be adjusted to allow hair extensions into the attachment area before scalp hairs. This way hair extension tips could be perforated alone without perforating, and thus weakening, the natural scalp hairs.

****Increasing Peel-Strength by Using Adhesives Composited with Stronger Polymers Some adhesives, such as pine rosin, are adequately sticky to hold two hairs firmly together against tensile-shear forces. In fact, they are attached well enough that an attached hair extension could pull a hair root from the scalp before coming unattached. However, rosin and some other functionally equivalent adhesives have incredibly weak peel-strengths and low resistances to heat. Similarly, there are polymers, like polystyrene that are relatively structurally sound with respect to peel-strength and heat resistance but have very little tensile-shear adhesive ability. This is to say these polymers will form a strong ring around hair fibers but won't hold onto them. By mixing a sticky, but otherwise structurally and thermally unsound, adhesive like rosin with a structurally and more thermally sound polymer, like polystyrene or an acrylic, a composite that has both adhesive tensile-shear strength and peel-strength can be achieved. In the case of a rosin and polystyrene composite, a hot-melt type adhesive would be produced. However, adhesives composites that cure by chemical reactions are also possibilities.

The use of hot-melt thermoplastics, especially those (such as polystyrene) that are dissolvable by organic solvents, is desirable. Such substances could be applied through heating and cooling but removed by a solvent such as acetone. As mentioned above, such thermoplastics may be improved by mixing a sticky substance, such as rosin, with them to increase their ability to provide tensile-shear strength by sticking to the hair better. Furthermore, other ingredients may be mixed with thermoplastics to adjust their melting point up or down and increase their peel-strength such as by mixing fibers or particles into them. The thermoplastic or hot-melt type materials used to increase peel-strength shouldn't be limited those discussed such as wax and polystyrene. Any functional equivalent that hardens to an acceptable peel-strength upon cooling could be used. Likewise, the sticky adhesive shouldn't be limited to those discussed such as rosin, any functional equivalent could be used. For example, the various sticky adhesives used on adhesive tapes could be used.

Finally, when using these sticky adhesive composites, there is a chance that the exteriors of the attachment beads will themselves be sticky. To counteract this stickiness, a fluid, or any other substance whose molecules themselves will be bound by the adhesive should washed sprayed, or otherwise exposed, over said bead, thereby, counteracting external stickiness. Such a substance could be integrated into the cleaning fluid formula or applied separately. Alternatively, this counteracting-substance means could include using a hot-melt fluid that's not sticky, thereby, applying a non-sticky outer coating. Finally, enough solvent, perhaps as part of the cleaning fluid, could be applied to wash only the external stickiness away. In all cases, the measures will most likely be applied in the attachment stack but they might also be applied after exit from the attachment stack.

****Increasing Peel-Strength by Using Adhesives Composited with Strengthening-Particles Application of adhesive with peel-strength-increasing particles, such as fibers, sand or small glass beads, could be used to increase adhesive peel-strength. Using fiber or particle composites to increase peel-strength opens up to possibility of using many types of adhesives whose peel-strength might, otherwise, be too low. For example, a waxy or hot-melt thermoplastic type material becomes a possibility. A wax or a thermoplastic with a very high melting point could be applied and strengthened by application fibers or sand particles.

Below are some various application methods for applying adhesive-particle composites:

1. Apply adhesive to the entire length of attachment point
   - -A. Blow-dry particles onto the adhesive which didn't have particles in it
   - -B. Mix an adhesive and particles together in a slurry before adhesive application.
     - --1. Use vacuum and/or pressurized air to spread the adhesive as described above
     - --2. The suck-back (dipping) approach: Squirt out and suck back the adhesive into the topmost high peel-strength adhesive nozzle, but only enough to descend the desired length down the hair. Note: During the cleaning phase between adhesive application, it is likely that a certain amount of sucked back adhesive at the nozzle tip will be discarded rather than risking contamination by mixing it back with the main supply.
2. Apply sand only to the top most portion of the adhesive attachment point length.
   - -A. Blow-dry sand particles onto the adhesive which didn't have particles in it.
     - --1. Use little enough vacuum disposal. intake power that the sand doesn't descend much vertically.
     - --2. Use a second higher dedicated vacuum that is only turned on during sand output, and maybe a little bit during the cleaning phase.
   - -B. Squirt an pre-mixed adhesive and particle slurry:
     - --1. Use little enough vacuum and/or pressurized air that the sand slurry is squirted out and descends very little vertically
     - --2. Use a second higher vacuum that is only turned on during sand output, and maybe a little during the cleaning phase.
     - --3. The suck-back (dipping) approach: Squirt out and suck back the adhesive into the topmost high peel-strength adhesive nozzle, but only enough to descend the desired length down the hair.

****Equipment Concerns Relevant to Using Adhesives Composited with Strengthening-Fibers The type of particle mixed into the adhesive to increase peel-strength could be small fibers. Generally, strengthening-fibers should have a length shorter, or not much longer, than the minimum diameter of the adhesive supply line and nozzles. These fibers should be made correspondingly thin in diameter themselves to achieve a certain degree of flexibility. These small fibers could be pre-added to the adhesive tank and agitated into suspension before each use.

The suspension in the tanks could be filtered with a screen, perhaps configured as a centrifuge, whose screen holes are equal to or slightly smaller than the smallest diameter of the adhesive feed line. This screen should be placed just before introduction into the adhesive supply line. Perhaps, said screen is enclosed in the same airtight chamber as the adhesive reservoir tank. In which case, it might be placed in the tank above the liquid level and liquid would be pumped into and returned through it either into the main tank or a smaller area that directly feeds the adhesive supply line. Its purpose would be to function as a filter to remove excessively large particles in the adhesive. Otherwise, these particles might clog the adhesive supply line if left in the adhesive.

Note: All sand and fiber slurry nozzles may have their slurries pumped to them as a continuous line of liquid slurry or the slurry could be delivered in isolated globs separated and forced through the supply lines by bursts of pressurized gas as shown in FIGS. 103 and 103.1

****Increasing Peel-Strength by Application of Chemical Vapor Deposition (CVD) Film Rings As the Attachment Adhesive Another possible way of increasing peel-strength is to somehow apply a ring of extremely strong material around the hairs that are to be held together. The inorganic solids formed by Chemical Vapor Deposition (CVD) are much stronger than polymer-based adhesives. CVD is a process that introduces two or more gases into an area and then exposes them to an energy source such as heat. The energy causes a chemical reaction resulting in the deposition of a solid. Many solids formed this way are extremely pure, and as such, extremely strong.

CVD rings could be generated around hairs to be attached by introducing gases and energetic light, or other energy, into the attachment chamber. The outputs would be arranged in a stack similar to the one shown by FIG. 104 and previously described. The gases would be output by nozzles very similar to those previously described for use with liquids. A tine-shaped prism that carries light via internal reflection could output the energetic light, most likely Infra-Red (I.R.). This light transport system would take a configuration much like the one previously described for carrying UV, in order to effect adhesive curing. A vacuum intake might be used to remove excess gases. In order to contain the gases in the attachment chambers, the pincher should make intimate contact with the left wall of the attachment chamber. The seal between the left wall and the pincher might be increased by making the pincher out of or attaching to it a soft flexible material. For example, small sheets of rubber placed on the exterior of pincher and extended partially over its notches could help increase this seal. The CVD system could use the following attributes to help enhance its function:

- -The interior notches of the pinchers could be reflective so that they reflect any light that goes through or around the hairs in the attachment chamber back at the hairs. This reflective surface will also help prevent the pinchers from themselves being significantly heated by the energy source.
- -Alternatively, the pinchers could have their own internal reflection light transport system constructed into their interior. This system would be similar the UV transport system previously described, except it would be constructed in the interior of the moving pinchers instead of the interior of static portions of the attachment stack.
- -The pinchers should be cooled either internally or externally by fluid. If an internal system were used, this fluid cooling system would most likely use a closed-loop coolant circulation system, similar to that previously described for cooling left wall nozzles of the attachment stack. If an external cooling system were used, it would most likely be based on left wall output nozzles spraying a cooling fluid through the attachment chamber and onto the pincher's interior surface.
- -The small bundle of hairs to be attached in each attachment chamber should be quickly heated up with focused I.R. Presumably, if a low enough frequency of I.R. were used, it would deeply penetrate and heat up the entire bundle at once rather than being stopped by the most superficial surfaces of the bundle.

--If the I.R. can't penetrate the bundle well enough, the of use focusing reflectors on the inside of the pincher that reflect any light that went around each hair bundle back at specific point said hair bundles could be provided. This will provide the light necessary to cause vapor deposition on sides of the hair bundles far relative to the left wall optical outputs.

Below are some characteristics and dimensions that CVD rings attaching hair bundles should ideally have, but they are not limitations:

--Diameter of one hair is about 50.7 microns

--The CVD ring around attached hairs should be 50–300 microns high, or long relative to the length of the hair.

--The ring's wall thickness should be about 3–5 microns

--The ring's diameter should be 100–200 microns

--Ideally, this ring should be clear

--The ring should have a high tensile strength

--The ring should be applied in about 0.25 seconds or less

--The application temperature should be <140–320 degrees C.

--Ideally, it should be brittle enough to be smashed off or somehow chemically dissolvable, such as by an acid. For example, calcium carbonate can be formed as a clear solid that can be dissolvable by moderate strength acids.

****Increasing Peel-Strength by Applying Coating Patterns to Keratin Fibers (as Opposed to Entire Surface Uniform Coatings):

Coating patterns applied to the surface of the hair extensions might could be used to either increase adhesive peel-strength or decrease the coefficient of friction of a hair extension's surface, thereby, making peeling an attachment point apart much more difficult. Such coating patterns would most likely be applied during the hair extension manufacturing process. Thus, for more details on this consult the section of this document that deals with hair extension manufacturing.

*Utility Features (Safety/Maintenance)--Stack Level*

The attachment stack might have certain features. incorporated into it that ensure safety and system maintenance. I call these features utility features. The following are such utility features:

****Escaped Electro-Magnetic Radiation Detector

In systems that use intense ultra violet, or any other type of intense electro-magnetic radiation, detectors might be used to detect escaped electromagnetic radiation. Usually, when intense electromagnetic radiation is used, it will be confined to a closed area. For example, the pincher, by being pressed against the left wall, could in large part be used to form this closed confining area. The isolation of this area could be further aided by an attachment chamber seal as previously described for containing gases in the CVD system. However, if there is a breach in this closed area allowing electromagnetic radiation to escape, a detector could alert of this. The alert could merely be audible, visual, or might shut the entire attachment system off. The detector should be placed along a line of sight to the attachment area where the electromagnetic radiation is being used. It may be placed above or below the attachment stack or even incorporated into the attachment stack as a layer within it.

****Automated Lubricant and Cleaning Solvent Outputs

The moving parts of the attachment stack will benefit from occasionally being lubricated and cleaned. For this reason, it might be advantageous to incorporate automated lubricant and cleaning solvent outputs into the attachment stack circuit itself. In this case, the outputs could be positioned in a similar manner to the adhesive outputs. Alternatively, the outputs could be configured in an entirely different manner. For example, placed well above the attachment stack, perhaps, as a part independent of it. Cleaning and lubrication could be performed by introducing solvents and lubricants separately. Alternatively, a solvent, such as acetone, could be mixed with a light lubricating oil. Most of the used solution could be drained into a reservoir. Very likely, this reservoir means would include a fixture to hold the handle unit and a lid to prevent splashes. The acetone portion of the residual solution would evaporate leaving the lubrication portion behind on the moving surfaces in the attachment stack. This cleaning process could be trigger automatically, for example, between every salon client. During this automatic triggering, the moving parts of the system would likely be activated so as to distribute the solution evenly. Acetone itself is a disinfectant. However, inclusion of other disinfects, if necessary could guarantee absolute cleanliness between clients.

At certain times automatically or manually triggered by a user, the internal fluid supply lines (such as for adhesive) might be cleaned by flushing them with solvents and/or hot fluids. These flushing fluids might simply be delivered out of the fluid outputs (nozzles) or they could be actuated back and forth in the lines in a forward and reversing motion, perhaps, under great pressure. To facilitate introduction of cleaning fluids the supply lines might have valves that shunt their normal fluid supplies in preference for the flushing-fluid supply.

[[Hair Extension Supply and Storage]]

*Hair Extension Feed Using Clips*

The hair extension holding clips, described in the original embodiment, can be said to be a pinching holding means because they hold hair extensions by pinching them. When supplying the system with hair extensions using holding clips, there are several concerns:

****Bending Hair Extensions Over Connectivity Bridges while Keeping them as Firms as Possible with the Straightening Peg:

Referring to FIG. 27, in order to give the hair extensions plenty of room to bend over the attachment stack's connectivity bridges, without causing a significant vertical curve in the hair extensions, the connectivity bridges could be placed even with or well behind position 27C where the hair hopper is wide and hasn't narrowed yet. In such a configuration, the hair extensions are free to bend more to the sides than if they were forced to bend over a connectivity bridge placed even with position 27D where the hair extension hopper's passageways narrow.

Figure 28:
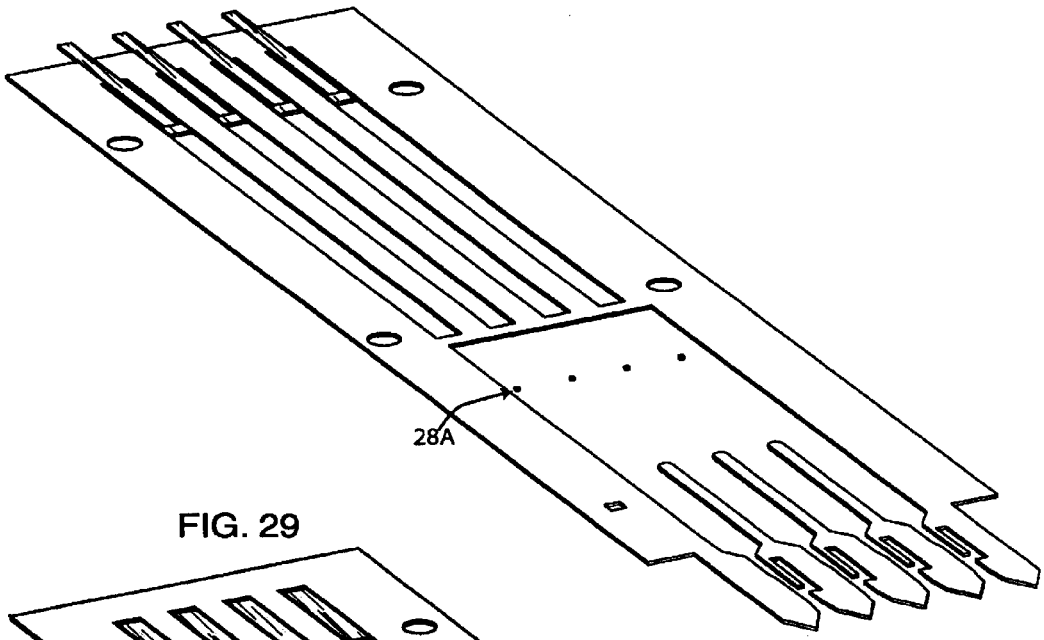
FIG. 28: A hair-hopper level illustrating the cross-section of spring-pins running through it. It represents the level of the stack on top of that depicted by FIG. 27. (Top Front Perspective View.)

Possibly, all connectivity bridges could be placed behind the rearmost hair extensions and the straightening pegs 28A, in FIG. 28, of the hair extension clips. This would mean that the hair extension tips would never have to bend over a connectivity bridge. Also, this would mean that the straightening peg could continue all the way down to the floor of the hair extension channel (tip trench). This would give further support from all sides for even very curly hair extension tips. The disadvantage to this design is that all tines whether those of the moving hair handlers, or some part of the stationary guide channels, must be made longer. This increase in length will make them less structurally stable.

In configurations where the straightening peg starts behind the connectivity bridges, at least it could be brought down as close to them as it needs to be. Fortunately, the straightening peg only has to keep the hair extensions rigid down through the thickness of the hair handlers because the pincher will pull the lower portions of the hair extensions into alignment.

****Hair Extension Tip Flexibility

When a hair extension is bent over a connectivity bridge, the slope of its bend angle is largely set by the bottom of the straightening peg. If the straightening peg comes down close enough to the top connectivity bridge, the slope of the bend angle can be almost a right angle. If the straightening peg comes less close to the top connectivity bridge, the slope of the bend angle will be less sharp. The sharper the hair's bend angle, the more spring force in it and the faster the hair will fling over the far edge of the topmost connectivity bridge.

Air currents could be used to straighten hair extension tips that are not being held in an adequately stiff manner by the hair extension dispensing system. For example, air blown straight down into the attachment area from nozzles above said area could straighten hair extensions tips. An excellent place to put such nozzles would be in the interior and underside of the hair hopper's channel obstructions. Such nozzles could be fed with air by a hollow tined-manifold.

The length of the tines from where their connectivity bridges end to where their functional areas begin should, generally, at least be equal to the depth in the attachment stack from the top connectivity bridge that hair extension must pass over down to the desired depth of the hair extension tip. This will allow hairs to fully straighten out in the hair extension tip trench 3C, in FIG. 3, before coming in contact with any functional areas of the hair handlers.

Previously, I said that the sides of the clips serve much the same function as the sides of a crimp on a paintbrush. Further still, the narrowed sides of the hair hopper also aid this function, and they help at lower levels closer to the hair handlers. The tips of the held-hair extensions extend down into a passage with vertically parallel walls 27F on two sides, as shown in FIG. 27, and a third obstructing wall 27G at the front. This third obstructing wall, which is part of the channel obstruction, is placed generally above the attachment area. It prevents the hair extensions from advancing too far forward past the attachment area. Of course, its exact placement depends on empirical calibration, and we may want the hair extension top to advance a little past the attachment area.

The hair extensions are usually held at a short enough distance from their tips so that their tips extend down in a relatively stiff manner. These tips are inserted downward into a cavity carved into the attachment stack. This cavity is known as the tip trench. This cavity and the tips of the hair extensions inserted into it extend at least down to the depth of those hair handlers responsible for hair isolation.

Because of the above-described factors, the hair extensions in each clip will be move with it as a bunch to the functional areas of the hair handlers. The hair extensions will be moved forward along a line largely perpendicular to the sides of their erect tips. The clips must pinch the hair extensions with enough force that they do not fall out during movement and do not fall out as their previously attached neighbors slide by them, as said neighbors are pulled from the clip.

*NON-CLIP-BASED Hair Extension Feed*

****Substitute Conveyor Belts for Clips

-The Parallel Pinch AND Convey to Attacher(Conveyor Belt Feed)

A non-clip based system that holds and moves hair extensions by using largely parallel pinching surfaces can be configured. It could best be described as a rotary conveyor system that pinches between opposing parts. Although two rotating opposing solid objects, such as two disks, fall under this definition and could be used, most likely it would take the configuration of two opposing conveyor belts which pinch hair extensions together between each other and whose interior belt portions both move in the same linear direction. Said belts can be visualized as using the two opposing belt surfaces to substitute for the two opposing surfaces of the hair extension clips previously described. However, while the hair extensions in the clips move with the clips. in a conveyor system they could be said to move through the system as a whole to a larger extent than they move with it. As with the clip-fed system, the hair extensions most likely move in a line largely perpendicular to their shafts.

The conveyor belt system itself must be fed with hair extensions, and this can be done in any of the following ways:

- -Hair holding clips either distant or on the handle unit itself could be the source. Distant means that they are not on the handle unit but somewhere such as the base unit. If the source hair extension holding clips are on the handle unit itself, the pinching conveyor system will be positioned on the handle unit between said clips and the attachment area where it brings the hair extensions.
- -A hair extension remover system that cut scalp hairs off the scalp hair or removes hair extensions, as previously described.
- -A spool system that unwinds to feed the conveyor belt. This spool will either have to be wound with hair extensions already cut to length, or allied with a cutting means that cuts them during unwinding.
- -A pile of free hair extensions lying largely parallel to each other in a container such as a box. A funneling hopper type means might be used to initially guide hairs from this pile into the conveyor system.

****The Parallel Pinch AND Convey Hair Extensions Using a Thread-the-Eye-of-the-Needle Type Design:

Another means of dispensing hair extensions involves unwinding them from a spool, therefrom, threading them, perhaps, directly into the attachment areas in which they are needed. There are two basic ways to unwind hair extensions from a spool:

Referring to FIG. 105, the first way 105A is to surround the spool with a path guide means 105B that will only allow hair extensions 105C unwound from the spool to extend only along the path bounded by said path guide means. Such a system could externally supply a rotational force to the source spool 105D causing it to rotate in the direction that causes hair extensions on the spool to unwind. The hair extensions would be guided by the path guide means to their functional target area 105E. Often, such a functional target area is an attachment chamber.

The second way 105F, in FIG. 105.1, is to feed the hair extensions on the spool into a powered rotating or reciprocating engagement-conveyance means 105G that pulls on them causing them to unwind from their source spool. (Engagement most likely by pinching but other means such as hooking are possible.) This rotating or reciprocating pinching means may move hair extensions largely tangent or parallel to its rotating or reciprocating surface. After the hair extension tips exit said engagement-conveyance means 105G, they can be directed either to a path-guide means 105H that guides them to insertion in their functional target area 105E or without a path-guide means directly into their functional target area 105E in which they will be inserted. A path-guide 105H is used when the conveyance means is not close enough to its functional target area to guarantee that hair extensions will be inserted in to it. This type of system usually will need a hair extension cutting means placed between the engagement-conveyance means and the functional target area. This way, the hair extensions coming off the spool will be cut to the desired length.

Of course, a hybrid 105J, shown in FIG. 105.2, of the above two unwinding systems can be configured. It may contain any or all of the above-described components working in combination. For example, it may contain a spool that is externally supplied with a rotational force in the direction that causes hair extensions on said spool to unwind. It may contain a path-guide means 105K that directs hair extensions into a rotating or reciprocating engagement-conveyance means; it may also contain a second path guide means 105L which guides hair extensions from a pinching conveyance means into a functional target area. If need be, it may contain a hair extension cutting means. This cutting means need NOT necessarily be placed between the pinching conveyance means and the functional target area.

Different Types of Functional Target Areas

The functional-target area described above can be any one of, but not limited to, the following areas:

-Any area along the hair extension supply channel or pathway that feeds the attachment chambers. This includes but is not limited to the following. . .

-Into the areas of the hair extension channel that precede the metering areas.

-Into metering areas

-Into holding areas (They will be described later.)

-Into attachment areas or attachment chambers

-Any other area that needs hair extensions fed into it

Different Types of Rotating or Reciprocating Hair Extension Conveyance Means

The rotating or reciprocating hair extension engagement-conveyance means described above can take on several configurations including but not limit to:

1. Rotating belts or cylinders that themselves press against other rotating belts, cylinders, or static surfaces in order to both pinch and move hair extensions between.
2. A part that pinches hair extensions (in the manner described above) and moves along a largely a straight line. Then, it releases its pinch, retracts backwards. It repeats this process again by re-establishing its pinch and moving forward again.
3. A rotating hair extension grasping conveyance means that has pinching and releasing members mounted on a rotating cylinder or belt. It is similar mechanism to that is used by a commercial hair removal product called the Braun Silk-Epil.
4. As in #3, except the rotating surface does not engage by pinching but some other hair fiber engagement means such as a surface coated with a sticky substance, an attractive static electrical charge on its surface, or having small hooks or similar hair engagement features on its surface.

Different Ways of Spooling Hair Extensions

The hair extensions can be spooled in several different configurations including but not limited to:

1. One single long continuous hair fiber per spool that needs to be cut to length after it is unspooled.
2. Many long continuous hair fibers in parallel per spool. They are unspooled together, and each needs to be cut to length after unspooling.
3. The hair extensions have already been cut to length before being spooled. When unspooled, they usually will not need to be cut to length.

Hair Extension Wefts can be Unspooled and Attached

In addition to the entirely linear hair extensions described above, hair extension wefts can also be unspooled and attached to the head. Hair extension wefts are of multiple hair extensions connected together with a largely perpendicular (to their lengths) member, which is usually flexible and may be a fiber itself. Unspooling of hair extension wefts can be accomplished in much the same manner as hair extensions. Unspooled hair extension wefts can be applied in the following manner:

1. Adhesive may be applied to the lower portions of the hair extension wefts, most likely the unifying portions (those perpendicular to the hair extensions) of the hair extension wefts. This can be done anytime after unspooling. The adhesive can be applied directly to the weft before it touches the scalp or head hairs. Alternatively, it can be applied to the scalp or head hairs directly. The hair extension wefts can be attached directly to the scalp or to the sides of head hairs.
2. Hair extension attachment can be can be achieved by running a thread or fiber back and forth through both the lower portions of the hair extension weft and lower portions of the scalp hairs, thereby, sewing the hair extension weft to the lower portions of natural scalp hairs. In this configuration, the thread or fiber itself could be unwound from a spool, perhaps the same spool, as the hair extension weft that it will attach. (Such an oscillating stitch pattern is likely based on a mechanism functionally equivalent to a sewing machine.)
3. Once the first portion of a weft is attached to the head, the remaining portions can be unspooled simply by the tension that results in the weft as the system is moved over the scalp.

Hair Extension Weft Placement Among Natural Scalp Hairs

However they are attached, hair extension wefts have to be guided into areas where the natural scalp hairs have been moved aside. To accomplish this spooled hair extension wefts 105M, in 105.3, are unspooled into recessed attachment areas 105N from where hairs have been displaced, by the attachment stack tines 1050. Where said unspooled hair extension weft tips are led towards the recessed attachment areas by one or more of, but not limited to, the following methods:

-Hair weft assembly stiffness and an externally applied rotational force on the spool.

-Linear movement of the entire spool assembly towards attachment area.

-Rotational movement of the spool where the front tips of the hair extension wefts are guided into the recessed attachment area by path-guides.

-The leading portion of a weft is attached to the head, and the remaining portions are unspooled simply by the tension that results in the weft as the system is moved over the scalp.

-The spooled hair is first grasped by a pinching means that moves it to the attachment area. Subsequent unspooling is achieved because the hair extension . . .

. . . has been attached causing the spool unwind to relieve tension of the extension as the device is moved over the scalp . . . is subject to a cycle of repeated or continuous engagement and advancement towards the attachment area, such as by the engagement conveyance system described above.

Note: Although unspooling is the preferred method for dispensing hair extension wefts among natural scalp hairs, the above method for dispensing hair wefts through a recessed area in the attachment stack's tines can be adapted for use with other hair extension dispensing means. For example, such wefts could be held by clips or any other of the non-weft hair extension dispensing means discussed could be adapted. Also, note that the recessed attachment areas described for wefts are not identical to the attachment areas described in the original embodiment. When we speak of attachment areas, not in reference to wefts, we typically will mean a type more like that described for the original embodiment. Further, these recessed areas 105N in FIG. 105.3 needn't be open to the hair channels, rather they could be holes through the tines that are entirely closed on all sides. Finally, longhair wefts needn't be the only type of hair extensions attached to the scalp or scalp hairs through a recessed area like 105N, unified bunches of hair extensions could also.

****Unified Hair Extension Bunch Dispensing System:

Referring to FIG. 106, a unified hair extension bunch dispensing system where bunches of hair extensions 41E have their tips unified together, usually by a unifying object 106A such as by an anchor/bead/disk that, might already or may at sometime, have adhesive applied to its surface and will be attached either to the scalp and/or scalp hairs:

1. Where before dispensing the unifying objects are held in an interlocking rail/frame/bracket configuration, as shown by "Pure Rail Interlock Type Clip" in FIGS. 106.1 (front view of clip) and 106.2 (side view of clip).

--Where said unifying objects are slid down the rail 106C, and the rail itself remains still. This could be facilitated by a spring means 106B pushing directly on the unifying anchor beads themselves.

--Alternatively, where the entire rail assembly moves forward to advance a new unified bunch towards the attachment area. This could be facilitated by a spring means pushing on the rail assembly rather than the anchor beads directly.

2. Where the hair extension portions are pinched and the unifying anchor bead portions are held in or against a rail assembly, as shown by "Pinch and Slide Along Rail-Type Clip" in FIGS. 106.3 (front view of clip) and 106.4 (side view of clip).

--Where said unifying objects are slid down the rail 106C, and the rail itself remains still. This could be facilitated by a spring means pushing directly on the unifying anchor beads themselves.

--Alternatively, where the entire rail assembly moves forward to advance a new unified bunch towards the attachment area. This could be facilitated by spring means pushing on the rail assembly rather than the anchor beads directly.

3. Where the hair extension bunches are pinched but no rail or bracket is used to directly stabilize the unifying anchor beads. In other words, the hair extensions bunches are held in hair extension clips, as described in the original embodiment. The unifying anchor portions if any do not secure said hair extensions in said clips. However, unifying anchor portions would likely be used to either help isolate a limited bunch of hair extensions, so the attachment system doesn't have to, or to attach said bunch to the scalp. For example, each unifying anchor portion could facilitate the attachment of a bunch of hair extensions directly to a bald scalp. Perhaps, the bottom of said bead could even have a sticky adhesive pre-applied to it. Likewise, each unifying anchor could attach itself and, thereby, its bunch of hairs to the sides of natural scalp hairs.

Note: Of course, whenever hair extensions have pellet-like anchors at their bases, the loading system very likely will manipulate these pellet-like anchors directly in preference to the fibrous portions. The manipulations could use the familiar hair handler mechanisms, however, scaled up to deal with pellet-like structures rather than the thinner hair fibers. Also, regardless of how bunches of hair extensions are attached together said bunches might be attached directly to the scalp. For example, hair extensions might be held into bunches by adhesives or being melded together, such as by heat or chemicals.

*Safeguards Against Deviant Processes*

****Means of Handling Deviant Hairs

To Prevent Unmetered Hairs from Entering the Attachment Area:

Extremely short scalp hairs can cause several problems. The main problem that said short hairs might cause is that they are too short to be manipulated accurately by the hair handlers. In such a case, an overly short scalp hair might pass under the entrance gates into an attachment chamber with another scalp hair. As such, two scalp hairs might undesirably get attached together. A second problem with overly short scalp hairs is that they might not be long enough to securely attach hair extensions to. Finally, in sophisticated embodiments of this invention where sensors are used, short hairs might be long enough to trigger a sensor but too short to be reliably kept straight by the hair straightening system and, as such, might not successfully be attached to hair extensions. In other words, the hair sensor system would be tricked into telling the computer to behave as if it were dealing with a viable scalp hair when it really was not.

To avoid these problems with overly short scalp hairs, it is best to make sure that such hairs lie relatively flat against the scalp. To a certain extent, short hairs might not be effectively held by the hair straightener and will fall to the scalp on their own. However, all overly short hairs will not do this. For this reason, we have to take action to make them lay flat against the scalp. There are at least two ways to do this. One way is to use air currents that force all scalp hairs that are too short to be held by the tensioning hair straightener towards the scalp. A second way is to trigger the hair handlers in such a manner that they will push down any hair that may have entered the attachment area in an unauthorized manner.

There are several ways to use air currents to force overly short scalp hairs to lie flat. Positive pressure air currents can be directed downward through the vertical thickness of the attachment area such as to flatten short stray hairs in or near the attachment area. These downward positive pressure air currents might be supplied from nozzles that point largely straight down over the attachment area. Using a hollow hair hopper channel obstruction with an air output on its underside is an excellent way to mount air outputs for such a downward pointing airflow. Alternatively, positive pressure nozzles can be positioned on a vertical wall in the attachment area, in a similar manner that the adhesive outputs are. Such nozzles will probably not generate an exclusively downward airflow. Instead, the airflow will create a positive pressure environment in the attachment area with airflow exploding out in all directions. This positive pressure will tend to push stray scalp hairs away from that attachment area causing them to lie down against the scalp.

Directing airflow largely parallel and along the bottom of the attachment stack will also usually cause stray hairs to lie down. This airflow can be generated using blown positive pressure air or sucked negative pressure air. The air outputs, or intakes, can be placed most anywhere below the attachment stack. A highly suitable location would be molding air outputs, or intakes, into the portions of the belt buckle that hang below the attachment stack. Most ideally, such positive pressure outputs could be placed vertically between the bottom the attachment stack and the bend-under system, assuming the kind of bend-under system that hangs below the attachment stack is used. Alternatively, the air outputs could also be placed below and to the sides of the attachment stack.

A great advantage of using airflow is that it can be directed or its intensity increased so that not only are loose hairs made to lie down in the attachment area but also the areas that precede the attachment stack where sensors might be used. This will help prevent sensors from being triggered by inviable overly short scalp hairs.

Earlier, I mentioned that hair handlers could be used to make overly short scalp hairs lie down. To do this, certain hair handlers that overlie the attachment area are triggered at the last possible moment before the authorized scalp hairs are brought in. This will clear the attachment area of short hairs that may have slipped under the higher-lying hair isolation system and entrance gates. An ideal hair handler to use for this would be a dedicated attachment area pushout actuator, or a part that is functionally equivalent. Ideally, the hair handlers used for this purpose should be placed as close to the scalp as possible. This is because hair handlers at higher levels might actually be too high to even come in contact with certain short scalp hairs let alone flatten them. As such, pushout-actuator type hair handlers should, ideally, be placed below most of the attachment nozzles and perhaps below the entire attachment stack. Possibly, the pullback hook could help clear the attachment area of short scalp hairs. One part that has two-axis motion that can act both as an attachment-area-pushout actuator and pullback in one might be ideal for this purpose. If any type of pullback hook is used for this purpose, it should be placed as close to the scalp as possible.

Dealing with Hair Extensions that do not Get Attached to Scalp Hairs:

Hair extensions brought into the attachment area may not always get attached to scalp hairs. This may happen because a corresponding scalp hair is not present to be attached or some type of adhesive malfunction. When it does happen, any unattached hair extensions will tend to remain in the attachment area. They will not be pulled away by the pullback hooks and bend-under system the same way hair extensions attached to scalp hairs are. This presents the problem of what do to with the remaining unattached hair extensions. If nothing is done, they will get in the way and if enough of them are allowed to accumulate they might jam the system. Clearly, these hair extensions should somehow be removed from the attachment area.

Recycling Unattached Hair Extensions

One way to remove the hair extensions would be in a manner that allows them to be recycled. One possibility for recycling them would be to open the hair extension entrance gate closest to the attachment area and any other gates between said entrance gate and the hair extension pushback gate. The pushback gate (gate farthest away from attachment area) itself should remain closed. Some type of hair handler that is capable of forcing the hair extensions backward behind the entrance gate should be employed. Next, the entrance gate closest to the attachment area should be closed. This would put the unused hair extensions between the pushback gate and the entrance gate nearest the attachment area. Next, the pushback gate (gate farthest away from attachment area) should be opened. Once again, the hair extensions should be forced backwards behind the pushback gate. The pushback gate should be closed and the hair extension have now been successfully recycled, because they are put back with the bunch that they originally came from and are ready to be metered out again.

However, the recycling approach described above has a couple disadvantages. First, it takes hair extensions that may be coated with adhesive out of the attachment area and puts them in contact again with other hair extensions and the hair handlers. This might cause adhesive to get in an undesirable location, or the hair handlers simply might not process adhesive coated hairs effectively causing them to jam the system. A second disadvantage is that this approach makes it impossible to meter out a new group of hair extensions while the group ahead of them is being attached. For these reasons, a hair extension recycling approach that does not require the hair extensions to leave the attachment area is preferable.

The steps below describe one such hair extension recycling approach:

1. Use the pushout actuator to push attached hairs out of the attachment area. Although placed relatively close to the scalp, the pushout actuator should be placed far enough above the scalp that it effectively moves the hair extension tips.

2. Move the slide out preventer out over the attachment area.

3. Trigger the pullback hook. It will pull the scalp hairs and attached hair extensions backwards, but not the unattached hair extensions. Instead, the unattached hair extension tips will flexibly yield to the under-passing pullback hook, as such, remaining to the right of the pushout actuator near the attachment area. To facilitate this, the pullback hook should be placed close to the scalp; probably below even the adhesive nozzle stack.

4. As an optional step: Move a hair extension distributor (like the pincher except it is notchless and only a single-level thick. It only moves to the left about as far as the right edge of the slide-out preventer. It may be mounted on a flexibly jointed tine to make sure does it does not go too far past said slide out preventer edge.) Its actions will distribute hair extensions evenly along the right edge of the slide-out preventer.

5. Make the hair extension transport-forward gate carry the next group of hair extensions into their positions in the attachment area.

6. Trigger the pincher's movement towards the left wall. This will, as evenly as possible, fill the pinchers notches with the recycled hair extensions. (Evenly because the recycled hair extensions have been pressed up evenly along the right edge of the slide out preventer.)

7. Before the pincher has completely reached the left wall, when its front is largely even with the right edge of the slide out preventer, make the slide out preventer retract. This will allow the recycled hair extension to join the new group of unattached hair extensions, in individual notches of the pincher.

8. Close the slide out preventer over the attachment area notches once again.

9. Retract the pincher to the right, away from the hair extensions. The hair extensions will remain divided in notches because the hair extension transport forward gate has remained in the attachment area, and the slide out preventer guarantees that they will stay in the hair extension transport forward gate's notches.

10. Make the scalp hair transport forward gate carry the next group of scalp hairs into the attachment area.

11. Make the pincher move towards the left.

12. After the pincher has made it partially under the slide out preventer, but usually before the pincher makes it all the way to the left, retract the slide out preventer. Scalp hairs have now joined the new and recycled hair extensions in individual pincher notches, also know as attachment chambers when pressed up against the left wall. The attachment process may now occur. If all goes well, all the unattached recycled and new hair extensions will be attached to scalp hairs this time.

13. Optional: In order to buffer an excess of unattached hair extensions, the hair extension transport-forward gate could be configured with extra notches directly behind, or in front of, those that match up with attachment chambers. These extra notches would not be filled with new hair extension, nor would they match up with the underlying nozzle stack in order to form attachment chambers. The sole purpose of these extra notches is to provide a temporary space for excess unattached hair extension in case an unusually large number fail to attach in a given time period. Thus, their reuse can be spread out over several attachment cycles instead of jamming the attachment chambers on a single cycle.

In order to make sure the unattached hair extensions participate in the above process, we should make sure they enter the notches of the hair extension transport-forward gate. As shown in FIG. 107, this can be achieved by having some structure like a portion of the channel wall or another hair handler overhanging, or underlying, the front and back sub-tines 107A and 107B, respectively, of said hair extension transport-forward gate. This is to make sure the unattached hair extensions only have access to the notches of the transport-forward gate, and they cannot get positioned in front or back of it. Referring to FIG. 107, this overhanging, or underlying, structure 107C is shown in hatching.

On a similar note, it is advisable to allow the pullback hook gate, or some other portion of the system, to completely overhang, or underlie, the pincher notches in their recessed positions to right in order to prevent entry of exiting hairs into said notches. If exiting hairs were allowed to reside in the recessed pincher notches while the pullback hook gate is moving backwards, they could cause a jam.

Disposing of Unattached Hair Extensions

There are some situations and embodiments of this invention where it would be more desirable to dispose of, rather than recycle, unattached hair extensions. This is especially true in embodiments that allow adhesive to progressively build up on unattached hair extensions. In such cases, so much adhesive might build up on a hair extension tip that it results in hair extensions getting jammed in the pincher notches, or elsewhere in the system.

To facilitate disposal of such adhesive-build-up-tipped hair extensions, some part needs to pull them from the system. The best way for such a part do this is to hook them in their narrower areas above where adhesive is building up on their tips. As said hooking part moves the hair extensions will slide through it until the hooking means encounters the bead of thickened adhesive near each tip. This will cause each such hair extension to be pulled from its holding clip and moved towards disposal in the bend-under system.

The most suitable part to participate as a hooking means is the pullback hook. However, the pullback hook should be configured somewhat differently than previously described. First of all, the pullback hook should be placed above, not below, the adhesive application nozzles. Additionally, the interior notch-width of said pullback hook should be relatively narrow. It will likely be narrower than the notches of the pincher. This way hair extensions are pulled from the system before the build up on their tips gets wide enough to jam the pincher's notches. If it is undesirable for the pullback hook to have only a single narrow notch, one wider notch could be divided into a few narrow notches by placing tines in the pullback hook's interior width parallel to its length and axis of movement. In summary, the narrowness of the pullback hook's interior notch or notches prevent the hair extension tips from flexibly yielding overtop of it.

In order for the pullback hook to feed the bend-under system with hair extensions, it must bring said hair extensions in contact with the bend-under belt system. Usually, this process is facilitated by the hair extensions being attached to scalp hairs, which help pull the hair extensions, attached to them into the bend-under system. However, when dealing with unattached hair extensions, the hair extensions must be fed directly into the bend-under system. One solution to facilitate this is to place the bend-under system not below the attachment stack levels, but within the attachment stack at about the same level as the attachment nozzles. Unfortunately, this is not a very attractive solution because it presents the problem of routing the supply lines that feed the nozzle stack around the bend-under belt system.

A more attractive solution would be to configure the pullback hook system so that it pulls to a point behind the engagement point of the bend-under belt system, and then moves itself and the hairs within it back again over said engagement point. This process would allow unattached hair extensions to be pulled far enough from their clips that slack is generated in said hair extensions. This slack would allow the hair extensions to dangle vertically beneath the bottom of the attachment stack at which point they could be engaged by the bend-under belt system.

However, this system would function most ideally if the pullback hooks were given a slightly different design. In said design, the pullback hooks should be configured in a shape almost identical to the scalp hair transport-forward gates, where notches of said pullback hook are open to the left-hand side, as those of the scalp-hair-transport-forward gates and pincher are in the original embodiment. Said notches will likely be somewhat thinner than the notches of the pincher. Such a pullback hook might be given multi-axis movement, so it could move towards the left over the notches of the push-out actuator in front of the exit channel, thereby, placing the exiting hairs in its notches. Next, it would have to move straight back with the familiar path of movement for the pullback hook, specifically, a path that is parallel to the exit channel and towards its back. Third, after moving past the front of the bend-under system, it would have to backtrack a short distance, thereby, coming in front of the bend-under belt system. Finally, it might move off to the right so that it no longer overhangs the exit channel. This final movement would cause it to completely get out of the way of the slackened hair extensions allowing them to fully drop into or in front of the bend-under system. Of course, before the cycle could repeat, this special pullback hook would have to move straightforward, preferably, while remaining completely to the right side of the exit channel and not overhanging it at all.

Use Sensors to Prevent Unpaired Hair Extensions

Of course, the best way to deal with hair extensions becoming unpaired with scalp hairs is not allow the situation to occur in the first place. This can be achieved by using a system that senses when a scalp hair is present in a metering area, and doesn't allow hair extensions to enter an attachment chamber unpaired.

****Means of Handling Deviant Adhesive Application

Liquid adhesive is often used as a means of hair attachment. In many embodiments, this liquid adhesive will not have time to solidify before exiting the system. Certain efforts will be made to keep this liquid adhesive from getting on the parts in the attachment stack. Most of these efforts occur in the attachment chamber and they include, but are not limited to, using a vacuum to suck away any excess adhesive, using a solvent wash to wash away any excess adhesive, and coating the hair-applied adhesive with a protective coating. The nature of the protective coating can be temporary such as a coating of liquid hot wax (or functional-equivalent) that is cooled and hardens before ever leaving the attachment chamber. In which case, the protected adhesive is given several minutes to cure, and then the protective coating is removed by dissolving it off, for example with hot oil. Alternatively, the protective coating might be permanent. For example, small powder particles be sprayed over the adhesive (such as by introducing an air-blown suspension through a left wall output). These small particles would stick to the adhesive, but shield the adhesive from coming in contact with anything external to it. While some of the most effective adhesive control measures occur in the attachment chamber and are of a similar nature to those just described, further measures could be taken to prevent any adhesive from rubbing off of the hairs as they exit the attachment system. The following are two such measures:

1. In order to prevent stray adhesive from sticking to attachment stack channels, Teflon coat (or functional-equivalent) not just the faces of the channels and hair handlers but also their vertical sides. This may include the vertical sides of all of the lower channel walls.

2. Take care to prevent stray adhesive from sticking to the bend-under belts. In addition to using Teflon belts (or functional-equivalent), make sure the belt grabs hairs above the adhesive level by making sure the pulley ribs hold the belt assembly sufficiently above the scalp, like stilts. Also or instead, continually run the belts through a lubricant/solvent solution. The application of this solution could occur in the base unit or anywhere along the path of the belts, where a reservoir, or other solution application means, could be brought into contact with the belts.

[[Multi-Chamber/Cycle Systems]]

*Moving Hair Handler System Optimization*

****Division of the Pushback and Transport-Forward Functions

Previously, a multiple-pushback gate system comprised of multiple-pushback gates all on one part was presented. I will call this type of pushback gate a compound-multiple-pushback gate because several pushback gates are attached as one piece. Alternatively, the multiple pushback gate system can also have the multiple pushback gates configured as separate objects, perhaps etched from separate sheets of metal. These independent pushback gates would function in an identical manner to the compound variety previously shown. Specifically, those pushback gates closest to the attachment area would close first followed by the next closest. The gate closing would continue in this serial manner until all the pushback gates had closed. This configuration of separate independent pushback gates will generally take up less width than the one-part compound-pushback gates. This is because independent pushback gates do not have to be staggered width-wise as they do on a compound pushback gate.

Although possible, it would not be as easy to move independent pushback gates forward as it is the compound variety. Thus, it is more difficult to use the independent pushback gates for the purpose of transporting the isolated hairs to the attachment area than it is to use a single compound pushback gate. Consequently, a dedicated transport-forward gate should be used, instead. Such a gate is very similar to a compound multiple pushback gate except that its notches can have blunt fronts and its gates need not be staggered. A drawing of such a dedicated transport forward gate 119A is shown in FIG. 119. Also, FIG. 108 shows a dedicated transport forward gate 108B with regular notches. The dedicated transport-forward gate can have this configuration because the hairs have already been isolated and cleared out of its way by the independent pushback gates. The dedicated transport-forward gate's notches and tines line up with those of all of the independent pushback gates. Once hairs are chambered between the independent pushback gates, the dedicated transport forward gate first slides out over the width of the channel. Next, the independent pushback gates are retracted and the dedicated transport-forward gate moves forward carrying the isolated hairs in its notches. When it stops, its notches will be lined up with the adhesive application nozzles.

When pushback gates are used in this manner, they can also be considered to have a holding function. Consequently, they can also be considered holding gates 119B, in FIG. 119. The area where they hold the hairs so that the transport-forward gate can engage them will be referred to as the holding area the holding is comprised of holding area notches 119C.

****Multi-System Simplification

Overlapping the Holding and Metering Areas is not Necessary

If something else, other than the pushback gates whose metering areas coincide with their holding areas, could isolate hairs and feed them one at a time to the holding area, the holding gates could be configured as dedicated holding gates as opposed to holding gates that also act as pushback gates. Unlike pushback gates, dedicated holding gates could be placed to coincide with the attachment area and its attachment chambers. This would mean that no transport-forward gates would be needed because the hairs would already be correctly position in the attachment area. Although this simplifies the design, it is less desirable because hair attaching and filling the holding area can't occur simultaneously. Thus, such a design would slow the system down. Thus, it is still optimal to use transport-forward gates.

Sloped Transport-Forward Gate Notches Prevent Hair-Slide Out

Referring to FIG. 108.1, the transport-forward gates could have sloped notches so that the hairs they carry, with forward movement in the direction of arrow 108A, tend to get directed towards the backs of said notches. Consequently, the hairs being carried get hooked and stay in the notches. This feature lessens the need for a slide out prevention gate. Pushback gates that serve the transport-forward function are themselves a form of transport forward gate and could have sloped notches themselves. However, the slope of their notches is more likely to be limited to only the most interior regions so that the more lateral regions can act as pushback gates in the manner of the original embodiment.

Sloped Attachment Area Rear Wall Lessens Need for Pushout Actuator

In order to lessen the need for a pushout actuator or pullback hook, those areas of the hair extension pathway that lie in front of the hair extension channel could be sloped.

Referring to FIG. 109, the lowest floor level could be sloped in the manner, as shown by encircled area 109A. Likewise, higher levels could be sloped in a similar manner, as shown in FIG. 109.1 by encircled area 109B. However, the pincher is probably wider than a flat-fronted (attachment area) pushout actuator, anyway. Thus, channel width would not be further reduced by the elimination of the pushout actuator. Consequently, there is less need to slope the pathway in order to eliminate the pushout actuator.

Entrance Gate Overlap of the Attachment Area

Theoretically, it might possible for both the scalp side supply system and the hair extension supply system to share the same entrance gate. This entrance gate might be continuous over the entire attachment area. Alternatively, it might be split into two projections with an open space between them over the center of the attachment area. However, this sharing does limit options because it would require the scalp hairs and hair extensions to enter the attachment area at the exact same time.

Ideally, each entrance gate should overlap the attachment area no farther than the interior edge of its closest bounding notch-tine of its closest transport-forward gate, when said transport-forward gate is positioned at rest in the attachment area. Entrances gates should not overlap any notches of the transport-forward gates because this would interfere with their function. The advantage of an entrance gate somewhat overlapping the attachment area is that it shortens the distance a hair has to travel from the metering area to it corresponding attachment chamber. A short travel distance is desirable because hair extensions and scalp hairs that travel relatively short distances likely remain relatively more perpendicular to the scalp than those that must travel farther. Scalp hairs and hair extensions that remain more perpendicular to the scalp remain more parallel to each other and as such are easier to bring together for attachment. Note: By notch-tine, I mean one of the sub-tines that divide the transport-forward-gate notches and, as such, help compose the functional areas of the transport-forward gates which are positioned on the tips of the channel-level tines of hair-handler tine-assemblies.

*Multi-Chamber Pincher Design*

****Pincher Chamber Design

The side walls of the pincher, (or each pincher notch), were previously shown to slant forward at the top at a constant angle as in FIG. 110. However, the pincher-notch sides and the left-wall surfaces that they interface with are not limited to this exact configuration. As shown in FIG. 110.1, where the side cross-section of a pincher-notch wall is shown in darker shading on the right and its interfacing left-wall side cross-section is shown in lighter shading on the left, they might both be configured as vertical walls with no forward slant. In which case, the left wall itself could be entirely flat, however, more likely the central-attachment-chamber portions (usually where the nozzles are) of it will project forward relative to lateral recessed notched areas where the sides of the of each pincher notch can impinge into, as shown in FIG. 16.2. These recessed notches may be present regardless of the side-cross-sectional shapes of the pincher-notch walls and portions of the left wall with which they interface. These recessed areas not only help provide a better seal but, also, likely contain much of the pincher-notch-wall-to-left-wall rubbing process used to guide wayward hair tips into place in the attachment-chamber interiors, as illustrated in FIGS. 18.0–18.2.

Alternative pincher-notch and left-wall side cross-sections are shown in FIGS. 110.3 and 110.4 where the pincher-notch walls slant forward but not at a constant angle and the left wall is straight, but not continuous, instead, having largely horizontal notches recessed into it. Here, the pincher-notch walls are composed of alternating areas; some that are angled forward others that are not. FIGS. 110 and 110.2 show other possible combinations of pincher-notch-wall and left-wall side cross-sections. However, generally all of the above-referenced pincher-notch-wall and left-wall side cross-sections can be interchanged with each other. That is various types of pinch-notch-walls with various type of left-walls. However, one should realize that potential pincher-to-wall configurations are not limited to what is shown nor permutations of it. Further, note that the idea that one of the, so-called, left-wall half always on the left or even on a wall is not true. For example, the so-called left-wall structures could be deployed as the functional area on a second opposing pincher structure.

All of the above-referenced drawings represent a side view of how the forward-most portion of the left wall and the forward-most portion of the pincher-notch walls interface with each other when brought together. FIGS. 110.5 and 110.6 show possible top plan views of the pincher and left wall cross-sections. As shown here, they are both the same widths. However, this would generally only be the case if the two halves did not rub past each other, as they do in FIGS. 18.0–18.2. Thus, in practice, one of the two halves will likely be narrower than the other. However, this does not have to be the case. For example, the halves could be configured as cross-sections disposed at different levels, thus, allowing them to be exactly the same width.

It may be desirable for the pincher to have a funneling shape that further helps direct hairs to its center and back. The funneling shape may take cross-sectional configurations as shown in the top plan view in FIG. 110.6 of the pincher and left wall. However, this funneling shape likely would not be extended down through the entire depth of the pincher. As shown before, the pincher notches may be hollowed out in the middle so that the hairs are grasped at the bottom and top but aren't touched by the pincher in the middle. Thus, the funneling pincher cross-sections need only be present at the bottom and top where the hairs are grasped.

We have mentioned before that the pincher notches are likely to be hollowed and wider in their middles to help enclose chambers formed when pressed up against an opposing object such as the left wall. Namely, the types of chambers formed are hair attachment chambers. I will now further elaborate on the features of these hair attachment chambers.

The narrowed bottom and top of each pincher notch (and/or left-wall or any opposing structure) not only grasps hairs but also forms a floor and ceiling for each hair attachment chamber. Said floor and ceiling may serve to help prevent any electromagnetic radiation or substances used in the attachment process from escaping from the chambers. To this end, the top and bottom areas may be manufactured out of, or coated with, flexible materials that form a seal when pressed up against the opposing left wall, or whatever opposes the pincher. The electro-magnetic radiation prevented from escaping includes, but is not limited to, Ultra-Violet light used to cure adhesives, or infrared light used to facilitate attachment in a CVD-based system. The substances being prevented from escaping include, but are not limited to, adhesives or any other substance (including gases) used in the attachment process.

The interior of the pincher may contain a similar set of outputs as those described for the left wall. This includes, but is not limited to, fluid and electro-magnetic outputs, such as optics for UV or I.R. The major difference would be that the pincher's fiber optics or fluid lines that supply these outputs would bend down though a vertical dimension before reaching their outputs in the interior of the pincher.

Additionally, the inside surface of the pincher may have a non-stick surface so that it resists adhesive attachment. Also, the inside surface of the pincher may have a reflective surface so that any electromagnetic radiation directed at the hair attachment point, by for example the left wall outputs, that then goes past said hair attachment point will then be reflected back at the hair attachment point. Use of a reflective surface in this manner, will allow electromagnetic radiation catalyzed attachment to occur from all directions around each hair attachment point. The above non-stick and reflective surfaces may be achieved through use of coatings or shells or by manufacturing the entire pincher interior out of materials that have these qualities.

*Single Hair Isolation Systems*

In the previously described first embodiment, a hair or a limited number of hairs were isolated in metering areas formed between entrance gates and pushback gates. However, when dealing with hairs of variable diameter, it will be less likely that the types of pushback gates shown previously can reliably isolate only a single hair per metering area. Since reliably isolating a single hair per metering area is desirable, refinements need to be made that will allow this. Single hair isolation will often occur in the metering area between the front-most entrance gate and rearmost pushback gate. However, often some other means needs to be introduced to subdivide the group of hairs in the metering area.

There a two broad approaches to the isolation of one hair. Both approaches share the forming of an isolation area, which at least partially isolates one or a very few hairs although maybe in a fleeting manner. This isolation area is further subdivided such that only one hair remains and/or is allowed to escape from it. The Two Approaches are:

1. Use sensors to tell where certain hairs' diameters start and stop. Use extremely small independently controlled gates to act on what the sensors tell them to isolate one hair.

2. Use mechanical gates that progressively subdivide the isolation area pushing out but a single hair. Usually, this involves pushing largely backwards all but the front-most single hair.

I will, first, describe some solely mechanical hair isolation schemes that function without sensors. Generally, sensors could be introduced to enhances these mechanical schemes and make them run more predictably. However, they will likely do fine without sensors.

****Converging-Point Wedging

The first versions of mechanical hair isolation schemes I will discuss fall into the category of what I call converging-point wedging. Generally, a narrowing or triangular shaped isolation area connected to the hair channel will be used. Often, it will, at least in part, be formed by an entrance gate 118B, usually, the one responsible for allowing isolated hairs out of the single hair isolation system. Referring to FIG. 111, notice how a triangular shape 111A is formed by a diagonally sloping entrance gate edge 111B imposed on the hair channel edge 111C. Hairs in the channel are encouraged to press up into this, generally triangular shaped, converging area formed in the hair channel. The first hair to reach the apex point 111D, regardless of its width, will be in the most stable position in the isolation area. It will be much more difficult to get this front-most hair at apex point 111D to move, than it will any of the hairs behind it. This is because the front-most hair is surrounded on two sides by the firm immovable edges that make up the converging area. In contrast, all other hairs (at most) touch the immovable edges on only one side and on all other sides are surrounded by other movable hairs. Once in the position 111D, any disturbance (such as vibrating the hair channel, exposing the hairs in the isolation area to a disturbing force such as air currents or static electricity, or forcing a mechanical object to run through the isolation area) will preferentially move the trailing hairs, to a much greater extent than the front -most hair. This property can be used to separate the trailing hairs from the front-most hair at apex point 111D. However, to permanently separate the trailing hairs from the front-most hair, an obstruction means should be brought between the trailing hairs and front-most hair, after they are separated. There are various types of obstructions means that can be used to do this. Many of them simultaneously function as forms of pushback gate means. Below follow examples of several types of such isolation area obstruction means:

Flexible Finger Type Isolation-Area Obstruction Means

As shown in FIG. 112 step one, one approach is to use flexible finger-like projections 112A as a supplementary pushback gate means. Supplementary because these finger-like projections can be considered pushback gates themselves. These flexible finger-like projections are moved towards the front tip 112C of the converging area largely along a line that bisects the converging area into two halves. During their forward movement, as in FIGS. 112.1 step two and 112.2 step three, they may even be vibrated so as to help push the unstable non-tip hairs. 112B (not at the apex of converging area) out of their way. As the fingers displace the unstable non-tip hairs 112B, they will move backwards away from the front-most apex point. As these hairs are forced backwards, the flexible finger-like projections might yield to them, as such, allowing their backward movement. Because of their angle of movement, the finger-like projections will tend to actually press the front-most hair 112D into the apex, rather than dislodging it. The end result will be that the finger-like projections in contact with the front-most hair will have flexibly yielded to and conformed around this front-most hair 112D, as shown in FIG. 112.3 step 4. Thus, this front-most hair 112D will have been isolated from the hairs behind it. Within limits, this scheme works regardless of how wide the hairs are relative to each other. Finally, notice how the finger-like projections that can make it, unobstructed by hairs, across the channel to its far side insert into notches 112E. These optional notches stabilize the fingers so that they can maintain their position and not allow any hairs around them from either direction. The flexible finger-like projections 112A could be supported on the tines of a tine assembly forming what could be considered a variable diameter hair isolator 112F.

Shaped-Finger Isolation-Area Obstruction Means

A refinement of the flexible finger-like projection pushback gate means leads to another variant of the converging-point-wedging hair isolation system. This refinement is to use what I call tapered end spring fingers. Rather than having spring fingers with blunt ends, as shown previously, the spring fingers could be configured to look and behave as shown in this series FIGS. 113 through 113.2, illustrating three sequential steps. Although shown at a different angle, this series of three drawings should be considered as having spring fingers 113A at the end of a hair handler tine and taking a path towards the apex 111D of a converging isolation area, just as the spring fingers in FIGS. 112 through 112.3 were. The tapered shape of the assembly 113C allows it to wedge its way into the isolation area using less force to displace the hairs 41D in its path. This or any spring finger assembly constructed with small-etched spring-like parts should usually be sandwiched between two or lying across one firmer supporting layer. Such supporting layers would have largely the same shape as the layer the fingers are formed into. However, the support layers should usually be continuous surfaces with no fingers etched into them. Although FIG. 113 shows the spring fingers etched into a single layer, alternatively, each finger could be formed from a separate, independently moving tine layer. Further, the yielding spring means could be placed anywhere between the tine-connectivity bridge and the tip of each finger, not necessarily as close to the hair-handler functional area as it has been shown up until now. This is true of all embodiments that need to get a hair handler to stop when obstructed by a sufficiently immovable hair 113D in its path at the apex 111D.

Wedge-Shaped Isolation-Area Obstruction Means

Similar to the above pointed spring fingers is another refinement of the converging-point-wedging type isolation means. In this refinement, the pointed displacement wedges are configured as several independent parts. In these drawings, the wedge shown moving, in a given step, is drawn solid, and the currently still wedges are drawn as outlines. Referring to steps one and two in FIGS. 114 and 114.1 respectively; the narrowest least intrusively shaped pointed wedge 114A is wedged into the isolation area first. It displaces any moveable trailing (non-apex) hairs that intersect its path but stops when it comes in contact with the highly stable front-most hair in the apex 114B. In FIGS. 114.2 through 114.4 showing steps three through five sequentially, the first wedge moved is followed by increasingly wider more intrusive wedges that push the more lateral hairs backwards and out of the isolation area. Like the first least intrusive wedge, all following wedges stop when they come in contact with the highly stable hair in the apex. The following series of wedges become increasingly more obtrusive by making them wider with more obtuse edge angles, and by placing increasingly wider diameter arcs at their front-most points. These arcs start convex and increase in diameter with each step and then become concave while continuing to increase in diameter with each step. Concave arcs are used to squeeze away any very small hairs trapped to the sides of a much larger front-most hair.

Once the front-most hair is isolated, another channel obstruction gate likely taking the form a more conventional pushback gate might be moved between said front-most hair and trailing hairs. This will keep any trailing hairs behind the wedges from sneaking around said wedges when the entrance gate is opened. The use of another more conventional pushback gate behind the wedges is optional. Additionally, a conventional pushback gate could be used to help clear a path for the wedges, so they would not have to go through as many hairs before reaching the front apex of the isolation area. This could be done by using a pushback entrance gate configuration as shown in FIG. 111. Finally, realize that the wedges are capable of yielding when they press up against the front-most hair in the isolation area. This yielding be achieved by mounting the wedges on individual tines that are flexibly attached to their connectivity bridges.

****Series of Sub-Hair-Diameter-Spaced Pushback Gates

The second type of mechanical hair isolation scheme I will discuss falls into the category of what I call sub-hair-diameter-spaced pushback gates. This type of system has a metering area with a front edge that need not narrow to a tip, although it might. If the metering area does not narrow, then it should ideally be no wider than about twice the diameter of the smallest diameter hair that will go through it.

Sub-Hair-Diameter-Interval Spaced Pushback Gate System

Referring to FIGS. 115–115.2 showing sequential steps one through three, the first embodiment of this system uses a metering area that will allow even the largest diameter hairs to touch its front-most edge. This system uses a series of pushback gates spaced from each other at intervals of less than the diameter of the smallest hair. Ideally, the pushback gates are spaced at intervals of less than the 50% of the diameter of the smallest hair. These individual pushback gates flexibly yield and stop when they come in contact with the front-most hair. However, if they cross the metering area at a point between hairs, they will not stop but continue across the metering area so as to close it off. Thus, the front-most hair is isolated from any hairs that follow it by the pushback gates between it and them. The greatest limitation of this system is that it can only be used with a very limited range of hair diameters. Hairs of too great of a diameter might not even fit into the metering area or if they do, might be pushed out the way they came in. This is because the pushback gates are only likely to stop if they intersect with the rearmost 50% of a hair's diameter, so as to push the hair firmly into the entrance gate. If a hair is intersected by a pushback gate in the front-most 50% of its diameter, it usually will be pushed backwards, thereby, obstructed from passing said pushback gate. Likewise, if the hairs have too small of a diameter, then more than one hair might get in front of the pushback gates. To solve these problems and to allow isolation of a wide variety of hair diameters, a second embodiment of the sub-hair-diameter spaced pushback gate system is described below.

Sub-Hair-Diameter-Accuracy Spaced Pushback Gate System

This second embodiment of the sub-hair-diameter spaced pushback gate system uses a metering area composed of a series of attached compartments that become increasingly narrower, usually with increasing proximity to the attachment area. Referring to FIG. 116, this set of compartments 116A is usually formed by notches 116B in an entrance gate 116C that is imposed on an edge of a hair channel 116D. Each sub-compartment allows only hairs of an extremely specific diameter range in it. For example, a hair of an extremely thin diameter will not stop moving forward through the compartments until it reaches the entrance to a sub-compartment too thin for it, or the dead-end of the very thinnest sub-compartment. In a similar manner, a relatively wide diameter hair will stop much sooner in one of the wider compartments. If there are any thinner diameter hairs trailing a wider diameter hair, they will be stuck behind it and this is fine.

Once we have hairs of a specified diameter range in the correct metering area sub-compartments, we can use a series of special pushback gates positioned with sub-hair-diameter-ACCURACY to isolate the front-most hair (the one closest to the processing area) in the metering area from all of those behind it (those farther from the processing area). Notice, I said positioned with sub-hair-diameter ACCURACY, not necessarily spaced at sub-hair-diameter INTERVALS, as in the embodiment described immediately above. Because the graduated chambers hold hairs of different diameters apart from each other, there is no need to space the isolation gates at the small sub-hair-diameter intervals needed in the INTERVAL-spaced system to separate two hairs of greatly differing diameter.

The pushback isolation gates take on the configuration and manner of operation shown sequentially in FIGS. 116.11–116.19. FIGS. 116.11–116.16 represent the first six sequential steps of various pushback gates moving over the channel and closing around hairs in the metering area. In the first two steps shown by FIGS. 116.11 and 116.12, the gates make it all the way across the channel unobstructed. When this happens, a notched area, like 116E in FIG. 116.2, remains over the channels. Although the front hair 1160 may be temporarily pushed backwards and out of the way, as in step 1.5 shown by FIG. 116.115, it will again move into the front-most area of its original compartment, as in step 2 shown by FIG. 116.12, after the involved pushback-isolation gate makes it all the way across the metering area. Of course, to make sure this happens, the sub-compartments should be sufficiently long so that the hairs are just pushed backwards but not completely out of said sub-compartments. However, in step 3 shown by FIG. 116.13, a hair at position 116F is encountered by a hook means on the side of a pushback isolation gate. Said hair obstructs said gate from making it all the way across the channel. When this happens, the notched area 116E does not make it over the channel. Thus, the front-most area (the area closest to the processing area) of the adjacent trailing sub-compartment 116L (sub-compartment farther from the processing area than the leading hair's sub-compartment) remains covered by the pushback-isolation gate. This keeps any other hairs in said trailing sub-compartment towards its entrance area (area of the sub-compartment farthest from the processing area) where they can't be protected from the subsequent pushback-gate portion 116H as they would in the front-most area of said sub-compartment. Thus, in step 4 shown by FIG. 116.14, when the next pushback gate swipes over the entrance area of said sub-compartment 116L, it forces all hairs in it out. The final result is said sub-compartment is entirely empty of hairs. In other words, hairs in sub-compartment 116L have been pushed backwards and out of the path of the hook means 116G and into the path of the pushback-gate portion of the following pushback-isolation gate actuated in step 5 shown by FIG. 116.15. Since all following isolation gates (those that have yet to move) will be held up by their own hook means by the front-most hair at point 116F, their notch areas like 116E will NOT be brought over the channels. This will cause all subsequent hairs in the compartments of the metering area to be forced backwards (away from the processing area) and entirely out of the metering area and its compartments in like manner. In step 6 shown by FIG. 116.16, a final more conventional pushback gate 116I which has no need for a hook means like 116G or a notch like 116E is moved over the channel.

In steps 7–11 shown by FIGS. 116.17–116.19, we see that the isolation gates are moved backwards in order to open the metering area. Notice that all hairs, except one, have been forced out of the metering area. Pushback gate 116I remains over the channel closing the metering area off. The isolation gates are moved away from the metering area starting with the second from last pushback gate 116J and proceeding in the reverse order that they originally moved over the channels. Notice that the second from last pushback gate 116J has an optional sloped edge 116K on the right side of its notch that will allow it to push any hair between it and the last pushback gate 116I out of its way towards the last pushback gate 116I, as in optional step 7X shown by 116.17X. Optional step 7X shows what happens if the front-most hair is in the widest sub-chamber. Notice the last pushback gate 116I has an optional concave area 116M in it that allows it to accept said hair in widest sub-chamber. This concave area is optional depending on how the final pushback gate is spaced relative the more forward pushback gates. In practice, all of the notched-push back gates may or may not have sloped or tapered right edges but one was just shown in 116J for illustrative purposes.

Notice in FIG. 116.2 that a variant embodiment of one of these isolation gates is shown. It shows that these gates can have straight edges like 116N rather than semi-circular notches intersecting with hairs as a hook means.

Note: The above refers to a metering area composed of a series of attached compartments that become increasingly narrower. Such a metering or isolation area need not be composed of sub-compartments but could simply be a single area that becomes increasingly narrower, most likely, with increasing proximity to the processing/attachment area. Also, the narrowing metering area formed in this embodiment, or any metering area or isolation area formed in any embodiment, need not necessary be formed by imposing a gate structure on a hair channel wall. For example, the narrowing metering area in this embodiment could be formed entirely as an opened-ended slit cut into a hair handler such as an entrance gate.

****Several Metering Area Sizes Available Choose the Best for a Given Person's Hair Lack of Hair Diameter Variability On a Head Simplifies Design:

To the extent that scalp hair diameter remains constant on each person's head but varies from person to person, two or more hair isolation sub-systems could be available, each calibrated for a specific diameter of hair. For example, there could be several pushback gates each with a different metering distance from its entrance gate. This would allow the metering area size to be adjusted to the hair diameters on a specific person's head. This simple entrance and pushback gate combination could be used as the single hair isolation system rather than the much more complex embodiments described above. Of course, this would mean that the system operator would somehow have to ascertain the diameter of hairs on a given person's head.

****The Use of Sensors and Flexibly Yielding Hair Handlers for Hair Isolation

In several of the above-described hair isolation system embodiments, there is mention made of certain hair handlers stopping when they come in contact with hairs in the metering area that get in their path. There are two basic types of systems that can be used to allow a hair handler to stop in this manner. The first involves mechanically yielding hair handlers and the second is based on electronic control via sensor monitoring.

Referring to FIG. 117.I, mechanical hair handler stopping may be facilitated by making each hair handler tine somewhat flexible along arrows 117F. Since several like hair handlers are connected and operating in independent hair channels, they cannot all be expected to stop independently unless they are flexibly connected. Thus, each hair handler has a flexibility joint at some point, along its tine, between its functional area and its supporting connectivity bridge. Referring to FIG. 117, one example of such flexibility joint involves interrupting the metal tine and placing a silicone connectivity joint 117A in its place. Such a silicone joint can be formed by starting with a metal pattern that has temporary supports 117B that bypass the area where the joint is to be placed and connect the distant end 117C of the tine to the connectivity bridge 117D. These temporary supports not only connect but also surround the future joint area so as to hold liquid silicone in the joint as it solidifies. After the silicone is solid, the temporary supports and any excess silicone should be cut away. The flexibility joint need not be composed of silicone. Any other suitable material or even a spring-like pattern 117E formed into the metal to form the joint may be used, as in FIG. 117.2. Further still, the flexibility joint need not be placed at exact position shown in the drawings. It can be placed anywhere between the functional area of each hair handler and its connectivity bridge.

Other possible mechanical methods include (but are not limited to) forming a flexibility joint by connecting two horizontal stacked rigid layers with a flexibly yielding material sandwiched between them. Further still, the use of a joint might not be necessary if the entire tine assembly can be fabricated from a sufficiently flexible material. However, such an assembly is likely to be too flexible and might need to be supported by being sandwiched between two or attached against one firmer layer. Finally, micro-machine type actuators, to be discussed below, could be used as a means of allowing functional areas to yield separately, even if sensors do not control them.

Electronic control via sensor monitoring is based on sending an electric or electromagnetic flow across a hair channel and modifying hair handler behavior when it is interrupted. In the case of the hair isolation system, the sensor flow could be sent across the metering area at several points subdividing each metering area. Each point monitored could have a gate capable of subdividing its metering area at or relative to said point. If a front-most hair interrupts a sensor's path, one or more hair handlers will not be moved as they normally would. This way said front-most hair would not be disturbed. The separately controlled hair handlers used in hair isolation should close behind this front-most hair at the first point the sensors detect. a gap between the front-most hair and trailing hairs. A sensor-controlled system has operational advantages over an entirely mechanical system. For example, a sensor-controlled system does have to disturb the hair that stops it. This means it need not undesirably risk pushing the front-most hair out of the metering area by bringing a hair handler in contact with the front-most 50% of said hair's diameter. This operational advantage allows a sensor-controlled system to handle a wider range of hair diameters than an otherwise identical non-sensor-controlled system.

However, the operational advantages come at the cost of increased complexity. A sensor-based system not only has to monitor several points across each metering area but it must be able to control the movement of each hair handler in each channel separately. Thus, like hair handlers cannot be joined by a connectivity bridge and moved in unison. Rather, some type of micro-machine technology would be most beneficial to use to control each hair-handler functional area separately.

****Multi-Chamber Holding Area Design

The original system presented included compound pushback gates that were also responsible for transporting, into the attachment area, the hairs that they had isolated in their notches. Next, I presented the idea that pushback function and transport-forward function could be assigned to two separate parts. Further still, the pushback function and holding function could be assigned to two separate parts. In other words, the holding gates could be configured as dedicated holding gates as opposed to holding gates that also act as pushback gates. Of course, this requires an independent hair isolation ;mechanism to feed these dedicated holding gates with isolated hairs. The single-hair-isolation mechanisms described above could be used for this purpose. A description of dedicated holding gates and dedicated transport-forward-gate function follows:

The following description refers to FIG. 118. In dedicated holding/transport-forward gate systems, instead of using multiple-pushback gates to isolate hairs, a single pushback gate 118C per channel meters out hairs one at a time. These isolated hairs don't go directly into the attachment area, but instead, they go into a holding area between the attachment area and a hair isolation means. An aggregate holding area is subdivided by holding gates 118A into individual holding areas or holding notches 118E. The holding gates closest to the attachment area, shown as holding gates 118A.1, may help serve as an entrance gate to the attachment area. Holding gate 118A.1 remains closed over the hair channel before any hairs are introduced into the holding area. After the first isolated hair (or hairs) is introduced into the holding area, holding gate 118A.2 closes behind it. Next, a second isolated hair is introduced into the holding area, and holding gate 118A.3 closes behind this second hair. The end result is that we have two hairs each isolated in its own holding notch in the holding area. Each time a hair is introduced into the holding area, the hair isolation system must cycle once. If we want to introduce two hairs into each holding notch and single hair isolation system is used, it must cycle twice before for each holding notch to be filled.

In a system where more than two holding notches must be filled, this process can be repeated for how ever many holding notches 118E there are. Note: The holding gates, (single) pushback gates 118C, and any entrance 118B or narrower gates all move from side to side. The flexible-fingers type variable-diameter-hair isolator most likely moves in from the side at approximately a 45° angle. The variable-diameter hair isolator 112F can be considered any means capable of isolating a single hair from a group of hairs that may have different diameters. In FIG. 118, the flexible-finger-like-projections configuration is the type of variable diameter hair isolator illustrated. However, in practice, any hair isolation system can be substituted for it. The scalp hairs enter in the direction designated by arrow 118D. Optionally, hair sensor circuit pathways designated by 12D and 12D' can be used to sense the presence of scalp hairs or hair extensions in the holding notches 1118E on either the hair extension or scalp hair side.

Referring to FIG. 119, once single hairs 41D or 41E are isolated in their individual holding notches, they are ready to be transported into the attachment area by the dedicated-transport-forward gates 108B. These multiple-transport-forward gates transport scalp hairs 41D and hair extensions 41E into the attachment chambers in the exact manner as the multiple-pushback gates originally described. The difference between the original multiple-pushback gates and the dedicated-multiple-transport-forward gates is that the dedicated-transport-forward gates don't have to isolate hairs because the hairs have already been isolated for them in holding area notches that line up with their notches. As such, the notch-separating sub-tines of the dedicated-multiple transport-forward gates don't have to have a tapered design capable of pushing hairs back and they don't have to have a staggered design where the front-most pushback gates cross the hair channel before those pushback gates farther away from the attachment area. Instead, the notch-separating sub-tines of the dedicated-transport-forward gates can all be equal length and even have flat fronts.

*Electro-Magnetic Pathways for Sensors, Micro-Machines and other Electrical Components in the Attachment Stack.*

Previously, I have discussed the incorporation of electrical components into the attachment stack. These electrical components include various types of sensors and micro-machines. By micro-machines, I am referring to extremely small devices that move by mechanical forces generated by themselves. These micro-machines usually are supplied with electricity and sometimes with water or other fluid in order to generate steam that allows them to function as small steam engines. The electricity and water could be supplied through pathways formed into various layers of the attachment stack. The pathways on each of these layers could be supplied with electricity by contacts at the back of each layer. As shown previously these input contacts might be arranged in a stair-step pattern at the back or one of the sides of the attachment stack.

Thus, micro-machines or any such functional equivalent which allows independent actuation of individual hair handler functional areas either freeing said functional areas from having to be placed on moving tine-assemblies or allowing said functional areas to move in a slightly different manner from the moving tine-assemblies which support them, should be considered as an actuation option. Alternatively, a hybrid between a tine-assembly with all like functional areas physically connected so that they move it unison and a micro-machine is a possibility. In such a configuration, the tine-assemblies macro-actuation means, such as solenoids, could simply be substituted for a micro-machine means contained entirely in the handle unit and, perhaps, the attachment stack itself.

****Micro-Wire Manufacturing:

The micro-wires that supply the sensors and micro-machines with electricity will have to be manufactured into individual layers in such a manner that they are electrically insulated. The following procedures describe some examples of how such micro-wires can be formed:

-Micro-wires within the layers can be generated by . . .

--Adhering a sheet of conductive material to a, perhaps clear, inorganic ceramic such as glass and using a laser, chemical etching, or other cutting means to selectively cut pathways in the conductor. The result is thin wire-like pathways supported, at least on one side, by an insulating inorganic material.

--Adhering the conductor to a thin flexible film and using a laser to cut channels both in the film and conductor. One should make sure the film has adequate margins around the conductor that it can hold the cut central portions together. The film-conductor assembly can then be sandwiched between layers of the attachment stack. The layers of the attachment stack will provide firm support for this probably fragile assembly. The flexible film will probably provide electrical insulation around the conductors and may also act as an adhesive that adheres the assembly to the adjacent layers of attachment stack. In might act as an adhesive because it is coated with a sticky substance like those used with adhesive tape, or because it melts when exposed to heat while pressed between adjacent layers of the attachment stack.

--Adhering the conductor to a substance (flexible or stiff, clear or opaque) that is more resistant to chemical etching than the conductor. Etch paths in the conductor using chemical photo etching.

--Forming directly by vapor deposition on or between non-conductive surfaces. Where said non-conductive surfaces may either be flexible or stiff.

Certain electrical circuits might be used to generate heat at a specific point. For example, adhesive outputs based on heated vapor bubbles need a small point of high electrical resistance that will heat up causing a vapor bubble. The areas that carry the electricity to the heating element, in order to remain relatively cool, should have relatively lower electrical resistance. This lower electrical resistance can be achieved by making these areas wider, thicker, or from a more conductive material than the heating area. This will likely require that the heating elements and less electrically resistant portions of the electrical supply pathways to be manufactured as separate layers that are joined together. To do this, after forming, the layers should be joined together by laminating them between the two non-conductive backings. Further, the two layers could be most securely joined by a means such as laser welding.

If a clear ceramic is used as the laminating material, its thickness matters less and it needn't be melted by laser welding. However, many other laminate types might get melted themselves during the laser welding. If they are thick and clear enough, they might survive. Otherwise, a second layer of laminate should be laser welded on top of the first ones to ensure electrical or optical insulation is maintained.

A vapor bubble system heated not by electrical resistance but, instead, by light or other electromagnetic radiation is a possibility. Optical pathways via internal reflection could carry the light. The light could be focused, most ideally on a light absorbent surface, at the point where heat is desired.

-Some of the sensors and other mechanisms that use light as energy will need to use optical pathways that carry light via internal reflection. There are several ways of forming such optical pathways including but not limit to:

-Molding.

-Vapor deposition.

-Chemical etching of an optically clear surface. Said optically clear surface most likely adhered to an acid resistant surface.

****Hair Channel Sensors:

A sensor typically detects hairs when its path across a hair channel is interrupted. The presence of detected hairs can be input into a computer for purposes such as hair counting and modifying the behavior of the hair manipulation system. For example, a sensor that detects hairs in the hair channels, in effect counting them, could be combined with a wheel type sensor that measures distance or speed of movement over the scalp. Together these two sensors could be used to judge the density of hair in an area of the head. With this density information, the system could adjust the number of hair extensions it attaches in any given area of scalp. Ideally, to achieve the most accurate counts, a single or very few hairs should be isolated in an area along the channel, such as a metering area. Thus, when a sensor detects the presence of hairs in this isolated area, the system can know that this means it has detected exactly one, or some other known number, of hairs.

Hair channel sensors could also be used to measure the diameter of each human hair on the head. For example, by deploying sensors across each in a series of in-line connected hair channel compartments that become increasingly narrower, usually with increased proximity to the attachment area (as in FIG. 116), the system can know within a certain range the diameter hairs present in these compartments. Since this configuration is based on the sub-hair-diameter-accuracy spaced single hair isolation system, it will most likely be used with it. Thus, a likely algorithm would be to detect the front-most compartment that has a hair in it, record this data as the hair-width measurement for the isolation cycle. Of course, sensors could also detect hair width in a manner analogous to the sub-hair-diameter-interval spaced system by spacing the channel sensors at sub-hair-diameters, however, this will likely be more difficult to implement. Some of the specifics involved with hair channel sensor implementation in general are discussed below.

****Electric Current Sensors:

In order to implement electric-current gap sensors, an electrical voltage could be run across a hair channel gap between two dipole ends of a gap-interrupted electrical circuit. Said dipole ends would not only be put on opposite sides of a hair channel but might also be put on opposite sides of a dielectric layer (one on top, one below). Said dielectric layer will help prevent the circuit from closing anywhere except the designated areas. The closest tips of said dipole ends will likely have very thin widths on the order of the width a human hair. Thus, in order for the voltage to arc, it must cross the hair channel at a specific point. Hair should have a different (probably higher) dielectric value than air does. Thus, when a hair is in the way, a different amount of electrical flow (probably less) will pass at a given voltage. This change can be used to detect the presence of a hair. Since the status of this voltage and electrical-flow characteristics can be monitored thousands of times per second; certain changes can be counted as individual hairs.

The gap between the two designated dipole ends of the circuit should have the smallest dipole moment available in the electric current. To achieve this, nearby conductors could be kept at a distance or insulated by a material with a high dielectric value. For example, both the top surfaces and perhaps even vertical sides of the hair channel could be covered with a dielectric coating. Likewise, the gap could be kept to a minimum simply by greatly narrowing a portion of the hair channel or by putting one of the dipoles' ends on a moving hair-handler functional area that temporarily narrows the gap.

In order to prevent arcing between electrical circuits in neighboring hair channels, the circuits in neighboring channels might be turned off while its closest neighbors are on. Alternatively, neighboring hair channels could use completely independent electrical circuits.

****Light and Electro-Magnetic Radiation

The hair sensors can also be based on passing a beam of light, or other electro-magnetic radiation, across the channel. Of course, hairs would be detected when the beam is broken. Independent fiber optic circuits that have gaps across each hair channel could facilitate this. A similar approach could be used with other types of electromagnetic radiation such as radio waves. Of course, this would mean a transmission and receiving means would each have to be placed on opposite sides of each hair channel.

*Micro-Machine Concerns*

****Micro-Machine Design:

Micro-machines are small electrically powered moving devices usually formed by etching, and often etched into a semi-conductive material or silicon-based material such as those materials usually used to form computer microprocessors. Although many micro-machines that have been fabricated are actually microscopic, such as a small steam engine actuator fabricated by. Sandia National Laboratories, those used for this invention typically won't be this small. They are, nevertheless, micro-machine-like and, as such, will be referred to as micro-machines in this discussion. In this discussion, macro-machine is used to describe other types of mechanisms. For example, hair-handling tine-assemblies are actuated by macro-machine parts, like solenoids, and are themselves macro-machine part of macro-machine assemblies because they depend on macro-machine parts for their movement. Substituting connectivity-bridge-attached hair handlers for independently moving micro-machine actuated hair handlers requires certain design modifications:

--Micro-machine-driven channel narrowers (or any micro-machine-driven part that overhangs the hair channels) might have the stresses against them reduced by placing a likely macro-machine powered and likely system wide channel narrower means, most likely based on a connectivity-bridge configuration, beneath them all such as to limit the area they overhang the hair channel unprotected.

-The micro-machine layer, or layers, in the stack could be placed in a manner similar to the sensor layer. This is to say they would require insulated electrical pathways leading to them. Further, they would be totally self-contained within their layer(s) and could be placed above or below the scalp sensors at any level in the attachment stack.

-In addition to micro-machine linear actuators, the use of micro-machine-driven circular members, such as gears, which advance, perhaps toothed, rods is a possibility to use to advance hair-handler functional areas.

****Specific Micro-Machine Uses:

Although in general micro-machine type mechanisms can replace all the moving-connectivity-bridge type mechanisms previously described, here are some specific examples of micro-machine uses:

-Conceivably, the use of micro-machine-based hair counting would lessen the need for having individually controlled adhesive application nozzle attachment jets. That is if individually controlled (ideally by micro-machine) hair-handler functional areas do not move hair extensions into the attachment chambers in channels which have chosen not to apply adhesive because their corresponding scalp-hair-holding chambers aren't sufficiently full.

-The use of holding gates can be optimized by constructing them as micro-machine type actuators. By using holding gates, the number of sensors per tine channel needed to confirm presence of scalp hairs in all holding notches can be reduced to one per tine channel (instead of one per nozzle or notch). This is because holding gates are filled one at a time, and thus, can be monitored by one sensor per tine-channel counting the hairs that passes it. Such a sensor would likely be placed somewhere between the hair isolation system and back of the holding area farthest from the attachment area. Also, the nozzles could be controlled in channel subsets a few at a time. This is because the front (nearest attachment area) holding gates are, in some embodiments, more likely to be filled than the last ones because they fill up front to back. If a hair channel sensor in the metering area doesn't count a sufficient number of hairs passing through it, it can be known that a certain holding-area notch is empty without monitoring this holding area notch directly. Thus, the nozzle or set of nozzles in the attachment chamber corresponding to this holding area notch could be kept from outputting adhesive and/or the corresponding holding notches which serve the hair extensions could be left unfilled on purpose.

-Consider using micro-machine actuators to control individual nozzle-shut-off valves. Said valves might be placed anywhere along the fluid-supply lines, including the base unit but they could be made smaller if placed in the handle unit or attachment stack itself, where the adhesive (or other fluid) supply lines are themselves smaller.

--Also it might be easier to implement shut off of the nozzles by rerouting the flow of each line's fluid in a U-turn back to the supply reservoir rather than closing them off by completely stopping their flow. Micro-machine actuators placed anywhere along a supply line might be used for this purpose.

-Micro-machines could combine several different types of hair handlers in the same level.

-In a predominately micro-machine system, certain macro-machine hair handlers might remain. Especially, likely to remain is a macro-machine type pullback hook system configured as tines on a connectivity bridge, as originally described above. This is because the pullback hook will usually move over a much greater distance than the other hair handlers will.

-The etching technology used to make micro-machines is relatively expensive on a size basis. Thus, the area where the actual micro-machine hair handlers reside should be minimized. This can best be done by surrounding, on any or all sides, the micro-machine layers of the attachment stack with supporting layers fabricated in a less expensive manner. For example, the micro-machine system might be confined to a thin band-like module (like largely perpendicular to the hair channels) in only the hair-handler functional areas. Naturally, the attachment areas would bisect this thin band.

In order to supply this thin band of micro-machine parts with inputs such as electricity and any needed fluids, it should somehow be fused in the attachment stack with less expensive supporting structures. These supporting structures will take on nearly the same configuration as that described for the first-described embodiment of the attachment stack system, except for having a subset of micro-machines embedded. In order to assure smooth attachment of the micro-machine module to the supporting portions of the attachment stack, adjacent layers of both should be staggered or overlapped at the connection joint(s) where laser welding or a similar form of attachment occurs. In other words, the vertical seam between the micro-machine stack and supporting portions of the attachment stack should not be straight line (when viewed from the side); rather alternating layers should be interwoven. To illustrate, if the length of a fluid channel wall segment is longer in the micro-machine module, it will be correspondingly shorter on the other side of the attachment joint in the support structure, or vice versa. Also in this scenario, the layers forming the floor and ceiling of said fluid supply channels would be longer in the support structure and correspondingly shorter in the micro-machine module. This leads to overlap which facilities a hermetic seal much better than trying to attach two blunt-ended stacks together. A similar situation exists with electrical supply pathways. Rather than putting the length of the pathway on the same level in both the support structure and module sections of the stack, a single pathway should be put on two adjacent and overlapping layers that can be fused together. Said fusing is likely done by a means of welding layers together such as laser welding.

--Before fusing the micro-machine module to the supporting structures of attachment stack, said micro-machine module might have connectivity bridges of its own. Once attached to the supporting. structures these connectivity bridges may or may not be destroyed. If destroyed, laser cutting will likely do it.

--The micro-machine module and support structures might both have holes through them that can be aligned with pegs. This is to ensure proper alignment during fusing.

-Micro-machines can be used as a means of allowing hair-handler functional areas to yield relative certain hairs in their path, in an analogous manner to the functional area flexibility joints, described herein. This yielding can be accomplished simply because the micro-machine functional areas can be calibrated to have a maximum strength. Of course, since micro-machine functional areas usually move separately from homologous functional areas in parallel hair channels, flexibility joints are unnecessary.

*Actuator/Tine Interface*

Referring to FIG. 120 a top plan view of portions of a hair-handler assembly with its tines omitted, the use of control rods 39J placed in slots through the connectivity bridges of the hair-handling tines was mentioned previously. These slots and rods accurately control the distances and directions that hair handlers can slide. When a hair handler slides in only one direction, it is simple to understand how a rod in a slot controls its distance of travel. However, some hair handlers need to travel along two or more axes. For this to occur, the actuators and their attached cables 39E, which move the hair-handling tine assembly, often pull in two directions simultaneously. One of these directions will be the desired direction of hair handler movement. The other direction will be against a side of the slot that is parallel to said direction of desired movement. This way the side that the rod is held against controls hair-handling tine's exact path and distance of movement. In such a configuration, it is helpful to use a rod that has at least one flat smooth side that lies parallel to each direction of desired movement. If the hair-handling tine has two-axis motion, the rod will likely have a four-sided rectangular cross-sectional shape. However, if diagonal or three-axis motion is also used, the rod's cross-sectional shape should include flat diagonal/sloped edges. In other words, the rod's cross-sectional shape might be hexagonal or octagonal. Using these principals, slots with more than four sides can be constructed to guide very complex motion patterns, such as slot 40K in FIG. 120.1, a top plan view of portions of a hair-handler assembly with its tines omitted.

Previously, the optional use of cable to hair handler interface sheets was mentioned. Referring to FIG. 120.2 (a front plan view of a stack of hair-handler assemblies and their connections to actuator cables) the thin interface sheets 120C allow the use of relatively thick cables to convey the motion of the actuators but mediate the attachment of these thick cables to the hair handlers. As such, only thin sheets come in contact with the hair handlers. The most ideal way to configure interface sheets is to wrap one end of a thin film 120C around the end of a bulky cable 39E and attach the other end of the film in a usually laminar manner to the surface of hair handler layer 120E. To facilitate a strong attachment, small holes could be made in the surface of the hair handler tine at this attachment point. These holes would allow adhesive or plastic melted from the interface means to penetrate them.

Of course, any means that causes the cable to get flatter or thinner will work. For example, if the cable is plastic, its end could be pressed into a sheet shape. Further still, although interface sheets are preferred, because their usually increased width compensates for their decreased thickness, any object narrower than the original cable could suffice. For example, an interface cable of smaller diameter than the original cable could be used. Such a cable could be configured either by attaching a smaller cable to the large one, or manipulating the larger cable's end to become narrower. Such a configuration is often preferable to using a relatively thin cable over the entire length between hair handler and actuator because the length of mechanical weakness is reduced to a very short span of cable.

Regardless of the form of the interface means, it is, in some direction, thinner than the actuator cables. This often means that the stack of hair handler tines and their flattened interface means will be thinner than the stack of actuator cables. If this is the case, unless something holds them together, the stacked hair handlers will not want to lie surface to surface, but rather, each hair handler will want to lie along the plane of its actuator cables. This is unacceptable so something must be used to push the hair handlers together. It may or may not be enough to rely on any higher stationary levels of the attachment stack to do this. If not, we should configure a part to push either directly on the hair-handling-tine assemblies or, more ideally, on their interface means 120C. It is preferable to push only the interface means together because whatever is pushed on will both rub and bend around the push together means 120F. Since the hair handling tines themselves must remain flat, ideally only the interface means should be expected to bend. As such, the push-together means 120F should be placed far enough from the hair-handling-tine assembly that the two never come in contact. Likewise, the actuator cables 39E should be placed far enough from the push-together means to allow for a sufficiently gentle slope of the interface means as they expand outwards towards their attachments 120D with their actuator cables 39E. The push together means 120F ideally should have a smooth and curved surface that facilitates the interface means bending easily around it.

Ideally, all misaligned actuator cables should all be either too far above or too far below their stack of hair handling tines. For example, if all misaligned actuator cables are too far above, as shown by bracket 120G, then only a push down means 120F is needed to push the hair handler tine stack together. An additional push up means is not needed.

Cable attachments for a hair handler with only one axis have been frequently shown. In such a configuration, there were only two attachment points; one point pulls the hair handler in one direction, and an attachment point, usually on the opposite side of the hair-handler-tine assembly, pulls in the opposing direction. If two or more axes of motion need to be used, at least four attachment points will usually be used. In other words, two sets of two opposing cables are used. Although these cables can be hooked to the hair handler assembly in a variety of ways, the most preferred manner is shown on the left side of FIG. 120. Each of the cables (or interface means) 120I that control side to side movement are placed on opposite sides of the hair handler tine assembly. However, the cables (or interface means) 120J that control front to back movement are placed on the same side of the hair handler assembly. Most ideally the front-to-back cables are attached to or very near one of the side-to-side cables. This placement conserves on the attachment notches that must be made in the hair-handler-tine assembly. This is because one of the side-to-side cables shares a single set of clearance notches with both of the front-to-back cables. This type of configuration conserves space much more than if additional clearance notches were to be introduced. Further still, this might allow the front-to-back interface means to share the same push-together means with the side interface means. Of course, this might mean that the side-to-side interface means would be curve along two axes forming somewhat of a bowl-shape. If this is found undesirable, the front-to-back interface means could each be given their own push-together means. All three push-together means could be formed into a single C-shaped part, where the interior of the C-shape is oriented towards the hair-handler assembly.

*Non-Attachment Uses of Attachment-Stack-Type Technology*

The previous discussion about the hair attachment stack discussed its purpose of to isolating scalp hairs and attaching hair extensions to them. However, the attachment stack's ability to isolate one or a limited number of scalp hairs is a very useful function itself. Once isolated, scalp hairs can be processed individually in a variety of ways. For example, once an individual scalp hair is between a pincher-like structure and a left-wall-like structure, it is, in effect, surrounded by an orifice or isolated processing chamber, which it can be pulled through lengthwise. To pull a hair through such an orifice, optionally, trigger a pushout actuator that moves the hair's lower portion beneath the orifice to the right. Next, optionally, trigger a pullback hook which moves the hair's lower portion back the exit channel, and allows it to be engaged by a bend-under means, such as the bend-under belts. By doing this while the pincher-like structure is still closed around the scalp hair, the scalp hair is being pulled through an orifice from the hair's bottom to top. This orifice can do things to the hair that change said hair as it moves through said orifice. We will give attachment-stack type systems the broader name of processing stack in order to refer to its use both in hair extension attachment and other types of hair processing. Accordingly, we will name the attachment chambers and attachment areas and structures homologous to them in other embodiments more broadly as processing chambers and processing areas because it is in these chambers and areas where the hair-related beautification or transformation takes place. Note: The means used to pull hair lengthwise through an orifice should not be limited to the above actuation sequence or any individual means recited above.

There are many types of processing a processing stack can perform besides attachment. These various other processes include, but are not limited to the following:

1. Applying fluids to the surface of relatively isolated hairs
2. Reshaping the cross-sections of individual hairs by removing material from each hair's surface or adding new structural material to it.
3. Implant and Remove Surgical Hair Implants.
4. Automated Hair Cutting Processing Stack
5. Dynamic Hair-Channel or Other Functional-Area Designs 1. Applying Coatings to Hair Surfaces If the processing done to the hair includes applying a fluid, or any material, to it, the fluid can be supplied through outputs in the left wall in a similar manner as that described for attachment adhesive. These outputs are likely to supply their fluid to the interior of an isolation chamber/orifice where it comes in contact with the hair that is likely, but not necessarily, being pulled lengthwise through said orifice. Although mechanics of applying coatings to hair surfaces will be described in great deal in the Hair Shaft Sculpting section below, this section details the many possible purposes for doing so. There are various types of fluid or material with which we might want to bring in contact, or coat, the hair. The following list includes some examples of types of fluid or material that we might want to bring in contact with each hair:

-A colorant such as a dye, pigment or bleach. The amount added might be controlled by optical color sensors capable of looking at a single hair in each isolation chamber.

-A structural material that allows the hair cross-section to be enlarged at certain areas. For example, thiol-dissolved keratin that can harden and form a solid augmenting coating on the outside of each hair fiber, in order to reshape each fiber. This can be achieved by allowing its dissolved disulfide bonds to reform, which they tend to do upon exposure to oxygen in the air or exposure to a thiol-neutrualizing chemical. Generally, whenever the word thiol is used in this document, any disulfide-breaking chemical or means could be substituted for it.

-A thiol or other disulfide-breaking chemical whose purpose is to temporarily soften the protein structure of each hair so each hair can be reshaped either with respect to its cross-sectional shape or longitudinal curvature. (Or any other substance capable of being used to modify the longitudinal curvature of a hair)

-A protective coating for the surface of each hair. For example, a coating capable of holding in good substances, like water and lipids and keeping out bad things, like UV, certain chemicals and minerals.

-A structural sealant capable of repairing damaged areas in a hair including adhering split ends together. Such a chemical is likely based on keratin-like chemicals.

-A plasticizer-like material that softens and conditions the hair.

--A temporary coating like wax to protect a slower hardening permanent coating such as dissolved keratin, while it hardens on the surface of the hair.

---Such a temporary protective coating could be used to hold dissolved keratin with excess thiol, or other protein-dissolving material, together with the hair shaft being coated. This approach will allow the natural hair keratin and the dissolved hair keratin to both dissolve and slightly mix together, and thus, form and harden together under the protection of the temporary coating.

--A temporary coating like wax to protect a hair while it undergoes some form of processing ---Such a temporary protective coating could also be used to hold in place any other substance applied to the surface of the hair while said substance slowly performs its function on the hair. Said substance may become permanent by any means not necessarily limited to hardening. Said applied substances included but are not limited to hair colorants, permanent wave and curl treatments, and conditioners.

--Such a temporary protective coating could act as a temporary supportive template of each hair's softened protein structure while each is being reshaped with respect to its cross-sectional shape or longitudinal curvature. Such a temporary supportive coating could be imparted its own shape by a mechanical hair setting means such as curlers, a curling iron, a flat iron, a crimping iron, or between two rollers.

--A colorant based on opaque pigments or other largely opaque coloring means. Such a substance is likely to be the functional-equivalent of many printing inks. In other words, the binders necessary to adhere the opaque pigments likely make the colorant so sticky or viscous that it would be mechanically difficult, if not impossible, to apply it to a great many hairs at once. However, it would be possible to apply it to just one or a very few hairs in isolation. This is especially true if heating could temporarily decrease the coloring substance's viscosity. Ideally, such a substance could be applied to the hair as such a thin coating that it would not affect the structural qualities of said hair. The end result of applying such a largely opaque substance is that a hair's externally perceived color can be changed without affecting its internal structure or internal pigments. Such pigments or coloring agents might be formulated (such as by selection of the appropriate binder) to give them certain other properties such as . . .

-- . . . where such a colorant coating is temporary because it can be removed from the hair such as by dissolving it off with chemicals (like organic solvents) or melting it off with heat. Since the hair's internal structure hasn't been changed, removal of the outer coating of pigment would allow the user to go completely back to his natural hair color. However, if neither solvents, heat, nor other removal chemicals are applied, then the structural coating and color ideally will remain permanently. (The same qualities could be given to colorants which aren't opaque also, thus, all discussion related to the opaque pigments applies to them as well.)

-- . . . where such a colorant coating allows for is water-permeable allowing moisture exchange, perhaps, because it is keratin-based, keratin-like-chemical-based or based on another substance capable of forming structurally-sound moisture-penetrable coatings, thereby, binding a coloring agent to the hair. Moisture penetrability is desirable so that normal styling of the hair may be undertaken. Normal hairstyling requires the hair structure to absorb water and soften and, then, dry out, thus, slightly hardening and retaining its shape.

-- . . . If the formulation is to be keratin based (or keratin-like-chemical-based), and temporary it will likely be formulated from at least three types of substances: 1. the color pigment (or other coloring agent), 2. the keratin or keratin-like material, 3. an allied material(s) that allows the keratin-like material to be heat meltable or dissolvable by organic solvents. Said allied material and the keratin or keratin-like-material could be allied in various ways including 1. chemically as a copolymer, 2. by some form of chemical cross-linking, including the possibility of linking using disulfide bonds, 3. mechanically mixed together, perhaps as a plasticizer. The allied substance(s) that the keratin-like materials are allied with will determine not only how the coating can be removed, but also how it will be made structurally sound on the surface of the hair. For example, the coating might be made structurally sound by hardening upon cooling, or by allowing chemically-dissolved disulfide bonds to reform, or by some other chemical mechanism or a combination of several of these things together. Theoretically, the coloring agent and allied material might be the same. Also, the allied material might itself be a form of keratin or keratin-like material that has been made more susceptible to be dissolved by disulfide-bond-breaking chemicals.

Note: A wax-like protective coating is mentioned. Generally, this refers to any coating that can be applied to the hair to protect it and then readily removed. It may also include substances that are liquid when hot but harden rapidly upon cooling.

Note: The qualities required for producing a temporary/water-permeable colorant coat described-above might also be used to formulate a coating (colored or otherwise) that could be used to fix the longitudinal curvature of hair in a given shape for a period of weeks or months. However, it could be removed at anytime during this period allowing the hair to go back to its normal longitudinal curvature. In other words, a hair-curling system that doesn't generally affect the internal disulfide bonds of each hair but, instead, the structural attributes of the coating hold the desired curvature pattern of the hair. Since said coating can be removed, said hair can go back completely to its natural state.

2. Hair Shaft Sculpting

We have just mentioned how bringing fluids in contact with a hair fiber's surface can improve it. We also said that one way a hair can be improved is by changing a hair fiber's cross-sectional shape. However, bringing a hair in contact with a fluid is not the only way it can be processed or changed for the better. We might want to change the cross-sectional shape of a hair shaft by cutting away or reforming under pressure, its surface in certain areas. This is desirable because the texture of a person's hair is based largely on its cross-sectional shape and diameter. This is to say variation in overall hair appearance from one person to the next has less to do with variation in the chemical compositions of hair than it has to do with variation in the shape and diameter of each individual hair's cross-section. Thus, the user of the system could choose a hair cross-sectional shape and diameter based on her desired hair texture. In which case, each individual hair's cross-sectional shape will determine the aggregate appearance of all of the hair on the head.

For example, straight hairs usually have near perfect circle cross-sectional shapes, and curly hairs have more oblong shapes. Hairs with very thin diameters will look too weak and wispy, while hairs with very thick diameters will look overly stiff. Hairs might be carved or reformed by a variety of devices. The description of one such device follows.

Carving Performed by Orifice with Two Halves

The most preferred way to carve a hair's cross-section is to surround each hair with two halves of a razor-sharp knife assembly and then, most likely, pull the hair lengthwise through this assembly. The halves will usually be semi-circles because they will usually be expected to carve hair cross-sections into a largely circular shape. The knives are best visualized as having an open-topped conical shape, similar to that of a volcano, as shown in FIG. 123. At the very top rim of this volcanic shape, should be a razor sharp cutting edge 123A. The diameter and shape of this cutting edge should usually be exactly the same as that desired for the hairs pulled through it, such as hair 41D. However, sometimes it should have a slightly smaller diameter than that desired for the hairs pulled through because these hairs are to achieve their final diameter by subsequently being pulled through an orifice that applies a permanent structural coating to their surface such as thiol-dissolved keratin. In such cases, it will be this structural coating that determines their final cross-sectional shape and diameter. For this reason, the razor-sharp cutting orifice is not only free to carve the hair down to a smaller diameter, but also it may carve the hair with an unnatural cross-sectional shape, such as a rectangular shape. Once again, this is fine because a structural coating will subsequently be added to the surface of the hair to achieve its final cross-sectional shape and diameter. Regardless of the exact cross-sectional shape carved, these razor-rimmed carving orifices work by shaving off very thin layers of a hair's surface where said surface is too wide, but shave little enough that they leave the hair structurally sound.

Finally, notice the ridged edges 124A of the carving orifice variant shown by FIG. 124. Although the ridges are optional, they are intended to preserve blade life by making the blade edge resistant to breaking or bending. Additionally, the razor edge of the carving mechanism is likely to have a diamond, or a similar very thin but very hard, coating deposited on its surface to further extend blade life. This coating is most likely applied using a form of vapor deposition.

FIG. 125 shows a side cross-sectional view of carving orifice halves 125A and 125B surrounding a hair 41D. One might wonder if hairs passing through these carving orifices would undesirably get cut in half transversely, rather than being shaved longitudinally. This is unlikely to happen for two reasons. First, the razor-rimmed edges of the carving orifices are placed in a plane largely perpendicular to the surface of each hair. Secondly, the hairs will be expected to remain this way because they are being held under tension, most likely by the tensioning hair straightener and because of the small scales involved, the hairs behave as rigid cylinders with reference to the orifices.

Those Reshaping Orifices Used for Coating are Usually Composed of Two Halves, Also Earlier, we said that one reason for application of coatings to the surface of hairs is to add material to the hair surfaces so as to change their cross-sectional shapes. Although there are several ways this can be done, including spraying materials from nozzles onto individual isolated hair held before them, in the hair-cross-sectional-reshaping process, materials are generally applied to hairs before or during their being pulled lengthwise through coating application orifices. These orifices are used to control the cross-sectional shape and diameter of the coating surface applied to the hair. Like the carving orifices described above, these coating orifices represent a type of cross-sectional reshaping orifice and are composed of two largely semi-circular halves each pair of which closes around a single hair. These orifices will usually be placed in-line with and below the carving orifices. Thus, hairs will be pulled lengthwise through a series of orifices-some of which cut away material, others that add it, but all of which are working together to give each hair a desired cross-sectional shape.

Some examples of what coating orifices may look like are described immediately below. Generally, coating orifices are composed of two largely semi-circular halves whose interior cross-sectional shapes and diameters are the same, as those desired for the outer dimensions of the coating they apply. Referring to FIG. 126, notice how the left half 126A of the coating orifice has a projection 126B extending from it with a hollow channel 126C inside. It is this projection that plugs into a fluid coating output on the left wall. Naturally, an alternative design would be possible in which the left wall bears a projection that plugs into a concave notch in the side of the left orifice half. Hair 41D is surrounded by said coating orifice's left half 126A and right half 126E. Referring to FIG. 127, we see a side cross-sectional representation of a left orifice half 127A plugging into the left wall 127B. Perhaps, nozzle output 127C on the left wall and/or orifice projection 127D have seals along their edges made out of a resilient material to prevent leaks. The hair being pulled through is represented by 41D. Next, we will discuss side cross-sectional representations of three different coating orifice shapes. Firstly, in FIG. 128, there is a constant diameter coating orifice variant whose entire interior is the shape and diameter of the cross-sectional-coating outer diameter it is to produce. Secondly, in 129, there is a constricted-bottom variant whose belly 129A is wide to allow easy flow of a high viscosity coating around the hair shaft 41D, but whose bottom 129C narrows to impart the cross-sectional-coating shape and diameter desired. Finally, referring to FIG. 130, the constricted-top-and-bottom coating orifice variant has both a constricted top 130A and bottom 129C. This design allows easy flow of high viscosity coating around the hair shaft 41D in the central region 129A, but prevents coating escape from both ends.

Since hair 41D, as shown in FIG. 131, will be pulled lengthwise vertically downward from one type of orifice to next, several different types of orifices are likely to be connected together vertically in-line as a single moving part attached to the end of a tine. This in-line assembly might include several coating orifices each/ applying a different coating. The razor-rimmed carving orifice 131A is placed in-line and above the coating-application orifices 131B and 131C. Although the razor-rimmed carving orifices could be vertically attached in-line with the coating application orifices below them, they are more likely placed on their own independent tine assemblies so that they can be controlled independently of the coating application orifices. Of course, in this drawing, all orifices are shown floating in space because the vertical attachments have been omitted. In practice, the orifices might be spaced so closely that a hair is not exposed to the external atmosphere as it passes from one orifice to the next. Alternatively, the orifices will have enough space between them that a hair will be exposed to the atmosphere as it passes from one orifice to the next. Often we will want to include a space between orifices so that vacuum intakes, likely positioned on the left wall, can carry away any excess escaped coating fluid and hair shavings. If we would like to expose the hairs to the benefits of a vacuum without exposing them directly to the external atmosphere, we can place vacuum orifices in the vertical stack without space above or below them. Vacuum orifices have largely the same structure as coating orifices, but instead of being supplied a coating fluid by the left wall; they plug into a vacuum intake, most likely on the left wall.

Of course, as with other hair processing systems, like the attachment system previously illustrated, we want to bring several hairs into each processing area at once so several hairs can be processed at the same time in a single channel. And thus, the system will process more hairs in a given amount of time. Therefore, each system should have several processing chambers, (in-line orifice sets), in the processing area of each channel. Referring to FIG. 132, we see what we will call a multiple-orifice pincher assembly. It has two, or more, orifices 132A and 132B (shown as generic orifices) per channel processing area holding two hairs 41D and 41D. By generic orifices, we mean any type of orifice including but not limited to carving orifices, coating orifices, vacuum orifices, and the yet to be discussed hair centering guides. Although only two orifices are shown here, in practice, there are likely five or more orifice sets per channel. Also, notice the interlocking convex projections 132E and 132F and concave notches 132G and 132H placed at the margins of the multiple-orifice assembly. These interlocking structures help guarantee alignment between the orifices halves. If these orifices were coating orifices, they could plug into the left wall using projections 132I and 132J. Naturally, 132I and 132J could be consolidated into one single projection which branches out within the assembly to supply the multiple orifices, therein.

Although the multiple-orifice assembly in FIG. 132 merely has two copies of one type of orifice, referring to FIG. 133, we see three multiple-orifice assemblies 133A, 133A', and 133A" vertically attached in-line by vertical-attachment beams 133D and 133D'. Notice how each multiple-orifice assembly is composed of a right and a left half. All the right halves are supported by beam 133D' and all the left by beam 133D. These vertical-attachment beams, themselves, will most likely each be connected to the end of a tine as shown by 134A and 134B in FIG. 134. Although shown as generic orifices, in FIGS. 132–134, these stacked orifices will most likely be of different types that perform different functions, such as carving and coating.

Orifice Halves are Closed Together by Placing Each Half On a Pincher Mechanism

This discussion has largely assumed that the hair-reshaping orifices will be composed of, at least, two moving halves, or parts. To be more specific, one half will be disposed on, or near, the left wall, and the other on a structure homologous to the hair extension attachment embodiment's pincher mechanism, as shown in FIG. 10. Although movement might be limited to only one half of each pair, ideally, it is more desirable to think of each in the pair of orifice halves as being on two separate moving pinchers. One would move from the right in a largely similar manner to the pincher previously described in hair extension attachment system. The other pincher would move from the left. In other words, the left pincher would be positioned between the left wall and the right pincher, such that it would come between the left wall and the more familiarly positioned right pincher. This dual-pincher design is desirable because both pinchers can be moved away from their encircled hairs simultaneously. This is advantageous because it allows processing of both sides of the hair to be stopped simultaneously. Furthermore, it could allow one type of processing to stop while other types of in-line processing continue to occur. For example, the hair cross-section could be carved by one pair of carving orifice pinchers below which another pair of coating application orifice pinchers would be responsible for adding structural keratin to the surface of the hair. In such a configuration, the carving pair of pinchers could be independently released allowing only the structural material adding orifices to continue. This maneuver is likely to be used when the hairs have been run through the system before, and only the areas near their roots need to be processed. This system could carve the areas only near the roots and apply material to only those carved areas and a little higher. In this scenario, if material application had to cease at the same moment as carving, a short segment of carved area would never be pulled through a coating-application orifice nor have structural material applied to it.

Since it is desirable to limit complexity wherever possible, we must question each pincher half's need to move. If a dual-pincher system is used for the application of any fluid, such as a structural coating, the leftmost pincher halves most likely will have a channel through each that interfaces with fluid outputs on the left wall. The desired fluid will flow from the left wall through this channel into the center of the isolation chamber where it will come in contact with a hair. As such, expecting the left pincher halves of the fluid application orifices to move once each processing cycle would be adding needless complexity to the system because it disturbs the junction with the left wall. On the other hand, if we were to simply build the left-orifice halves into the left walls as non-moving, the system could only give the hairs one cross-sectional shape and diameter. In order to enable a selection of various cross-sectional shapes and sizes while still reducing complexity, the left pincher should be allowed to move but only between client sessions when the cross-sectional shape and size setting needs to be changed.

To allow the system to produce several different sizes or shapes of hair cross-sections, several different types of cross-sectional-reshaping assemblies could be placed separately on different connectivity-bridge tine assemblies. As shown by the perspective view of a single hair channel in FIG. 134, there is one set of vertically in-line orifices for each type of hair cross-section, and each said set is composed of two moving halves, such as the left half 134A and right half 134B. Each of these halves is attached to its own tine assembly. These different types of cross-sectional-reshaping assemblies could be nested, as pairs, in the storage area bracketed by 134C which is out of the way of the path of hair flow through the channels. In other words, exiting hairs flow to the left of this storage area. In said storage area, there are three different cross-sectional-reshaping assembly sets, each one capable of producing a different hair cross-section. For visually, clarity only the front-most set is fully illustrated, the two sets behind it are only shown as footprints 134E and 134F. Said illustrated footprints correspond to orifice assembly sets composed of two halves, each half is independently attached to a tine assembly like both 134A and 134B. Thus, this, drawing implies six separate halves, which require independent attachments to six separate connectivity-bridge tines, although only two are actually illustrated.

When called out of storage for use, the left and right orifice-set halves, although on separate tines, likely travel together. Referring to the top plan view of same hair channel in FIG. 135, we see each orifice set travels along the path illustrated by arrows 135A, 135B and 135C. As such, the left half may interface with the left wall at point 135D which supplies the various coating and cooling fluids in addition to vacuum intake air currents. At this point, the left half 135E will usually remain stationary and plugged into the left wall during hair processing and will remain so until processing of an entire human head of hair is completed, and a new head needs a different hair-cross-sectional-reshaping-orifice set to be used. However, the right half 135F of the assembly moves once to pinch hairs and once to release them each processing cycle. In doing so, its lateral movement is very much like that previously described for the attachment system pincher as illustrated by FIG. 10. The halves of each set may even have forwardly slanted tops, like those described for the pincher in the hair extension attachment embodiment for the purpose of guiding wayward hair tips into place, as illustrated by the three steps in FIGS. 18.0–18.2.

-Referring to FIG. 134, nesting is possible in the right rear storage area 134C of the hair channel. This nesting area is available because, unlike the hair extension attachment system, there is no opposing flow of hair extensions from the back. The nesting pattern of the orifice-pincher-connectivity-bridge-tine assemblies is shown from a plan right side view by FIG. 136. Here, it is assumed that four in-line reshaping orifice halves 136A, 136B, 136C, and 136D are attached vertically together. Thus, in FIG. 136, the razor-rimmed carving orifices would move together with the coating application orifices. In FIG. 137, it is assumed that all in-line coating orifice halves are attached vertically together on a independent tine assemblies 137A, 137B or 137C, but each razor-rimmed carving orifice half is placed on its own tine assembly 137D, 137E, or 137F. In which case, the carving orifices are able to move independently of the coating application orifices. For reference, the connectivity-bridge portion of the tine assemblies is bracket by 137G in FIG. 137 and by 136G in FIG. 136.

As enclosed by perimeter 135G in FIG. 135, the isolation and sorting mechanisms for the scalp hairs are likely present in the same area as in the hair extension attachment stack and function virtually identically as described for the attachment system. For example, transport-forward gates will likely be used to carry scalp hairs into alignment with each orifice chamber (or processing chamber) of the cross-sectional reshaping system in the exact same manner transport-forward gates were used to do the same for the hair extension attachment embodiment's pincher notches (or attachment chambers), as illustrated in FIG. 48. Also, in the same manner as the attachment stack, when hairs reach the end of a hair channel, they will be forced under the connectivity bridges by a bend-under means such as the bend-under belt assembly.

Of course, if only one cross-sectional shape and size choice were desired, the left orifice halves could be permanently built into the left wall, and the right halves could be configured as a single pincher, very similar to the one used to form attachment chambers in the attachment system. Such a pincher would only need to be given a simple side-to-side movement pattern and could be stored to the far right and in direct line with the left wall half, like the attachment system's pincher is. It wouldn't need to be nested to the rear. Such a system might even be able to stop carving before coating. This could be achieved in at least two ways. The most reliable way would be to configure the carving orifice pincher with both left and right moving halves, both independent of the left wall. In a less reliable variant, the left carving half would be stationary and built into the left wall. This configuration would depend the moving right orifices half's release of pressure, in order to cease carving.

Hair-Centering Guides

It is desirable to make sure that hairs are centered in their processing orifices. This especially true of coating application orifices, which are wider than the hairs going through them, and optimally, we do not want the hair fibers to rub up against the coating-application-orifice sides, because this would mean the coating would be applied unsymmetrically around each hair. To center hairs, hair-centering guides could be used. The hair-centering guides, as illustrated from top plan view by 138A and 138B in FIG. 138, should be configured as two opposing mirror-image pinchers whose notches, often V-shaped, funnel or converge in cross-section with increased lateral distance from their leading ends. These funneling pinchers could be disposed on opposing tines. Each tine should be capable of flexibly yielding, such as with flexibility joints placed in tines like those described for use with the single hair isolation system in the hair extension attachment embodiment, and illustrated in FIG. 117.

Referring to the top plan view in FIG. 138, funneling centering guides 138A and 138B will meet on opposing sides of the hair 41D that needs to be centered. They will flexibly yield to accommodate said hair's diameter. Since they both yield the same distance under the same amount of force, they will place the hair's center at the exact center point between them. This center point should be calibrated to coincide with the very center of the processing orifice 138D. In FIG. 139, this centering mechanism is shown from a perspective view converging on a hair in order to center it in a processing orifice.

In order to increase the centering accuracy of such guides, their maximum displacement distance, caused by contact with a hair, should be limited to a very short distance not much greater than a few hair-diameters wide. This is to say, although the flexibility joints involved most likely will be capable of moving a much greater distance than a few hair-diameters, the maximum distance they should actually be allowed to move to accommodate variations in hair size should only be a small fraction of this. This will mean that the spring-force change, in response to flexibly yielding relative to a hair's surface, will be very small. This can be best done by making both the guides come in contact with part of the surface of the orifice which they serve in such away that they get hooked or stopped by said orifice at a very specific point. Said stopping point's position relative to the center of each orifice will be very accurately controlled, and with reference to the centering-guide convergence points 138E and 138F in FIG. 138, and should be less than a few hair-diameters from the center of said orifice. This will simultaneously accurately position the starting position of each guide and limit its potential displacement in response to hair-diameter variation.

Referring to a bottom perspective view of orifice 140A and its centering-guide halves 138A and 138B in FIG. 140, notice how the bottom of centering-guide half 138B has a projection 140D on its underside that comes in contact with the surface of orifice 140A, thereby preventing farther advancement of centering-guide half 138B. The same relationship exists between centering-guide half 138A and the projection 140E on its underside. The centering guide halves get hooked at points where their apexes, or convergence-points, have advanced at most a few hair-diameters past where the outer surface of where a centered hair should be. You should note that although the guide might move a relatively great distance before it contacts a part of an orifice, once its in position to center a hair, it will have an extremely small displacement distance. Since in practice multiple-orifice assemblies will be used, the hooking point and hooking projections used might look slightly different than shown in FIG. 140.

However, even in multiple-orifice-per-channel configurations, the centering guides should have some degree of independent movement from other centering guides even those in the same channel. This is necessary because slightly different size hairs might be in a single processing area at once, which would require that the various centering guides involved to resiliently yield different amounts. This movement independence might be achieved by various methods including sub-dividing the tine all the way back to the flexibility joint into sub-tines each with a single centering guide half disposed on its end. Likewise, independent spring-resilience means could be placed at the tips of each tine between the long portion of the tine and the functional area portion that constitutes a centering-guide half. Placing independent micro-machine-based centering guides on a tine is an example of the latter.

If the opposing hair-centering guides achieve their movement variability or resilience through tine flexibility joints, then they will likely be placed on independent tine assemblies not attached to the vertically in-line cross-sectional-reshaping-assembly orifices, but rather, nested among them using a scheme similar to that illustrated in FIG. 137. However, if they are based on micro-machines actuators or any other resilience means placed at the tine tips, then they could either be attached vertically in-line as part of each cross-sectional-reshaping assembly or disposed on independent tine assemblies. In either case, micro-machine type actuators could be entirely contained at the distal tip of the tines next to the hairs they're responsible for centering. Wherever centering guides are placed on separate tine assemblies from the vertically in-line orifices which they serve, they will likely have their own dropped-down nesting pattern as illustrated by FIG. 137 and previously described with reference to imparting independent movement to carving orifices. Although less likely, centering guides might be placed on the stationary walls of the hair channel, for example on the left wall.

Referring to 131, centering guides will function best when one pair 131D is placed above the processing orifices and another pair 131E below. However, centering guides placed above carving orifices might sometimes be redundant because the carving orifices function as centering guides themselves when carving hairs with diameters greater than their own.

Hair centering guides will likely contact the hair fibers with a low-friction surface, such as a Teflon coating, and will likely have rounded beveled or even downward funneling smooth edges. In fact, said centering guides may even be configured as some type of opposing roller means.

Since the centering guides are in contact with hairs that have coatings on their surfaces, small shavings of said coating might rub off and build up on the guides. To prevent cumulative buildup, in addition to exposing the guides to vacuum currents and squirted cleaning fluids from the left wall, the guides might be temporarily retracted from the hair surfaces and moved over a parallel surface that serves to scrape them clean. Of course, this means that a given pair of guides would temporarily stop centering when they're moved out of contact with their hair. To remedy this, centering-guide pairs could be deployed in vertical stacks of at least two pairs at each region along the hair that needs to be centered. When one pair is retracted, another stacked pair would take over. Since centering guides will likely be placed both above and below the in-line processing orifices, there may be two such stacks used.

A similar option of keeping the centering guides clean is to limit their contact with the hairs. For example, the lower centering guides might only contact a hair for a fraction of a second at the start of lengthwise pull-through and, then, retract before the coated portions of each hair reach them. At this point, the presence of other mechanisms such as rollers placed under the processing stack could help the hair remain centered.

Further Tine Assembly Simplification by Consolidation

Referring to FIG. 141, a top perspective view of two consolidated tine assemblies, the cross-sectional reshaping system can be further simplified by consolidating all orifices on the same side, but with different cross-sectional shapes or diameters, onto a single connectivity-bridge tine assembly. For example, all left orifice halves have been placed on tine-assembly 134A and all left halves on tine assembly 134B. Based on the cross-sectional shape and diameter desired, the appropriate set of vertically in-line reshaping orifices could be moved into alignment with the left wall fluid outputs. This consolidated configuration simplifies movement and reduces the number of tine-assemblies involved, at the expense of requiring several different in-line orifice assemblies to move at once. Each processing cycle, the entire right-side tine assembly 134B and the several vertically in-line orifice sets on it would have to move together.

Further still, using micro-machines, all orifices and hair centering guides could be placed on just two consolidated connectivity-bridge assemblies, one for the left half the other the right. Micro-machines will not only allow the independent flexibly yielding nature needed for the centering guides, but also, the independent movement needed to move the carving orifices away from the hair before the coating orifices. As mentioned before with reference to the attachment system, the use of micro-machines reduces the complexity of tine-assembly movement, sometimes obviating the need for tine movement entirely by localizing part movement to only the functional area of a hair handler that is directly in contact with a hair. Thus, referring to FIG. 141, the consolidated tine assemblies 134A and 134B would only have to move into alignment with the left wall once per user session. During the many processing cycles in a session, they could remain stationary using only the localized movement, provided by the micro-machines, to pinch and release the orifice halves.

To further reduce tine-assembly movement in the consolidated-tine configuration, multiple vertically in-line fluid supply outputs and vacuum intake clusters could be placed longitudinally along the length of the left wall. In other words, the system would have the familiar set of left wall functional structures duplicated at several points spaced longitudinally down an extended length left wall. In such a configuration, the tine-assembly movement could be limited strictly to side-to-side movement because all vertically in-line orifice sets would always be laterally in-line with the left wall regions which they can plug into simply by being moved sideways. Hairs would be brought to a different longitudinal position along the hair channel depending on the orifice set currently in use. Since there would be unused orifice sets, such a system would face the problem of either wasting processing fluids or having to turn off the left wall fluid output stacks not in use. What has been said about placing micro-machines on a consolidated-tine assembly can be extended to placing them on a hair channel wall.

Example Reshaping Sequence

A likely processing sequence for changing the cross-sectional shape and diameter of a hair is as follows. Note that the frame of reference of the following steps is a point on hair as it is pulled lengthwise through the following series of orifices from highest to lowest. All or several of these steps maybe performed on different points of single hair simultaneously.

1. Highest level: A hair goes through encircling razor-ring orifice type pincher.
2. Next highest level: A hair has structural keratin applied to it by coating application orifice type pincher.
3. Next lowest level: A slightly wider concentric orifice is used. With it, hair is coated in a temporary protective wax coating that will harden fast holding the structural keratin coating in place against the hair as said keratin coating fuses with the native keratin of the hair.
4. Lowest level: A cooling liquid (or gas) is applied to the temporary wax coating instantly hardening it. Technically, applying cooling fluid should be considered a type of coating application, and thus, is done by coating application orifices.

Note: Steps 3 and/or 4 might be skipped if the structural coating fluid is or can become sufficiently hard on its own immediately after the coated portion of hair exits the application orifice. Perhaps, this could occur by cooling of said structural keratin coating.

5. Removal of wax protectant: Just as the wax protectant used in the hair extension attachment process needs to be removed, the wax protectant applied during the cross-sectional reshaping process does too. A likely way to do this is to apply hot oil to the hair, which will dissolve the wax. The hot oil itself could then be washed off with water and detergent. Of course, a device similar to the hair extension remover, previously described, would be perfect for such a process. Note: This step occurs after the hairs have been waiting on the head a few minutes. It is NOT performed simultaneously with steps 1–4 nor by the vertically in-line orifices used in said steps.

Somewhere among the above outputs, on the left wall, could be one or more vacuum intakes to dispose of shavings from the hair, excess structural keratin, cooling fluid and wax that escapes, especially when the pincher orifices open. Referring to FIG. 134, these vacuum intakes might be placed as horizontal slits between the various fluid output nozzles 127C or as long vertical slits 134H on either side of them.

Coating Extruded Under Positive Pressure

There are, at least, two approaches to applying a coating to the surface of a hair. One is to try to seal the top end of the orifice off by making it narrow and perhaps using a resilient material to form a seal around the entering portion of the hair. With the top end sealed off, any applied fluid is free to be extruded only through the bottom of the orifice. Of course, the hair is being pulled through this same orifice. Thus, the material will be extruded concentrically around the hair. The goal should be to match the material extrusion speed with the speed that the hair is being drawn through the orifice. Thus, a concentric coating will be extruded around the central hair fiber. If two concentric extrusion orifices are placed vertically in-line, they might both have permanent seals on their top holes. Or the moving extruded material from the bottom of the topmost orifice might be fed into the top of the lower orifice in such a tight manner that said moving extruded material itself forms a temporary seal in the top of the lower orifice. In most cases, this concentric extrusion approach is relatively technically challenging.

Coating Simply Sticks to Hair Surface

A simpler approach would be to use a coating fluid delivered by a combination of very low pressure and capillary action through the supply channels and orifice interior. Said fluid is so viscous and delivered under such low pressure that it fills up the interior of each coating application orifice, but cannot overcome capillary action within the orifice, and lack thereof outside, in order to escape from the orifice by itself. Ideally, the fluid should be introduced into the interior of the orifice chamber by an output nozzle that has a relatively large diameter or cross-sectional area in comparison to any open area the orifice has around the hair in its interior. The coating fluid should have a great enough affinity for the surface of the hair that it sticks to said hair and is pulled from said orifice on the surface of the hair. The lowest (nearest the scalp) and final cross-section of the orifice encountered by the hair is likely narrower than the more central portions of the orifice. It is this final cross-section's purpose to impart a final cross-sectional shape and diameter to the fluid coating as it leaves. The coating is viscous enough to hold this shape until either the hair is coated with a temporary fast hardening coating, such as wax, most likely a fraction of a second later or the structural coating hardens itself in a fast manner. In the latter case, the structural keratin itself could be hardened by immediate application of a cooling liquid or gas upon exiting the orifice, perhaps, obviating the need for the protective wax coating. In this case, it is likely that the structural keratin had been warmed somewhat itself before application to the hair in order to decrease its viscosity.

Of course, a variant process, which relies on actively controlling the flow rate of the liquid coating rather than entirely on low pressure and viscosity to stop the flow, could be considered. Such a variant would be, otherwise, the same relying on the coating sticking to the hair and a lower orifice imparting a final cross-sectional hair shape.

Reduce Tight Turns for Exiting Hairs

During the hair cross-sectional reshaping process, the hair is pulled lengthwise downward through the vertically in-line reshaping orifices by virtue of the pullback and/or bend-under means acting on it. This presents a problem because these systems must be designed to allow access close to the scalp, which necessitates that the hair follow a path made up of relatively sharp corners during pullback and bend-under. These sharp corners will typically be acceptable in the hair extension attachment embodiment. However, sharp corners might disturb the still-soft hair coatings applied by the hair cross-sectional reshaping embodiment. Naturally, we can take efforts to lessen the damage any sharp corners may cause by making them rounded and slippery, ideally, perhaps using rollers on such surfaces if feasible. In particular, we will want to make sure that the surfaces of the lowest centering guides, the pullback means, and the connectivity bridge area over the bend-under belts are all smooth and rounded. However, corners with smooth and rounded surfaces, might not be able to completely counter the effects of tight turns in path. Thus, the ideal embodiment should have a way of obviating tight turns in a hair's exit path while still allowing the system to access the hairs close to the scalp.

The best way to both obviate tight turns and still allow access close to the scalp is to cause the processing stack 142A to elevate away from the scalp 430, as shown in FIG. 142, after the hairs 41D are chambered in their vertically in-line reshaping orifices 142D. As such, the first lengths of hair pulled through said orifices are not pulled by the pullback or bend-under systems, but rather, by the stack elevation system 142F. This stack elevation is most likely achieved by mounting the cross-sectional reshaping stack on its belt buckle 76G using an assembly 142F that allows the stack to elevate relative to the belt buckle while the belt buckle itself remains the same distance over the scalp at all times.

Once the reshaping stack is elevated, perhaps several centimeters over the scalp, it will be possible for the pullback and bend-under systems to guide the exiting hairs along a path made up of much wider-radius corners. Of course, to realize this situation, the pullback and bend-under systems have to be configured somewhat differently themselves.

First of all, the pullback system should be configured of smooth surface guides, ideally rollers, placed underneath the reshaping stack to guide the exiting hairs around gentle corners on their way back to the bend-under system. Before the reshaping stack is elevated away from the scalp, there is not much room for the smooth surface pullback guides or rollers under it. Thus, while the stack is near the scalp, these guides must be stored elsewhere and brought into position under the reshaping stack only while it is elevated. There are various places where a pullback-guide-support assembly 142G could be stored while not in use, and various ways it could be moved into position under the processing stack. For example, said assembly and the guides within it could swing down from recessed portions in bottom of the processing stack, like landing gear on an aircraft. Alternatively, said assembly could be positioned to the side, back, or front of the reshaping stack most likely on the top surface of the belt buckle and slid into position laterally or longitudinally, respectively. Finally, a combination of these things used together might be used.

Referring to FIG. 143, we see that it represents FIG. 142 at a later point in time after the pullback system comprised of guides 143C and, optionally 143D, has been actuated backward and the exiting hairs 41D have been engaged by the bend-under system 2E. Optionally, a smooth-surface guide 143B remains stationary underneath and very slightly behind the center of the vertically in-line processing orifices 142D to lessen the stresses and rubbing against the lowest hair centering guides. Optionally, a guide 143A can be placed underneath and very slightly in front of the center of the vertically in-line processing orifices 142D to help lessen the stresses and rubbing against the lowest hair centering guides. Although both guides 143A and 143B are optional, guide 143B is more strongly recommended. At least one smooth surface guide 143C serves the function of a pullback hook and, as such, is moved back towards the bend-under system 2E. Optionally, at least one other smooth surface guide 143F serves as a leading protecting edge of the connectivity bridges in the belt buckle and/or bend-under system. Alternatively, a functional equivalent of this can be achieved by configuring the moving pullback system with two smooth surface guides on both forward and rearward sides of the exiting hairs as shown by the inclusion of the optional guide 143D.

In all cases, the smooth surface guides are most ideally rollers. Ideally, these rollers will either be made up of independent passive (moved only by hairs in contact with it) segments, one for each channel or a single roller that is actively driven at the same linear speed and direction that the hairs are moving over its surface. Note: By passive rollers, we mean rotated only by exiting hairs moving over their surface. By actively driven, we mean rotation is driven by a mechanical mechanism.

At the end of each processing cycle, lasting about second or less, the whole process must reverse so that the reshaping stack can descend towards the scalp and isolate a new batch of hairs in its chambers. Most ideally, the reshaping stack would be split into two stacks, one that elevates, the other that doesn't. In this situation, the portions of the reshaping stack responsible for isolating individual scalp hairs would not elevate, but rather, remain near the scalp so that they could be working while the reshaping orifices were elevated.

Potentially, this scheme of elevating and introducing smooth-surface pullback guides could be used with any processing-stack configuration including the hair extension attachment stack. In fact, it can be considered as an alternative means of either hair pullback, bend-under, or both. In fact, more generally it could be considered a means of preventing hair buildup in front of an obstruction associated with the processing system. This is to say that if the processing stack elevates high enough, and the hairs it deals with are short enough, no other bend-under means would be necessary. Also, one should note that the other means of pullback and bend-under discussed, herein, could be applied to this system instead of the exact guide configuration described above. For example, rather than moving pullback rollers backwards themselves, they might remain in place but be actively rotated so that they pull hairs into themselves and push said hairs out under themselves.

Summary of Cross-Sectional Process Variants

There are different possible variations of the hair sculpting and coating methods described above. The methods previously described above are those preferred for on-head scalp hair processing. However, there are other methods and all methods can be adapted for the alternative purpose of applying concentric coatings during a factory fiber extrusion manufacturing process. The following catalogs different approaches, which might be, used both for processing scalp hairs and applying concentric coatings during a factory manufacturing process for artificial hairs:

Centering Within Orifices During Extrusion

The center of the hair could be forced to coincide with the center of the processing orifices it passes through by one of the following centering mechanisms:

-Where the central fiber is centered in orifices . . .

- . . . by a stretchable skirt, around the orifice and in contact with the hair fiber so as to center it, that uniformly expands around the fiber going through it.

. . . by a spring-mounted individual mechanical supports that converge towards the center point of the each fiber. Such a support is most likely made up of several gores that together form a conical structure. The gores likely have a spring-like quality that pushes them inward to meet at a central point but allows them to yield outward to accommodate a hair running through the central axis of the orifice which they serve. They might have a flat smooth surfaces or perhaps rollers at their tips in contact with the hair.

-- . . . by two spring mounted, or otherwise resilient, mechanical supports converging on the hair from opposite sides and that contact the hair with notches whose shapes are mirror images of each other and should be configured as two opposing mirror-image pinchers whose notches, often V-shaped, funnel or converge in cross-section with increased lateral distance from their leading ends between which the hair cross-section will be held.

This description includes both tine-mounted supports with flexibility joints and micro-machine type supports.

-- . . . by an adjustable iris setup in which the hair cross-section will get held:

The iris is forced to adjust by the force of the hair pushing on it.

-- . . . by placing the entrance of a second orifice so close to the exit of a first (<1 mm) that the exiting fiber remains stiff and, thus, centered in the second orifice by the first.

Approaches to Adding Keratin-Like Materials to Natural Scalp Hairs.

1. Concentric Coating of Hair only:

Concentric-only coating is when coating is added only to hair surfaces, but coating is stopped when the tip of a hair exits the application system. The following catalogs some concentric-only coating variants:

-Coating is stopped because a sensor detects that the length of the hair has been exceeded.

--Said sensor causes the system to stop extruding coating material

--Said sensor causes the system to trigger a cutter that clips any coating material that trails the hair tip.

-Coating is stopped because the pressure at which the coating material is extruded into the interior of extrusion orifice is not great enough to exit said orifice. The coating material can only exit if it sticks to a hair surface as it is pulled through the orifice.

-The coating material might exit the orifice but it is not structurally stable unless it is coating the surfaces of a hair. Thus, if the coating leaves the orifice without a hair, it gets pulled away by vacuum, perhaps before it even reaches the wax coating orifice.

--The coating material is structurally unstable unless coating a hair, in part, because only enough coating material is supplied to the extrusion orifice and only fast enough to coat a hair, not to form a new length of fiber via extrusion 2. Formation of Additional Hair Fiber Length Via Extrusion:

Not only should the keratin-like material be used to coat natural scalp hairs, but when the tip of a hair exits the application system the coating extrusion is continued, no longer as a concentric ring coating, but as the extrusion of a full diameter hair shaft. Thus, the extruded material extends the length of each natural hair.

Specifics Regarding Hair Attributes Achieved Through Processing.

Hair Curliness Changing in Response to New Hair Cross-Section

Thiols or other chemicals capable of breaking disulfide bonds could be applied to the hair in its natural state (not in curlers, coated with wax-like substance or otherwise fixated) after hair cross-sectional sculpting. When a hair is given a new cross-section by sculpting, the internal forces that determine its degree of curliness would be expected to change. However, the hair's original internal protein molecules will, in some cases, still be locked together largely in the same manner that they were before hair shaft sculpting. Application of disulfide-breaking chemicals will allow the molecules to reorganize themselves in accordance with the new stresses they are experiencing. Thus, if a hair cross-section is made rounder, it will tend to reorganize its molecules in a manner that encourages straightness. Likewise, if a hair cross-section is made more oblong, it will tend to reorganize its molecules in a manner that encourages greater waviness or curliness. In other words, when a hair cross-section is made more oblong, application of perm chemicals without curlers could produce increased curliness, anyway. Without cross-sectional hair sculpting, application of perm chemicals without curlers would probably either do nothing or make the hair straighter.

When using this disulfide bond reorganization scheme, it is probably best to configure the process so that the hair dries before the disulfide-breaking chemicals are neutralized. Since all hair tends to straighten out when soaking wet, the hair will not experience the true effect of its new cross-section until somewhat dry. Thus, by exposing the hair to disulfide-breaking chemicals during the drying process, molecular reorganization will be possible during the drying process. In turn, the molecules will organize in manner consistent with the internal forces present in dry hair, not wet hair. To summarize, the sequence of application would be hair cross-sectional sculpting by carving and/or coating, removal of any temporary protective coating, application of disulfide-breaking chemicals to unfixated hair, letting hair dry with said chemicals on them. Of course, an alternative approach is to simply estimate the waviness that corresponds to a particular cross-sectional hair shape and fixate the hair in a manner consistent with this waviness. In this case, the disulfide-breaking chemicals could be neutralized while still wet.

There are several possible ways to fixate hair in the wavy manner that corresponds to its particular cross-sectional shape. The first is to use conventional external fixation devices, like curlers, with conventional disulfide-breaking chemicals, like perm solutions and, of course, to apply them in the conventional manner. A second way to fixate hair is to apply a disulfide-breaking chemical to the surface of each hair and then coat each hair with a temporary protective coating, like a wax-like substance. This wax-like substance could then be curled or crimped into the appropriate shape, which would hold the hairs in place without any external fixation devices, such as curlers. The disulfide-breaking chemical and protective coating could be applied during cross-sectional hair reshaping. In which case, the disulfide-breaking chemical could be one and the same as that mixed in with the keratin-type coating to keep it dissolved. Alternatively, additional disulfide-breaking chemical could be added directly to the hair's surface during cross-sectional hair reshaping. In either case, under the influences of disulfide-breaking chemicals, the keratin-type coating would tend to meld with the surface of the hair, and the entire hair's protein structure would soften allowing it to take on a new degree of curliness corresponding to its new cross-sectional shape. Likewise, the temporary protective coating, used for fixation, would likely be the same one applied for the purpose of cross-sectional reshaping.

During the fixation period, chemical reorganization means that the hair might not only be soft enough to change its shape but, most likely, to actually meld with the structural keratin-type coating applied to it. Chemically speaking, this includes formation of disulfide bonds between the native hair keratin and the keratin-type coating. Further still, it might even include a small degree of volumetric mixing of the two. As such, the protective coating would be necessary to support the hair during this weakened time.

It is possible that fixation might not always be necessary which might make a wax-like temporary protective coating something that could be avoided so long as the structural keratin material remains undisturbed on the hair while it chemically hardens. One way to do this is to formulate the structural keratin-like coating so that it becomes fairly solid upon cooling. Of course, cooling alone probably would not provide the long-term stability we desire. Thus, this coating might be designed so that when it is cooled far below room-temperature it hardens, but when allowed to re-warm to room-temperature, it softens enough to allow chemical hardening to take place via a mechanism such as the oxygen in the air causing thiol-reduced disulfide bonds to re-establish. Remember, reducing agents in the coating will likely leach over to the native hair keratin causing it to soften and little, thus, allowing melding of the coating with the native hair. During this fragile re-melt period, the hairs will need to be protected from sticking together and perhaps even deforming.

To achieve this, we could revert back to the wax-like coating, which is capable of even holding somewhat liquid coatings to the surface of the hair. In addition to, or instead of, a wax-like protectant, we might be able to use a thick liquid or gel that doesn't harden, but acts as a protectant by virtue of its lubricity and intrinsic physical structure. Said liquid protectant ideally will have affinity for the keratin-like coating on the hairs, however, its presence would keep adjacent coated head hairs from sticking together, just as cooking oil keeps food from sticking to the pan. Also, the lubricity of this coating will help hairs exit from the reshaping system stack with so little friction that their coating isn't rubbed off or distorted even if the hairs are expected to bend around an object on their way out. Of course, one of the greatest advantages of using a non-hardening protectant is that it can simply be washed off once the structural coating's hardening is complete. Finally, we should note that the liquid or gel protectant could serve the simultaneous purpose of a coolant for the structural coating or any other type of coating applied prior to it.

Coating Affecting Hair Surface Properties

Rapid Cooling to Change Surface Texture

Structural keratin-like coating of a hair followed by passing the hair through an orifice, or output nozzle, that exposes it to a rapid change in temperature which causes the applied coating to wrinkle, thereby, giving the hair a rougher less light reflective texture. This rapid cooling can be achieved by use of a cool liquid or gas. This temperature-induced wrinkling can be calibrated to produce the precise surface texture desired.

Note: Using a structural keratin-like material that can thoroughly re-melt before hardening permanently by a chemical reaction or using only a non-solidifying protectant will encourage surface-texture wrinkling generated during a rapid cooling to smooth out. Doing the opposites will encourage a rougher surface texture for a less shiny more muted hair appearance.

Imparting Texture Through Surface to Surface Contact

Structural keratin-like coating of a hair followed by passing the hair through an orifice that exposes it to a textured, perhaps vibrating, surface in order to impart (imprint or abrade) a rough less light reflective texture on the surface of the coated hair. Said textured surface might be configured as the familiar in-line orifice with two halves or in an similar manner to the textured moving-cylinder extrusion roller pairs described in the artificial hair manufacturing section. The rollers could transfer the texture imprinted on their inner-surfaces to the hair fiber's coating, whether the coating was applied before or during said fiber's movement through said rollers. Of course, any such use of the moving-cylinder approach would have to be modified so that the cylinder pairs can fit into the multiple parallel processing areas of the connectivity-bridge tine configuration used in the hair-reshaping system.

Structural Coatings as a Way to Control Hair Color

The keratin-like structural coating might have a custom color that matches the hair. Where this color is custom-produced by mixing component colors. The component colors can be mixed as pure colorants and then introduced to the structural coating. Or the structural coating can be produced in several standard component colors which are then mixed together to produce the final custom color. The mixing can occur anywhere between the component supply reservoirs and the output nozzles. The colors could be of a transparent nature that allows the natural hair color to influence the appearance of the hair. Alternatively, the colors could be completely opaque such that they completely hide the natural color of the hair shaft and produce whatever artificial color is desired.

Structural Coatings Additives as a Way to Control Hair Texture

In an analogous manner to colorants, particles could be added to the coating to influence its texture. Such particles might help give the hair a rough less light reflective texture.

Alternative Hair Cross-Section Modification Means

In addition to razor-edge carving and coating, some additional ways of hair cross-sectional modification are catalogued below. Most likely, these methods would be employed themselves using some type of orifice that the hairs are drawn through during processing:

Hair maybe carved away by various means:

-Mechanical carving/cutting by razor edge

-Mechanical grinding or abrasion

--Where said grinding is vibrational

-Destruction by electromagnetic energy

--Laser vaporizing/burning (especially excimer)

---Laser directed tangentially on a plane

---Laser directed in a cone formation with a diameter shield

---Laser directed parallel to hair shaft

--Electron beam vaporizing/burning

Hair maybe reshaped with pressure by various means:

-Mechanical melting & reforming of shape

-Mechanical pressure to reform from the side (maybe combined with heat)

-Mechanical stretching to reform by putting direction means

Note: Most of the above-mentioned pressure-reshaping means work by pulling the hair through a narrowing conical orifice which acts like a die that the hair is drawn or extruded through in a similar manner as that used in the manufacture of metal wire. * If using draw-through orifice/die-approach, heating hair to soften, before or during pull-through, or applying disulfide-breaking chemicals ahead of time could be a beneficial adjunct.

Alternative Hair Cross-Section Modification Means Examples

If a laser, such as an UV excimer laser, were used to carve hair cross-sections, its light would be supplied in a similar manner to the UV adhesive-curing laser, previously described. However, it would, most likely, output its light from the two halves of an orifice that close around each hair. These halves would likely have largely semi-circular shapes. Ideally, these halves would serve as optical outputs capable of directing their light either along a cylinder with walls largely parallel to the surface of the hair, a cone that both encircles and slants towards the hair shaft's center, or along many lines in a largely flat plane each with angles tangent to the outer surface of the hair's cross-section. In all cases, the goal is to aim light superficially at the surface of the hair so that if preferentially carves only the most protruding surfaces of the hair while leaving the recessed areas untouched.

Using an abrasive to carve the hair surface is another alternative. Naturally, like the laser, the abrasive would be positioned in two halves surrounding the hair. Most likely, the halves would be semi-circular in shape. However, neither a laser nor abrasive is the most preferred way to carve a hair's cross-section, but rather, are alternatives to the encircling razor ring.

Miscellaneous Notes on Hair Cross-Sectional Reshaping

*We have already discussed that disulfide-reducing chemicals can redissolve a concentric coating layer and also the hair itself causing them to merge as one while they are being held together and protected by an outer temporary protective coating layer such as wax.

--To further this melding process, perhaps use laser or light energy, or a mechanical means, to cut holes through the hair shafts in order to allow the added keratin coating to actually penetrate the hair shaft. Of course, such a hole-cutting means would likely be deployed on tines and positioned in-line with the reshaping orifices.

*The centering guides (and perhaps pushout and pullback actuators too) should likely have very smooth funneling surfaces that may even have indentations, the shape and size of a hair cross-section semi-circle, at their rearmost hair contact edges. Ideally, these smooth surfaces through capillary action and/or a hydrophilic nature would encourage the hair to hydroplane along their surface.

*The coating coolants should likely be formulated with an anti-freeze that allows its temperature to be made extremely low, thereby, allowing it to work faster.

*Cooling fluid likely applied using a coating orifice in preference to a spraying nozzles so that it can be applied in the way that least disrupts coatings previously applied to a hair's surface. However, spraying nozzles are an option.

*Cleaning nozzles maybe present on the left wall in the reshaping system in the same way they are likely to be in the attachment system, as previously described.

*Many of the concepts useful in the Hair Extension Factory Manufacturing section can be applied to hair-cross-sectional reshaping and vice versa. For example, the chemical coatings and chemical hair fiber formulations used in factory manufacturing can usually be used as structural coatings for hair-cross-sectional reshaping. Likewise, many of the physical structures, such as the moving-cylinder spinneret hole approach, can be applied. Similarly, when we speak of structural keratin materials that can be used as coatings, it should be understood that keratin-like materials might be substituted.

*Whenever we speak of wax coatings, such as for temporary protective coatings and for temporary fixation purposes, we should realize that any wax-like coating could be substituted whether it is technically a wax or not. By wax-like, we mean something that softens when heated and hardens when cooled.

*In the attachment system, the processing area is more specifically called the attachment area. Since other variant systems, used for purposes other than attaching hair extensions, are analogous to the attachment system, what's true for the attachment area in the attachment system should usually be true for the processing areas of the other types of systems. For example, the processing area of the cross-sectional-hair-reshaping system could be referred to as the reshaping area, and is supplied with scalp hairs in a similar manner to the attachment area. The column of vertically in-line reshaping orifices are a form of processing chamber homologous to the processing chambers in the attachment system called attachment chambers. Thus, in discussions of the support equipment, such as the tensioning hair straightener, connectivity-bridge-bend-under system, and belt buckle, what applies to the attachment stack and its attachment area applies in an analogous manner to any processing stack and its processing areas and chambers. Types of processing systems that perform functions other than hair extension attachment include those that, apply coatings to the surface of hairs, reshape hair cross-sections, automatically cut scalp hairs to a controlled length, and those that implant and remove hair implants into and from the scalp.

*The various orifices used for cross-sectional reshaping require extremely tight tolerances sometimes on the order of less than one micron. This is especially true of the razor-rimmed carving orifices whose razor edge is so small it most likely must be produced without the aid of grinding equipment. Thus, for all orifice types coating-types included, but particularly those involved in carving, extremely precise manufacturing methods must be used. The most promising method involves electro-forming the orifice-halves on a template which itself was produced by ion-beam milling. The orifice-halves would likely be formed out of a metal such as nickel. Thus, in order to preserve the sharpness of the razor-rimmed cutting edge, vapor deposition of a diamond-like coating onto the nickel is advisable.

3. Implant and Remove Surgical Hair Implants

Use of Surgical Hair Implants

Conventional Surgical Hair Implants

By conventional surgical hair implants, we mean those artificial devices that. have anchors that allow a hair fiber, real or artificial, to be anchored into the dermis. In contrast, hair transplants involve transplanting living human follicles onto the head.

There are many problems with hair implants. First, since they don't grow, the wearer is typically confined to a single hairstyle. Additionally, most of the people with implants, also, have natural hair on their heads of approximately the same length. Thus, during haircuts, great care has to be taken to make sure only the growing natural hair is cut. If implanted hair is cut, it will not grow back. Consequently, small hair-cutting mistakes can have a cumulative effect over time. Furthermore, since implanted hairs don't grow, over the years they tend to wear out. Undesirably, this will necessitate their eventual removal. Finally, the hair fibers used in implants need to be composed of some organic material in order to look natural. This material can be natural human hair harvested from a donor's head or artificial fibers fabricated out of a plastic. However, in both cases, the wearer's immune system is highly likely to reject organic material, which it considers non-self. This will likely lead to itching and inflammation around each implant site which will necessitate their eventual removal.

Solution to Conventional Implants

To solve the problems of conventional implants we would first have to use extremely short hair implants, perhaps, with less than 2 centimeters of fiber above the scalp. This way there's no way that they could accidentally get cut during haircuts. Second, we could either manufacture them out of or coat them with an inert inorganic material. For example, a thin diamond-like coating, applied to the surface of an organic fiber using vapor chemical deposition, could be used to do this. This would make it nearly impossible for the implants to wear out. As an added benefit, the inorganic surface of said implant would most likely prevent the immune system from reacting with it. In fact, if we weren't concerned about them wearing out or being cut, we could configure full-length implants whose tips were inorganic, or coated as such, but whose longer cosmetic fiber portions were entirely organic. Such a scheme would probably prevent the immune system from reacting with them, but such fibers would still wear out. (Note: The entire fiber could be coated with inorganic material to prevent it from wearing out. However, this would preclude entirely normal hairstyling, and such fibers could still get cut accidentally.)

Up until this point, it seems that we have to make a choice between implant fibers that will wear out and short unnatural-looking inorganic implant fibers. The solution is simple. Implant the short, long-lasting, non-allergenic inorganic fibers for use as anchors. Finally, use the hair extension attachment system, previously described, to attach temporary cosmetic hair extensions to them. If the hair extensions wear out or are accidentally cut, they must simply be removed using the hair extension removal process, previously described. The anchor implants remain, and a fresh set of cosmetic hair extensions can be applied to them. Also, the wearer is free to change his hairstyle whenever he desires by having the old cosmetic hair extensions removed and new batch applied.

Finally, it should be noted that using inorganic implant anchors is not necessarily the only way this invention can be applied. Most any material that doesn't trigger the body's immune response might be used to make implantable anchors. The key idea is that the cosmetic appearance of the implant anchors doesn't matter because the cosmetic hair extensions will later be attached to them. For example, a protein from someone's body, such as his own hair keratin, might be used to form the implant anchors.

Using Processing Stack Technology for Hair Implant Surgery

Processing Stack Modifications Needed to Implant Hair Implants

A modified version of the hair extension attachment system could be configured to implant hair implants into the skin. Such a system would assume that many patients still have some natural hair. Thus, the tensioning hair straightener, the front funneling portions of the hair channels, and some hair handlers like the pushback gates, all as previously described in the hair extension attachment system, would likely remain. These structures could be used to control the position of the person's natural scalp hairs, although we won't be attaching anything to said scalp hairs or changing them in anyway. The various methods of storing and loading cosmetic hair extensions into the processing area can be adapted for the storing and loading of hair implants into their processing areas. Of course, since hair implants often have pellet-like anchors at their bases, the loading system very likely will manipulate these pellet-like anchors directly in preference to the fibrous portions.

When speaking of processing chambers with reference to the surgical hair implantation system, we are referring to a needle or other means capable of being actuated and driving implants beneath the surface of the skin. The needle, or other sub-dermal actuation means, should be considered a homologous structure to the attachment chambers in the previously described hair extension attachment system and to the in-line processing orifices in the previously described hair cross-sectional reshaping system. Of course, this needle, or more broadly sub-dermal actuation means, will be loaded in an analogous manner to said homologous structures. For example, such a needle, or hollow chamber, will likely either have a slit in its side to allow loading or be loaded from the top. After a superficial loading of the implant into the upper-regions of the chamber, it is likely that a plunger, or functionally equivalent means like pressurized air, will be actuated down into said chamber pushing said loaded implant down with it. Said chamber will likely narrow or have an internal rim that catches the implant as a specific point in the chamber. However, this catch point shouldn't be an absolute barrier. Either the implant's end should be able to be forced past it with increased pressure of the plunger, or it should be a movable obstacle.

Forcing the implant past the obstacle could be made possible by making the obstacle's position on the interior wall of the chamber flexible by cutting slits in the chamber wall that would allow this. This would be particularly true if said obstacle was position at the freest end of a long tab-like structure formed by three intersecting cuts in the wall. Of course, to encourage flexing of said tab-like structure, the obstacle on it might have a somewhat tapered or ramp-like shape towards the direction from which the implant will come. Alternatively, the obstacle might just be made flexible itself by being configured in a spring-like shape such as an arch or from a flexible material.

Alternatively, the obstacle could be made movable by some exterior actuator. For example, attaching an extremely thin and strong fiber to it that can be pulled could externally actuate the flexible tab-like structure. Said fiber might be placed in the interior or exterior of the chamber. Alternatively, the obstacle can be made movable by positioning an external member through a hole or slit in the side of the chamber. The obstacle could be moved itself by moving the external member as a whole. Said external member is likely configured with an L-shape where the foot of said L-shape is inserted to serve as the obstacle. Both the extremely strong fiber and the L-shaped external member might conform so closely to the exterior of said chamber that they could be forced sub-dermally with it. Either the fiber or external member might be actuated by constructing them, at least partially, out of a material that changes its shape in response to electric currents. Further still, the fiber and external member might both be entirely obviated by constructing the obstacle itself or a portion the sub-dermal actuation chamber itself out of such a material.

With the implant chambered in the sub-dermal actuation chamber, said chamber is ready to be actuated down into the human skin. Said chamber pierces the skin by virtue of being the functional equivalent of a needle-itself or by the end of the implant having a sufficiently sharp point. Once at the correct depth beneath the skin surface, if necessary, the implant is moved past the obstacle holding it by actuation of the chamber's internal plunger means and pushed out the end of the chamber. While the plunger remains extended, the walls the chamber should be retracted out the skin, thereby, leaving the implant underneath the skin's surface.

The system will likely have a bend-under means, like that described for the hair extension attachment embodiment, operating. This will allow the person's long natural hairs, and any implants if long enough to need it, easy passage under the connectivity-bridges of the system.

Preventing Damage to Remaining Hair Follicles

Of course, for maximum rapidity, this system is best configured as a tine-based system with multiple channels in parallel. This would mean that multiple sub-dermal actuation chambers, or needles, would be held largely perpendicular to the human skin directly over parallel processing areas. We would probably limit the number of needles per processing area to one because, being performed only once in a person's life, this operation does not have to be as fast as hair extension attachment. The scalp-hair tops can be held aside from these processing areas at any given moment. This is made possible by the forward tension of the tensioning hair straightener, the backward tension of the bend-under system, and the hair handler's ability to close out scalp hairs from said processing areas. Thus, the processing areas are relatively free of obstructions just as if someone were parting the hair with his fingers in these regions.

However, there still are follicles and hair shaft bases that we would rather not hit with a needle. So that the sub-dermal actuation chambers are only forced into the skin where there are no follicles or hair-shaft bases beneath them, we could use the following system configuration. First, all sub-dermal actuator chambers, or needles, are attached at the distal ends of a tine-assembly. Said tine assembly is oscillated back forth either independently of the entire processing stack or as one with the entire processing stack. At the same ends of these tines, or ends of an independent parallel tine-assembly layer, are optical sensors that look perpendicularly down at the skin along axes parallel to the sub-dermal actuation chambers. The oscillation pattern is such that it can be known that an optical sensor will sweep over a given area of skin a known amount of time before a corresponding sub-dermal actuation chamber. In other words, the needles and sensors take turns being over a given any point of skin in the processing area. If a sensor doesn't detect any obstacles in the way of the single needle, which it serves, said needle would be actuated down into the skin when it reaches the patch of skin the sensor found clear. However, a detected obstacle will prevent this. You should note that, although parallel sensors and needles move as a single unit, each needle's actuation is controlled individually, and each sensor is monitored individually.

The sensors work by detecting a difference between hair follicles, hair shaft bases, and empty skin. The needle must only be forced into regions of empty skin, which have adequate safety margins from follicles and hair shaft bases. The sensors are based on the assumption that follicles and hair shaft bases have different optical profiles from empty skin. To guarantee that this is true, a cream-like preparation could be worked into the follicles. This cream or fluid is likely a carbon preparation that absorbs infrared light. Such carbon preparations are already used in medicine for purposes of laser hair removal. In laser hair removal applications, they absorb laser energy so as to become hot and kill the hair follicle. Such a preparation would guarantee a distinct optical profile for the follicles. However, the use of follicle colorant cream needn't be limited to those that absorb IR. Perhaps, formulations that absorb or reflect other frequencies of light could be used. Nevertheless, due to its ability to penetrate the skin, IR is an excellent frequency to use. Hair shaft bases might be made optically distinct with a coloring agent that selectively colors hairs but not the skin's surface.

Although the sensor system might rely entirely on natural light, it is probably more likely that an external light source will be attached to or used with the system. Most likely, this light source will be IR.

At some point, the optical sensors will need to convert the light image into digital electric currents that a computer can understand. This conversion might take place in consolidated sensor components atop the processing stack from which wires run to the computer in control of the process. On the other hand, fiber optics might be run from sensor optical inputs to a remote electro-optical conversion system. Thus, the light would be run to a remote location where it is digitally converted, rather than atop the processing stack. The advantage of this second approach is that the conversion apparatus itself could be made larger than if it had to be placed atop the hair-processing stack.

The systems will likely control and monitor its movement over the scalp precisely using mechanisms described for the hair extension attachment system. For example, it likely will have wheels rolling over the scalp capable of monitoring the system movement speed. Further still, these wheels might be configured with braking capabilities so that they can slow the system down if necessary. As in the hair extension attachment system, hair density can be judged by using hairpresence sensors across the hair channels and comparing the number of hairs to the movement speed over the scalp. Additionally, this embodiment could employee its optical follicle and hair base sensors to facilitate hair density estimation. In either case, the system could adjust the density of hair implants that it applies based on this information.

Finally, the independent movement of needle chambers makes it possible to use depth gauges to guarantee exact skin depth penetration every time. A depth gauge might be something as simple as a collar or other such obstruction on an exterior side of each needle. To further increase accuracy and ensure needles always enter the skin at the same angle, the needle assemblies could be give a slight ability to pivot. A part of each needle assembly, most likely flat and concentric to each needle itself, could proceed each needle itself to the skin. Upon contact with the skin, this part will cause said needle assembly to pivot to the exact, largely perpendicular angle, with the skin desired. Since the actual needle and its proceeding part have a telescopic relationship, being composed of sliding overlapping sections allowing compression, the needle will continue to move and enter the skin. Of course, the needle angle and depth could be controlled by actively driven mechanisms. For example, the pivot that controls the needle angle could be actuated to the desired angle. Perhaps, this angle might automatically change as the position on the head changes.

Reverse the Entire Process in Order to Remove Hair Implants

In order to remove hair implants, the entire process can be reversed but with just a few modifications. During the reversal of the process the sub-dermal actuation chamber, or needle, will be expected to grab the implant out of the skin, rather than letting go of it. To do this, the obstruction on the interior of the needle needs to be able to temporarily move out of the way of the implant as the needle moves down around it. This can be achieved in the exact same ways as obstruction movement is achieved above. The only difference being a ramp-like structure, if used, should taper towards the bottom of the needle, or in other words, the direction from which the implant will come at it.

Of course, the system has to be configured so that it can locate the implant and actuate a needle only when it is centered on an implant. The first way this can be done involves the use of the optical sensors as described before. The portions of the implant, especially the portions of it that anchor it beneath the skin, should have surfaces of an optically distinct material, most likely in the IR range. This way the system can look for each implant's profile and use at least two sides of the margin of normal skin around an implant to determine whether it is centered on said implant. This will also allow the system to discriminate between natural hairs and implants.

A second way that might be used, in addition to or instead of the sensor method, involves mechanical needle guides. Of course, we said before that the needles would likely be mounted in a pivoting manner and that the needle chambers are homologous structures to the attachment chambers and in-line reshaping orifices. Thus, if we use the mechanisms described in the analogous embodiment to load an orifice, or hook, on the side of or in-line with, the needle with an in-scalp hair implant's fiber portion, then the needle assembly could slide down along this hair. Since the needle assembly would pivot during this sliding process, the needle would be perfectly lined up with the implant by the time it reached the skin's surface. The system would, likely also, need some type of sensor means to differentiate between natural scalp hairs and hair implants.

One way to obviate the need for said sensor means is to first give the person a sufficiently short haircut and, next, use the hair extension attachment system to attach hair extensions to all scalp-anchored hairs real or artificial. After allowing the natural hairs to grow out, use an extremely precise hair-extension-removal system that only removes hair extensions at a minimum distance away from the scalp. It could do this my not applying solvent below a certain hair length. The much longer hair extensions that remain would only be attached to artificial hair implants. Configure the automated implant system such that it only hooks its needles onto hairs above a certain length. Thus, the needles would only be hooked onto hair extensions attached to artificial implant anchors and, thus, would only remove artificial implants.

This Device Could be Used to Transplant Hair Follicles

Of course, if living hair follicles could have their follicle portions pelletized or made into small plugs, they could be implanted in the exact same manner as that previously described for non-living implants. With advances being made in culturing hair follicles in vitro, we believe that industrial processes based on growing hairs out of the body will be possible. Such processes would serve as an excellent source for hair follicles that could be pelletized, placed in cartridges, and implanted in the head using the automated device described herein.

4. Automated Haircutting Processing Stack

Basic Automated Hairstyle Cutting System

In this alternative embodiment, we will describe how the basic processing stack design can be adapted for cutting hair with the professional precision required to produce attractive hairstyles. In the prior art, there is a device that allows a person to cut his own hair. This device consists of a relatively conventional electric hair trimmer mounted in a bracket that holds said trimmer portion a fixed height over the scalp while at the same time supplying a vacuum source above said trimmer portion. The vacuum source both holds hairs straight upward so that they all get cut at the same length and carries away hair trimmings. The problem with this system is that it produces a haircut in which every hair on the head is cut to the same length, unlike most professional haircuts which have many lengths, and this length is limited to a maximum far below that required for most women's hairstyles. Our processing-stack type system will not have these limitations. It can cut hairs to different lengths at different positions on the head.

First of all, we've said that the processing-stack haircutting system will be able to vary its cutting length at different positions on the head. Of course, this requires that its control system is able to ascertain its position on the head. This will be possible because the hair-cutting embodiment, like other processing stack embodiments, will usually be guided over the head using a track-guide cap, or functional equivalent. It may be the normal procedure for the system operator to move the handle unit over the tracks in a standardized specific order, or to have access to an input device that lets the system's computer know the nature of an impromptu track-order change. The system computer will know when the end of a track is reached and a new one begun either because there is a scalp contact sensor on the handle unit or a finger switch that the operator is supposed to trigger between track changes. The system will also have sensors that detect movement speed and distance over the scalp, like those discussed elsewhere within this document. Combining knowledge of the track number with data about the movement along that track, the system will be able to estimate its position on the head. This will allow the system to cut different areas of hair to different lengths. Note: This is the preferred method of locating unit position on the head. However, the herein-described haircutting system will be able to function with any position-location means.

At this point, we could simply configure the processing stack as a conventional tine-based hair trimmer with the unique feature of being able to elevate and descend relative to the scalp. This would achieve benefits over the prior art in that it could accurately cut different areas of hair on the scalp different lengths. However, such a configuration would still have a maximum hair-cutting length less than that required for many women's hairstyles. Thus, we will likely want to implement a still more sophisticated embodiment.

In this more sophisticated embodiment, the system should be configured with the hair isolation and chambering capabilities as described for the hair extension attachment system, using mechanisms described for it, such as the hair handlers or functional equivalents. Just as the attachment system isolated individual hairs and put them into attachment chambers, the haircutting system will put isolated hairs into homologous structures that we will call hair-cutting chambers. Unlike the attachment and cross-sectional reshaping systems, which ideally, require that only a single scalp hair be put in each processing chamber. The haircutting system can be a little more lax and allow a limited number of hairs per chamber. In fact, the system might very well use one consolidated chamber per tine channel that allows many hairs together in it. This reduced precision is acceptable in the hair-cutting variant because it's fine if many hairs from a small region of the head get cut the same length. After all, this is what happens when a professional hairstylist uses scissors. Once the hairs are chambered, we will have a hair handler (most likely moving-tine or micro-machine based and equipped with a sharp cutting edge) slide like the pincher 9C of the attachment system embodiment towards the left wall of the processing area, thereby cutting the hairs in the processing area chamber or chambers.

The critical parameter is when to trigger this cutting mechanism. We have already explained how the system estimates its position on the scalp, but it must, also, be positioned at the correct point along the length of the hair before cutting. This can be achieved in the same manner as described for pulling hairs through the cross-sectional hair-reshaping embodiment. Pullback means and/or bend-under means and/or stack elevation means should be used to pull the hairs lengthwise through the orifices in which they're chambered. Because we will most likely be using a tensioning hair straightener means, we will assume hairs in processing chambers are pulled tight and are, in effect, zeroed with reference to the amount of their length that has yet to be pulled through a given processing chamber. At this point, the means used to pull the hair lengthwise through the chambers from hair base to hair tip should be actuated. Since the rate at which this device pulls the hairs should be known and ideally constant, we can estimate the length of hair pulled through by timing. When the system computer determines the correct hair length has been reached, the cutting means is actuated. (The lengthwise pull through means may or may not have been stopped.) Thus, a limited number of hairs have been cut to a specific pre-programmed length. This is repeated many times as the system moves over the head.

Note: Even if micro-machine type hair handlers aren't used, independent control among different hair channels and hair cutting chambers is still possible using a tine-based system. The configuration that allows this requires tines that have hair-handler functional areas (like cutters) in only a subset of the channels, not all of them. This would require that the stack of moving tine-assemblies to have more layers, and as such, be thicker. Nevertheless, this is entirely acceptable, especially, because the system can be calibrated to take this into account. For example, the lower cutting tines in the stack could be timed to be actuated later than the higher ones. This is because the corresponding length points on each hair reach said lower cutting tines later than the higher ones. Also, the cutting means isn't limited to a pincher coming from a single side. The cutting means could be composed of two cutters that mesh together as the blades of a pair of scissors do. One of these of these blades could be either stationary or moving.

Programming Hairstyles into the System

We have explained how the system can cut hairs at different positions on the head different lengths, but how does the system know what those different lengths should be? More specifically, what lengths will produce a specific and aesthetically pleasing hairstyle? There are two ways the system can determine this. In the first method, the system could be given basic parameters about the size and shape of a person's head, most likely based on the size and shape of track guide chosen. Next, a standard hairstyle could be chosen, such as from a standardized picture book, and this selection could be entered into the computer. Finally, the computer would have been pre-programmed with the hair-length information necessary to achieve the selected hairstyle on the given head type.

A second manner of programming a hairstyle into the system is to use empirical sensor measurements from a specific individual's head. This way a person could have her hair cut once by a professional, perhaps a world-famous hairstylist, and have this exact haircut automatically duplicated on her head for years to come. Technically, how the sensor measurements would be made is by placing a hair presence sensor, or sensors, at a position where it can monitor the presence of hairs in the processing area, or even in individual processing chambers by using multiple sensors. Ideally, this sensor should be placed at approximately the same height as the sharp-edged cutting hair handler and have hair-detecting capabilities limited to a line or plane at said height. To program the system, it should be moved through all of the hair on the head using a standardized pattern. During this programming operation, no hair will be cut. Ideally, programming should be done immediately following a professional haircut, and the data obtained should be saved for later use. Of course, the system measures hair lengths in a very similar manner to the way it estimates when to cut hair, as described above. Specifically, we will assume hairs in processing chambers are pulled tight and are, in effect, zeroed with reference to the amount of their length that has yet to be pulled through a given processing chamber. At this point, the means used to pull the hairs lengthwise through the chambers from hair base to hair tip should be actuated. Since the rate at which this device pulls the hairs should be known and ideally constant, we can estimate the length of hair pulled through by timing. When the hair presence sensors detect that most hairs have been pulled through the chamber past their tips, the computer records the hair length at this specific point on the head. It is at this length that the cutting means will be triggered when automated hair cutting is performed in the future. Thus, the lengths of hairs at all positions on the head have been measured and recorded.

Note: This recorded hair-length data can be used not only to control the cutting process but, also, to determine, in advance, whether an individual's hair is long and dense enough all over to accept a particular haircut style. The density can be determined through the hair counting methods, described elsewhere in this document, or using sensor means sensitive to the volume of hairs passing before them in the hair channels. Such volume-sensitivity might be possible because increased hair volume will affect the electric currents or electromagnetic radiation circuits of the sensors more greatly.

-Hair presence sensors will likely have a range of sensitivity so that they can discriminate between having a processing chamber full of hairs in front of them or a sparsely filled chamber. A sparsely filled chamber, for practical purposes, could be treated like an empty chamber.

-The hair length and position data can be applied to another person's head of a different shape and size by expanding, contracting or, in the case of a greatly receded hairline, throwing out corresponding data points altogether so as to fit hair-length data to homologous regions on the two heads.

-In order to ensure that the track-guide cap is positioned on the head correctly, the system might require scanning runs before cutting. If the cap is misaligned, the system could require the user to realign it or the system could calculate new cutting-position data based on the misalignment by mapping the length-position data to a new grid pattern.

-Optionally, additional hair presence sensors could be positioned in the portions of the hair channels and bend-under system behind the processing area in order to confirm that the hair really is being cut to the correct length. This would be achieved by using a linear array of sensors spaced along the exit path. For example, a linear array spaced down the length of a bend-under belt assembly. Hair length would be estimated based on the last sensor activated. Longer hairs stay in the bend-under belts longer and activate more sensors than shorter ones. If placed on the bend-under belt assembly, this array is likely constructed in a flexible manner.

-For all hair presence sensors in this system, it is important to keep them clean. This might mean a tine-based part swiping over them periodically or, in the case of sensors placed along the bend-under belt assembly, having one or more tabs on the edge of the bend-under belts that swipe across its sensors periodically.

-In addition to hair presence sensors, optical sensors that record hair color information could be used and placed, most ideally, in a position adjacent to the processing chambers. This way as hairs are pulled through the processing chambers, color information about the hairs at various lengths and positions on the head can be recorded so that later a colorant application system could. duplicate the coloring pattern.

-Although direct measurement of movement over the scalp is the most likely way to measure system movement and estimate position on the scalp, if something is known about the volume or number of hair on a person's head, sensors that measure hair volume or count hair number passing through a hair channel could be used to estimate movement, and from that position on the scalp.

-It is important that the operator hold the system sufficiently near the scalp. For this reason, sensors that measure scalp contact or distance could be included in the handle unit.

-Whether a tensioning hair straightener system is used to hold the hair (more) perpendicular (than its natural state) to the scalp or it is done by another means, such as by hand, ideally it should be done. Otherwise, the system might not be positioned along the length of the hairs correctly. To make sure adequate straightening tension is being applied a pressure sensor could be used to push (most likely perpendicularly) into the hairs under tension. The system could be calibrated so that the hairs under tension counter the pressure sensor with certain amount of force. If they don't, they're not under adequate tension, and the system computer (if one is used) could act accordingly by taking measures such as sounding alarms and/or ceasing the system from any further activity especially cutting. These pressure sensors are likely configured with a line or band, perhaps under tension itself or a solid bar which is not, which presses into the hairs most likely positioned above the processing stack and ideally aligned largely perpendicular to hair flow above and across several processing areas. Hair-presence sensor methods for doing the same might be employed such as running an optical beam across and area where hairs should or should not be if they are under tension.

Use as an Intelligent Thinning Shear Means

Some people think their hair is too thick. For this reason, there exists in the prior art a class of device known as thinning shears. Whether constructed as manually operated scissors or as an electric hair trimmer, these devices work by cutting only one out of a specific number of hairs that pass through them. For example, they might cut one out of twelve hairs that pass through them. This is acceptable the first time thinning is performed. However, if as some later time after the hairs cut grow partially, but not all the way, back to their original length, the person might want to have her hair thinned again. She'll desire this because her hair will be getting overly thick close to the head, but not at longer lengths because the hair hasn't had time to grow out this far yet. Ideally, what needs to be done is to thin only the hair closer to the head. However, a problem arises because conventional thinning shears can't cut the same exact hairs that they did the first time. Thus, after conventional thinning shears are used a second time, most of the originally thinned hairs will remain the same length while many long hairs get cut undesirably. Thus, the hair will be thinned all over, not just close to the head. This means that either the portions closer to the head won't be thinned enough or the portions farther away from the head will be thinned too much.

In subsequent thinning sessions, an ideal thinning shears system would cut the exact same hairs the second time as it did the first while not cutting any previously uncut hairs. Such a system is possible by integrating the above-described in-chamber cutting and in-chamber sensor monitoring functions into a system where they function simultaneously. One change that would have to be made is that the sensors should be placed toward the tops of the hair-cutting chambers, approximately one to three centimeters higher than the cutting means portions. This distance is equal to the distance hair grows in the several weeks expected between thinning sessions. While the hairs are being pulled through the chambers, the sensors detect the tips of the shorter thinned hairs before said shorter hairs have cleared the cutting chambers. At or timed slightly after their detection, the hair cutting means positioned below should be actuated. Unlike the programmedhairstyle-cutting embodiment described above, for optimal performance, the hair thinning embodiment requires each hair to be isolated individually in separate processing chambers and for there to be an independent cutting mechanism and independent sensor mechanism for each separate processing chamber. If more than one hair were placed into a single chamber, either longer hairs that weren't supposed to get cut would or shorter hairs has that were supposed to get cut wouldn't. These separate cutting means are most ideally configured by placing the cutting edges as functional areas on micro-machine type actuators.

Naturally, the mechanisms described for the hair-thinning embodiment can be used in a manner that produces preprogrammed hairstyles. In other words, the longer hairs that aren't to be cut for thinning are dealt with in the same manner as described above for the basic automated preprogrammed hairstyle-cutting embodiment. In fact, a system can be embodied that performs both thinning and hairstyling functions simultaneously on one pass over the head.

Applying Coloring Agents to Simulate a Preview Before Cutting

In order to gain a client's confidence before allowing the system to actually cut the hair, the system could be configured with the capability to simulate the appearance of what the haircut will look like by applying a dark temporary hair coloring agent to those portions of the hair which are planned to be cut while not coloring those portions that will remain uncut.

This is achieved using the same process used for timing the actuation of the cutting means. However, instead of actuating a cutting means, a color application means is activated. Naturally, the color application should begin at exactly the same point cutting would have been performed and it should continue until the hair's tip is reached. Perhaps, a hair presence sensor could be used to determine when the hair's tip has been reached so as to prevent wasting coloring agent. Most likely, this coloring agent will be applied to hairs at locations within the interior of the processing chambers using either bare nozzles or coating orifices, as described for the hair cross-sectional reshaping system. The most probable position of the coloring agent supply is through the left wall as described for other processing stack embodiments.

Computer imaging could even be used to produce a preview picture of a person showing these colored areas automatically edited out.

5. Dynamic Hair-Channel or other Functional-Area Designs

In the embodiments described up until this point, it has been assumed that the hair-channel wall means portions would remain stationary relative to the processing stack configuration as a whole. Likewise, many functional areas disposed on said hair-channel wall means, such as nozzles, intakes, and dipole ends of a sensor gap, would also remain stationary relative to the rest of the system. In such systems, hair-channel-wall spacing remains constant. However, we can configure designs where the hair-channel-wall tines (or more broadly functional-area-supporting projections into a mass of hair) that support the hair channel walls themselves move relative to each other and the processing stack (or more broadly system) as a whole.

More dynamic configurations are possible where the hair channels formed between said functional-area-supporting projections (perhaps, tine-like, perhaps not) could do things such as reposition themselves relative to hairs, perhaps, even going to the hairs rather than the hairs to them. This can be achieved by configuring said functional-area-supporting projections involved as moving and capable of forming isolation areas within the areas between some of their functional areas (usually including their hair-channel-wall functional areas). This might be achieved by functional areas on a single projection moving relative to each other, for example by micro-machine means, and/or entire functional-area-supporting projections moving relative other functional-area-supporting projections. Hairs may enter said isolation areas by any of, but not limited to, the following: 1. Hairs being moved in by a mechanical hair handler 2. Hair-Channel-wall-based funneling means guiding them in 3. Pure chance 4. Hair attractive or repulsive force means, such as static electricity or air currents 5. Sensor means guiding the movement of said isolation areas to hairs 6. Sensor means telling a computer that functional areas, which form an isolation area, to close around a hair(s) when said functional areas happen to be in its proximity.

Said isolation areas can be one and the same as the processing areas, which perform the desired functions on the hair. Or said isolation areas each with a hair(s) in them can be moved closer relative to said processing areas so that the net effect is that hairs are brought to said processing areas or sub-areas within said processing areas, such as processing chambers.

Note:

- -We refer to functional-area-supporting projections extending into a mass of hair rather than tines because we aren't requiring that there be multiple projections nor that they be configured in a tine-assembly fashion
- -The above-described functional-area-supporting projections might, (in addition to, or instead of, a hair-channel-wall functional area), support functional areas described as metering-area side walls, isolation-area side walls, processing -area or chamber side walls. (But not limited to this list.)

Various functional areas such as hair channel wall means may form hair channels or hair-channeling areas during processing even if said channels and channeling areas aren't present all of the time.

-Regardless of whether a dynamic or stationary hair channel configuration is used, those functional areas of hair handlers which manipulate hairs by making surface-to-surface mechanical contact with them could be replaced by functionally-equivalent hair-handling functional areas which generate (non-solid-based) forces that effectuate hair manipulation. For example, moving fluids (liquid or gas), electrical charges or currents, forms of energy including, but not limited to, sound, heat, magnetic, electromagnetic, could be used to manipulate hairs in homologous manners to ways many of the direct-mechanical-contact functional areas do. The mechanisms that generate these (non-solid-based) hair-handling forces could be deployed on tines, or more broadly, functional-area-supporting structural projections into a mass of hair. Said mechanisms likely occupy relatively discrete positions on said structural projections, in a similar manner to mechanical-hair-handler functional areas, fluid-output nozzles, and hair-channel sensor gaps. Furthermore, fluid or electrical supply lines likely power them in analogous manners, for example. Note: If electrical charges are used for manipulation the system might (or might not) be configured so that it imparts a certain electrical charge to the entire human body and/or all the hairs on it. The means that does this could be part of, or independent of, the hair-processing system itself.

This dynamic hair-channel-wall design could applied to embodiments that serve various hair processing functions including, but not limited to, those described in this document such as hair-extension attachment, hair-coating application, hair cross-sectional reshaping, automated haircutting, automated hair-implant application.

Finally, just as the dynamic hair-channel-wall configuration can be applied across many embodiments, so too can features illustrated in one embodiment be applied by analogy to other embodiments. For example, the processing-stack-elevation system, shown illustrated for the cross-sectional hair reshaping system, can be applied to the other embodiments including, but not limited to, hair-extension attachment, automated haircutting, and automated hair-implant application.

Refinements and Ideas Concerning the Overall Attachment System (and other Types of Processing by Analogy)

*Attachment System Enhancement Features*

Just as the attachment stack can be embodied and enhanced in many ways, so too can the overall attachment system. The following represent variations, and in some cases, enhancements of the overall attachment system.

****Different System Types on One Handle Unit

Removal and Attachment Systems On Same Handheld Unit

Originally, the hair extension removal and attachment systems were placed on two separate handle units. However, a system where the attachment stack follows immediately behind the hair removal system is a possibility. In such a system, hair extensions are recycled in a different manner. Rather than first filling clip cartridges with hair extensions from the removal system, hair extensions from the remover are fed by a conveyor system directly to the attachment stack. The conveyor may first take the hair extensions through some type of refinement system that may do things such as clean, sort out undesirable, and realign how the conveyor holds the hair extensions. Alternatively, the hair extensions maybe taken directly from the removal system to the attachment stack. Regardless of the path the conveyor takes. in the middle, it will typically leave the back of the remover with detached hair extensions and bring them to the attachment stack from the back or top. In other words, it will loop around from the front of the handle unit to a place towards farther back in the trailing attachment stack. In such a system, a single pass over each scalp area would both remove hair extensions and then reattach them closer to the scalp. Naturally, such a system would ideally have a hair straightener. It may use one hair tensioning straightener that precedes both the removal and attachment systems or it may use two straighteners, one preceding each directly.

The remover, attachment stack, and straightener can each be considered a separate functional unit. Each functional unit should have close contact with the scalp. In FIG. 78, it is shown how the attachment stack held by its belt buckle and the straightener both were allowed to rotate relative to the handle unit and each other in order to conform to the surface of the scalp. Referring to FIG. 75, rotation of these two functional units is achieved by their peg-in-hole connection to the stilts 75B of the handle unit. However, when more than two functional units are attached to a single handle unit, a slightly different system for allowing them to conform to the scalp must be used. For example, all functional units could be mounted with resilient connections that permit their movement both rotationally relative to and vertically away from the scalp. This includes simple attachment by spring or rubber band to the rigid handle unit, mounting on a handle unit comprised of independently flexible segments, or introducing additional pairs of handle unit stilts where each pair of stilts has the ability to retract away from the scalp when pushed in and resiliently rebound towards the scalp when this pressure is released. These additional pairs of stilts would most likely be introduced one behind the other.

Cross-Sectional Reshaping and Hair Attachment On One Handle

Another possible combination of two systems on one handle is to place a hair cross-section-reshaping stack in front of a hair extension attachment stack. Such a system would reshape the cross-sections of natural scalp hairs and then attach hair extensions to them. Naturally, such a system would ideally have a straightener. It may use one straightener that precedes both the reshaping and attachment systems or it may use two straighteners, one preceding each directly.

Hair Extension Removal and Cutting Function On One Handle

Yet another possible combination of two systems on one handle is to place a scalp hair cutting system after the hair extension removal unit. The hair cutting system could be either be some form of conventional electric hair trimmer or the automated hair cutting processing stack embodiment. In such a system, the hair extensions would be removed and scalp hairs cut to the desired length in one step. Such a system is desirable for people who want to keep their natural scalp hair very short and unseen relative to the hair extensions. Ideally, a straightening system should continue to tension scalp hairs as they are cut and the cutting system's height above the scalp should be made adjustable.

****Pre-Programmed Styles:

Another labor-saving strategy is to use hair extensions that are already cut to the correct lengths before they are attached to the scalp hairs. Such a system would make possible pre-programmed hairstyles. To best do this, the hair extensions should be cut to length by the time they are placed in the hair extension cartridges. Since hairstyles usually are composed of hairs of different lengths, the clip cartridges will have to be filled with hairs of a variety of lengths. This can be done several ways:

One way to fill clip cartridges with a variety of hair lengths is to fill each clip with hairs from different sources. This can be done by moving the hair extension clip cartridges relative to their filling sources.

Another way to fill clip cartridges with a variety of hair lengths is to cut hair extensions to the correct lengths as they move on a conveyor system headed towards the clip cartridges. The best way to do this is to introduce a hair tensioning and straightening means such as a vacuum along the path of the conveyor. This will pull all of the conveyor held hairs largely straight and perpendicular to their supporting conveyor system. Further, place a cutting mechanism such that the tensioned hairs must flow through it at some point along their lengths. The cutting mechanism should be given the ability to move towards and away from the hair-supporting conveyor. This will allow the hairs coming through the conveyor to be cut to a variety of controlled lengths. As such, the hair extensions placed in the clip cartridges can have a variety of lengths ordered to produce a desired hairstyle when attached to the head.

To better control the filling of clip cartridge, counting sensors could be placed along the length of the hair conveyor that feeds the cartridges.

*Utility Features (Safety/Maintenance)--Macro Level*

The attachment system might have certain features incorporated into it that ensure safety and system maintenance. I call these features utility features. The following are such utility features:

****Between Customer Automatic Cleaning Process

The attacher and remover handle units could have some means of applying degumming, lubrication and disinfection that is used between hair attachment sessions. This application means could be a system that pipes the various maintenance fluids to the handle units and, perhaps, sprays it on them. Alternatively, the handle units could be soaked in tanks of lubrication, cleaning and disinfection fluid. This fluid application means could be deployed automatically between sessions. If soaking tanks are used, sensors, such as floats, could be incorporated as part of the handle units in order to enforce dunking in the tanks. During fluid application, the moving parts could be activated so they get lubricated better. Before fluid application, the various application outputs, such as adhesive and solvent outputs, should use negative pressure to pull their contents back into the supply lines. This will cause air bubbles to form at the output nozzles. These air bubbles should obstruct entrance into the supply lines, preventing mixing of cleaning fluid with the output fluids such as adhesives. Whether sprayed or dunked, the handle units should be placed in a largely sealed container during cleaning to prevent cleaning fluid from escaping and causing a mess in the hair salon. Said container likely has a drain. Additionally or instead, heat or UV light might be applied in this container to facilitate cleaning.

****Use of Sensors to Monitor for Correct Handle Movement

Both the remover and attacher handles are typically run over the scalp by following between track-guides placed on the surface of the head. In order to ensure that these track-guides are followed and that the system is moved over the scalp at the correct speed, alarms could be used. Tracking centering alarms could be based on sensors that measure pressure against the track-guides or electromagnetic sensors, such as optical or magnetic sensors, that measure relative position of the track-guides. If magnetic sensors were used, the track-guides would have to be impregnated with a magnetically detectable material. Pressure sensors that give feedback on how hard the system is being held against the scalp might also be helpful. When such pressure sensors show that the system has been moved too far away from the scalp, the system's computer might be programmed to assume the end of a track-guide row has been reached. Or if it knows otherwise because of some other means like a speed and distance measurement device, it could alert the user. Finally, if the system is being moved over the scalp too fast an alarm could sound or trigger a mechanism that acts like a break to slow the system down.

*Tensioning Hair Straightener Enhancement Features*

There are alternative ways of configuring a hair straightening and tensioning means. Below are descriptions of variant tensioning hair straightener embodiments:

The scalp hair straightener originally was shown as a set of tines that first moves sideways (against another set of tines) to pinch scalp hairs and then moves upwards to straighten them under tension. However, the straightener could be configured so that it only has to move sideways in order to pinch and hold scalp hairs. In order to move the hairs upwards away from the scalp, air could be blown or sucked in the appropriate direction. Hairs would be held firmly when the sideways motion pinches them, and move upward when sideways motion releases the pinch. The pinch and release motion should occur fast enough that the system could be moved over the scalp at a desired speed. As with most straightener designs, the scalp hairs should be pinched and firmly held during hair processing and metering. It is not as important that hairs be held under tension when they are being brought into or exiting the attachment area. It should be noted that any means capable of conveying hairs upwards could be substituted for air, such as forces derived from electrical charges.

****Use of Non-Solid-Based Forces to Straighten Hair:

Systems that used non-solid-based forces to straighten the hair could be employed. Functional areas which generate these (non-solid-based) hair-lifting forces could be positioned on the straightener's surfaces (likely tine-based surfaces) homologous to those illustrated in the first-described embodiment of the tensioning hair straightener. If force-generating functional areas are actually positioned on surfaces which extend into the hair, such as tines, then these surfaces may require pathways through their supporting structures in order to power the forcegenerating functional areas. For example, air could be carried to the functional areas in hollow tubes but output only through discrete functional areas in the form of nozzle on a tine's surface. However, the various non-solid-based forces used don't necessarily have to be applied on functional areas supported by tines or any type of projection extending into a mass of hair. Instead, the force could be applied from a general location exterior to mass of hair on the human head. For example, vacuum intakes or electrically charged surfaces could be used to attract the hair upward. The intake nozzle or attractive charged surface could simply be placed on a fixture that holds it a desired height above the scalp.

The types of non-solid-based forces used to lift hair include, but are not limited to, moving fluids (liquid or gas), electrical charges or currents, forms of energy including, but not limited to, sound, heat, magnetic, electromagnetic.

Systems that use air to help straighten hairs away from scalp should have their air nozzles placed in various manners. If the air nozzles suck air into themselves in order to create a vacuum, they should be placed a distance above the scalp at least equal to the desired length of hair straightening. Alternatively, if the air nozzles blow air out of themselves in order to create positive pressure air currents, they will usually be placed near the scalp below the desired length of hair straightening. In either case, straightening systems that only use air and no mechanical pinching are a possibility. However, they're less able to hold straightened hairs under tension than systems that use mechanical pinching.

Generally, air and other non-solid-based forces will perform the hair lifting and straightening function better than they will the hair-engagement-holding function (such as pinching or tension holding via hooking or pinching). Thus, a hair straightener that uses non-solid-based forces to lift will likely retain a separate hair engagement function such as pinching. For example, a system that uses air currents to lift, but having some portion composed of pinching tines like those shown in the first-described embodiment is a likely implementation. This pinching portion may (or may not) be limited to only one portion of the straightener, such as a band along its top. This type of configuration will likely still be used even if non-solid-based forces are generated by mechanisms that are NOT supported by projections extending it a mass of hair such as tines. For example, vacuum intakes placed on fixture (which itself could be part of the straightener unit) that holds them over the scalp could be placed above a pinching means (like a set of pinching tines). The vacuum would generate the hair lifting, and the pinching means could be solely responsible for pinching and holding the hairs in position.

****Use of a Rotary Means to Straighten Hair:

Rather than the using tines that pinch and slide relative to each other to tension scalp hairs, tines that rotate relative to each other could be used. Such a rotary straightening means might be rollers of a largely cylindrical shape used to move hairs away from the scalp. Alternatively, the rotary means might be belts that are used to move hairs away from the scalp. Regardless of the exact configuration of the rotary means, the rotating members should typically be used in pairs, functionally and structurally analogous to the tine pairs of the first embodiment of the straightener. Each member of a pair should rotate in an opposite rotational direction than the other, and their closest rotating edges should both move in the same linear direction away from the scalp. Although less ideal, a system that uses rotating members paired not with other rotating members but with stationary surfaces is possible. Regardless of whether rotors are paired with other rotors or stationary surfaces, scalp hairs should be guided between each member in a pair in order to allow the rotors tight contact against the scalp hairs. In order to guide hairs into these tight central passageways, the rotary means should be preceded by narrowing areas that funnel the scalp hairs into said passageways. These funneling passageways could be formed by placing pointed shaped projections in front of the rotating members. These pointed projections could be non-rotating and independent of the rotating members or part of the rotating members; for example, the rotating cylinders could have fronts that narrow into cone shapes. Regardless of the exact nature of the funneling system, it should prevent hairs from going between two separate rotor pairs because the most lateral rotating surfaces of each pair move in a linear direction towards the scalp.

The rotating pairs should be able to exert a certain amount of pinching force on the hairs between them. To best do this, each member of the pair could be resiliently mounted relative to the other. This resilience may be achieved by a mounting each rotating member on a resilient axle, by placing a resilient material under the rotating belts, or by fabricating the rotating parts themselves out of a resilient material. Alternatively, the pinching force could be achieved in the same manner it was in the straightener originally described in the original embodiment. In other words, my actuating the straightener's tines (or pinching pairs) together.

The rotating members will likely be driven by a mechanism such as a pulley system that has a belt or cord interlaced through it. It is most likely that each individual roller will not be independently powered, but all the rollers will be connected so as to share a single power source. This connection of rollers could benefit from a connectivity bridge situation where the tines are the individual rollers and the connectivity bridge between them is the drive system. For example, the belt or cable in a shared pulley system could be considered a connectivity bridge. At those areas between each roller pair that form the hair pathways, the drive system should be elevated above the desired length of hair straightening. In these same areas, the drive system should usually have a shield near it that separates its moving parts from the scalp hairs. However, the drive system can extend downwards towards any lower-lying rollers in any of those areas where they do not intersect the scalp hair pathways (hair channels).

Although rollers in each pair (of pinching tine structures) must rotate in opposite (rotational) directions, it is most ideal to configure a drive system that uses a single belt or cable moving in only one direction. In order to get a single direction drive means to rotate rollers in opposite directions, it will is best to contact opposing rollers from opposite sides, be twisted backwards around certain rollers, or first contact a direction-reversing roller or that goes on to contact a hair pinching roller itself.

If belts are used as the rotating pinching means, then belts of various heights (their direction of move is perpendicular to the scalp) can be used along the length of the hair straightener. For example, taller belts that touch the scalp, in order to pick up hairs, could be used at the front of the straightener. Likewise, shorter belts that do not touch the scalp, but remain above the attachment stack where they serve to keep hairs straight could be used at the back of the straightener. A functional equivalent can be achieved by stacking rollers. The stacks should be linear with hair pathways between them. Such stacked rollers would only need to be driven by a belt from the back of the straightener if they interlocked with each other so as to transfer rotational movement among each other. This interlocking would most likely include the use of much thinner rollers or gears, that do not come in contact with the hair, placed between the rollers that do. Said thinner rollers would be used to transfer rotational movement among the larger rollers in a manner so that they all rotate in the same direction.

****Independent Pinching Means Used with Straightener

Regardless of the type of straightener used to lift hairs, an independent pinching (or other form of engagement) means (most likely a set of pinching tines) could be placed over it (or in the case of non-solid-based-hair-lifting forces, sometimes under the areas that generate them). This pinching (or other engagement) means would not be responsible for lifting hairs over the scalp. Rather, its primary duty would simply be to help keep the straight hairs that enter it straight. It could help a pinch-and-release type straightener (the type in the original embodiment) by pinching when the lifting mechanism below releases. It could also help any type of straightener by securing tension or pinching in a manner that it acts like a break, stopping forward advancement of the attachment or removal system. For example, it might be desirable to stop forward movement of the attachment system while hairs are being attached. It also might be desirable to secure the tension on the scalp hairs while they are, for example, being metered out by a hair isolation system. Such a pincher most ideally should be composed of or coated with a high coefficient of friction material such as silicone rubber. Although some use might be found for such a pincher break with the remover system, it is probably best not to use is there because it might prevent the bend-under belt system from carrying detached hair extensions away.

****A Description of the Straightener with Respect to the Entire Handle Unit and Attachment (Processing) Stack Regardless of its exact mechanism of operation, any straightener will usually be positioned in a special manner with respect to the attachment stack or remover, or any other processing system, for which it is straightening scalp hairs. Since a straightener may serve either an attachment stack, remover or any of the processing-stack embodiments, whether described herein or not, all will be subsumed by the phrase, "processing system." Below various attributes of straightener position relative to a processing system are described.

First, a hair straightening system should usually be positioned in a flexibly yielding manner that allows it to move relative to the processing system (for example attachment stack) it serves. The following describe some methods of such placement:

The straightener is often located in the following manner:

-Attached, either directly or indirectly, to handle means AND in front of a processing system, such as the attachment stack -Portions of it often extend back over a processing system, such as the attachment stack.

The straightener usually moves relative to the processing system in one or more of the following ways -Mounted on a fulcrum, so that it moves rotationally -Mounted on a spring or other flexible mechanism, or straightener itself made from deformable materials, so that in can move in one or more of the following ways:

-Vertical retraction away from, and advancement towards, the scalp

-Horizontal retraction away from, and advancement towards, the scalp

Note: Although the above movement patterns usually apply to a straightener where the entire unit moves, they also usually apply to a straightener that allows part of itself to retract into itself.

Force Exertion Areas of Hair Straightener Means:

Additionally, a hair straightening system should usually exert force on scalp hairs within the following areas with respect to the processing system that it serves. The scalp hair tensioning or straightening means should exert largely upward (with respect to the scalp 430) force on hairs in the following areas, designated by letter described below and shown in FIG. 121:

121A: The force extends down below and in front of the attachment stack (processing system) down to or very near the surface of the scalp 430 AND may also exert this upward force on scalp hairs in one or more of the following areas:

121B: The force remains in front of the attachment stack.

121C: The force remains above and in front of the attachment stack.

121D: The force remains directly above the attachment stack.

[AND OPTIONALLY: The straightener means is so attached relative to the attachment stack (processing system) that the forces maintain these relative positions, such that a hair lying flat on the scalp experiences these force-areas 121A, 121B, 121C, 121D, sequentially.

And as a further option, it might only experience forces attributable from only one of these areas (or an area with one of these area) at any given time and not be disturbed by forces out said force-attributable area. In other words, it might be moved from one area to the next incrementally, but until, it reaches the next area the next area cannot influence it. This option is would not be the case if, for example, air intakes were simply placed on a fixture that holds them several cm over the scalp because the resulting air currents would usually move erratically between several areas. However, if an actuation means or non-solid-based force-generating actuation means had discrete functional areas placed on projections (such as tines) extending into a mass of human hair, then said functional areas could limit their spheres of influence. For example, such functional areas capable of limiting the spheres of influence include, but are not limited to, micro-machine actuators, gentle air currents generated by nozzles placed near the hairs, electrically-charged surfaces placed in a similar manner.]

Note:

-Moving hairs through the straightener in increments from on functional area to the next may be desirable because it is more predictable and needn't affect anything outside of the hair straightening system. An example of a short distance would certainly include a distance less than the height of the attachment stack (or more broadly hair processing system).

-By sometimes using the words tensioning straightening with reference a device which holds hairs more perpendicular than their natural state relative to the scalp, we are trying to differentiate between it and chemical and heat hair straighteners that are designed to, at least somewhat, fixate the hair with a longitudinal curvature. This is not to say all embodiments of tensioning hair straighteners apply a great amount of tension to the hair. For example, if static electricity was used to orient hair in a more perpendicular orientation the scalp, one could argue that many of the force vectors suspending the hair technically aren't tension. However, we would still consider such a system to fall under the category of a tensioning hair straightener. This not to say that in many embodiments of the tensioning hair straightener that the tension isn't real. It many it is, and often very strong.

-Ideally, but not always, a straightener's channels (if it has any) should line up with the processing stack that it serves. This way the hairs from the straightener will flow directly into the processing system's channels and will not have to be refunneled into rows again.

*Handle Refinements*

Previously, handles for holding the attachment stack and hair extension removal system were shown. These handles may be enhanced with any of the following features:

-Referring to FIG. 75, rollers could be put on the bottoms of the front stilts 75B of the handles. These rollers allow the front-most stilts to roll over the scalp without disturbing the hairs below. Furthermore, these rollers could be used to measure speed and distance over the scalp by feeding their rotational movement to a sensor. Additionally, these rollers could be attached to actuators that cause them to automatically brake under control of the system computer. To facilitate this breaking, the rollers could be comprised of a high friction material like rubber and/or have cleats.

-A processing system, such as the attachment stack, could be made to move up down relative to the scalp, in a manner similar to an elevator. This could be accomplished in a variety of ways. For example, referring to FIG. 75, the front stilts 75B on the handles could be configured so that their tips move in and out, causing shortening and lengthening of the stilts. Alternatively, if stilts are not used, whatever portion of the handle that holds the processing system could be made to go up and down relative to the rest of the handle. Finally, the belt buckle, or functional equivalent, could have an elevator means within it that moves the attachment stack, or analogous processing system, up and down relative to the scalp.

-Several parallel processing stacks could be connected to a flexible backbone means that holds them aligned with- the tracks of the track-cap (if one is used otherwise simply laterally spaced), thereby, allowing them to all advance over several tracks (positions) on the head together. Said backbone could be configured as or attached to a handle unit means. Alternatively, this like all handle assemblies could be held by a mechanical arm(s) or moving support means, instead of by a human. The above-described assemblies may even obviate the need for using a track-cap.

*Attacher Supply Lines—Joining & Configuration*

The processing stack embodiments and hair extension removal systems all must be supplied with various inputs. These inputs may be energy, such as electrical or mechanical, or various substances. Although discussed to a certain extent before, below is further discussion of supply lines.

Previously, the idea of using "contact-cards" (as illustrated by 67B if FIG. 67) to consolidate many electrical contacts into a single unit was discussed. At this point, it should be made clear that the surfaces of these contact-cards are not necessarily perfectly flat. Often, the various contacts on each card must be arranged in a stairstep pattern relative to each other. Further, contact cards need not only be employed to carry energy. They could also be used to unify tubes into a single orderly array. An array of tubes joined together by a contact-card structure could be molded as a single object, ideally out of a flexible tough plastic such as Teflon.

****Thermally Insulating Connected Supply Lines

Clearly, there is a benefit to uniting tubes with a contact-card immediately before they connect with the attachment stack. However, we may also want to unite parallel wires, fibers and tubes into bundles along their length. This is especially true if they are carrying a substance that must remain hot, cold, or otherwise protected from the environment. For this reason, similar tubes (say tubes carrying heated materials) should be wrapped together with an insulative means such as an infrared reflective tape. To further control temperature within these bundles, heating elements could be introduced within each bundle. These temperature regulation elements could be of various types. For example, heating elements could be electrical resistance or tubes that carry a heated liquid in loops. If temperature-regulation tube loops are used, the segment of each loop that carries liquid towards the attachment stack should be incorporated into the insulated bundles. However, the sides of the loops that return the temperature-regulation fluid might well be left on the outside of the temperature-regulated bundles.

When a thermally insulative wrapping is used, it will ideally be wrapped as close to the attachment stack as possible, perhaps even around the attachment stack itself. If this is impossible, then the contact card might be made out of an insulative material or a sealant material with insulative properties could be applied between the attachment stack and where the thermally insulative wrapping ends.

Although most likely used with the attachment stack, the above-described temperature control strategies could also be used with the hair extension removal system or any analogous processing system.

****Liquid Propulsion Systems:

Adhesive and other liquids used in the attachment process, or any process, can be propelled through the supply lines by pressure applied by several different methods as described below:

----Gas-in-Line Propulsion

In the first method, adhesive or other fluid could be transported to the nozzle outputs via air pressure behind it in the supply line. In such a system, there is no need to suck the fluid back towards its source reservoir. This is because only a small amount of fluid has been infused into the fluid supply lines. Any excess fluid remaining after a single use can simply be expelled. This is possible because this small volume of adhesive or other fluid is pushed from its source reservoir several feet along a supply line by air pressure behind it in the line. The line only contains a small amount of fluid at the very front of the pressurized air. This means the fluid supply line will be emptied between uses and can actually be blown or washed out before its next use.

Such a system will usually have a small chamber that is filled up by a much larger fluid supply reservoir. Once the smaller chamber is filled, perhaps by gravity, a valve between it and the main fluid reservoir should be closed. Next, a valve that supplies this smaller chamber with air pressure should be opened forcing the adhesive through the supply line. This air pressure should be introduced into the small chamber such that it is behind the adhesive. For example, the adhesive line could exit through a funneling bottom in the small chamber, while the air pressure could be introduced from the top. Sufficient air pressure should be applied in order to bring the adhesive to its output nozzles in the attachment stack. This can be done by applying a timed pulse of air pressure, or by constant low-pressure air. Constant low-pressure air will be sufficient to move the adhesive through the relatively wide supply lines but not to expel it through the thin output nozzles in the attachment stack. Naturally, when adhesive is desired to be squirt out of these nozzles, air pressure will be applied in short powerful pulses. Any small amount of excess adhesive that remains at the end of a session can simply be discarded by forcing it out nozzles. The lines can even be washed with a solvent and then blown clean. If a washing solvent is used, it should be introduced into the same small chamber in the same manner that the adhesive was.

-----Liquid-in-Line Propulsion

A second type of propulsion scheme pushes adhesive through the entire length of a supply line solely by raising the pressure in the main adhesive reservoir. It has an entire supply line of adhesive uninterrupted from the reservoir. In such a configuration, when adhesive is expelled through an output, more always takes its place from behind. This means that to prevent adhesive contamination between uses, negative pressure might be applied to suck the adhesive backward through its supply line. Hopefully, the resulting air bubbles at the tip of the supply lines will prevent contaminants from moving backward down the supply line.

A system such as this one not only has an adhesive supply line that leads straight from main adhesive reservoir to the adhesive outputs in the attachment stack. It also has to have some means of applying both positive and negative pressure to the adhesive in this large reservoir. In theory, a mechanical means of pressing directly against the contents of the reservoir could do this. However, it is more practical to apply air pressure into the reservoir.

Regardless of the type of adhesive-propulsion scheme used, these propulsion schemes apply not just to adhesives but all fluid outputs used in the attachment process, or by any type of processing system. Each of these various fluids should be kept in its own reservoir. Each of these reservoirs will need to be cared for in its own way. For example, cyanoacrylate adhesive cures upon exposure to moisture in the air. Its life could be extended if the air at the top of its reservoir tank could be kept dry, such as with the use of desiccants. In a similar manner, the wax-rosin mixture will turn solid if not kept above a certain minimum temperature. Thus, the wax rosin reservoir tank should be heated prior and during system use.

-----Using Color Adhesive:

Most ideally, a clear invisible adhesive that works fine with all colors of hair will be used. However, if using different colors of adhesive on different heads of hair is desirable, then the system can accommodate this by using one of the following methods. You should note these following methods apply not just for dealing with various colors of adhesives, but also for dealing with various colors or types of fluid to be applied on the hair such as various coatings.

----->Mixing Custom Colors:

When creating custom colors of adhesive, relatively pure coloring agents can be mixed together in proper proportion and added to the adhesive. Alternatively, the adhesive could be supplied in several primary colors that are mixed together in proper proportion. In both methods, mixing must occur. This mixing will usually occur in a small mixing chamber. This mixing chamber might be placed anywhere between the adhesive supply reservoirs and the adhesive output nozzles. In fact, simply placing several primary color adhesive output nozzles near each other in the attachment chamber might provide sufficient mixing. If the gas-in-line propulsion method is used, then it does not really matter how close the mixing chamber is placed to the output nozzles in the attachment stack. Because air pushes the adhesive through the entire line, the same amount of colored adhesive is used regardless of the. distance it must travel. However, if the liquid-in-line propulsion method is used, ideally, the mixing chamber should be placed very close to the output nozzles because there will need to be a continuous line of custom-color adhesive between the mixing chamber and the output nozzles. Generally, this custom-color adhesive will have to be discarded after a single use. Thus, a long distance between the mixing chamber and outputs wastes much adhesive.

In both configurations, the components to be mixed could be introduced into the mixing chamber through one way valves. In the gas-in-line propulsion system, this mixing chamber could be the same small chamber that adhesive is usually released into before it is sent through the supply lines. In the liquid-in-line propulsion system, the pressure of inputs into the mixing chamber through one way valves could force the mixture out of a single valve that feeds a single supply line.

----->Selecting Among a Selection of Standard Colors:

Alternatively, the system could work like a modern gas pump. There could be a selection of several standard colors, each having its own reservoir, but all sharing the same adhesive supply line. In the liquid-in-line propulsion system after each use, the last color used should be sucked from the shared supply line completely back into its holding reservoir. In gas-in-line propulsion system, all colors would have different main reservoirs but would all probably share the same small pre-line chamber.

*Various Means of Preventing Hair Buildup in System*

The various hair processing-stack type systems usually work most effectively on hairs that stand largely perpendicular to the scalp. However, unlike conventional hair trimmers, most of the processing-stack embodiments can't simply cut hairs all hairs in their path. Thus, this presents a problem because hairs have entered the hair processing stack system and various structures associated with it, and said hairs are oriented largely perpendicular to the scalp. If such systems do nothing to help the hairs that have entered them exit, the hairs will tend to remain in the mechanisms of the system, taking up space, for too long of a time. Thus, regardless of whether a processing-stack type embodiment is used, or some completely different type of hair processing system that is also subject to hair-buildup in its mechanism, ideally, devices should be implemented to prevent this buildup. In other words, device that moves, hairs out of path of the processing system and its mechanisms faster than they would move out of said path because of mere processing device movement over the scalp.

The device originally discussed for moving hairs out of the way in the first-described embodiment of the hair extension attachment system was the bend-under system. The first-described embodiment of the bend-under system was configured using two pairs of pinching belts, to engaged hairs, and it was placed below and towards the terminal ends of the processing stack's hair channels. However, the embodiment of the bend-under system first discussed is neither the only possible variant of a bend-under system nor the only embodiment of a broader class of device which we will refer to as a means of preventing hair-buildup in front of an obstacle associated with a hair processing or manipulation system. Generally, wherever a bend-under system is referenced, other types of hair-buildup-prevention systems can be used in its place.

Hair-buildup-prevention systems can be divided into two general categories: Continuous and Intermittent.

****Continuous Hair-Buildup-Prevention Systems

The continuous hair-buildup-prevention systems are based on bend-under schemes. This is to say bending hairs under some part of an obstacle associated with a hair processing or manipulation system. Although these systems are likely to use belts and bend hairs under the connectivity-bridge portions of a hair processing system, neither using belts nor bending hairs under connectivity bridges is an absolute requirement. For example, the system could use rollers to engage the hairs, and many of the hairs might get bent under the tine portions of an assembly.

Further still, different types of bend-under systems can be configured. For example, bend-under systems that use air, electrical currents or charges, rotary, or reciprocating means to apply the force needed to bend hairs under their obstacles are all possibilities. An air-based system, depending on where it is placed relative to the processing system, could be based on either blown or sucked air. Any rotary or reciprocating means might be used in a pair in order to pinch and pull hairs. Such means might be paired with another rotary or reciprocating means or simply a stationary surface that it presses against in order to pinch hairs. Alternatively, a rotary or reciprocating means might have a hooking or other hair engagement means on it with which it engages hairs so that they can be pulled under their obstacle. Regardless of what type of means is used to deliver the necessary force to the hairs, generally, systems that deliver said force by pulling on hairs are placed beneath the hair-processing-related obstacle for which they're clearing a path. Whereas, systems based on pushing hairs are placed above the obstacle for which they're clearing a path.

The originally presented bend-under belt system presented an example of a below-obstacle system. For an example of an above-obstacle system, refer to FIG. 122, such a bend-under system 122A will both pull hairs 122C back into itself and push them out under the obstacle, in this case connectivity bridge 122B. Such a system would do this by applying force (non-solid-based or sold-based) to hairs so that it moves them in a direction of any of the movement vector arrows 122D, or a combination these individual vectors. Unlike a under-the-processing-system-positioned variant that needs no assistance once it has engaged a hair, an above-system variant is aided by an obstruction 122E to obstruct the exit channel and prevent hairs from forming their bends towards the attachment area, rather than under the obstacle, in this case a connectivity bridge. This obstruction 122E can be where it is shown or placed anywhere along the dotted vertical line 122F, including thickening it and placing at all points along said vertical line. Said obstruction 122E might be the pullback hook, or any other means that can temporarily obstruct the channel at this point.

This series of drawings shows a single hair, at different points in time, being bent under the connectivity bridge using an above-bridge system. In the final drawing No. three, we see that the tops of the hairs have been both pulled into and pushed-out of the bend-under system until finally the system drops them, and the hairs are pulled out of said system by their own weight and tendency to straighten. Note: Only one hair is shown in the drawing, but many could be handled simultaneously. In FIG. 122, bend-under system 122A may be a pair of rollers or belts that engage the hair by pinching or otherwise.

****Intermittent Hair-Buildup-Prevention Systems

Intermittent Reversing Hair-Buildup Prevention

We will discuss two types of intermittent systems that prevent hair-buildup in front of an obstacle associated with the hair processing system. The first type involves back-tracking or reversing hair movement through the processing system and the second type involves elevating the processing system relative to the scalp. There are two variants of the reversing system, largely-parallel-to-movement-path-oriented processing systems and largely non-parallel-to-movement-path-oriented processing systems. By movement path, we are referring to movement of a processing system relative to the scalp. By parallel vs. non-parallel orientation, we are speaking of said movement path direction over scalp relative to the most prominent direction of movement hairs take within a processing system.

1. Largely-Parallel-to-Movement Path-Oriented:

The operational sequence of the largely parallel system is to backtrack exiting hairs through their original movement paths into the processing system after they have been processed or manipulated by it. Next, convey said hairs laterally to at least one lateral side of the processing system. Finally and optionally, apply force to said exiting hairs capable of moving them backwards. The most prominent direction of movement hairs take within the processing system is largely parallel to its movement over the scalp. Note: Means used to convey or apply force to hairs may selected from, but not limited to, any means previously described in this document for these purposes.

2. Largely-Non-Parallel-to-Movement-Path-Oriented:

In the largely-non-parallel system, the paths hairs take inside the processing system are configured to have the most prominent direction of movement hairs take in a largely non-parallel direction relative to the system movement over the scalp. Thus, hairs must be backtracked through said largely non-parallel portions. Once backtracking is complete, said hairs are largely in an area that isn't obstructed by the processing system relative to its movement over the scalp, thereby, avoiding hair-buildup.

However, a means of actively encouraging hairs to take the largely perpendicular path into the hair processing system, such as a preliminary actuator that engages hairs and moves them in, a preliminary-hair-actuation (non-solidbased) force that does the same as said actuator, movement of hair processing system itself into the hairs, or configuring the tensioning hair straightener means to tension so that hairs arc under some tension around the entrance areas of said (largely-perpendicular-path) hair processing system might be necessary. Note: This arcing under tension is due to a tendency for the hairs to want to straighten out in a straight line intersecting the hair-processing system or on the far side of said hair-processing system. Preliminary actuator and preliminary-hair-actuation force denote actuation means that wouldn't be necessary if the processing system were oriented more parallel to hair flow.

Notes for Both System Orientations:

-In both LARGELY-PARALLEL-TO-MOVEMENT-PATH-ORIENTED and LARGELY-NON-PARALLEL-TO-MOVEMENT-PATH-ORIENTED embodiments, ideally, some preliminary-obstruction means for keeping the limited group of scalp hairs, which currently have authorized access to the hair-processing system, separate from those trailing behind them during hair-processing-system entrance and exit via reversing (processed hairs) through their paths. Additionally, said preliminary-obstruction means might be used in preventing trailing hairs from moving laterally and past the hair processing system prematurely before being processed. This preliminary-obstruction means could include, but is not limited to, an additional set of hair-metering means perhaps based on a multiple hair channel design or, alternatively, based on one large hair channel placed ahead of the cardinal-processing system. The cardinal-processing system is defined as that processing system which performs (at least some of) the processes on or relative to the hairs which are the purpose of the use of the hair-processing system, as a whole, in the first place. Whereas, the preliminary-obstruction means serves to prevent premature entrance to or passage around said cardinal processing system.

-The most prominent direction of movement hairs take within a processing system should be assumed to be that of final approach into the processing areas before contact with a functional area which has a purpose other than to merely act as a stationary hair-channel wall. This direction of approach should be assumed to be largely perpendicular to a line running through like areas in parallel processing areas if the system is actually, or was to be configured, with multiple processing areas and/or hair channels in parallel.

-Generally, there should be enough space between the preliminary-obstruction means and cardinal processing system that exit of hairs reversed relative to the cardinal-processing system have a free path of movement either laterally around said cardinal system and/or past it. Of course, said free-path includes the path formed through a hair-conveyance means if any is used.

-Reversal of hairs through the cardinal-processing system can be effected by said cardinal system itself backing up relative hairs in it rather than only a means of actuating said hairs out of the processing system.

-A hybrid of LARGELY-PARALLEL-TO-MOVEMENT-PATH-ORIENTED and LARGELY-NON-PARALLEL-TO-MOVEMENT-PATH-ORIENTED embodiments can be configured, such as a processing system oriented diagonally to the direction of movement over scalp.

-The means of laterally helping hairs around the side of cardinal system after reversal from it can include blocking entrance to it with an obstruction means whose forward edge is slanted in a direction largely non-perpendicular to the direction of system movement over the scalp. This blocking should occur in a time period after reversal of hairs out of the system is complete but before the preliminary-obstruction means (if one is used) allows another group of hairs access to enter the processing system. Said obstruction edge may (or may not) include a means of engaging the reversed hairs in front of it and guiding or conveying them in a direction either to a lateral side of the system or the back of the system or both.

Intermittent Elevating Hair-Buildup Prevention

-Processing system elevation, such as originally shown in the hair-cross-sectional reshaping embodiment, could be used as a means of preventing (processed) hair-buildup in front of an obstruction associated with the processing system. It is based on intermittently actuating the processing system relative to scalp by using a mechanism that moves said processing system either relative to a handle unit and/or a processing-system-attached fixture whose purpose is to support the processing system above the scalp. For example, the stilt-portion of the handle unit shown in the first embodiment is a fixture whose purpose is to support the processing system above the scalp.

*A Computerized Control System that Requires a Code to Function*

In order to make sure that the operator does not use inferior materials, the system could be configured so that a code has to be entered in order to get the system to do a certain amount of work. The code verification system could require that a different code be entered for each batch of material used. For example, to ensure that the authorized brand of adhesive is used, with each container of adhesive sold, a valid code should be supplied. This code will allow the amount of adhesive in the container to be used, but the machine will only accept this code once. In order to use the next container of adhesive, the system will require a new code. Ideally, each code will be custom generated to work only on a specific unit. As such, valid codes provided for one machine cannot be shared and used in an unauthorized manner with another machine. The codes can be supplied by a variety of means including keyboard, diskette, swipe card, or any other computer input system.

In order for the system to know how much work is being done, it could simply keep track of the time it is turned on. However, some operators might keep the machine turned on even when they are not really using it on the hair. Thus, use could be verified by sensors that sense movement over the scalp and/or hairs passing through the system. Such sensors include sensors hooked to wheels and sensors run across the channel pathways that detect movement of hairs through the system.

Refinements and Ideas Concerning the Hair Extension Removal System

The hair extension remover system has been previously described. However, further refinements to this type of system are described below.

*Mechanical Aspects of Remover*

Hair extension remover system refinements of a primarily mechanical nature are described in the list below:

-The remover's input vacuum nozzles, usually, should be divided into thin slits, small apertures or have screens placed over them. This will prevent any hair extensions from being sucked into the vacuum nozzles rather than being carried away by the hair transport belts. Of course, this does not have to be the case if the hair extensions are supposed to be carried away by the vacuum nozzles. This might be desired if the hair extensions are simply to be removed and not recycled. It might also be the case if there, is a sophisticated recycling system that can deal even with hairs sent to it after they have been sucked through a tube.

-Improve solvent's ability to dissolve by warming it before applying it to the hair.

-In many attachment systems, a temporary fast hardening adhesive means, such as wax, will be applied in conjunction with a longer last adhesive means such as cyanoacrylate. This temporary adhesive means is likely to rapidly soften and harden with heating and cooling. In order to remove this temporary adhesive means, the hair extension remover could be have a mode where it only applies a heated fluid to the hair. It would apply and suck away this heated fluid in the same manner as it does solvent and cleaning fluid. This fluid might be washed over the hair in great quantities and sucked up in a fraction of a second after application. Alternatively, it might be applied and left on the hair for a short time. The hot fluid might be an oil or some other organic fluid that once melted the temporary adhesive would tend to remain dissolved in. The hot fluid might have a very thick, even gel-like, viscosity so that it sticks to the hairs and/or sticks the hairs together in bunches so that detached hair extensions don't fall from the head spontaneously.

The temporary adhesive removal substance may use some other removal means than heat. It might use a solvent strong enough to dissolve only the temporary adhesive but not the more permanent adhesive. For example, isopropyl alcohol will dissolve a mixture of beeswax and rosin, which can be used as a temporary adhesive. However, isopropyl alcohol does not effectively dissolve cyanoacrylate adhesives, which can be used on a more permanent basis. Regardless of the exact nature of the temporary-adhesive-removal substance, it will have to be washed off itself. Perhaps, this can be done by using the remover system to apply a detergent and water solution which will be vacuumed away a moment after it is applied to the hair.

-The solvents used to detach hair extensions are usually flammable. In order to reduce this risk of fire, certain precautions might be taken. For example, a sensor capable of detecting fire and fire extinguisher nozzles could be placed in or near the remover handle unit. Naturally, the sensors would be configured to trigger the fire extinguisher nozzles placed nearby.

Alternative fire prevention methods include incorporating a fire retardant substance into the solvent or applying such a substance with the solvent. To illustrate, a flammable solvent gel could be under, above, or sandwiched between a fire-retardant gel. A mechanical process would accomplish this. For example, fire-retardant gel could be extruded through nozzles positioned on either side of each solvent gel nozzle. A similar mechanical scheme could be used to apply a protective fluid, gel or foam that shields the scalp from the solvent gel, so as to minimize the amount of solvent absorbed by the human skin.

-To further reduce fire risks and health hazards, the hair extension remover handle unit could have a vacuum nozzle within it. This would suck any escaping solvent vapors from the unit. Such nozzles might be placed near and even in line with the solvent application nozzles themselves. In a similar manner, a hair cap that sucks solvent vapors from it could be produced. This cap would be used during the period while the solvent is detaching hair extensions. Solvent vapor rich air, from either source, could be bubbled through a solvent that will dissolve them, such as water in the case of acetone. Finally, this solvent could be safely flushed down the drain.

-In most cases, the hair extension detaching solvent will be applied to the hairs, on the head, in long flat beads that will act on the adhesive for several minutes. In order to prevent hair extensions from falling out in an unorderly manner, the solvent should be thick and sticky enough that it holds hair extension in place, even after the adhesive that holds them have been dissolved. Ideally, the remover handle unit should be configured so that the long solvent beads line up with the remover channels that originally applied them. This way one row of hairs matted into a sheet-like group will go to only one remover channel, and won't be disrupted by being split between two channels. This is facilitated in great part because the remover could use the same type of track guiding means that the attachment system does most likely a track-guide cap.

****Alternative Hair Extension Removal Means Remove CVD Films Rings with:

An alternative hair extension attachment removal means should be used if chemical vapor deposition (CVD) was used to deposit a ring of inorganic material around a scalp hair and a hair extension in order to attach them together. These rings typically will not be dissolvable by organic solvents; therefore, another removal means will be necessary. Below is a list of strategies for removing hair attachments without using organic solvents:

-Hair extension attachments that are not dissolvable by organic solvents might be dissolved with acids or bases. These acids or bases should usually be formulated into a semi-solid gel or paste.

-It is possible that an attachment means that uses a combination of an organic adhesive with an inorganic ring might be used. For example, the inorganic ring might be applied using CVD or by crimping metal around the hair attachment area. However, these inorganic rings, although strong, might it some cases slide so that they fail to hold their positions on their hairs. To prevent this sliding, an organic adhesive might be applied to both the rings and the hairs, after the rings have been placed around their hairs. In order to dissolve such a combination attachment, the organic adhesive should first be dissolved with an organic solvent, as previously described. Once the solvent is removed, the rings could be slid off the hairs by pulling them lengthwise through slits that have a wider diameter than the hairs but smaller diameter the rings. These slits might be configured as funneling notches cut into the connectivity bridge area. Hairs will be funneled into these thin slots where they will be pulled through by the bend-under system. As the hairs are pulled through, the rings will be pulled off. Likewise, these rings could be slid off by sliding hair bundles through pincher notches similar to those pincher notches described for use with the attachment system.

-Alternatively, such inorganic rings, or any sufficiently rigid attachment means might be cracked mechanically. Ultra sound should be counted among such mechanical cracking means. A crushing means such as hammers or rollers are other possibilities. However, the danger of using such a crushing means is that the hairs themselves may be permanently flattened and damaged. To prevent this, the narrowest distance between crushing surfaces must be held to a minimum distance. Furthermore, only a limited number of hairs, at any given moment, should be allowed between crushing surfaces. This might require the use of metering/isolation system like those described for the attachment system.

****Ways to Prevent and Deal with Attachment of 2 or More Scalp Hairs to Each other:

The attachment stack can use systems that isolate single scalp hairs. This way only hair extensions will be attached to scalp hairs. Scalp hairs will not be attached to each other. However, what if the systems used by the attachment stack fail to do this, and two or more scalp hairs get attached to each other. Certainly, this is undesirable because if a person combs or runs her fingers through her hair, the fingers might get caught under the arcs of the attached scalp hairs.

Although it is preferable to prevent scalp hairs from getting attached to each other, if this cannot be prevented, a system that detaches scalp hairs from each other but leaves them attached to hair extensions could be used. The best way to configure such a system is to space sheets with wedge-shaped cross-sections pointed forwards, as tines along a connectivity bridge. The flat surfaces of these wedge-shaped sheets should be largely perpendicular to the scalp and parallel to their direction movement over the scalp, and the tips of the wedges should be placed near the scalp and pointed forward relative to their movement over the scalp. These sheets could have a center to center spacing less or approximating equal to the spacing of hair follicles on the scalp, in other words about 0.05 of an inch (1.27 mm). They could also have an edge to edge spacing sufficient to allow hairs to pass between them, about 0.01 of inch (0.254 mm), or greater. This assembly of wedges could be moved over the scalp in a similar manner to the way that the straightener is. In fact, like the straightener, this wedge assembly might be made moveable relative to its handle unit. The points of these wedges will tend to get caught under the arcs that connected two connected scalp hairs form. Further, each gently sloping wedge-shape will relatively gradually force itself between connected scalp hairs, thus, peeling them apart. However, these wedges will tend not to detach hair extensions from scalp hairs because they cannot get caught between a scalp hair and its attached hair extension. Since the adhesives used usually temporarily weaken upon exposure to heat, heating these wedges will help them peel two scalp hairs apart.

The heated-wedge system could be combined with the remover unit. Other systems that could be combined with it and the remover include a hot oil applicator for dissolving the temporary holding wax/rosin adhesive and a solvent gel applicator for dissolving the longer term holding adhesive.

*Keeping Applied Solvent only where It's Needed*

Hair extension remover system refinements that primarily deal with keeping the applied solvent only where it's needed are described in the list below:

-In order to use any solvent that is undesirable to get on the scalp, such as methylene chloride, mix the solvent into a slurry with- small particles that will through capillary action prevent solvent from escaping. It's important that the pore size between slurry particles is sufficiently smaller than that found between human hairs so that the slurry wins the competition with the hairs for soaking up solvent, and thus, keeps it off the scalp. Also, the slurry-paste should stick to the hairs so that gravity doesn't pull it down the hair shafts onto the scalp. A sticky slurry paste is also desirable from the standpoint of immobilizing detached hair extensions before the remover can get to them.

Means of making the slurry paste sticky include 1. Formulate it with a thick viscosity 2. Allow its viscosity to increase with a partial evaporation of solvent from the slurry. 3. Use a chemical hardening reaction similar to plaster of Paris or concrete (only weaker only small percentage of slurry on its exterior surface should react this way). 4. Add sticky organic substances to the slurry. Perhaps said organic substances are slightly in solution or perhaps their molecular weights are too great for them to be dissolved (or there's some other reason they can't be dissolved). In fact, organics that don't fully dissolve could replace inorganic grains that don't dissolve. In other words, the product would be a gel rather than slurry. Finally, this thick solvent slurry or gel might itself be applied under or within protective foam that retards evaporation of the solvent. Said protective foam would most likely be simultaneously applied by a separate set of nozzles on the remover.

-Think of small grains as having little capillaries between them that are forced to form small capillaries that dead end at their line of contact no matter how big and non-porous the object is they're in contact with. The solvent in these capillaries dissolves the adhesive, which is carried off and diluted deep within the capillary channels by diffusion (not capillary action).

-It is undesirable for the solvent in the slurry to evaporate because this means that it is no longer around to do its job. In order for the solvent in a slurry to evaporate, it must evaporate through the pores on the exterior surface of the slurry mass. These pores can be called exterior terminal pores because they are the ends of the capillary tunnels exposed to the air. To prevent undesirable solvent evaporation, consider the possibility of using a substance that dissolves in the solvent within the slurry-paste such that as the solvent evaporates from the exterior terminal pores this dissolved substance builds up clogging the exterior terminal pores. Thus, a "skin" is formed on the exterior of the solvent mass. This skin prevents further solvent evaporation from the paste. This same type of evaporation-preventing-skin-formation approach could also be used in pastes and gels that are entirely organic. However, since in 100% organic gels there typically won't be small particles, passageways or pores, the skin will be responsible for preventing evaporation of the entire surface area of the solvent mass in envelops.

-Gelatin can be an example of an organic molecule that really doesn't dissolve in water but can retain it. Hot gelatin mixed with solvent and extruded under pressure is likely to stay put in the hair. Of course, there are many alternative organic molecules that could be used to make a solvent gel. Ideally, organic molecules that will retain a solvent without fully dissolving in it and weakening its solvency should be used.

-The slurry-paste or gel could be extruded through a slot on the remover as if it were caulk. The extrusion could be completely powered from the base unit and its rate synchronized with the remover's movement speed over the scalp to prevent excess solvent paste application.

-Alternatively, the remover's solvent could be introduced into an air stream by a liquid output nozzle close to the exit of its air output nozzle. This would allow for fast adjustment of the application rate.

-By applying hair tension far enough back with the tensioning hair straightener, at least during solvent paste application, the caulk-like ribbons of solvent can be placed at an exact distance from the scalp and their ribbon-like structure will help: 1. Support the detached hairs. 2. Hold hairs into pre-separated and straightened rows such that the straightener need not be used on the remover's solvent washing pass, or at least it would not be used as vigorously. Note: The washing pass is the second pass the remover usually makes. During this pass, it washes the caulk-like ribbons of solvent from the hair after the solvent has dissolved the hair extension attachments.

-Bald spots might present a problem in terms of protecting the scalp from solvent contact. To remedy this, hair sensors could be put in the remover. Solvent would not be applied in areas where there are too few hairs. Alternatively, bald areas could be sprayed with a substance, perhaps a powder, that is less absorbent of the solvent than the paste-forming solvent vehicle is. Such a substance could be applied manually to bald spots or sprayed on by the remover either using outputs located below the solvent outputs or outputs that spray at a steep angle that's sure to make it to the scalp through the hair.

-Solvents (usually organic) might be used on hair for various purposes including removing hair extension attached with adhesive or solvent-dissolvable hair coatings. In order to reduce any drying effect the solvent might have on the skin and hair, certain steps can be taken like dissolving conditioners in it. These conditioners may include various substances known to form a protective film on keratinous surfaces or an oily substance similar to the natural oils found in hair. Dissolving such substances in the solvent will reduce its ability to dissolve adhesive, so their concentrations should be carefully calibrated.

The ideal solvent dissolves adhesive (or coatings) fast and thoroughly, while robbing the hair of as little moisture and oily substances as possible. The nail polish remover industry faces these same challenges. Prior art in this industry includes nail polish removers that combine powerful solvents, like acetone or ethyl acetate, with proteins like collagen. Said proteins form a protective film on the hair surface that helps prevent moisture loss. We suggest that all prior art intended for use nail polish removers be considered when formulating adhesive (or coating) removal solvents for hair. Three of the most relevant U.S. patents concerning formulating gentle yet effective nail polish removers are U.S. Pat. No. 4,829,092 and 5,342,536 and 5,486,305.

Refinements and Ideas Concerning the System that Recycles or Disposes of Hair Extensions after They have been Removed from the Scalp -Complete vacuum transfer may be optional if the grasp position at the remover is sufficient constant. If belts need to be transferred to a second belt for any reason simply maintain engagement in one belt set and using vacuum to pull hair largely perpendicular to said belt set before introduction to a second parallel belt set. Also, a double belt remover is an option for getting hairs between to be held between two belt sets.

-Potential problem: Overly short and/or overly curly hair extensions might jam the system. Overly short hairs might jam the vacuum transfer unit by being sucked up as a clump or more likely overly short hairs would get conveyed to the clips as a clump. Overly curly-tipped hair extensions might not hang straight down into the attachment area.

Solutions:

--Apply water to hair extensions while they're being carried on the first transport belt before they reach the vacuum transfer unit. This is an effort to straighten hairs.

--Before the vacuum transfer unit, have the first transport belts take the hair extensions through a process that removes overly short hair extensions (too short to make it successfully through the vacuum transfer unit). This process would consist of first pulling hair extension straight down from the transport belts by applying downward air currents (vacuumed or blown) or any other functionally equivalent hair straightening means (said belts may have to be turned upside first). During application of downward air currents, a second lower transport belt system should pinch/engage hair extensions at a distance far enough below the first higher belt set that short hairs don't get pinched. Next, the original and highest transport belt sets should release their pinch on the hair extensions. Thus, overly short hair extensions will no longer be pinched. Instead, they will be vacuumed away and discarded. Next, upward air currents should be applied to the belts. The higher transport belts should resume their pinch. The lower transport belts could now release their pinch, but they might continue to maintain it. At this point, the belt system is only holding sufficiently long hair extensions. The belt system can now enter the vacuum transfer unit.

Note: In order to ensure that the upward air currents don't blow both the upper and lower hair extension tips into the higher transport belt, the lower belts could be surrounded laterally by marginal platforms on both sides. Ideally, these marginal platforms should begin after the lower belts have pinched the hair extensions but before the higher belts have relinquished their pinch. The marginal platforms should continue until the upper transport belts have re-established their pinch. The marginal platforms could be placed at a height above the lower transport belt set's very bottom but below the upper transport belt. In order to prevent lower hair-extension tips from finding their way between the marginal platform and the lower transport belt, the platform most optimally be placed at the same height as the lower transport belt system such that it forms a seal around the lower transport belt system. In which case, upward air currents should originate at or above the marginal platform's surface.

-To remove overly curly tipped hair extensions, have the second transport belts take them through a sorting process after the vacuum transfer unit. First the upper second transport belts should release their pinch on the hair extension. (Alternatively, the upper second transport belt may be configured such that it hasn't yet pinched the hair extension.) In an area where there are no upward air currents straightening the upper tip of the hair extension, the upper second transport belts should establish their pinch on the hair extensions. Overly curly hair extension tips won't extend high enough to be pinched. If the belts are moving so fast when the upper pinch establishment area that air resistance causes even straight hair extensions to bend, then reduce the air resistance by blowing from behind, sucking from the front, or even establishing a sealed vacuum chamber that is continually evacuated by suction. Optionally: Once the upper transport belt has reestablished pinch, blow a sideways air current between the upper and lower belt such that tips that are just barely held by the upper belt are dislodged from it. Perhaps, have a third level intermediate transport belts establish pinch on the hair extensions during this blowing process. These middle belts would be placed directly below the upper belts. Dislodged hair extensions will be blown horizontal to such an extent that the middle belts will not pinch them. Next: Have the lower belts release pinch on the hair extensions. Vacuum away hairs that are dropped. They are the overly curly hairs that didn't get pinched by the upper transport belt. Using a marginal collar around the upper or middle transport belt, create downward air currents. During this time, have the lower belts re-establish their pinch on the hair extensions. If a middle belt is used, have it release its pinch on the hair extensions. Finally, create upward air currents, and have the upper belts re-establish pinch on the hair extensions. The hair extensions are now being held by an upper and lower set of second transport belts, which are taking them to the hair extension clip filling system.

Refinements and Ideas Concerning Independent (Optional) Accessories that Work with the System [[Independent Accessories for Safety and Convenience]]

The various hair processing systems described in this document can benefit from certain independent accessories that work with such systems. Descriptions of such accessories follow.

Protective Eyeglasses and Masks

Protective eyeglasses or goggles could be used to protect a customer's eyes from any unhealthy agent that might escape from a hair processing system. The type of protection needed depends greatly on the embodiment of the processing system. However, such eyeglasses may protect against agents like UV, solvents, and hot liquids. The eyeglasses may fit over the ears in the normal manner. However, since the customer will most likely be wearing a track cap as shown in FIGS. 83 and 83.1, it is likely that the eyeglasses will somehow snap onto the track cap. For example, it is likely that the eyeglasses could engage the track guide supporting perpendiculars below the ears and side burn area. The supporting perpendiculars are those portions of the track cap perpendicular to the parallel track guide portions. A likely form of engagement would be concentric cylinder over cylinder snap. For example, the cylinders attached to the eyeglasses could each be hollow with a slit in its bottom that allows it to fit over the cylindrical perpendiculars.

Such goggles might be equipped with a positive pressure air hose that pumps clean air into said goggles in order to exclude solvent vapors from them. This positive-pressure goggle assembly might even be extended down over the nose and mouth as a mask.

Braiding Gloves

In order prevent ripping off attached hair extensions by putting excessive force on them when styling the hair, for example when- braiding the. hair, braiding gloves could be used. These gloves have a relatively slippery surface, which is likely to be made slipperier by application of a lubricant. Hands wearing said gloves will be unlikely to grasp any hair extensions tight enough to rip their attachments to scalp hairs. The storage case for these gloves should have a lubricant reservoir in it. In fact the gloves themselves should be stored within the lubricant reservoir or at least touching a lubricant soaked object, such as a storage case lining made of sponge. The gloves will most likely be made of a slippery cloth, such as silk, or have their surfaces coated with a low coefficient of friction material, such as Teflon.

Snap-to-Guide Track Place Holder

A snap-to-guide-track placeholder could be used to keep processed and unprocessed hairs separate so the attacher can be lifted from the scalp and refilled with a fresh cartridge, should the cartridge run out in the middle of a track-length. In other words, the track cap has rows formed between parallel tracks. In the event that the hair attacher has to be paused in the middle of a row, a placeholder constructed as a rod with a clasp on each end where said clasps are spaced one track width from each other should be attached to the track at a point between the scalp hairs that have been processed and those that have not. This should be done before the attachment system is moved away from the head. The placeholder, by holding the processed and unprocessed hairs apart, will allow the user to begin again where she left off. Ideally, the clasps can slide along the track so when the user begins she can slide the rod of the placeholder back over the processed hairs out of the way of the system. As long the rod is not slid too far back, it will make the processed hairs lay flat and keep them out the attachment system, even if the attachment system touches them. The clasps I am referring to most likely are made out of a flexible material, have a largely circular cross-sections (or cross-section similar to each track's) with a slit near the bottom each. Each slit, when pressed down over the track, first flexibly widens over the track and then hugs around said track.

Custom Fabrication of a Track Cap

The track cap is illustrated in FIGS. 83 and 83.1. Although several standard sizes of prefabricated caps might be used, there might be advantages to custom forming a track cap to an individual's head. The best way to do this is to start with components made out of a relatively flexible material that can be treated to become a rigid material. The track cap itself is composed of two types of tracks. Most tracks are guide tracks. These guide tracks are the many parallel tracks that run from front to the back on the head. These are the tracks that the hair attachment system is guided between. A second type of track is the supporting tracks that hold the guide tracks together. These support tracks run largely perpendicular to the guide tracks and largely parallel to the hairline. There can be thought to be two support tracks, one in front of the hair running across the forehead, and one behind it running across the nape of the neck. However, these two support tracks usually connect together, often somewhere below the ear, to form a single support structure that encircles the head. The support tracks should maintain an adequate margin from the hairline so that they never overlie the hair, because this would obstruct the attachment system.

A custom-made track cap could be constructed in place on a customer's head. This is begun by attaching both ends of each flexible guide track member perpendicularly with both the front most support track and the rear most support track. The first guide track to be attached between the two support tracks is the one most in the center and at the top of the head. Once this is done the two support tracks are conveniently held together and one can work outwards symmetrically adding new guide tracks on each side in turn. After all of the guide tracks are attached, both ends of one support track should be attached to the other support track. The guide tracks should be equally spaced, one standard track-width apart through their entire length. This spacing can be accomplished by using a device functionally the same as the snap-to-guide-track placeholder described above. These track spacing means should only be left on the cap assembly until it is treated and becomes hard.

Although the support track might have receiving holes in it, it is best if a clasp means is attached to the end of each guide track and then clasped around the support track. Although guide tracks might have their clasping means integrally attached to one end, the clasp means attached to the opposite end of each guide track most ideally should be a separate part from each guide track. This is because we don't know how long each guide track should be, and each will have to be cut to size on the head. If clasps were pre-attached to both ends of a guide track, one clasp would probably have to be cut off anyway. Thus, a joiner configured as a separate part comprised of a clasp to fit around the side of the support track and attached perpendicularly to a clasp or open-ended cylinder to fit around the end of a guide track. These joiners themselves should probably be composed of a soft plastic that becomes rigid or otherwise permanently attached to the pieces they hold together.

However, independent joiners don't have to be used at the ends of all guide tracks. For example, the guide track to be used in the very middle of the head can be pre-attached to both support tracks. The assembly can be molded this way as one piece. Similarly, all of the guide track to support track attachments on just one of the support tracks might be prefabricated at equal distances from each other. However, the remaining guide-track-to-support-track attachments shouldn't be made on the second support track because this would make it difficult to get the tracks to conform to the shape of different-sized heads.

The previously described guide track spacers, which are to be used every few inches along the guide tracks and then removed after the cap is hardened, could each have one of its ends pre-attached to a guide track and a clasp disposed on their other end. After hardening, these spacers should be removed. Thus, ideally the preattached end is very thin and weak so that it can easily be cut or broken off. And the clasp end either remains soft, (perhaps by making it out of a separate material), so that it doesn't engage its track very tightly, or is made thin or perforated so that it too can be removed from the guide track to which it had been attached.

A Brush That Doesn't Get Caught between Hairs Attached in an Undesirable Manner:

Also use of flexible bristles, bristles with balls, or other smooth objects, at their ends, or large ends with a cone shape. In other words, brush or comb bristles (or bristle-like rods) with large ends can't get caught between two scalp hairs that have been undesirably joined together.

Hair Diameter Gauge

A hair diameter gauge that is made up of parallel narrowing channels juxtaposed with a diameter measuring scale inscribed on it is a desirable accessory. By using a form of precession manufacturing, such as electro-forming, a comb-like device with narrowing funnel-like passageways between its tines could be formed. These funnel-like passageways could narrow down through the range of scalp hair diameters. The thinner a hair is the farther it could make towards the apex of each passageway. Juxtaposed to the passageways could be a scale indicating their width at various points. By running this implement through the hair like a comb and then observing the narrowest diameter to which most hairs make it, an estimate of the typical diameter of the hairs present on a person's head can be made.

Crimping of Hairs Coated with a Wax-Like Temporary Protective Substance which Have Also Been Exposed to a Disulfide-Breaking Chemical.

In many cases it might be desirable to use chemical setting of the hair in conjunction with the special types of hair processing described within this document. Before attaching cosmetic hair extensions, it might be desirable to straighten a person's natural hair. Likewise, after hair extensions are attached, both the hair extensions and natural hair could be given a permanent wave or curl together. Also, after cross-sectional hair reshaping, it may be desirable to permanently set the hair using chemicals. Such a procedure will help influence the desired hair growth patterns. Whether the hair is straightened or given tight curls the procedure remains similar. Specifically, the hair has to be treated with a chemical that will temporarily allow some of the disulfide bonds in it to be temporarily broken and it must be set to hold it in the shape of a desired longitudinal curvature while the disulfide bonds are allowed to reform.

However, there are some disadvantages with conventional hair setting methods. In the case of hair curling, curlers are time consuming to apply. In the case of hair straightening, the chemical agents used are often stronger than those used for curling and are not adequately prevented from coming in contact with the scalp. This causes irritation of the scalp. In both cases, the chemical agents tend to release an unpleasant odor. For these reasons, I have contrived an accessory that performs chemical hair setting without these disadvantages.

This device doesn't use curlers to temporarily set the hair in place. Rather, after a disulfide breaking chemical is applied to the hair, the device coats the hair with a temporary coating, such as wax. This temporary coating both alleviates the need for curlers by serving as a fixation means itself and prevents the chemical agent from escaping from the hair, thereby preventing scalp irritation and odor.

For the temporary coating to hold the hair it a certain shape, it must first be set in a particular shape itself. Crimping the wax-coated hair between surfaces in order to give said coated hair a desired shape can best do this. These crimping surfaces could be referred to as crimping irons. The wax, or other temporary coating material, has to be malleable enough to be crimped but firm enough to hold its shape. This might be facilitated by using heated crimping surfaces to soften the wax during crimping. The devices that apply the chemical, coat with temporary coating, and crimp might be separate implements run through the hair individually or built into a single unit. In many cases, it is desirable to configure the system with a bend-under means that will allow the hairs to be pulled through it. Processing areas can be formed along a specific length of each hair channel, perhaps by isolating a limited number of hairs in said area. By holding hairs in a processing area, hairs can be pulled vertically through said processing area or even individual processing chambers. The processing occurring in this area may include application of a chemical agent and protective temporary coating and crimping.

Crimping should occur in segments starting at the proximal bases of the hairs and moving lengthwise towards the distal tips of the hairs. This segment-by-segment crimping should be facilitated by intermittent pulling of the hairs by a bend-under system, and/or a processing system elevation means, such as originally described in the hair-cross-sectional reshaping embodiment, and referred to later as an intermittent elevating hair-buildup (in front of obstacle) prevention means.

Specifically, the bend-under system will pull a length of hair through approximately equal to the length of hair the crimping iron process in a single step. Crimping is facilitated by crimping-iron surfaces disposed largely parallel to lateral edges of each processing area channel and capable of moving inwards into the processing area in order to crimp the lock of hair therein. Likely, the said crimpingiron surfaces will be disposed as functional areas on moving tines or even supported by stationary channels and actuated by an intra-channel means of actuation like micro-machines. The crimping-iron-placement relative to the hair should be considered structurally homologous to the placement of the protective side walls of the hair remover system shown in, and orifice halves in the coating/cross-sectional reshaping embodiment. Naturally, both the hair channels and the crimping irons are likely to be configured in a tine-based manner using connectivity bridges. A convex-shaped iron should be placed on one side of each hair channel and be made capable of meshing with its concave counterpart on the other side of the channel. Either both the convex and concave members move together to meet in the middle of their channel, or only one of them may move in order to meet its static counterpart on its counterpart's side.

Crimping irons usually function in complementary concave/convex pairs of counterparts. However, their specific shape depends on the desired degree of hair curliness. desired. If perfectly straight hair is desired, each crimping-iron pair used will most likely be composed of two perfectly flat surfaces, neither convex nor concave. However, if a certain degree of hair curliness is desired, each half of a crimping iron pair will have a somewhat semi-circular shape, one half convex, and the other half the same shape but concave. Usually, this will mean each crimping-iron-pair half has a "C" cross-sectional shape. However, we can imagine each half having several semi-circular sections joined together forming a serpentine cross-section, such as an "S"-shape.

Of course, since different clients will desire a different curl tightness and shape, so too will the exact shapes of the crimping irons have to vary. This variance can be achieved by several methods. First, there can be several entire crimping-iron handle units each with its own size and shape of crimping iron. Alternatively, there can be a single crimping-iron handle unit to which various sizes and shapes of crimping irons can be easily removed and attached. Finally, the cross-sectional shape of the crimping iron surfaces might be given the ability to actually change their shape under the guidance of an automated mechanism. To illustrate, the crimping-iron surfaces could be composed of a flexible sheet or film on the interior (non-hair-touching side) of which rods or bars move to support and influence its shape. Said movable rods could be firmly attached to said flexible sheet, in which case, the diameter, or height, of the crimping surface would vary with its degree of curvature. As an alternative, said movable rods could freely slide relative to said flexible sheet. In which case, the crimping surface diameter, or height, could remain the same at any degree of curvature so long as the flexible sheet is held against the movable rods by a stretchable means, such as springs. Of course, it should be obvious that many hybrids of the attached-rod and sliding-rod system can be readily imagined. For example, an attached-rod system that maintains its diameter at different curvatures because its flexible sheets is itself composed of a flexible material. Likewise, a sliding-rod system which uses an attached-rod configuration at only a few strategic points, such as to the most interior concave point of a concave curvature in order to hold the sheet inward over all the rods.

Notes:

-This device is largely homologous to the automated hair-cutting embodiment except the cutters have been substituted for crimping irons. With respect to applying coatings and chemicals, this device may be homologous to embodiments that use orifice halves to apply coatings to hairs pulled lengthwise through them.

-This is a device that crimps disulfide-breaking-chemical soaked/ wax-coated hairs in order to replace the need for curlers. (The wax or other temporary coating placed on the hair serves as a fixation means replacing curlers.)

-The system might spray the chemical and/or temporary fixative coating on using nozzles that spray a great numbers of hairs at a time, like in the remover.

Alternatively, it may use small nozzles or coating orifice halves like those described for the cross-sectional reshaping/hair coating system embodiment. Like it the fashion described for the remover, it may (or may not) also apply a protectant to the scalp.

-The system may also have a twist function built into it so that the entire system or part (like a tine-assembly or functional hair handler portion) of it twists relative to the scalp, thereby, imparting a spiral twist to the hairs strands that pass through it in addition to, or instead of, a crimp-generated wave.

-Since the system applies the disulfide breaking (or any other type of hair processing chemicals) accurately; it can keep them off the scalp. Additionally, since the system applies a coating over said chemicals it can contain their odor and prevent them form rubbing off of the hairs onto the scalp.

-For disulfide-breaking chemicals can be substituted any substance which can used to change the longitudinal curvature of hair either permanently or temporarily. For example, NaOH can be used to relax curliness of hair, thereby, making it straighter.

-Application of longitudinal-curvature-changing chemicals, protective coating, and crimping may all occur on the same or different passes over the head. Mostly likely, curvature-changing chemicals are applied followed by the protective coating in the one pass over the head, and crimping is performed in a second. A third pass (optional) may use methods, as those described for the remover, to remove the protective coating. All of these functions might be integrated into a single system in one handle unit or placed on different handle units.

-Protective coating application often includes application of a coolant to facilitate said coating's hardening.

-Crimping during lengthwise pull through is optional. Crimping could be handled by a more conventional implement such a conventional crimping iron or curling iron without the automated lengthwise pull-through function.

-Also, the heart of this embodiment is applying a temporary protective coating to hair which is capable of acting as a temporary fixation means and/or protective coating means while a more permanent hut somewhat slower-acting hair longitudinal-curvature-changing substance has been applied to the hair. Thus, any means of applying such a coating and such longitudinal-curvature-changing substance fall under this embodiment.

Use of Hot Iron Straightening Combs in Sets with Decreasing Tine Spacing

-Certain people have such tight curly hair that many of these processing systems might not be able to be run through it unless said hair is first straightened (curliness removed) at least temporarily. One way to do this is to use conventional hot iron straightening combs. However, to best prepare the hair a set of several combs each with increasingly narrower hair channels (decreasing tine spacing) could be used. The wider-channel tines could be used as a preliminary measure and the narrower-channel tines for further refinement. This set of tines might be mounted in the conventional manner on conventional handles using one type of tine-width per handle. Further, increasingly narrower tine combs could be mounted together longitudinally into a single assembly so that the when combed through the hair, areas on the head are exposed to increasingly narrower tines in a single pass. Additionally, such hot iron combs (individual or sets) could be mounted in a manner homologous to the hair tensioning straightener, for example, ahead of a processing stack or system. Further, such hot iron combs (individual or sets) could be mounted ahead of the hair tensioning straightener. Finally, the hair tensioning straightener could be made the functional equivalent of a hot iron comb by heating it to a sufficiently high temperature. Such devices can be used to make sure even the coarsest and tightest-curled hair flows smoothly through the processing system without getting jammed in it.

Refinements Concerning the Manufacture of Hair Extensions and Filling Cartridges with Them

***Hair Extension Factory Manufacturing

-Keratin Extrusion Manufacturing Process

Previously, it was mentioned that an ideal source of hair extensions is manufacturing them from animal sources of keratin. Usually, this would involve dissolving and extruding animal keratin into fibers shaped like human hairs. There are many animal sources of keratin including hair, wool, hooves, and feathers. Chicken feathers because of their lack of pigmentation, low cost and vascular structure, which allows for rapid chemical degradation, are an excellent keratin source. Because these fibers are comprised of proteins very similar to those found in human hairs, they should behave like human hairs. In other words, they can be styled into whatever hairstyle a person desires. This is possible because proteins, unlike most synthetic polymers, soften and change their shape when exposed to water. When dried, this allows the hair to be set. Extruded keratin is an ideal hair extension source, not just because it is relatively inexpensive, but also because it allows man-made fibers to be used which helps to standardize the entire attachment process. The following steps outline a basic process that could be used to manufacture extruded keratin hair extensions:

1. The keratin source, such as feathers, should be mechanically washed and then chemically dissolved. Dissolve the keratin using a thiol to break the disulfide bonds and a detergent that will allow the keratin to be dissolved in solution. Once chemically dissolved, the keratin may or may not suitable for extrusion. If there are undesirable impurities in the keratin that we do not want in the extruded hair extensions, then once in solution, the keratin should be purified by methods such as filtering and chemical manipulations. Most of this process should occur in the absence of oxygen because oxygen will neutralize the thiol allowing the disulfide bonds to once again establish themselves.

If the keratin source is a slightly softer type of keratin than human hair, it might be harden by increasing the cross-linking in its chemical structure, for example by vulcanization. In the case of vulcanization, this is to say additional disulfide bonds should somehow be introduced into the protein structure. However, if the keratin source is a slightly harder type than human hair, some of its disulfide bonds should be removed. This is probably best done by introducing chemicals that react with the cystine sulfurs so that they do not form disulfide bonds. Of course, it would probably be too difficult to remove the sulfur entities themselves without destroying the protein structure. A third option to achieve the correct keratin hardness is to mix keratin from two sources. Once source is harder than human hair, the other softer. A variant of this third solution is to mix an overly hard type of keratin with a softer synthetic polymer that acts as a plasticizer. Polyurethane should be an excellent choice to act as plasticizer.

2. The keratin and any other structurally compatible compounds that remain should be extracted from solution or transformed into a more concentrated solution. For example, this achieved by evaporation of the solution or some form of chemical precipitation. The keratin should still have a thiol concentration great enough for it to remain soft. Probably, it should be brought a paste-like consistency. The dissolved keratin should probably still be protected from atmospheric oxygen at this point.

3. Optional: This keratin paste should be mixed with color pigments to achieve the desired hair color. This mixing should probably occur in an airtight container that does not allow oxygen to come in contact with the softened keratin. By mixing the coloring agent in before fiber extrusion, subsequent dying will not be necessary. Pigments mixed into the fiber will likely be more stable than many dyes applied by soaking. Additionally, if any plasticizers are to be mixed in that could not have been added previously, they should be mixed into the keratin paste now.

4. The thiol containing softened keratin should be feed from a storage container to a gear pump, or equivalent, which extrudes it through a spinneret. The keratin source container and gear pump should not allow oxygen to come in contact with their contents. The keratin used should be free of all gas bubbles and soft enough to make it through the small diameter spinneret holes but hard enough that once extruded the resulting fibers won't readily deform or stick together. Optionally: The keratin fibers should be allowed to fall onto a screen conveyor belt that moves at their extrusion speed.

5. The extruded keratin fibers should be allowed to come in contact with sufficient oxygen to neutralize the thiol in them so that they may harden. This may mean blowing air over the fibers or spraying them will a thiol neutralizing liquid. After neutralization, the fibers should be washed of extraneous chemicals.

6. Optional: The now hardened keratin fibers, presumably washed of extraneous chemicals, should continue down their screen conveyor belt, or path, where they are sprayed, or soaked, with a solution that coats them with a protective coating.

A protective coating is a concern for the following reasons. Normal human hairs are largely made up of one homogenous blend of keratins. However, their surfaces have a thin protective cuticle layer of much harder keratin than the rest of the hair. This protective cuticle layer regulates the rate at which moisture and ions can enter and exit the hair. A hair stripped of this barrier might dry and become brittle because water exits from it too fast or it might allow undesirable dissolved substances to enter the hair. A protective coating semi-permeable to moisture can take the place of this cuticle. This protective coating might be a hard form of keratin, keratin mixed with a synthetic polymer, or an entirely synthetic polymer. In many cases, the protective coating should be dissolved because it is broken down to monomer or short chain. lengths, or if it has disulfide bonds that are temporarily broken.

This coating, or its polymer sub-units in solution, should have an affinity for the surface of each hair. However, this coating should be applied thin enough such that after it hardens around the surface of the hair fiber, it does not greatly affect the flexibility of the inner keratin fiber. For this reason, said coating should be designed such that only a certain amount of it can coat a hair's surface regardless of the amount applied. This might mean that the coating is composed of the structural polymer sub-units and a filler substance that is also attracted to the surface of the hair, however, later can be washed away. Perhaps, once the coating is hardened this filler substance could be washed away leaving only the very thin and somewhat porous polymer coating. The use of such a washable filler is a potential method for increasing a coating's porosity and permeability while setting and upper limit on coating thickness. Alternatively, the chemical properties of the coating and the solution it is in could be chosen to control the coating's affinity for the hair's surface.

The coating, when applied, should be of sufficiently high molecular weight that it couldn't be absorbed into the porous structure of the hair extension fiber. At the same time, this high molecular weight should not lead to such a high viscosity that applying a thin coat of coating isn't feasible. For these reasons, it might be desirable to dilute the coating chemical in a solvent. Of course, this same solvent's properties should be chosen so as to control the affinity between the keratin fiber's surface and the polymer sub-units or monomers.

A coating molecule should be chosen such that it forms a polymer that adheres to the keratin fiber surface, allows adhesives to hold on to it, and is not weakened by the solvents and other removal means used to detach the attachment adhesives. Such coating-to-fiber surface adherence would likely be facilitated by using a coating chemical capable of engaging in disulfide bonding with the keratin fiber surface.

7. Optional: The screen conveyor belt, or any other form of conveyor, should pass through some means of removing excess coating liquid, such as squeezing rollers or a vacuum under the screen belt. The excess liquid coating should be removed and perhaps returned for reuse. The result will be individual hairs evenly coated with a thin coating.

8. Optional: If necessary, the coated hairs could have an initiator wash applied to them to harden their coatings. By initiator, I am referring to a substance that starts the chemical hardening process, such as a free radical that starts a polymerization reaction.

9. Optional: The screen conveyor should pass through some means of removing excess liquid that returns the excess initiator liquid for reuse.

10. Optional: The hairs should once again be washed to remove any extraneous substances.

11. Optional: Once again, the hairs should pass through a liquid removal means. However, the liquid removed is considered waste, which needs to be disposed.

12. The extruded hairs are brought together in bundles and then either wound up on spools for storage or sent to cutting machines that cut the continuous hair bundles to a length that can be used by the hair attachment system.

13. Optional: The cut bundles of hair are conveyed on a belt system to a vacuum transfer belt junction. This should be a transfer unit, similar the one illustrated for use with the hair extension recycling system, in FIG. 86, but that has multiple incoming belts but only one outgoing belt. This outgoing belt, of course, is used to fill the hair extension cartridges. This modified use of several incoming belts allows several batches of hair extensions to be mixed uniformly together. Each of the mixed batches should be a slightly different color or texture. This process is desirable because natural hairs on a head are not all exactly the same. Thus, this mixing scheme achieves a natural looking texturing and coloring patterns. It gives the hair highlights. Of course, such a mixing system could also be supplied with hairs that were previously wound up on a spool.

14. Optional: From the vacuum transfer junction, hairs should be sent to a clip filler device. This device should have some means of sensing the amount of hair it puts in each clip. When one clip, or set of clips, is full the next clip, or clips, in the series should be advanced into position and filled.

-General Notes on Mechanical Fiber Quality and Manufacturing

Mixing of Different Batches of Hair:

A vacuum transfer system is not the only way of mixing multiple batches of hair. Several slightly different types (colors or textures) of hair from different sources could be laid on a conveyor belt together. This would be form of mixing. Additionally, hairs from several different sources could simply be brought together as a single bunch before being placed into the clip cartridges.

Design of Spinnerets and Otehr Extrusion Equipment Used:

The holes of the spinneret might be cut into a non-moving plate, as is the more conventional approach. Alternatively, the spinneret holes might be configured as notches cut into the outer surfaces of two cylinders whose outer surfaces are rotating against each other. The inner-surfaces of these extrusion holes would, in effect, be moving at the same speed as the keratin they're extruding. This would greatly reduce extrusion friction on the fiber surfaces in comparison to holes cut through the thickness of a non-moving plate. This moving cylinder approach is analogous to that used by steel manufactures to extrude beams and rails.

The moving-cylinder-extrusion approach has other advantages. For example, these notched cylinders can be fed not only by a softened keratin paste, but also by a flat sheet of keratin delivered by other cylinders behind them. Said sheet will be cut and shaped into fibers by the notched cylinders. Additionally, the notched cylinders can be fed by extremely fat fibers or bars of keratin. One way this can be done is by placing relatively large extrusion holes behind the cylinders that would extrude thick bar-like keratin. These holes would most likely be cut through a non-moving plate in the manner of most conventional spinneret orifices. Next, the front-most notched cylinder pairs would be responsible for narrowing this bar-like keratin down to the correct diameter and shape and imparting the desired texture of the final hair fibers. Alternatively, fibers extruded with a larger diameter might be brought to their correct diameter by passing through a mechanism designed to stretch them out by drawing, thereby decreasing their diameters.

Also, the cylinder approach allows the cross-section of a hair to vary with hair length and even makes it possible to use cylinders that by themselves cut off the hairs coming out of them so that they only produce hairs of a certain length, rather than endless strands that need to be cut. This could be achieved by using two cylinders with discontinuous extrusion notches. Further, it would require that the rotation of these cylinders be synchronized. Such systems could produce hair extensions of varying cross-section, hair extensions cut to length, and even hair extensions with widened ends that can serve as anchors, as those used by hair implants below the skin, or to otherwise aid later processing or use.

Using rotating cylinders allows greater control of hair surface texture compared with conventional spinneret holes with static edges. Static-edge holes tend to smooth and polish the surfaces of the fibers they extrude. This may produce hairs that are too shiny. It is true that this shine from the polishing can be reduced if the edges of the extrusion holes have small groves on their surfaces parallel to the direction of extrusion. However, this produces long continuous scratches on the fiber surface, which may not yield the precise appearance desired. Fortunately, extrusion holes made using rotating cylinders do not polish the fibers that they extrude. Further, the inner-surfaces of the cylinder notches can be textured themselves and will transfer the exact mirror image of this texture to the fiber they are extruding. This provides much greater control of fiber surface texture.

Surface texture can also be roughened by rapid changes in temperature after extrusion. For example, if still relatively soft extruded keratin fiber is rapidly cooled by exposure to a very cold liquid or gas, its surface may wrinkle. This temperature-induced wrinkling can be calibrated to produce the precise surface texture desired.

In contrast to fiber surface texture, there is hair texture. For example, too kinky and too stiff describe two undesirable types of hair texture. Hair texture greatly depends on the cross-section of the hair fiber. Hairs must have an ideal diameter and shape to be cosmetically ideal. For example, hairs with round cross-sections are generally straight while those with oblong cross-sections are curlier. Hairs with overly large diameters are stiff while hairs with overly thin diameters are undesirably delicate and wispy. For this reason, the cross-sectional width and shape of extruded hairs must be carefully chosen and controlled. Thus, the spinneret holes used will like vary in diameter and shape from perfectly round through oval.

Sealing the Roller System

In the roller system, unlike with conventional static spinneret holes, the passage that carries the fiber-forming-material flow from the pump to the first set of extrusion orifices cannot be one continuous structure. This supply passage in the roller system must be an independent part from the rollers, so that they can rotate. However, this independent supply passage should form such a tight seal with the rollers that the fiber-forming-material flow does not escape to their sides, rather than being forced through their extrusion holes. This means that the supply passage must conform to the shape of the back of the roller assembly and it should probably contact the rollers using a conforming flexible material in order form a good seal. The rollers must be supported and driven from at least one end. Thus, the area of seal contact should only contact the central bodies of the rollers, avoiding the more lateral support and driving mechanisms. This is because these more lateral mechanisms, such as gears, are likely to have a more complex structure that is difficult to form a seal against.

The rollers, such as shown in FIG. 145, should be set up in pairs, as shown by FIG. 146. Each roller in a pair should have concave notches, with largely semicircular cross-sections, carved into its surface as rings around its circumference. The semi-circular notches on one roller should mesh with mirror-image notches on the other roller, in order to form, largely circular, spinneret extrusion holes. Each roller in a pair should rotate in an opposite rotational direction, but in the same linear direction and speed at their point of tangency. Usually, the linear speed should be calibrated to be the same as that of fiber extrusion. The line of tangency between each pair of rollers will form a single line of fiber extrusion holes parallel to each other.

Several pairs of rollers in parallel may share the same fiber-forming-material supply passage. In this case, some effort should be made to seal the areas between roller pairs. This seal might be a flexible conforming material pressed up between roller pairs, most likely from behind, where behind is the direction from which the fiber-forming material comes. On the other hand, this seal might be achieved by placing raised ridges with largely semi-circular cross-sections as rings around the rollers, such as the roller shown in FIG. 144. These convex semi-circular rings will mesh with the concave semi-circular notches on the adjacent roller in another roller pair, as shown in FIG.146. This will seal notches, which would have, otherwise, been left open between roller pairs. Two semi-circular notches on different roller pairs should not be used as an extrusion orifice because their linear direction of movement is backwards and against extrusion flow. Any fiber extruded from such a hole would experience a rubbing force on its surface opposite to its direction of extrusion. However, the entire purpose of using rollers is to reduce the rubbing an extruded fiber experiences.

Entirely Mechanical Kneading System

Although less likely to produce the highest quality of artificial hair fibers, solely mechanical methods that extrude keratin without chemically dissolving it first might be practical. Such a system might first unify individual pieces of keratin such as feathers or hairs into a single large object. It might do this by putting them under enormous pressure by using a means such as a piston in a cylinder. It might further homogenize this large keratinous object by kneading it. It might knead by using a rotational means that pulls and pushes on the keratinous object. Alternatively, kneading might be achieved by extruding the keratin through multiple pathways that intersect with each other. Homogenization can also be achieved by first grinding the keratin into a fine powder before putting it under mechanical pressure.

Fiber Compositions and Coatings

The reason for a semi-permeable coating around the hair shaft is largely to control the moisture level in the hair. Adequate moisture in the hair helps keep the hair soft. This is largely how conditioners work to keep hairs soft. However, conditioners are not permanently polymerized around hair shafts. A moisture barrier does not just keep the hair soft by allowing the hair to retain a minimum amount of moisture. It may also prevent the hair from absorbing too much moisture especially on humid days. Hairs with too much moisture might be too soft and limp, or might become frizzy. In short, the coating forms an artificial protective cuticle around the extruded keratin shaft. If possible, it would be beneficial to make this protective barrier Ultra Violet impermeable. Also, this barrier should protect against chemicals and ions by keeping them from being absorbed by the keratin protein. Conceivably, this coating could even increase the shine of a keratin fiber's surface. It should not be such a perfect barrier that no water can enter or exit the hair. If this were the case, the hair might behave as it were a conventional plastic. In which case, water could not be used to influence the styling of such hairs. HAIR COATINGS CAN BE APPLIED AT THE FACTORY TO ARTIFICIAL HAIRS OR THEY TYPE USED FOR CROSS-SECTIONAL RESHAPING PROCESS IN A SALON.

Certain fiber compositions make protective coatings less necessary. These compositions are less vulnerable to drying and becoming brittle and to absorbing undesirable substances from the environment than is most hair keratin. They accomplish this by being allied with synthetic non-amino acid substances. This might mean that the keratin protein is mixed with another substance such as a plasticizer. This mixed substance may help soften the fiber, or impede the entrance and exit of all substances including water. Fibers composed of such substances might have a lower water content than would expected with pure keratin. Nevertheless, the mixed in plasticizer will keep them soft. Further still, such fibers would be expected to have a higher water content than conventional plastic fibers would. This would allow hairstyling. The mixed-in substance may or may not itself be a polymer and may or may not be chemically cross-linked to the keratin or keratin-like material.

Keratin and keratin-like materials maybe be made softer and less vulnerable in ways other than infusing a plasticizer into them. For example, the keratin-like polymer chains can themselves be a co-polymer with a non-amino-acid-based monomer unit in them. Keratin-like sub-chains joined with urethane sub-chains are such an example. The presence of urethane sub-chains will both soften the fibers and reduce their vulnerability to the environment.

Although synthetic hairs should generally be formed from substances that behave like keratin, true keratin is not necessarily the only option. We use the term keratin-like to refer to substances that behave like keratin. Most substances that are keratin-like will be expected to have a chemical structure similar to keratin. This includes various proteins and poly-amino acids.

Proteins are intricate sequences of amino acids arranged in order by the design of nature. Poly-amino acids are long polymers of amino acid units with a random order, determined only by the monomer units present during polymerization. Poly-amino acids may be composed entirely of one type of amino acid or several types of amino acids.

Below, are several types of keratin-like chemical compositions that can be used to manufacture artificial hairs (specifically entire hair fibers):

--Pure thiol (or other disulfide-bond breaking chemical) dissolved keratin.

--Keratin proteins broken down into protein sub-chains (for example, by hydrolysis) which are then converted to reactive entities (for example, acid anhydrides or chlorides) that are allowed to react together to reform long structural keratin-like molecules.

---Where these keratin protein sub-chains are reacted together with non-amino acid based monomers or sub-chain units to form a co-polymer.

---Where the non-amino-acid-based entity is one or more of the following: urethane monomer, short poly-urethane chain, or one of the sub-components used in the manufacture of the urethane monomer such as an isocyanate or polyol or any synthetic monomer or sub-chain capable of forming a peptide bond--like polyols or any synthetic monomer or sub-chain capable of forming a peptide bonds, for example, like various polyols.

---Where these keratin protein sub-chains are reacted together with amino-acid based monomers or sub-chain units to form a co-polymer.

--Keratin (or keratin-like) molecule with synthetic polymer (or other structurally compatible non-keratin substance) mechanically mixed in with it, perhaps to serve as a plasticizer or change physical properties of the mixture like water permeability.

--Where said synthetic polymer (or non-keratin substance) is polyurethane

--Where said synthetic polymer is a poly-amino acid

---Where said synthetic polymer is chemically cross-linked to the keratin or keratin-like material.

---Where this chemical cross-linking is done through disulfide bonds.

--Poly-amino acid polymer with synthetic polymer mixed in with it, for example to serve as a plasticizer or change one or more physical qualities.

---Where said synthetic polymer is poly-urethane

---Where said synthetic polymer is chemically cross-linked to the poly-amino acid polymer.

---Where this chemical cross-linking is done through disulfide bonds.

--Poly-amino acid and non-amino acid entities reacted together as a copolymer.

---Where the non-amino-acid-based entity is one or more of the following: urethane monomer, short poly-urethane chain, or one of the sub-components used in the manufacture of the urethane monomer such as an isocyanate or polyol or any synthetic monomer or sub-chain capable of forming a peptide bonds, for example, like various polyols.

There are several types of chemical compositions that can be used to serve as protective coatings around hair fibers, regardless of whether said fibers are artificial or natural hairs. (These coatings can also be used for cross-sectional reshaping of the size and shape of individual scalp hair diameters.):

-Any of the above described compositions for manufacturing fibers can be applied for use as fiber/hair coatings as well, in addition to the below . . .

-Extruded keratin (or keratin-like material) or natural hair coated with any of the following:

--A different type of keratin dissolved by disulfide-bond breaking chemicals (for example, a type, that has a greater degree of disulfide cross linking)

--A poly-amino acid.

--A poly-amino acid urethane co-polymer

--Poly-amino acid and non-amino acid entities together as a copolymer.

---Where the non-amino-acid-based entity is one or more of the following: urethane monomer, short poly-urethane chain, or one of the sub-components used in the manufacture of the urethane monomer such as an isocyanate or polyol or any synthetic monomer or sub-chain capable of forming a peptide bond--like, for example, like various polyols.

--Keratin (or keratin-like material) with a non-amino-acid-based polymer mixed in with it, such as to serve as a synthetic plasticizer ---Where said synthetic polymer is chemically cross-linked to the keratin or keratin-like polymer.

---Where this chemical cross-linking is done through disulfide bonds.

--A poly-amino acid with a non-amino-acid-based polymer mixed in it, such as to serve as a synthetic plasticizer ---Where said synthetic polymer is chemically cross-linked to the poly-amino acid polymer.

---Where this chemical cross-linking is done through disulfide bonds.

Hair-Fiber Designs that Ensure Strong Attachment to Scalp Hairs

Use of Slippery Coatings:

Although the most obvious way of ensuring that hair extensions remain attached to scalp hairs is using the strongest possible adhesive, another way is make the surface of the attached hair extension slipperier. If the surface of a hair extension is slippery, it becomes much more difficult to grasp and pull firmly enough that its attachment will fail. For this reason, coating fibers with a low coefficient of friction substance such as Teflon is desirable. However, using such a coating might have disadvantages. For example, the coating might retard the entrance and exit of moisture to such a degree that the hair cannot be styled. Further still, such a coating might have such a great non-stick effect that adhesive will not work effectively on it.

To alleviate these disadvantages, the coating could be applied in a pattern so that it does not coat the entire surface of the fiber. This will allow moisture exchange and adhesive contact with the uncoated areas of fiber surface. In order to maintain the coating's low-coefficient-of-friction effect, the coating thickness to spacing between coated areas ratio should be high. This way, fingers that grasp the fiber will only come in contact with the slippery coating, not the less slippery uncoated areas of the fiber.

In order to produce the interrupted coating pattern on the fibers, some printing means needs to be used. This can involve any type of printing technology, or other analogous pattern-forming technology, available including laser printer, ink jet printer, and offset press technologies. For example, the fibers could be run between flexible rubber cylinders that print a pattern on them. This pattern can be the coating resin itself, which will subsequently be cured by some means such as heat. Alternatively, this pattern could be a masking substance with the purpose of preventing the coating resin from sticking to areas where it has been applied. Of course, after this masking substance, the coating resin would be subsequently applied and cured, and then the masking substance itself would be removed. In a similar fashion, entire fibers could be coated and then areas of the coating could be removed with a directed energy source, such as a laser.

Using Notches and Holes through Hair Fibers:

Another way of keeping hair extensions more firmly attached is to give their adhesive a structure that is most ideal for it to adhere. Although there are adhesives that can effectively attach two smooth fibers' surfaces to each other, if the surfaces were made more porous, the adhesives would work even better.

One way of making a hair extension surface more porous is to cut holes or notches in it. A possible way to do this is to run the hair fiber through a hole to support and steady it while cutting holes in it with a laser or other analogous focused-energy device. Possibly, even a precisely manufactured mechanical implement could be advanced into the hair in order to notch it or make small holes through it. Such a mechanical device might take the form of a pincher that grasps the hair from two opposing directions simultaneously in order to steady it. Regardless of whether directed energy or a mechanical means is used, this fiber perforation means might be used shortly after the hair fiber has been extruded or the hair fiber has been unwound from a storage spool. Whether directed energy or mechanical, the perforation means is likely configured as a tined-fork. In the case of a directed energy tined-fork, for a visual analogy, refer to the previously described fork-like prism that uses internal reflection to distribute UV light in order to cure adhesive. In the case of a mechanical tined-fork, for a visual analogy, refer to just about any of the moving hair handling tines previously described for use in attachment stack, such as.

-Sorting of Natural Hair to Packages as End Product

Ways of Sorting Hair Extensions into Groups of Equal Length:

Although it is desirable to use man-made hair, hair fibers obtained from humans or animal sources is an option. The basic mechanisms previously described for use in the salon-based hair extension recycling system can also be used in a factory that fills hair extension clip cartridges with human hair. Hair could be cut off the head using a mechanism similar to the remover, but instead of applying solvent to the head, it would cut the hairs, by having cutting shears incorporated into the remover as a structural layer. The first transport belts would take the hairs from the remover to a mechanism similar to the hair extension recycling system. As described before, this system would line the hair extension tips up in one direction such that the conveyor belts are grasping the hairs all at an equal distance from their tips. At this point, the hairs could be fed into clip cartridges, as in the previously described salon version of the hair recycling system. However, head hair is a mixture of many lengths, and it might be desirable to sort them by length first.

Sorting Hairs by Length:

The following procedure could be used to sort hairs by length. Once hairs are grasped at an equal distance from their tips by a grasping conveyor system, introduce a vacuum source approximately in line with the grasping conveyor, positioned on the same side of the conveyor as the variable hair lengths, and at a distance greater than the length of the very longest hair. This vacuum will pull all the conveyor-held hairs largely straight. Between the vacuum source and this first grasping conveyor, place a second grasping conveyor system. Only the longest hairs will be able to reach this second conveyor system. If necessary, place funneling guides in front of this second conveyor system in order to guide hairs into it. The longest hairs are now held by two conveyor systems. By making the second conveyor system grab each hair tighter than the first one and then by making it take a diversionary course away from the first one, the longest hairs will carried away by the second conveyor system, and the shortest hairs will remain in the first conveyor system. For this reason, I call the second conveyor system the sorting conveyor system. Hairs of increasingly shorter length can be sorted out by running the first conveyor system through a series stages that repeat this process. However, in each progressive stage, the sorting conveyor system should be placed closer to the first conveyor system. Thus, shorter and shorter hairs will be obtained from each stage. The end result is hairs sorted by length.

When speaking of a grasping conveyor system, it should be understood to mean any means capable of rotary or reciprocating motion and pinching hairs. Likewise, the vacuum source should be thought of as a hair tensioning means. Any other force capable of hair tensioning might be used. For example, blown air currents, static electricity, or a mechanical means that gently pinches or rubs the hairs moving them away from the hair-grasping conveyor are other options. Such a mechanical system is similar to the type previously described for use as a straightener for the attachment stack.

Such a sorting system might be used as an industrial method of harvesting real human hair cut from human heads. Alternatively, it might be incorporated into the salon-based hair-recycling unit. In this second configuration, it would serve to recycle only sufficiently long hairs while discarding excessively short natural hairs.

Ways of Filling Hair Extension Clip Cartridges:

Regardless of how hair extensions are obtained, they should be put into clip cartridges. Usually, instead of directly filling the cartridges used by the attachment stack, a disposable introduction cartridge, as shown in FIG. 99, will be filled at the factory. However, the following systems for filling clip cartridges work for both types of clip cartridges, disposable introduction and small attachment stack-ready.

If the hair extensions are man-made, this will usually mean that they are hundreds or thousands of feet long. This will allow cartridges to be filled in a continuous manner. Whether directly obtained from the extrusion spinnerets or first rolled up on spools, the terminal ends of these man-made hair extension fibers should be brought together in bunches large enough to fill each clip entirely. There should be as many of these bunches, as there are clips in a batch of clip cartridges that need to be filled. These bunches should be held separate from each other. Ideally, whatever separates these bunches should have a similar shape, width and spacing as the hair-holding interior channels of the clips of clip cartridges. This is to say that it should be composed of many separate parallel hair-holding channels, and all said channels should superimpose congruently on those of several clip cartridges arranged in a straight line. Probably, the hair-holding channels of this bunch-separating means should be just slightly wider than the interiors of the clips of the cartridges because they should not grasp the hair extensions as tightly as said clips. This bunch-separating means can be open on one side or closed on all sides.

The bunch-separating means should be used to help fill the clip cartridges in the following manner. First, a desired length of hair should be pulled through the bunch-separating means. Next, the clip cartridges should be aligned with bunch-separating means, if they are not already. The clip cartridges and bunch-separating means can approach each other from below or above, their front or their backs. Naturally, there should be some fixture that holds the cartridges and helps facilitate this alignment. Once aligned with the bunch-separating means, the clips of the clip cartridges will, in effect, be filled with hair extensions. Finally, a cutting means should cut the hair extensions at a very short distance above the clips of the clip cartridges. These filled clip cartridges can now be moved away, and a new group of empty clip cartridges can be brought in to take their place.

Ideally, it would be fine for the empty clip cartridges to be aligned with the bunch-separating means before the hair extensions are pulled through them. In order for the above system to function most effectively, it should be configured as follows: The clip cartridges should be placed below the bunch-separating means. (Below meaning down line with respect to the direction that the hair extensions are pulled from their source.) The cutting means should be placed between the bunch-separating means and the clip cartridges. Thus, after cutting, the bunch-separating means will still be threaded with hair bunches. This will allow a device to pinch the bunch tips extending from the bunch-separating means and pull them further through. This pinch-and-pull means itself is likely to have hair-holding channels that align congruently with those of the bunch-separating means and clip cartridges. As such, it might be configured as two layers with channels of a similar shape, width, and spacing as those of the bunch-separating means. To pinch hair bunches one or both of these two layers could slide relative to each other to narrow their hair-pinching channels. This pinch-and-pull means could continue to pinch a batch of bunches until after they have been cut. This would provide tension on the hair extensions during both cartridge filling and hair extension cutting. Ideally, the pinch-and-pull means should be formed out of or coated with a high coefficient of friction material such as silicone rubber. Said bunch-separating means could itself be configured as two layers with pinching capability. If so, the bunch-separating means could pinch hair bunches to aid in steadying them during cartridge filling or hair extension cutting, but release this pinch when the filled clip cartridges are removed.

Regardless of how the clip cartridges are filled, they can be conveyed into the position where they are to be filled in various ways. In the case of disposable introduction clip cartridges, they could be fed into position as a continuous web. After filling, this continuous web could be broken or cut into individual disposable introduction clip cartridges, such as the one illustrated by FIG. 99. This web might be wound into a coil. This web might be conveyed by gear-like interlock with some rotating or reciprocating part. For example, referring to FIG. 99, the holes at the lateral edges of each introduction cartridge could be engaged by cogs in a wheel.

If individual attachment stack-ready cartridges are used, they should be loaded onto some holding means that moves them into position for filling.

Regardless of the type of clip cartridges used, they have to be aligned with the bunch-separating means in order to get filled. This can happen in a variety of ways. The clip cartridges and their holding means can move towards the bunch separating means; the bunch-separating means, the pinch-and-pull means, and the cutting means can move together as a unit towards the clip cartridges; a combination of these two events can occur.

INDUSTRIAL APPLICABILITY

We expect that this invention will be applied to the hair-care industry as a professional product used in hair salons, rather than being used as a home product. There are two reasons for this. First, because of the relative complexity of this family of devices, it is most advisable for them to be operated by highly trained users. Second, since these systems are much more elaborate than any hair-care device up to this time, they will be correspondingly more expensive to manufacture. Thus, they ideally should be used in a professional setting where their higher cost can be spread out over many users. The operation of this device by a hairstylist has already been described in the above description. However, this not to say units for home use couldn't be economically implemented. We expect the various embodiments of this system to operate fast enough that they can process an entire human head of hair in a matter of minutes.

What is claimed is:

1. An apparatus for the relative movement of hairs through and facilitation of their controlled isolation, comprising:

A hair isolation area means for substantially isolating at least one surface-attached hair-like fiber from any said surface-attached hair-like fibers trailing it;

a cued hair supply means for supplying cued surface-attached hair-like fibers in which the hair-like fibers are cued substantially in the order that they will be supplied and between two supply cycles said cued surface-attached hair-like fibers remain substantially cued so that a substantially defined set of the trailing cued hairs can be supplied immediately after those leading hairs that were supplied in the immediately prior supply cycle and yet to be successfully supplied hairs wait their turn substantially in cue to be supplied in the following supply cycle;

a repeating dispensing means for repeatedly dispensing substantially intact a substantially controlled amount of hair into said hair isolation area means by repeatedly receiving hair from said cued hair supply means and dispensing it into said hair isolation area means.

2. The apparatus of claim 1 further comprising:

a dispensing actuation means for actuating said repeating dispensing means;

a hair-flow sequencing control means for controlling the actuation of said dispensing actuation means so as to dispense hair into said hair isolation area means at a moment in the processing sequence when said hair isolation area means is ready to accept more hair.

3. The apparatus of claim 1 further comprising:

a hair processing means for processing said surface-attached hair-like fibers so as to change their cosmetic appearance, whereby it processes hairs in said hair isolation area means;

a hair processing actuation means for actuating said hair processing means;

a hair processing sequencing control means for controlling the actuation of said hair processing actuation means in order to cause the actuation of said hair processing means so that processing occurs when said surface-attached hair-like fibers are positioned appropriately relative to said hair processing means so as to be ready for processing.

4. The apparatus of claim 1 further comprising a straightening maintenance means for providing and maintaining longitudinal lengths of said surface-attached hairs in a substantially perpendicular orientation relative to their direction of movement through relevant portions of said apparatus.

5. The apparatus of claim 4 wherein said straightening maintenance means comprises a hair tensioning means for applying tension to said surface-attached hairs so as to cause the orientation of their longitudinal shafts relative to the surface which they are attached to be substantially perpendicular.

6. The apparatus of claim 4 wherein said straightening maintenance means comprises a perpendicular orientation sensor control means for providing and maintaining said surface-attached hairs in a substantially perpendicular orientation relative to their direction of movement through by using sensor-controlled movement of said relevant portions of said apparatus relative to said surface-attached hairs.

7. The apparatus of claim 6 wherein said perpendicular orientation sensor control means comprises a tension-based sensor-control means for basing relative movement control of said relevant portions of said apparatus on tension detected in said surface-attached hair-like fibers.

8. The apparatus of claim 6 wherein said perpendicular orientation sensor control means comprises a speed-based sensor control means for basing relative movement control of said relevant portions of said apparatus on speed of advancement of said relevant portions of said apparatus relative to the surface of hair attachment.

9. The apparatus of claim 1 wherein said repeating dispensing means comprises a hair transport means for engaging a limited number of hairs in said cued hair supply means and transporting them into said hair isolation area means.

10. The apparatus of claim 9 further comprising a hair processing means for processing said surface-attached hair-like fibers in a manner so as to change their cosmetic appearance in which at least some of the cosmetic change is facilitated using a force whose source is independent of any force applied by any movement of said hair transport means, whereby said hair processing means is positioned so as to have access to hairs in said hair isolation area means.

11. The apparatus of claim 9 further comprising a subsequent hair transport means for engaging the hairs provided to said hair isolation area means by said repeating dispensing means and further transporting said hairs.

12. The apparatus of claim 1 wherein said repeating dispensing means comprises a hair pathway obstruction means for intermittently obstructing the path of hair flow from said cued hair supply means to said hair isolation area means.

13. The apparatus of claim 12 further comprising:

a hair metering area that is positioned at a point along the hair-flow pathway earlier encountered than said hair pathway obstruction means so that the path of hair flow from said hair metering area into said hair isolation area means is intermittently obstructed by said hair pathway obstruction means;

a hair pushback gate means for intermittently obstructing the path of hair flow from said cued hair supply means into said metering area so as to substantially isolate a limited number of hairs in said metering area between said hair pushback gate means and said hair pathway obstruction means allowing substantially only the hairs in said metering area to pass said hair pathway obstruction means upon its intermittent allowance of hair flow.

14. The apparatus of claim 1 further comprising:

a hair-extension supply means for supplying hair extensions into said hair isolation area means;

a hair attachment substance means for attaching said hair extensions to said surface-attached hair-like fibers, whereby said attachment substance means provides continued attachment of the hairs;

a hair attachment substance supply means for supplying said hair attachment substance means into said hair isolation area means in which it comes in contact with both said hair extensions and said surface-attached hair-like fibers so as to attach the two types of fibers together.

15. The apparatus of claim 14 further comprising an attachment substance supply sequencing control means for controlling said hair attachment substance supply means so as to provide said hair attachment substance means into said hair isolation area means at a moment in the processing sequence when the hairs to be attached are in said hair isolation area means.

16. The apparatus of claim 14 further comprising:

an attachment substance fixation means for fixing said attachment substance means so as to effectuate the attachment of said hair extensions to said surface-attached hair-like fibers;

an attachment substance fixation supply means for supplying said attachment substance fixation means into said hair isolation area means so that it may be introduced to said attachment substance means in order to effectuate attachment of the hairs.

17. The apparatus of claim 14 further comprising an excess attachment substance removal means for removing any excess of said hair attachment substance means from said hair isolation area means so as to leave a coating of said hair attachment substance means on the hairs to be attached.

18. The apparatus of claim 1 further comprising:

a longitudinal hair movement means for moving at least one of said surface-attached hair-like fibers in a longitudinal direction along its shaft relative to and through said hair isolation area means so as to convey a length of said surface-attached hair-like fiber through said hair isolation area means;

a coating substance;

a coating substance supply means for supplying said coating substance to said surface-attached hairlike fiber that is in said hair isolation area means so as to coat said surface-attached hair-like fiber as it is conveyed longitudinally through said hair isolation area means.

19. The apparatus of claim 1 further comprising:

a longitudinal hair movement means for moving at least one of said hair surface-attached hair-like fibers in a longitudinal direction along its shaft relative to and through said hair isolation area means so as to convey a length of said surface-attached hair-like fiber through said hair isolation area means;

a cross-sectional reshaping means for reshaping the cross-sectional shape of said surface-attached hair-like fiber as it is conveyed longitudinally through relative to said cross-sectional reshaping means by said longitudinal hair movement means, whereby said cross-sectional reshaping means is situated to have access to the hair fiber as it is longitudinally conveyed through said hair isolation area means.

20. The apparatus of claim 1 further comprising:

a hair surface row segregation means for segregating said surface-attached hair-like fibers substantially originating from two adjacent surface areas so that the segments of the hair shafts that will be processed are segregated in a specific row prior to and during hair dispensing by said repeating dispensing means and said hair surface row segregation means rests on the surface to which said surfaced-attached hair-like fibers are attached and is substantially stationary relative to said surface during processing;

a track guide means for guiding said repeating dispensing means by substantially continuous contact between said track guide means and said repeating dispensing means so as to provide alignment with one of the segregated rows of surface-attached hair-like fibers so as to allow the hair segments from substantially only this single segregated row to be guided into said repeating dispensing means as it moves along a substantially defined path that substantially coincides with said single segregated row and this alignment during repeating dispensing means movement is possible individually for both adjacent rows of segregated surface-attached hair segments.

21. The apparatus of claim 20 further comprising:

a position ascertaining means for ascertaining longitudinal position of said hair isolation area means along a specific row of said track guide means;

a row determination means for ascertaining within which of the segregated rows said hair isolation area means is positioned;

a longitudinal conveyance means for conveying a longitudinal segment of a group of at least one surface-attached hairs longitudinally through said hair isolation area means;

a hair length measurement means for ascertaining the longitudinal length of said longitudinal segment of the group of surface-attached hairs that has been conveyed through said hair isolation area means by said longitudinal conveyance means;

a cutting means for cutting hair that is in said hair isolation area means;

a cutting control means for using data coming from said position ascertaining means and said row determination means and said hair length measurement means and corresponding to a specific longitudinal position along a specific segregated row to compare to intended hair length data substantially corresponding to the position so as to trigger said cutting means to cut the group of longitudinally conveyed hairs at a moment when the group's linear length measured from said cutting means to the surface of hair attachment approximately equals the intended hair length.

22. The apparatus of claim 1 further comprising a bend-under means for applying a conveying force that conveys surface-attached,hair-like fibers through said apparatus at a rate faster than said apparatus is moving relative to the surface of hair attachment causing said surface-attached hair-like fibers to be conveyed substantially longitudinally along their shafts through and relative to said apparatus and under an obstructing portion of said apparatus.

23. The apparatus of claim 22 wherein said bend-under means comprises a below obstruction bend-under means for engaging said surface-attached hair-like fibers at a location partially below an obstructing portion of said apparatus and applying a conveying force that conveys the hair-like fibers at a rate faster than said apparatus is moving relative to the surface of hair attachment causing said hair-like fibers to be conveyed longitudinally along their shafts through said apparatus and under said obstructing portion of said apparatus.

24. The apparatus of claim 22 wherein said bend-under means comprises a rotary conveyance means for applying a conveying force to said surface-attached hair-like fibers by engaging said surface-attached hair-like fibers at a point which moves on a rotary mechanism.

25. The apparatus of claim 1 further comprising an apparatus elevation conveyance means for applying a relative conveying force to said surface-attached hair-like fibers by elevating an obstructing portion of said apparatus away from the surface to which said hair-like fibers are attached so as to convey the fibers substantially longitudinally along their shafts through said apparatus and under said obstructing portion of said apparatus.

26. The apparatus of claim 1 further comprising:

an attachment substance degrading means for degrading an attachment substance that is holding hair extensions together with said surface-attached hair-like fibers;

an attachment degrading application means for applying said attachment substance application degrading means to hairs isolated in said hair isolation area means;

a detached hair extension separation conveyance means for conveying hair extensions detached by said attachment substance degrading means away from said surface-attached hair-like fibers.

27. The apparatus of claim 1 further comprising:

a hair-flow reversing means for causing surface-attached hairs that have entered said hair isolation area means to exit it substantially in the reverse net relative direction that they approached said hair isolation area means to enter it;

an exiting hair separation means for intermittently substantially separating the exiting hairs that reversed direction so as to exit said hair isolation area means from the hairs in said cued hair supply means and said exiting hair separation means is positioned along the hair-flow path between said hair isolation area means and the hairs in said cued hair supply means;

a reversed hair exit pathway means for allowing the exiting hairs that have been reversed in direction out of said hair isolation area means by said hair-flow reversing means to exit said apparatus through said reversed hair exit pathway means and its origin is positioned along the hair-flow path between said exiting hair separation means and said hair isolation area means and its terminus is positioned clear of the path of hair flow into said repeating dispensing means so as to direct the exiting hairs away from reentering said repeating dispensing means.

28. The apparatus of claim 1 further comprising a post-isolation hair transport means for engaging at least one of said surface-attached hair-like fibers in said hair isolation area means and transporting said surface-attached hair-like fiber.

29. The apparatus of claim 1 further comprising a hair presence sensor means for sensing the presence of at least one of said surface-attached hair-like fibers in said hair isolation area means.

30. An apparatus for attaching hair extensions to surface-attached hair-like fibers, comprising:

a hair attachment area in which said hair extensions are attached to said surface-attached hair-like fibers;

a hair-extension supply means for supplying hair extensions into said hair attachment area;

a surface-attached hair-like fiber supply means for supplying said surface-attached hair-like fibers into said attachment area;

a hair attachment substance means for attaching said hair extensions to said surface-attached hair-like fibers;

a hair attachment substance supply means for supplying said hair attachment substance means into said hair attachment area in which it comes in contact with both said hair extensions and said surface-attached hair-like fibers so as to attach the two types of hairs together.

31. The apparatus of claim 30 further comprising an attachment substance supply sequencing control means for controlling said hair attachment substance supply means so as to trigger release of said hair attachment substance means into said hair attachment area at a moment in the processing sequence when the hairs to be attached are in said hair attachment area.

32. The apparatus of claim 30 wherein said surface-attached hair-like fiber supply means substantially supplies said surface-attached hair-like fibers by way of said apparatus's relative movement along a vector whose direction is substantially parallel to the surface to which said surface-attached hair-like fibers are attached so as to encourage these fibers to enter said surface-attached hair-like fiber supply means and this direction of movement is substantially continuous between entrance of two separate batches of hair into said hair attachment area.

33. The apparatus of claim 32 further comprising a bend-under means for applying a conveying force that conveys said surface-attached hair-like fibers through said apparatus substantially longitudinally along their shafts at a linear rate faster than said apparatus is moving along a vector whose net direction is substantially parallel relative to the surface to which said surface-attached hair-like fibers are attached so. as to cause said surface-attached hair-like fibers to be conveyed substantially longitudinally along their shafts through and relative to said apparatus and under an obstructing portion of said apparatus, thereby assisting their exit from said apparatus.

34. The apparatus of claim 30 wherein said surface-attached hair-like fiber supply means substantially supplies said surface-attached hair-like fibers by moving along a vector whose relative direction is substantially parallel to the surface to which said surface-attached hair-like fibers are attached so as to encourage these fibers to enter said surface-attached hair-like fiber supply means and this direction of movement is substantially continuous between entrance of two separate batches of hair into said hair attachment area, further comprising:

a hair-flow reversing means for causing surface-attached hairs that have entered said hair attachment area to exit it substantially in the reverse net relative direction that they approached said hair attachment area to enter it;

an exiting hair separation means for intermittently substantially separating the exiting hairs that reversed direction so as to exit said hair attachment area from the hairs in said surface-attached hair-like fiber supply means that have yet to enter said hair attachment area and said exiting hair separation means is positioned along the hair-flow path between said hair attachment area and the hairs in said surface-attached hair-like fiber supply means that have yet to enter and be cosmetically processed in said attachment area;

a reversed hair exit pathway means for allowing the exiting hairs that have been reversed in direction out of said hair attachment area by said hair-flow reversing means to exit said apparatus through said reversed hair exit pathway means and its origin is positioned along the hair-flow path between said exiting hair separation means and said hair attachment area and its terminus is positioned clear of the entrance path of hair flow into said attachment area so as to direct the exiting hairs away from reentering said attachment area.

35. An apparatus for the processing of hairs which are attached to a surface configured so that processing of any hair only occurs a substantially controlled number of times, comprising:

a hair processing means for processing surface-attached hair-like fibers so as to change their appearance as a group;

a hair surface row segregation means for segregating said surface-attached hair-like fibers substantially originating from two adjacent surface areas so that the segments of the hair shafts that will be processed are segregated in a specific row prior to and during processing by said hair processing means and said hair surface row segregation means rests on the surface to which said surface-attached hair-like fibers are attached and is substantially stationary relative to said surface during processing,;

a track guide means for guiding said hair processing means by substantially continuous contact between said track guide means and said hair processing means so as to provide alignment with one of the segregated rows of surface-attached hair-like fibers to allow the hair segments from substantially only this single segregated row to be guided into said hair processing means as it moves along a substantially defined path that substantially coincides with said single segregated row and this alignment during hair processing means movement is possible individually for both adjacent rows of segregated surface-attached hair segments.

36. The apparatus of claim 35 wherein said hair processing means comprises a means for attaching hair extensions to said surface-attached hair-like fibers and further comprising:

a hair attachment area in which said hair extensions are attached to said surface-attached hair-like fibers;

a hair-extension supply means for supplying hair extensions into said hair attachment area;

a surface-attached hair-like fiber supply means for supplying said surface-attached hair-like fibers into said attachment area;

a hair attachment substance means for attaching said hair extensions to said surface-attached hair-like fibers;

a hair attachment substance supply means for supplying said hair attachment substance means into said hair attachment area in which it comes in contact with both said hair extensions and said surface-attached hair-like fibers so as to attach the two types of hairs together.

37. The apparatus of claim 35 wherein said hair surface row segregation means comprises multiple rows that together substantially form a cap structure that substantially conforms to a human head.

38. The apparatus of claim 35 wherein said hair processing means comprises a hair cutting means for cutting said surface-attached hair-like fibers so as to change their appearance as a group.

39. The apparatus of claim 35 wherein said hair processing means comprises a hair extension attachment means for attaching hair extensions to said surface-attached hair-like fibers so as to change the appearance of said surface-attached hair-like fibers as a group.

40. The apparatus of claim 35 wherein said hair processing means comprises a cross-sectional reshaping means for reshaping the cross-sectional shape of said surface-attached hair-like fibers as they are longitudinally conveyed through relative to said cross-sectional reshaping means.

41. The apparatus of claim 35 wherein said hair processing means comprises a hair coating application means for applying a coating to said surface-attached hair-like fibers as they are longitudinally conveyed through relative to said hair coating application means.

42. The apparatus of claim 35 wherein said hair processing means comprises a sub-dermal hair plug delivery means for delivering a hair plug sub-dermally into to the surface of hair attachment so as to change the appearance of the pre-existing surface-attached hair-like fibers as a group and wherein said surface of hair attachment is the scalp.

43. An apparatus for attaching non-surface-attached hair-like fibers to a surface amongst surface-attached hair-like fibers already attached to said surface, comprising:

a hair channel pathway means for guiding said surface-attached hair-like fibers into an area of high concentration coinciding with said hair channel pathway means so as to leave an area of decreased surface-attached hair-like fiber concentration lateral to said hair channel pathway means;

an application area means for applying non-surface-attached hair-like fibers in proximity to said surface wherein said application area means is positioned to substantially coincide with said area of decreased surface-attached hair-like fiber concentration;

a supply means for supplying said non-surface-attached hair-like fibers into said application area means;

an attachment means for attaching said non-surface-attached hair-like fibers in said application area means to said surface, whereby said non-surface-attached hair-like fibers may either be attached directly to said surface or indirectly attached to said surface by way of attachment to the pre-existing surface-attached hair-like fibers.

44. The apparatus of claim 43 wherein said supply means comprises a unified group supply means for supplying a unified group of non-surface-attached hair-like fibers into said application area means.

45. The apparatus of claim 43 wherein said application area means comprises an attachment area means in which attachment of non-surface-attached hair-like fibers to said surface occurs.

46. The apparatus of claim 43 wherein said non-surface-attached hair-like fibers are in the form of a hair plug and wherein said attachment means comprises a subdermal hair plug delivery means for delivering said hair plug subdermally into to the surface of hair attachment and wherein said surface of hair attachment is the scalp.

47. An apparatus for the cross-sectional reshaping of a surface-attached hair-like fiber comprising:

a hair isolation area means in which at least a single surface-attached hair-like fiber can be substantially isolated from other surface-attached hair-like fibers;

a longitudinal hair movement means for moving at least one of said hair surface-attached hair-like fibers in a longitudinal direction along its shaft relative to and through said hair isolation area means so as to convey a length of said surface-attached hair-like fiber through said hair isolation area means;

a cross-sectional reshaping means for reshaping the cross-sectional shape of said surface-attached hair-like fiber as it is conveyed longitudinally through relative to said cross-sectional reshaping means by said longitudinal hair movement means, whereby said cross-sectional reshaping means is situated to have access to the hair fiber as it is longitudinally conveyed through said hair isolation area means.

48. The apparatus of claim 47 wherein said cross-sectional reshaping means is comprised of a cutting edge that shaves material off the surface of said surface-attached hair-like fiber as it is conveyed through relative to said hair isolation area means.

49. The apparatus of claim 47 wherein said hair isolation area means is supplied said surface-attached hair-like fibers by apparatus's relative movement along a vector whose direction is substantially parallel to the surface to which said surface-attached hair-like fibers are attached so as to encourage these fibers to enter said hair isolation area means and this direction of movement is substantially continuous between entrance of two separate batches of hair into said hair isolation area means.

* * * * *